US008028623B2

(12) United States Patent
Takenouchi et al.

(10) Patent No.: US 8,028,623 B2
(45) Date of Patent: Oct. 4, 2011

(54) CONTACT-PRESSURE ADJUSTING METHOD AND CONTACT-PRESSURE ADJUSTING SYSTEM FOR LIQUID APPLICATION MACHINE

(75) Inventors: Akihiko Takenouchi, Noda (JP); Hiromitsu Numauchi, Tsukuba (JP); Akehiro Kusaka, Noda (JP)

(73) Assignee: Komori Corporation, Tokyo (JP)

( * ) Notice: Subject to any disclaimer, the term of this patent is extended or adjusted under 35 U.S.C. 154(b) by 712 days.

(21) Appl. No.: 12/043,020

(22) Filed: Mar. 5, 2008

(65) Prior Publication Data

US 2008/0216697 A1 Sep. 11, 2008

(30) Foreign Application Priority Data

Mar. 5, 2007 (JP) ..... 2007-053847

(51) Int. Cl.
*B41F 31/32* (2006.01)
*B41F 13/34* (2006.01)

(52) U.S. Cl. ..... 101/352.02; 101/218; 101/247; 101/352.01; 101/351.1

(58) Field of Classification Search ..... 101/218, 101/247, 352.01, 352.02, 484, 485, 351.1, 101/351.2, 351.3, 351.4, 352.03, 352.04, 101/352.05
See application file for complete search history.

(56) References Cited

U.S. PATENT DOCUMENTS

| | | | | |
|---|---|---|---|---|
| 3,691,956 | A * | 9/1972 | James et al. | 101/247 |
| 5,485,785 | A * | 1/1996 | Schneider et al. | 101/487 |
| 5,588,362 | A * | 12/1996 | Sugiyama et al. | 101/218 |
| 6,098,542 | A * | 8/2000 | Dufour | 101/352.05 |
| 6,543,350 | B2 * | 4/2003 | Gilliam et al. | 101/213 |
| 6,761,112 | B2 * | 7/2004 | Faist et al. | 101/247 |
| 7,021,209 | B2 * | 4/2006 | Faist et al. | 101/216 |
| 7,150,226 | B2 * | 12/2006 | Hirt et al. | 101/352.01 |

FOREIGN PATENT DOCUMENTS

| | | | |
|---|---|---|---|
| JP | 63-141732 | U | 9/1988 |
| JP | 63-264354 | A | 11/1988 |
| JP | 1-171642 | U | 12/1989 |
| JP | 3-124838 | U | 12/1991 |
| JP | 4-128835 | U | 11/1992 |

* cited by examiner

*Primary Examiner* — Judy Nguyen
*Assistant Examiner* — Leo Hinze
(74) *Attorney, Agent, or Firm* — Birch, Stewart, Kolasch & Birch, LLP

(57) ABSTRACT

Disclosed is a contact-pressure adjusting method and a contact-pressure adjusting system, each of which automatically adjusts the contact pressure between two rotors, for a liquid application machine including: a first rotor to which liquid is supplied; a second rotor to which the liquid is supplied from the first rotor; and a contact-pressure adjusting unit for adjusting the contact pressure between the first rotor and the second rotor. By using a temperature measuring unit, measured is: the temperature of at least one of the surfaces of the first and second rotors; the temperature of at least one of the liquid on the surface of the first rotor and the liquid on the surface of the second rotor; or the temperature of at least one of the vicinity of the first rotor and the vicinity of the second rotor. The contact-pressure adjusting unit is adjusted in accordance with the measured temperature.

4 Claims, 100 Drawing Sheets

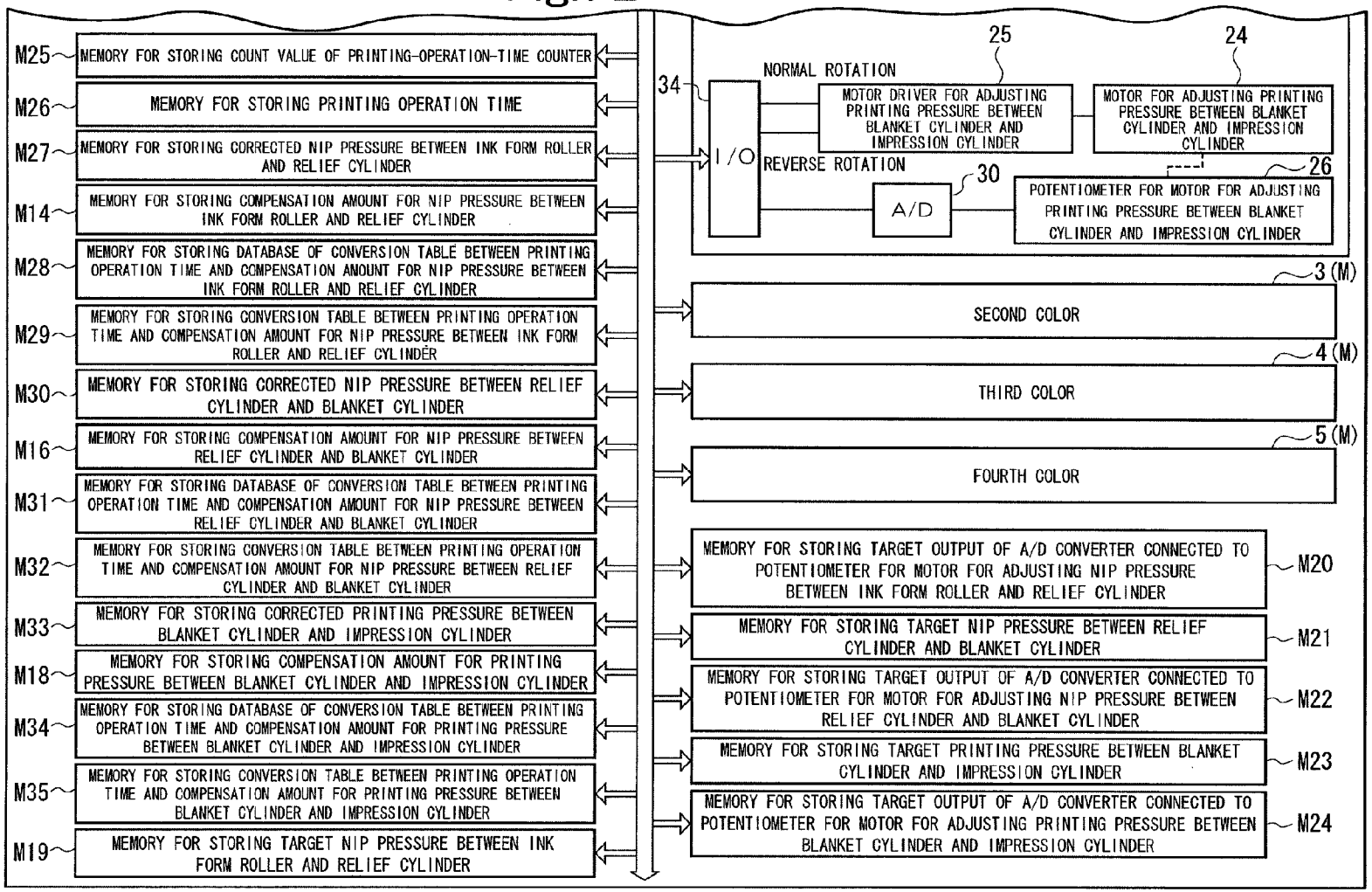
Fig.7B
MEMORY FOR STORING COUNT VALUE OF PRINTING-OPERATION-TIME COUNTER
M25
MEMORY FOR STORING PRINTING OPERATION TIME
M26
MEMORY FOR STORING CORRECTED NIP PRESSURE BETWEEN INK FORM ROLLER AND RELIEF CYLINDER
M27
MEMORY FOR STORING COMPENSATION AMOUNT FOR NIP PRESSURE BETWEEN INK FORM ROLLER AND RELIEF CYLINDER
M14
MEMORY FOR STORING DATABASE OF CONVERSION TABLE BETWEEN PRINTING OPERATION TIME AND COMPENSATION AMOUNT FOR NIP PRESSURE BETWEEN INK FORM ROLLER AND RELIEF CYLINDER
M28
MEMORY FOR STORING CONVERSION TABLE BETWEEN PRINTING OPERATION TIME AND COMPENSATION AMOUNT FOR NIP PRESSURE BETWEEN INK FORM ROLLER AND RELIEF CYLINDER
M29
MEMORY FOR STORING CORRECTED NIP PRESSURE BETWEEN RELIEF CYLINDER AND BLANKET CYLINDER
M30
MEMORY FOR STORING COMPENSATION AMOUNT FOR NIP PRESSURE BETWEEN RELIEF CYLINDER AND BLANKET CYLINDER
M16
MEMORY FOR STORING DATABASE OF CONVERSION TABLE BETWEEN PRINTING OPERATION TIME AND COMPENSATION AMOUNT FOR NIP PRESSURE BETWEEN RELIEF CYLINDER AND BLANKET CYLINDER
M31
MEMORY FOR STORING CONVERSION TABLE BETWEEN PRINTING OPERATION TIME AND COMPENSATION AMOUNT FOR NIP PRESSURE BETWEEN RELIEF CYLINDER AND BLANKET CYLINDER
M32
MEMORY FOR STORING CORRECTED PRINTING PRESSURE BETWEEN BLANKET CYLINDER AND IMPRESSION CYLINDER
M33
MEMORY FOR STORING COMPENSATION AMOUNT FOR PRINTING PRESSURE BETWEEN BLANKET CYLINDER AND IMPRESSION CYLINDER
M18
MEMORY FOR STORING DATABASE OF CONVERSION TABLE BETWEEN PRINTING OPERATION TIME AND COMPENSATION AMOUNT FOR PRINTING PRESSURE BETWEEN BLANKET CYLINDER AND IMPRESSION CYLINDER
M34
MEMORY FOR STORING CONVERSION TABLE BETWEEN PRINTING OPERATION TIME AND COMPENSATION AMOUNT FOR PRINTING PRESSURE BETWEEN BLANKET CYLINDER AND IMPRESSION CYLINDER
M35
MEMORY FOR STORING TARGET NIP PRESSURE BETWEEN INK FORM ROLLER AND RELIEF CYLINDER
M19
34
I/O
NORMAL ROTATION
REVERSE ROTATION
25
MOTOR DRIVER FOR ADJUSTING PRINTING PRESSURE BETWEEN BLANKET CYLINDER AND IMPRESSION CYLINDER
30
A/D
24
MOTOR FOR ADJUSTING PRINTING PRESSURE BETWEEN BLANKET CYLINDER AND IMPRESSION CYLINDER
26
POTENTIOMETER FOR MOTOR FOR ADJUSTING PRINTING PRESSURE BETWEEN BLANKET CYLINDER AND IMPRESSION CYLINDER
3(M)
SECOND COLOR
4(M)
THIRD COLOR
5(M)
FOURTH COLOR
M20
MEMORY FOR STORING TARGET OUTPUT OF A/D CONVERTER CONNECTED TO POTENTIOMETER FOR MOTOR FOR ADJUSTING NIP PRESSURE BETWEEN INK FORM ROLLER AND RELIEF CYLINDER
M21
MEMORY FOR STORING TARGET NIP PRESSURE BETWEEN RELIEF CYLINDER AND BLANKET CYLINDER
M22
MEMORY FOR STORING TARGET OUTPUT OF A/D CONVERTER CONNECTED TO POTENTIOMETER FOR MOTOR FOR ADJUSTING NIP PRESSURE BETWEEN RELIEF CYLINDER AND BLANKET CYLINDER
M23
MEMORY FOR STORING TARGET PRINTING PRESSURE BETWEEN BLANKET CYLINDER AND IMPRESSION CYLINDER
M24
MEMORY FOR STORING TARGET OUTPUT OF A/D CONVERTER CONNECTED TO POTENTIOMETER FOR MOTOR FOR ADJUSTING PRINTING PRESSURE BETWEEN BLANKET CYLINDER AND IMPRESSION CYLINDER

CONTACT-PRESSURE ADJUSTING METHOD AND CONTACT-PRESSURE ADJUSTING SYSTEM FOR LIQUID APPLICATION MACHINE

BACKGROUND OF THE INVENTION

1. Field of the Invention

The present invention relates to a contact-pressure adjusting method and a contact-pressure adjusting system for a liquid application machine.

2. Description of the Related Art

In a printing press, after the start of printing, the temperature inside the printing press gradually increases with the operating time. Since each component of the printing press thermally expands due to the increase in temperature, the contact pressure (a nip pressure or a printing pressure) of every part of the printing press changes from a value that is set at the start of printing. For the purpose of compensating for the change, the printing press has the following structures. Specifically, it is possible to adjust the contact pressure between a form roller, which applies ink to a plate surface, and the plate surface, while the printing press is in operation. In addition, it is also possible to adjust the contact pressure between the plate surface and an impression cylinder, as well as the contact pressure between the plate surface and a blanket cylinder. Particularly in a relief printing, such a change in contact pressure causes printing troubles, such as the darkening of colors and the thickening of lines, near the raised portions. For this reason, the operator has to frequently adjust the contact pressure while checking printing products all the time. In addition, such an increase in temperature varies depending on various factors, such as printing patterns, printing systems, the number of colors to be used, and printing materials to be used. Minute changes in contact pressure due to these factors affect largely on printing products. Accordingly, for the purpose of compensating for the change in contact pressure, a printing press is provided with a contact-pressure adjusting system which adjusts the contact pressure during operation of the printing press. Examples of such a contact-pressure adjusting system are disclosed in Japanese Utility Model Application Laid-open Publication Nos. Hei 1-171642, Hei 3-124838, Hei 4-128835, and Sho 63-141732, as well as Japanese Unexamined Patent Application Publication No. Sho 63-264354.

However, in the contact-pressure adjusting systems disclosed in the above publications, it is necessary for the operator to manually adjust a contact pressure (a nip pressure or a printing pressure) very frequently. Accordingly, a heavy burden is imposed on the operator. In addition, since a contact pressure is adjusted in accordance with the operator's gut feeling based on his or her experience, the quality of printing products varies depending on the operators. Moreover, the changes, with the operation time, in contact pressures bring about changes of the quality of printing products.

SUMMARY OF THE INVENTION

In view of the above-described circumstances, an object of the present invention is to provide a contact-pressure adjusting method for a liquid application machine and a contact-pressure adjusting system for a liquid application machine, the two of which are capable of automatically adjusting the contact pressure between two rotors.

A first aspect of the present invention for solving the above-described problems provides a contact-pressure adjusting method for a liquid application machine including: a first rotor to which liquid is supplied; a second rotor to which the liquid is supplied from the first rotor; and contact-pressure adjusting means for adjusting the contact pressure between the first rotor and the second rotor. The contact-pressure adjusting method includes the steps of: measuring any one of, a temperature of the liquid on at least one of the surfaces of the respective first and second rotors, and a temperature of a vicinity of the first and second rotors; and controlling the contact-pressure adjusting means in accordance with the measured temperature.

A second aspect of the present invention for solving the above-described problems provides a contact-pressure adjusting method for a liquid application machine including: a first rotor to which liquid is supplied; a second rotor facing the first rotor, and holding a liquid-applied member to which the liquid is supplied from the first rotor; and contact-pressure adjusting means for adjusting the contact pressure between the first rotor and the second rotor. The contact-pressure adjusting method includes the steps of: measuring any one of, a temperature of the liquid on at least one of the surfaces of the first rotor and the liquid-applied member, and a temperature of a vicinity of the first and second rotors; and controlling the contact-pressure adjusting means in accordance with the measured temperature.

A third aspect of the present invention for solving the above-described problems provides a contact-pressure adjusting method for a liquid application machine including: a first rotor to which liquid is supplied; a second rotor to which the liquid is supplied from the first rotor; and contact-pressure adjusting means for adjusting the contact pressure between the first rotor and the second rotor. The contact-pressure adjusting method includes the steps of: measuring one of the operation time after the operation of the liquid application machine is started, and the number of sheets to which the liquid is applied after the operation of the liquid application machine is started; and controlling the contact-pressure adjusting means in accordance with the value of the measured one of the operation time and the number of the sheets.

A fourth aspect of the present invention for solving the above-described problems provides a contact-pressure adjusting method for a liquid application machine including: a first rotor to which liquid is supplied; a second rotor facing the first rotor, and holding a liquid-applied member to which the liquid is supplied from the first rotor; and contact-pressure adjusting means for adjusting the contact pressure between the first rotor and the second rotor. The contact-pressure adjusting method includes the steps of: measuring one of the operation time after the operation of the liquid application machine is started, and the number of sheets to which the liquid is applied after the operation of the liquid application machine is started; and controlling the contact-pressure adjusting means in accordance with the value of the measured one of the operation time and the number of the sheets.

A fifth aspect of the present invention for solving the above-described problems provides a contact-pressure adjusting system for a liquid application machine including: a first rotor to which liquid is supplied; a second rotor to which the liquid is supplied from the first rotor; and contact-pressure adjusting means for adjusting the contact pressure between the first rotor and the second rotor. The contact-pressure adjusting system includes: temperature measuring means for measuring any one of, a temperature of the liquid on at least one of the surfaces of the respective first and second rotors, and a temperature of a vicinity of the first and second rotors; and contact-pressure controlling means for controlling the contact-pressure adjusting means in accordance with the measured temperature.

A sixth aspect of the present invention for solving the above-described problems provides a contact-pressure adjusting system for a liquid application machine including: a first rotor to which liquid is supplied; a second rotor facing the first rotor, and holding a liquid-applied member to which the liquid is supplied from the first rotor; and contact-pressure adjusting means for adjusting the contact pressure between the first rotor and the second rotor. The contact-pressure adjusting system includes: temperature measuring means for measuring any one of, a temperature of the liquid on at least one of the surfaces of the first rotor and the liquid-applied member, and a temperature of a vicinity of the first and second rotors; and contact-pressure controlling means for controlling the contact-pressure adjusting means in accordance with the measured temperature.

A seventh aspect of the present invention for solving the above-described problems provides a contact-pressure adjusting system for a liquid application machine including: a first rotor to which liquid is supplied; a second rotor to which the liquid is supplied from the first rotor; and contact-pressure adjusting means for adjusting the contact pressure between the first rotor and the second rotor. The contact-pressure adjusting system includes: any one of operating-time measuring means for measuring an operation time after the operation of the liquid application machine is started, and application-number measuring means for measuring the number of sheets to which the liquid is applied after the operation of the liquid application machine is started; and contact-pressure controlling means for controlling the contact-pressure adjusting means in accordance with the value of the measured one of the operation time and the number of the sheets.

An eighth aspect of the present invention for solving the above-described problems provides a contact-pressure adjusting system for a liquid application machine including: a first rotor to which liquid is supplied; a second rotor facing the first rotor, and holding a liquid-applied member to which the liquid is supplied from the first rotor; and contact-pressure adjusting means for adjusting the contact pressure between the first rotor and the second rotor. The contact-pressure adjusting system includes: any one of operating-time measuring means for measuring an operation time after the operation of the liquid application machine is started, and application-number measuring means for measuring the number of sheets to which the liquid is applied after the operation of the liquid application machine is started; and contact-pressure controlling means for controlling the contact-pressure adjusting means in accordance with the value of the measured one of the operation time and the number of the sheets.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 7B shows a hardware block diagram continued from FIG. 7A;

DETAILED DESCRIPTION OF THE INVENTION

Hereinafter, a contact-pressure adjusting method and a contact-pressure adjusting system for a liquid application machine according to the present invention will be described with reference to the accompanying drawings.

First Embodiment

Figure 1:
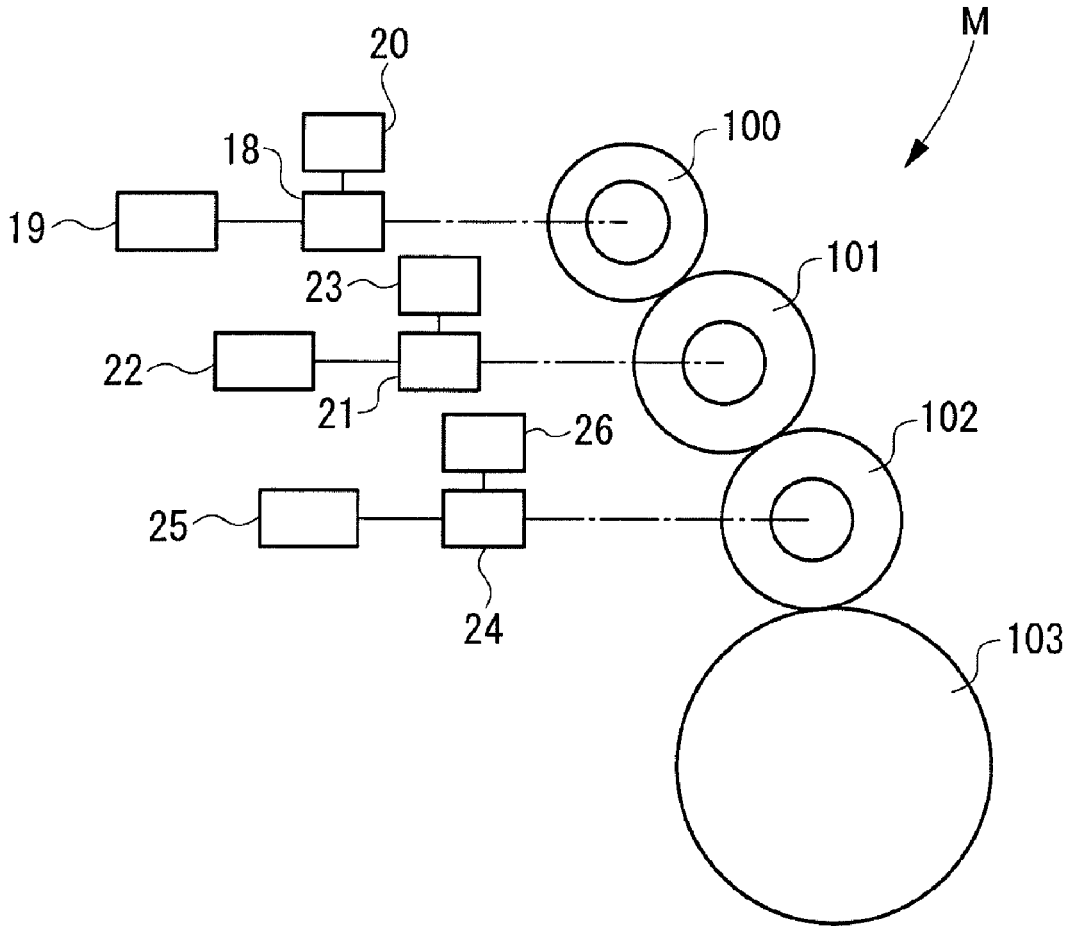
FIG. 1 shows a schematic view of the inside of a printing press to which a contact-pressure adjusting system for a liquid application machine according to a first embodiment of the present invention is employed.

A description will be given of a contact-pressure adjusting method and a contact-pressure adjusting system for a liquid application machine according to a first embodiment of the present invention. FIG. 1 shows a schematic view of the inside of a printing press to which the contact-pressure adjusting system for a liquid application machine according to the first embodiment of the present invention is employed. As shown in FIG. 1, the printing press according to the present embodiment includes an ink form roller 100, a relief cylinder 101, a blanket cylinder 102, and an impression cylinder 103, for each printing unit M. The ink form roller 100 evenly applies ink to an image area on a plate. The relief cylinder 101 includes the plate with protruding portions which are brought into contact with the ink form roller 100 to function as the image area. The blanket cylinder 102 is in contact with the relief cylinder 101, so that ink on the image area on the plate surface is transferred to the blanket cylinder 102. The impression cylinder 103 applies a printing pressure to a printing product that is in contact with the blanket cylinder 102.

The ink form roller 100 is provided with a motor 18 for adjusting the nip pressure between the ink form roller 100 and the relief cylinder 101 for the purpose of adjusting the nip pressure between the ink form roller 100 and the relief cylinder 101. The motor 18 for adjusting the nip pressure between the ink form roller 100 and the relief cylinder 101 is controlled by a motor driver 19 for adjusting the nip pressure between the ink form roller 100 and the relief cylinder 101. In addition, the motor 18 for adjusting the nip pressure between the ink form roller 100 and the relief cylinder 101 is provided with a potentiometer 20 for the motor for adjusting the nip pressure between the ink form roller 100 and the relief cylinder 101 for the purpose of detecting the nip pressure between the ink form roller 100 and the relief cylinder 101.

The relief cylinder 101 is provided with a motor 21 for adjusting the nip pressure between the relief cylinder 101 and the blanket cylinder 102 for the purpose of adjusting the nip pressure between the relief cylinder 101 and the blanket cylinder 102. The motor 21 for adjusting the nip pressure between the relief cylinder 101 and the blanket cylinder 102 is controlled by a motor driver 22 for adjusting the nip pressure between the relief cylinder 101 and the blanket cylinder 102. In addition the motor 21 for adjusting the nip pressure between the relief cylinder 101 and the blanket cylinder 102 is provided with a potentiometer 23 for the motor for adjusting the nip pressure between the relief cylinder 101 and the blanket cylinder 102 for the purpose of detecting the nip pressure between the relief cylinder 101 and the blanket cylinder 102.

The blanket cylinder 102 is provided with a motor 24 for adjusting the printing pressure between the blanket cylinder 102 and the impression cylinder 103 for the purpose of adjusting the printing pressure between the blanket cylinder 102 and the impression cylinder 103. The motor 24 for adjusting the printing pressure between the blanket cylinder 102 and the impression cylinder 103 is controlled by a motor driver 25 for adjusting the printing pressure between the blanket cylinder 102 and the impression cylinder 103. In addition, the motor 24 for adjusting the printing pressure between the blanket cylinder 102 and the impression cylinder 103 is provided with a potentiometer 26 for the motor for adjusting the printing pressure between the blanket cylinder 102 and the impression cylinder 103 for the purpose of detecting the printing pressure between the blanket cylinder 102 and the impression cylinder 103.

Figure 2:
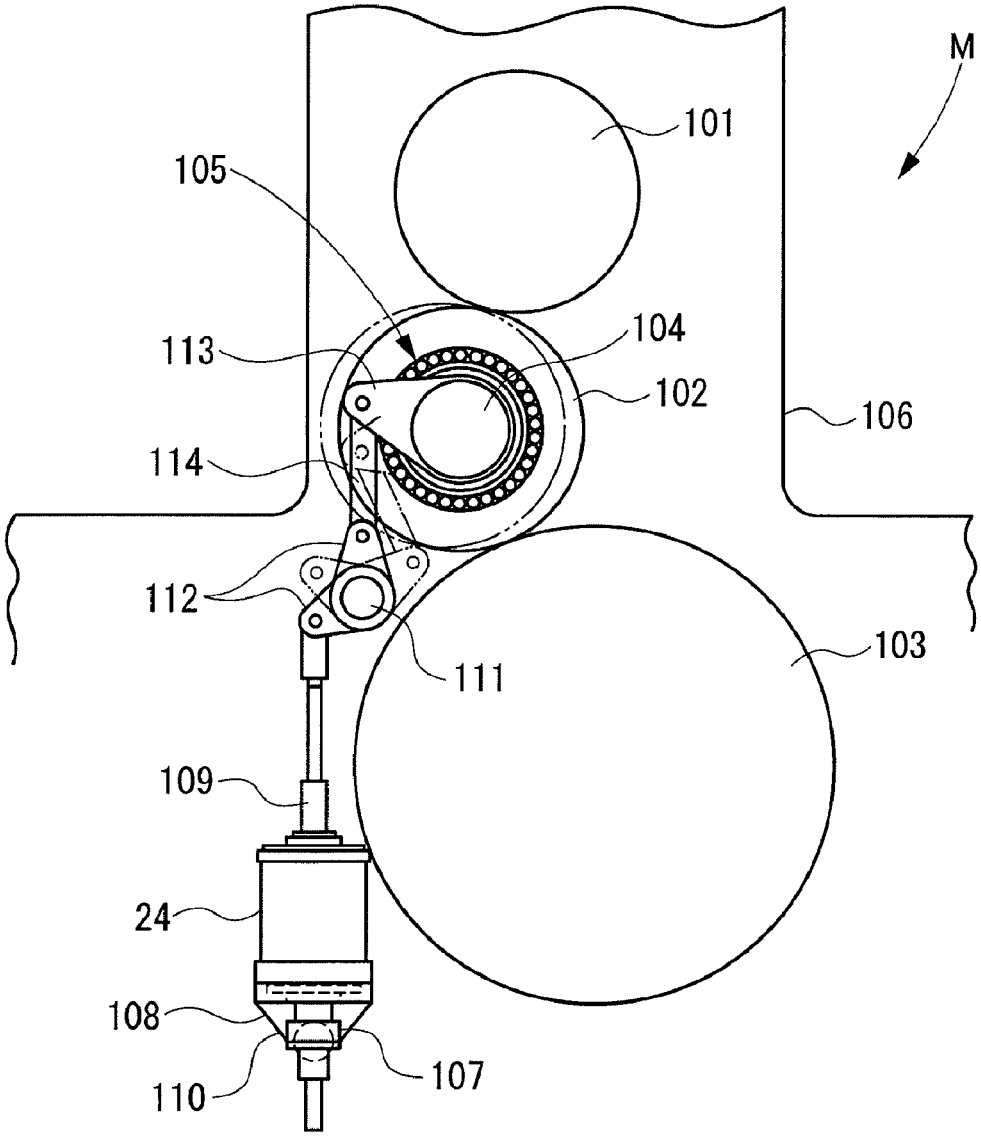
FIG. 2 shows a schematic view of a contact-pressure adjusting method for adjusting a nip pressure or a printing pressure, according to the first embodiment of the present invention.

Here, a description will be given of a contact-pressure adjusting means for adjusting a nip pressure or a printing pressure according to the present embodiment. FIG. 2 shows a schematic view of a contact-pressure adjusting method for adjusting a nip pressure or a printing pressure according to the first embodiment of the present invention. Note that, although a description will be given here of the case of adjusting the nip pressure between the blanket cylinder 102 and the impression cylinder 103, contact-pressure adjusting methods to be employed to other cylinders also have substantially the same configuration as that of the case to be described here.

As shown in FIG. 2, the contact-pressure adjusting method includes: the relief cylinder 101, on which the plate for printing is mounted; the blanket cylinder 102, which includes a blanket mounted on the circumferential surface thereof, and which is in contact with the relief cylinder 101 during the printing operation; and the impression cylinder 103 serving as a printing cylinder, with which the blanket cylinder 102 is brought into contact during the printing operation. Among these cylinders 101, 102, and 103, the two end shafts of the impression cylinder 103 are pivotally and rotatably supported, with unillustrated bearings, by left and right frames 106 provided to the printing unit M. In addition, the two end shafts 104 of the blanket cylinder 102 are pivotally and rotatably supported by eccentric bearings 105, which are provided eccentrically to the center axis of the blanket cylinder 102, and which are fitted into the left and right frames 106.

On the other hand, a bracket 108 is supported on a stud 107, which is adjacent to the end shaft of the impression cylinder 103, and which protrudes outward from one of the frames 106. A motor 24 for adjusting the printing pressure between the blanket cylinder 102 and the impression cylinder 103 serves as a drive device, and is fixed to the bracket 108 in a state where a drive rod 109 is brought in an upright position. The rotation of the motor 24 for adjusting the printing pressure between the blanket cylinder 102 and the impression cylinder 103 causes a nut 110 to rotate, in turn causing the drive rod 109 having a screw portion screwed into the nut 110 to advance and retreat up and down. Moreover, a lever shaft 111 is located above the drive rod 109, and is pivotally supported, at the two end portions thereof, by the left and right frames 106. Connecting lever 112, each formed in an L shape in the front view, are pivotally attached to portions, protruding on one side, of the lever shaft 111.

Bearing levers 113, fixed respectively to the left and right eccentric bearings 105, are connected to the connecting levers 112 with rods 114. The rotation of the motor 24 for adjusting the printing pressure between the blanket cylinder 102 and the impression cylinder 103 causes the drive rod 109 to advance and retreat. The drive power is thus transmitted via the connecting lever 112, the rod 114 and the bearing lever 113 to the eccentric bearings 105 on the two sides so as to rotate the eccentric bearings 105. Such a method as described above makes it possible to adjust the printing pressure between the blanket cylinder 102 and the impression cylinder 103. Note that, although the contact-pressure adjusting method as shown in FIG. 2 is employed in this embodiment, the nip pressure or the printing pressure may be adjusted by employing another method.

Figure 3A:
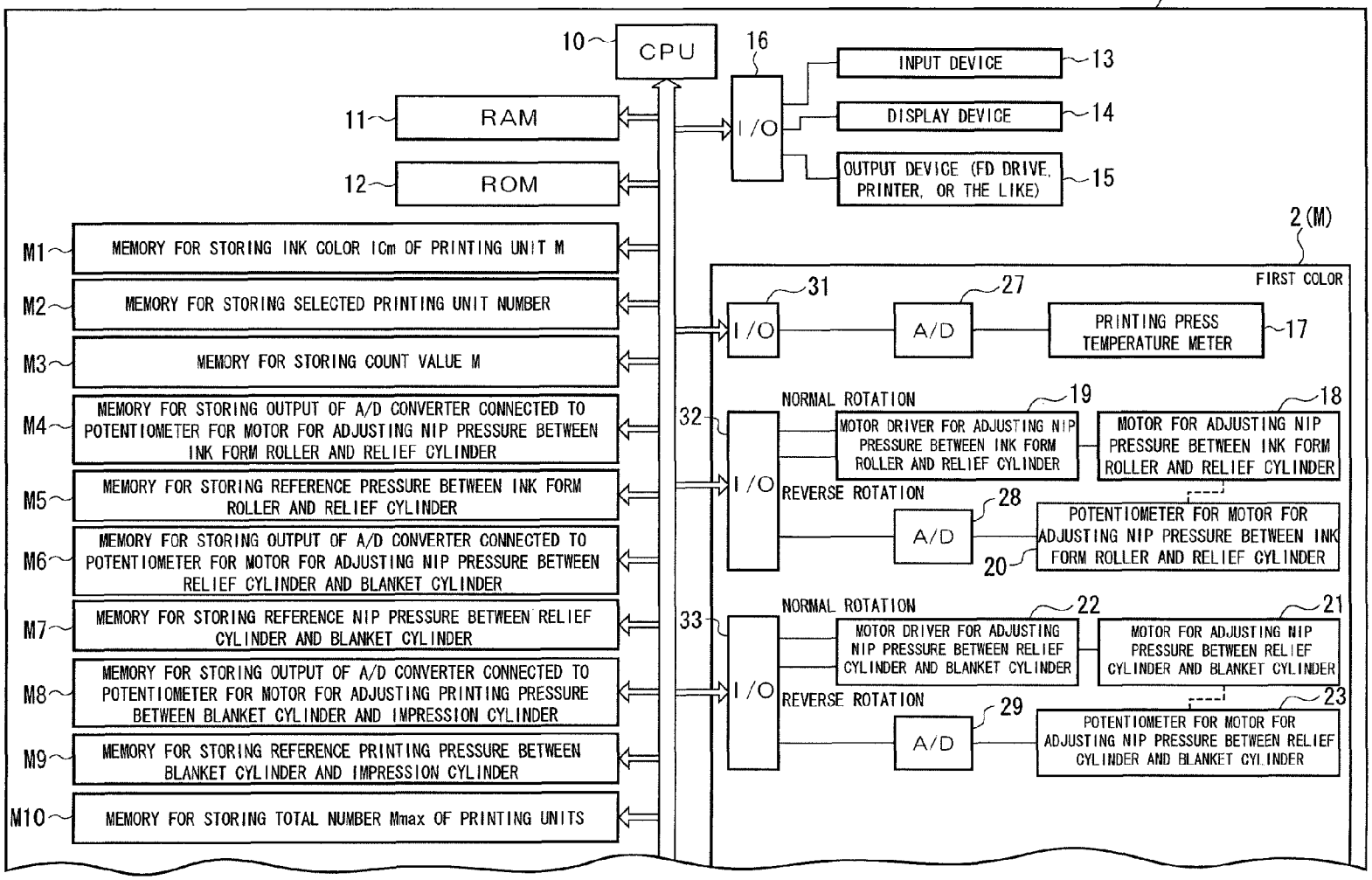
FIG. 3A shows a hardware block diagram of the contact-pressure adjusting system for a liquid application machine according to the first embodiment of the present invention.
Figure 3B:
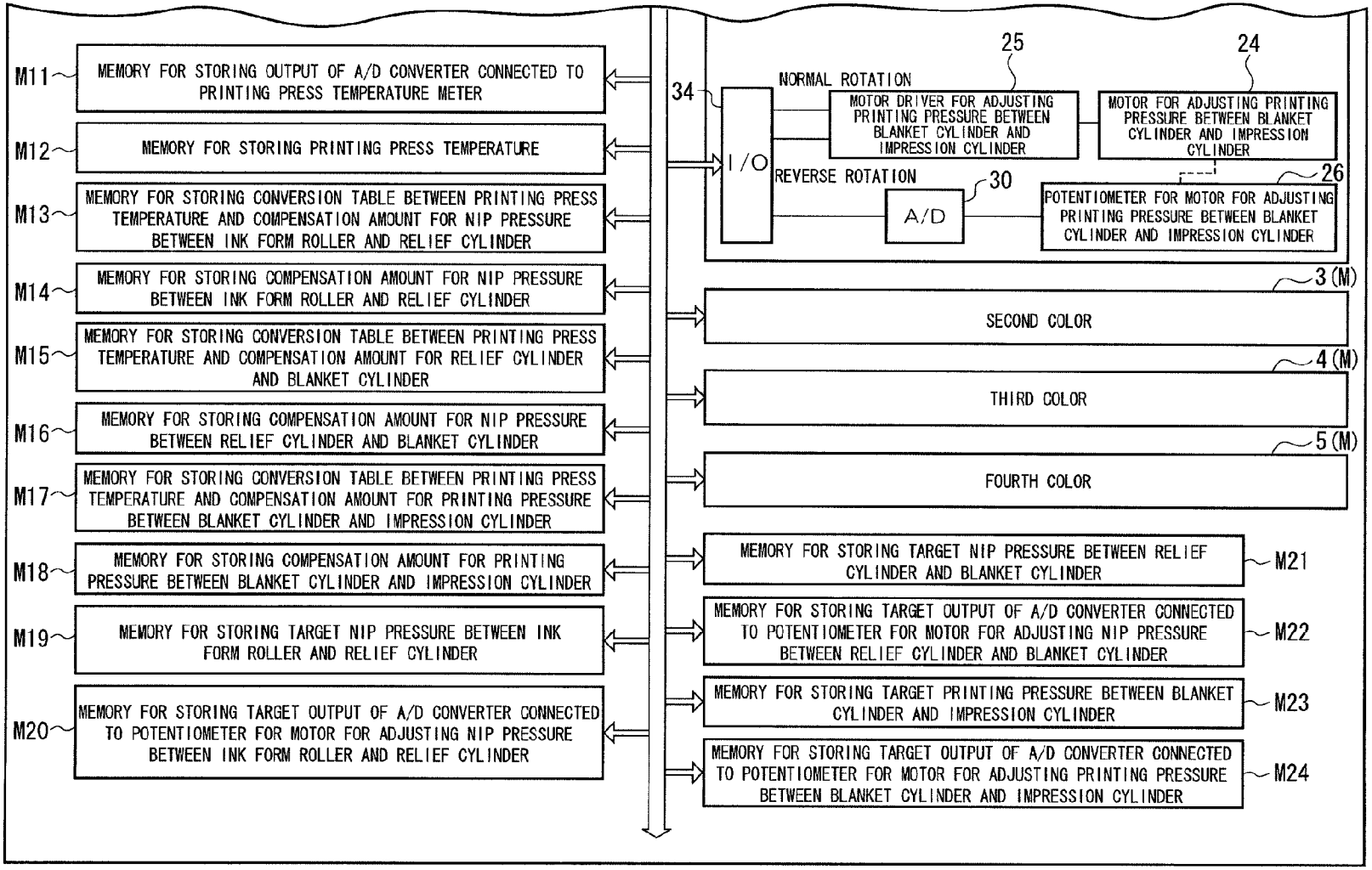
FIG. 3B shows a hardware block diagram continued from FIG. 3A.
Figure 4A:
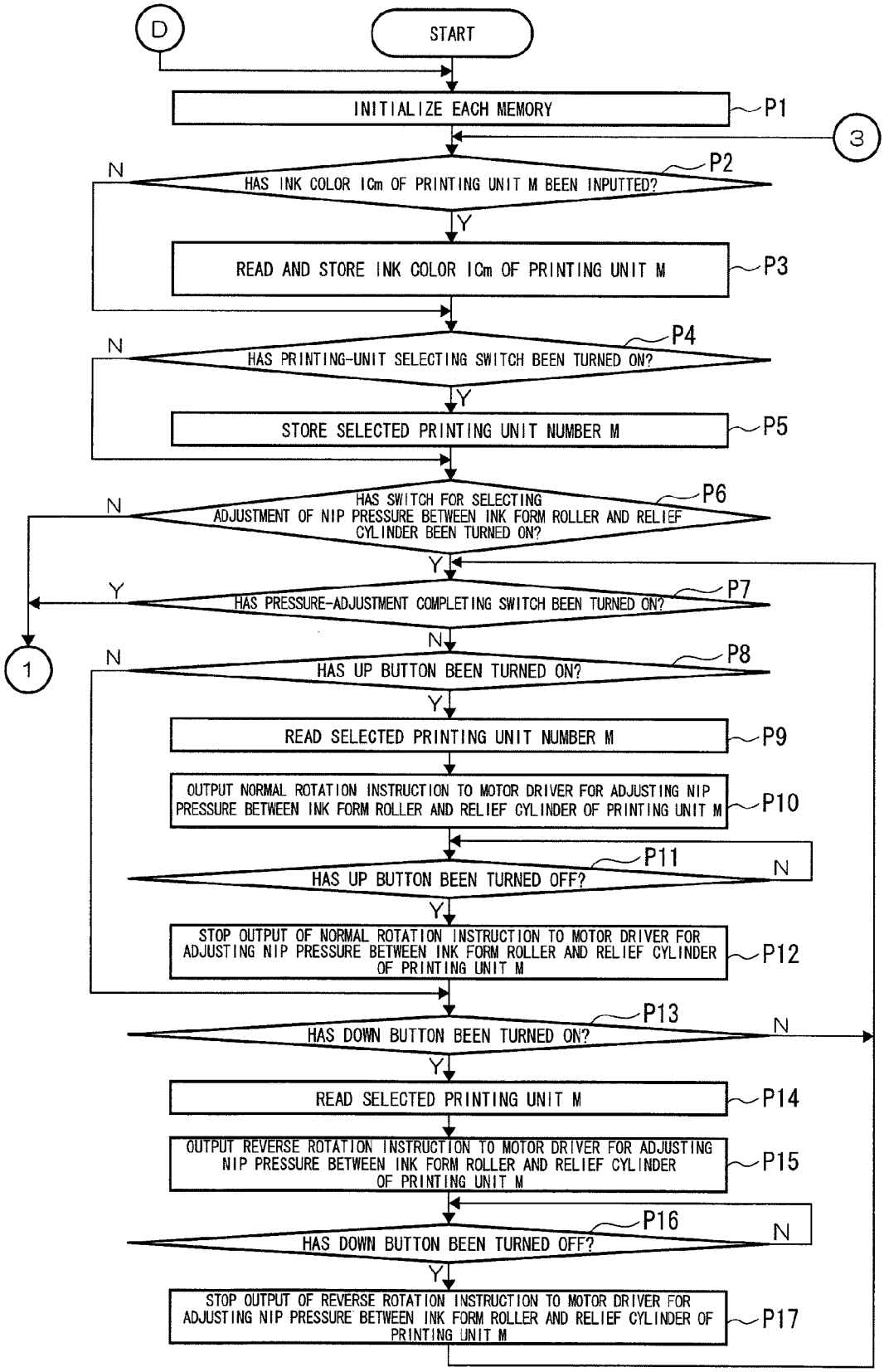
FIG. 4A shows an operational flowchart of the contact-pressure adjusting system for a liquid application machine according to the first embodiment of the present invention.
Figure 4B:
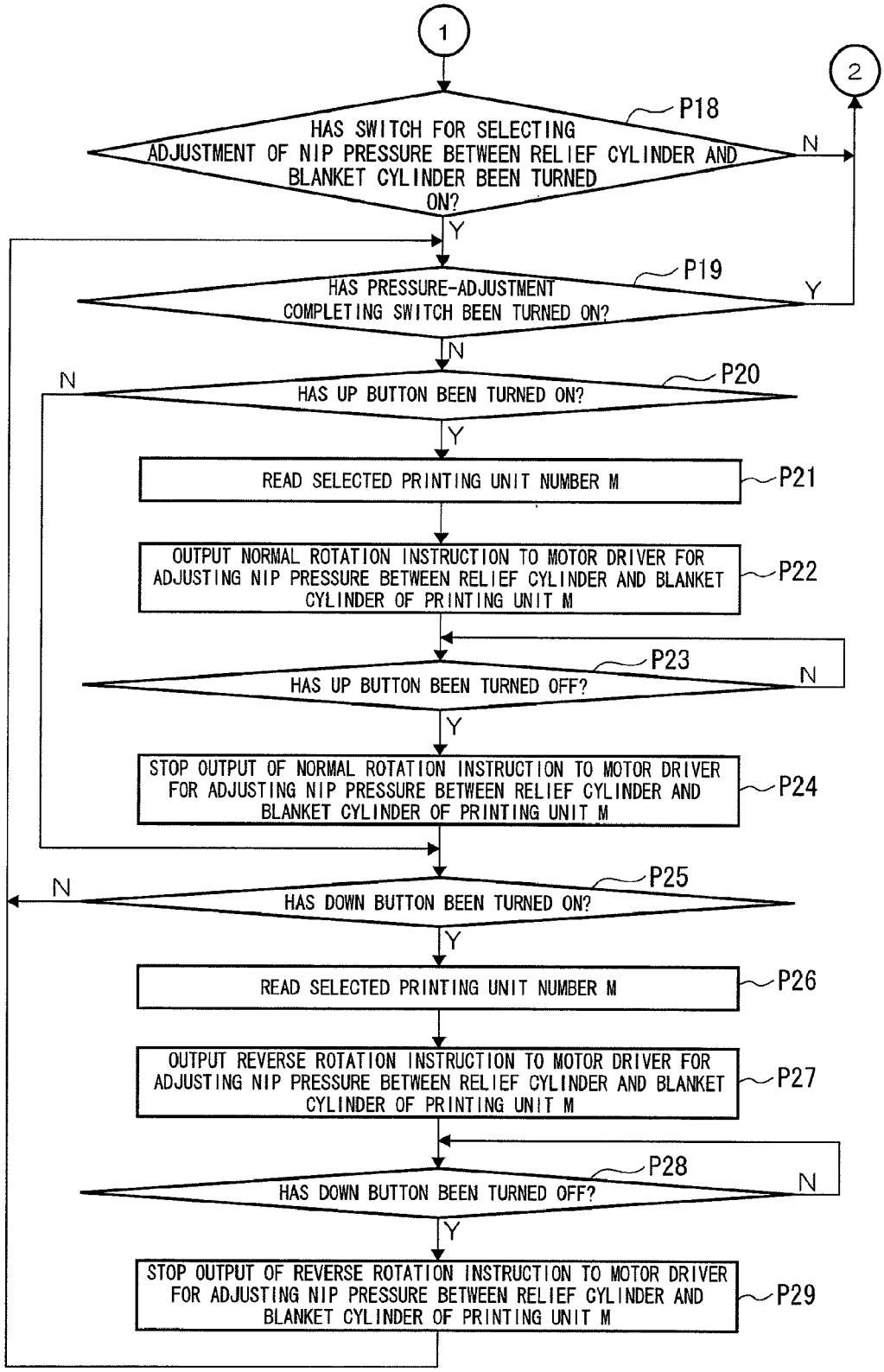
FIG. 4B shows an operational flowchart subsequent to that of FIG. 4A.
Figure 4C:
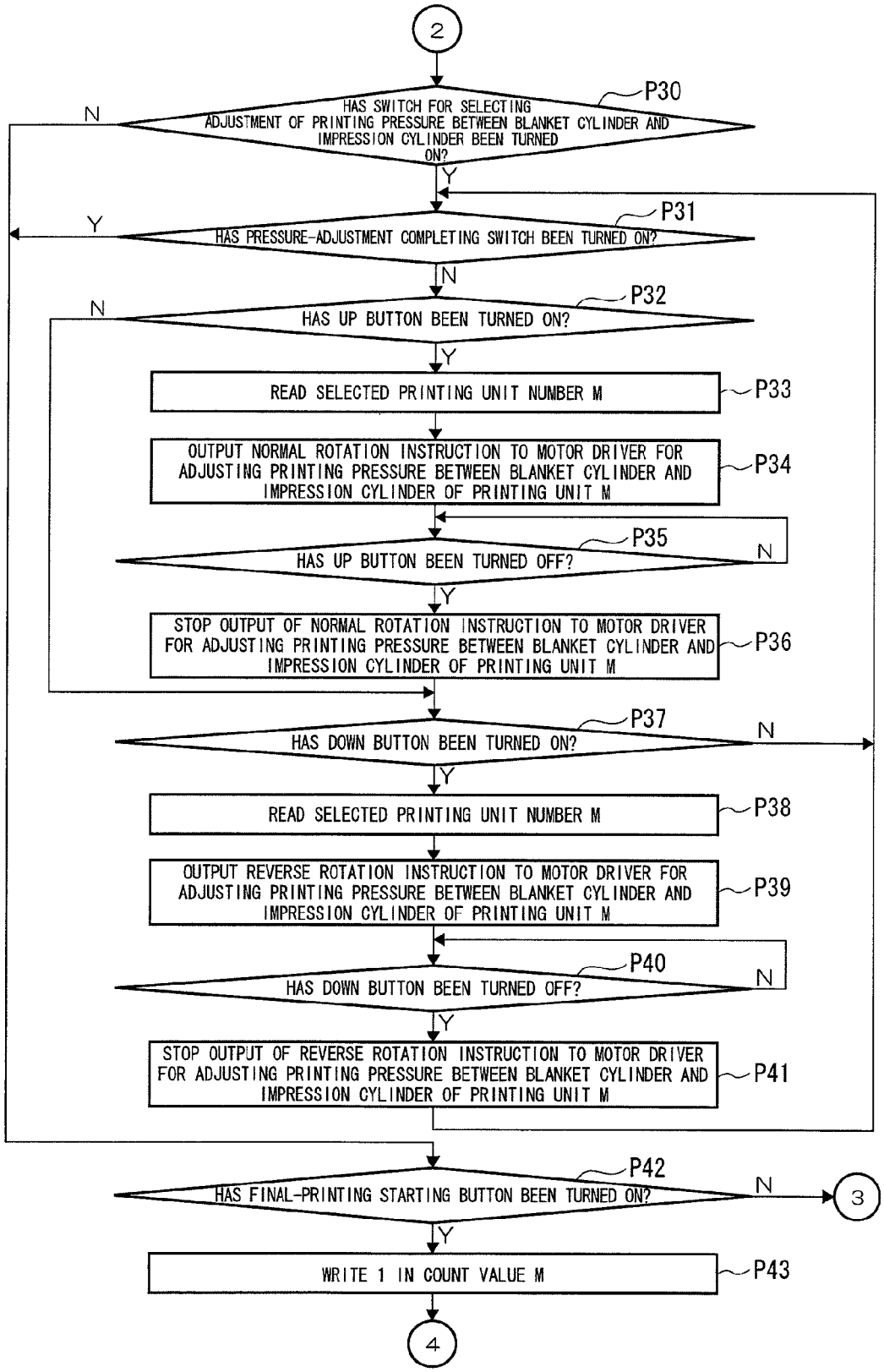
FIG. 4C shows an operational flowchart subsequent to that of FIG. 4B.
Figure 4D:
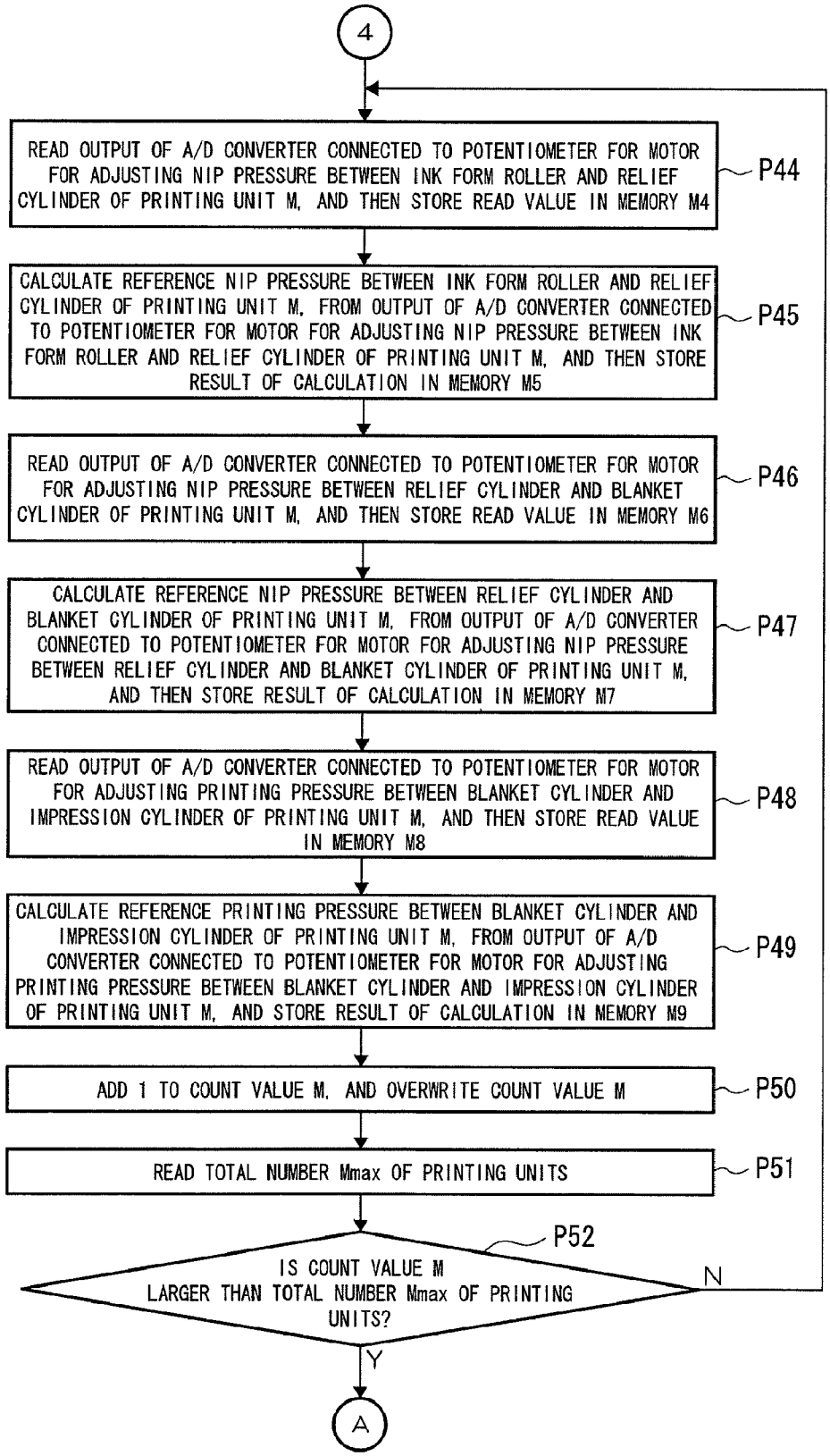
FIG. 4D shows an operational flowchart subsequent to that of FIG. 4C.
Figure 5A:
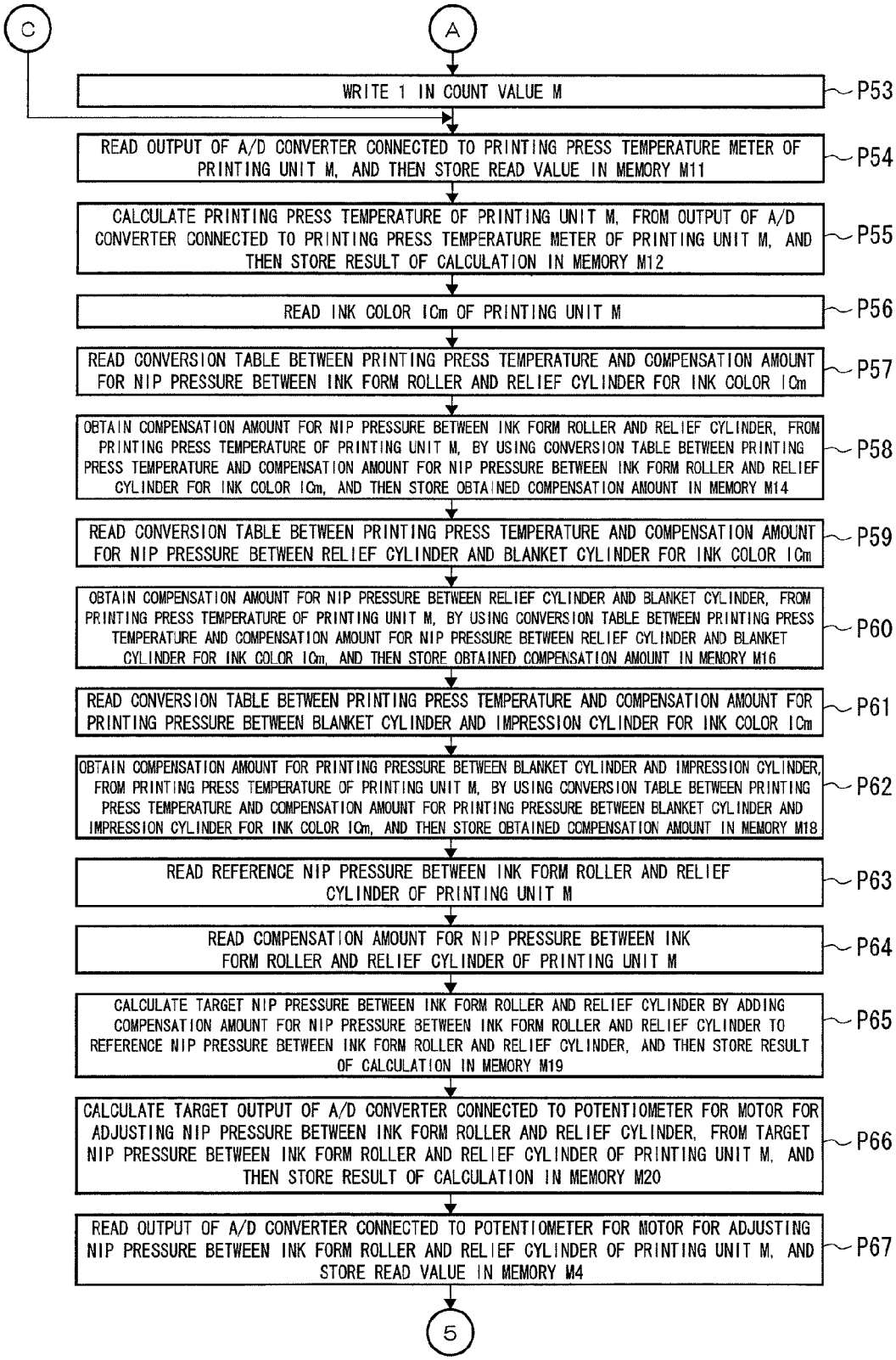
FIG. 5A shows an operational flowchart subsequent to that of FIG. 4D.
Figure 5B:
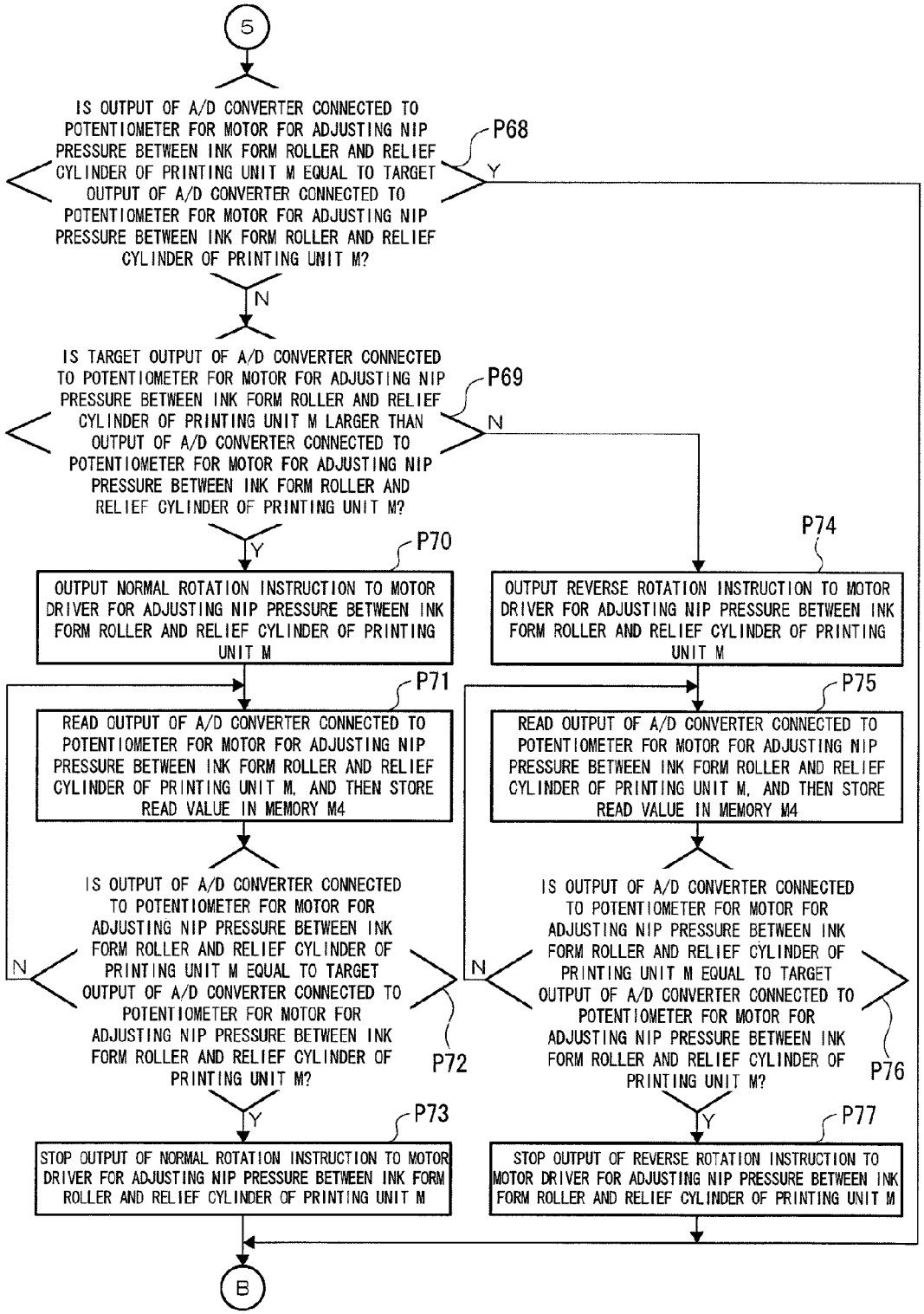
FIG. 5B shows an operational flowchart subsequent to that of FIG. 5A.
Figure 6A:
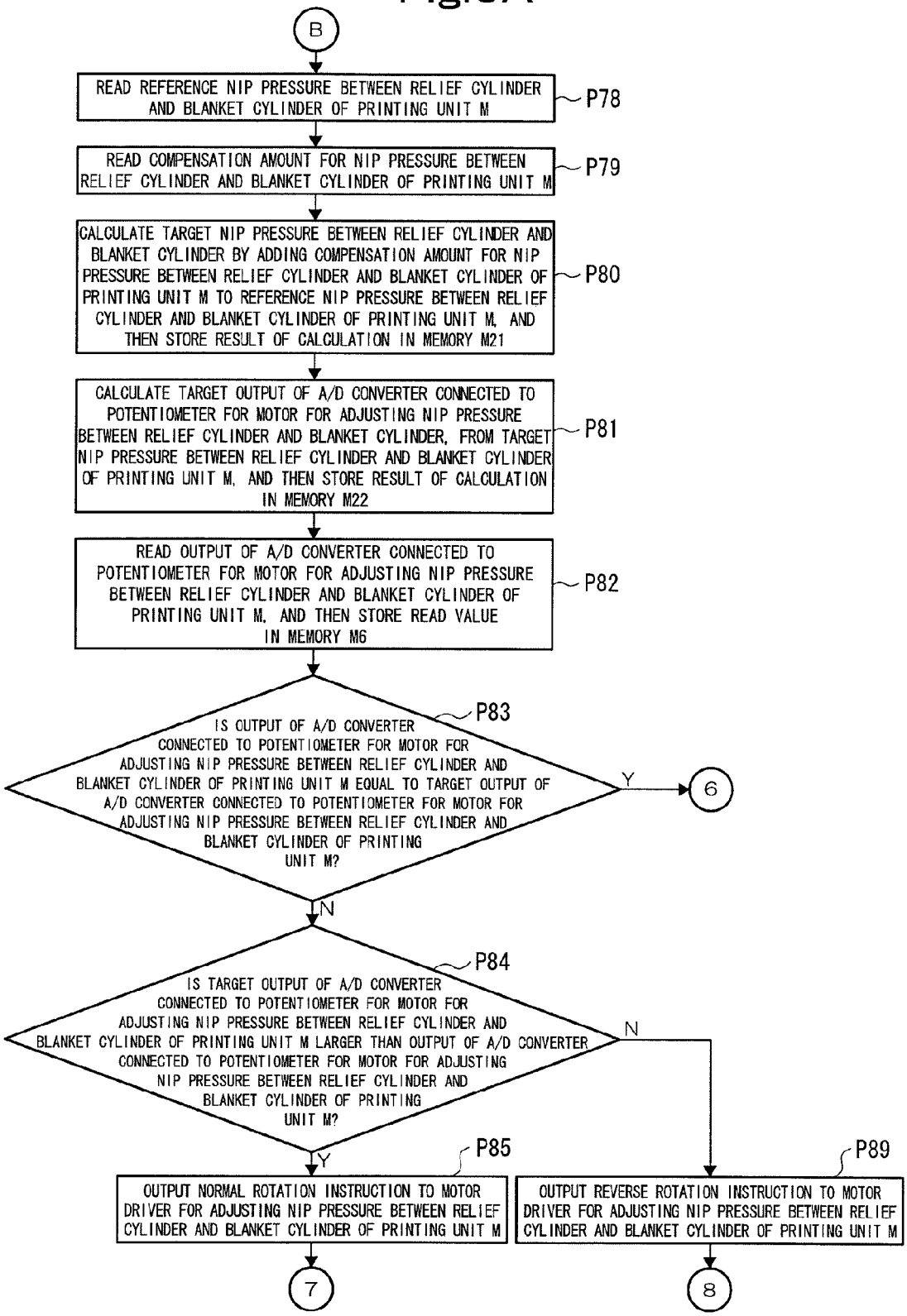
FIG. 6A shows an operational flowchart subsequent to that of FIG. 5B.
Figure 6B:
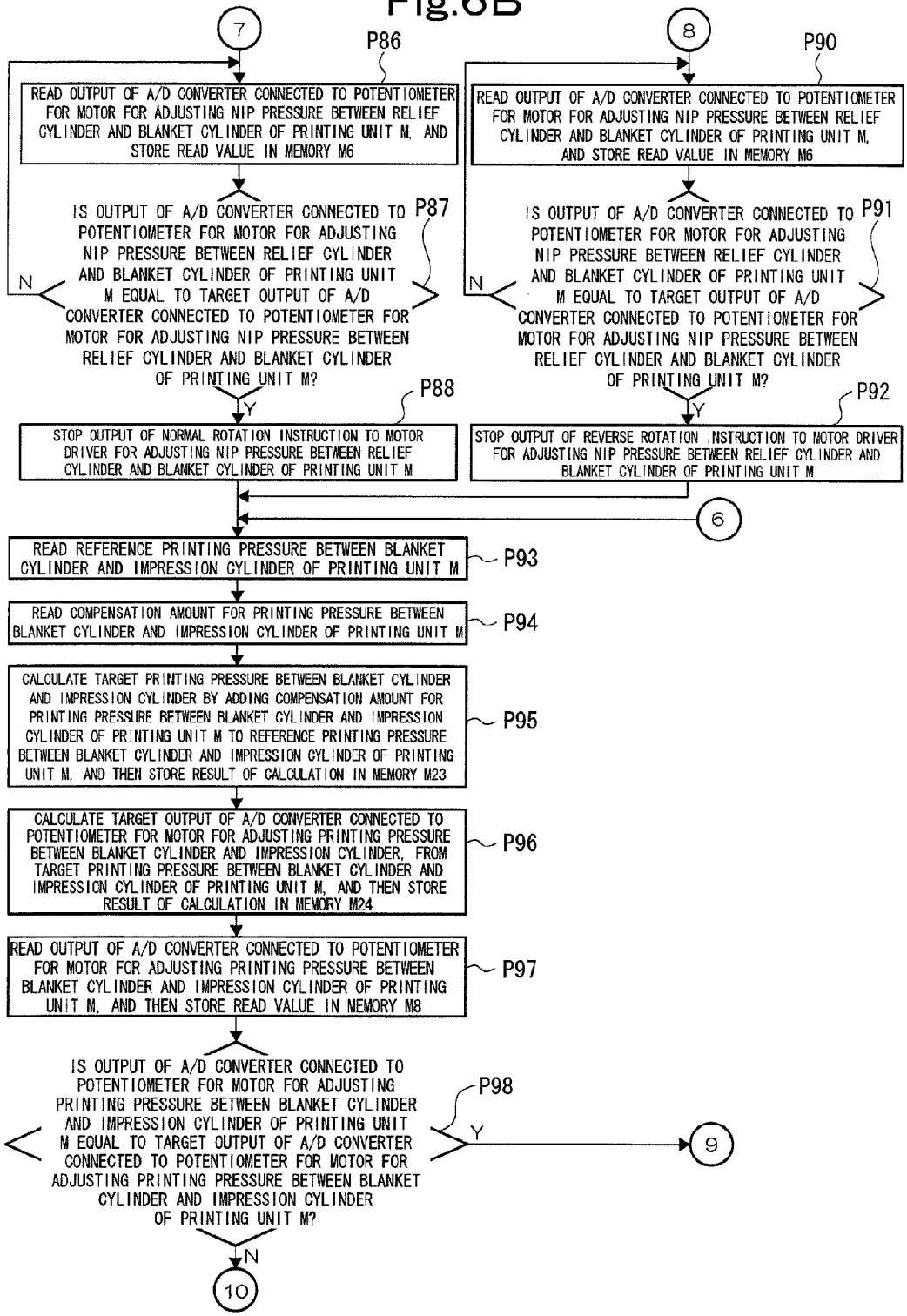
FIG. 6B shows an operational flowchart subsequent to that of FIG. 6A.
Figure 6C:
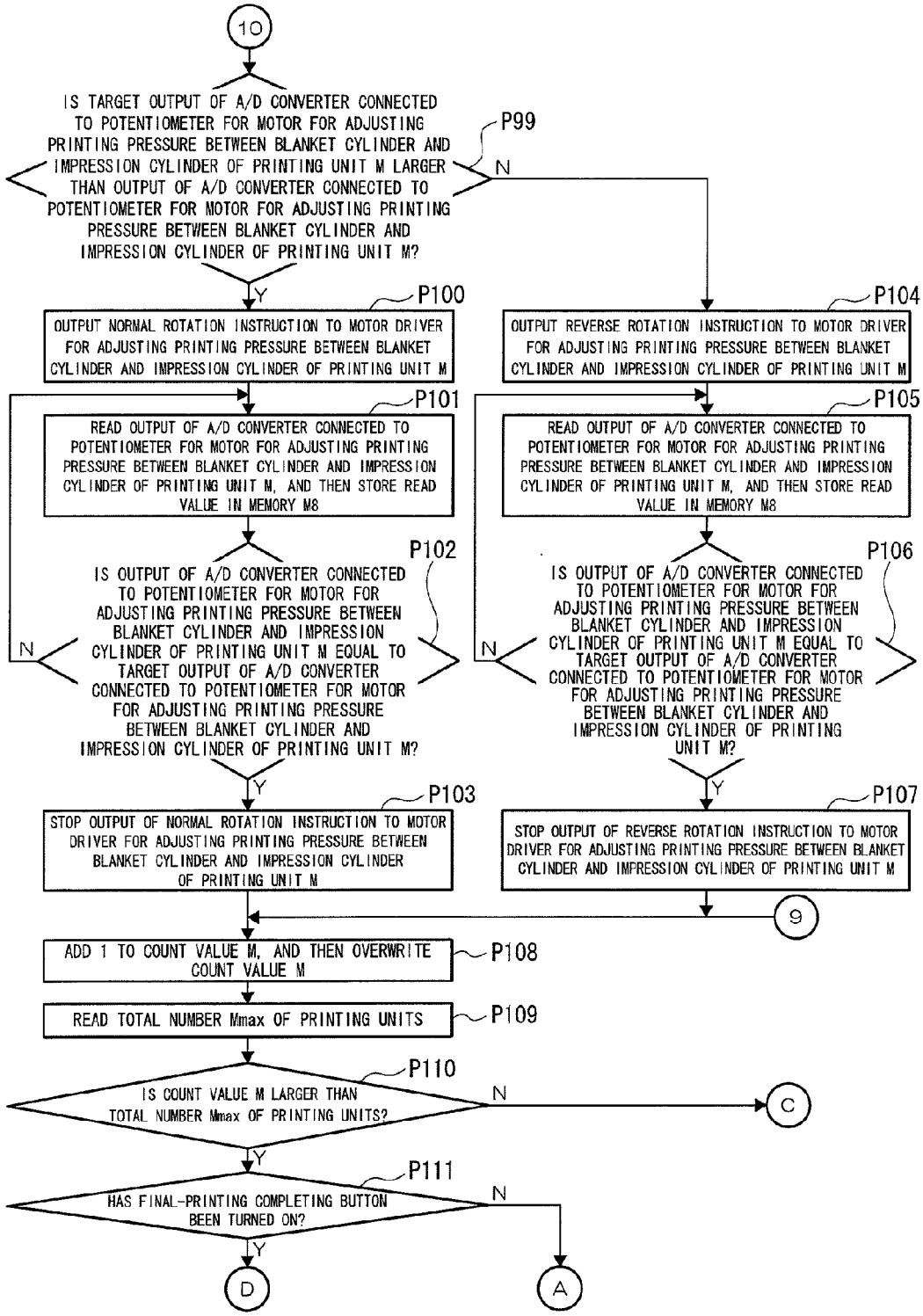
FIG. 6C shows an operational flowchart subsequent to that of FIG. 6B.

Next, a description will be given of a contact-pressure adjusting system for a liquid application machine according to the first embodiment of the present invention. FIGS. 3A and 3B show hardware block diagrams of the contact-pressure adjusting system for a liquid application machine according to the first embodiment of the present invention. As shown in FIGS. 3A and 3B, the contact-pressure adjusting system 1 for a liquid application machine includes a CPU 10, a RAM 11, a ROM 12, an input device 13, a display device 14, an output device (an FD drive, a printer or the like) 15, and an I/O (input/output) interface 16.

In addition, the printing unit M includes a printing press temperature meter 17, the motor 18 for adjusting the nip pressure between the ink form roller 100 and the relief cylinder 101, the motor driver 19 for adjusting the nip pressure between the ink form roller 100 and the relief cylinder 101, the potentiometer 20 for the motor for adjusting the nip pressure between the ink form roller 100 and the relief cylinder 101, the motor 21 for adjusting the nip pressure between the relief cylinder 101 and the blanket cylinder 102, the motor driver 22 for adjusting the nip pressure between the relief cylinder 101 and the blanket cylinder 102, the potentiometer 23 for the motor for adjusting the nip pressure between the relief cylinder 101 and the blanket cylinder 102, the motor 24 for adjusting the printing pressure between the blanket cylinder 102 and the impression cylinder 103, the motor driver 25 for adjusting the printing pressure between the blanket cylinder 102 and the impression cylinder 103, the potentiometer 26 for the motor for adjusting the printing pressure between the blanket cylinder 102 and the impression cylinder 103, A/D (analog/digital) converters 27 to 30, and I/O (input/output) interfaces 31 to 34. Note that, the printing press temperature meter 17 is configured to measure, as a reference, the temperature inside the printing unit M, or the temperature of ink on the surface of each roller. Accordingly, the printing press temperature meter 17 may be installed in a vicinity of the ink form roller 100, the relief cylinder 101, the blanket cylinder 102 and the impression cylinder 103.

In the printing press according to the present embodiment, inks of four colors are used. Accordingly, each of a printing unit 2 of the first color (for example, black), a printing unit 3 of the second color (for example, cyan), a printing unit 4 of the third color (for example, magenta), and a printing unit 5 of the fourth color (for example, yellow) includes the printing press temperature meter 17, the motor 18 for adjusting the nip pressure between the ink form roller 100 and the relief cylinder 101, the motor driver 19 for adjusting the nip pressure between the ink form roller 100 and the relief cylinder 101, the potentiometer 20 for the motor for adjusting the nip pressure between the ink form roller 100 and the relief cylinder 101, the motor 21 for adjusting the nip pressure between the relief cylinder 101 and the blanket cylinder 102, the motor driver 22 for adjusting the nip pressure between the relief cylinder 101 and the blanket cylinder 102, the potentiometer 23 for the motor for adjusting the nip pressure between the relief cylinder 101 and the blanket cylinder 102, the motor 24 for adjusting the printing pressure between the blanket cylinder 102 and the impression cylinder 103, the motor driver 25 for adjusting the printing pressure between the blanket cylinder 102 and the impression cylinder 103, the potentiometer 26 for the motor for adjusting the printing pressure between the blanket cylinder 102 and the impression cylinder 103, the A/D (analog/digital) converters 27 to 30, and the I/O (input/output) interfaces 31 to 34. Although the inks of four colors are used in the present embodiment, the number of colors of inks to be used may be increased or decreased by increasing or decreasing the number of printing units.

Moreover, the contact-pressure adjusting system 1 for a liquid application machine includes memories M1 to M24. In the memory M1, an ink color ICm of the printing unit M is stored. In the memory M2, a selected printing unit number is stored. In the memory M3, a count value M is stored. In the memory M4, an output of the A/D converter connected to the potentiometer 20 for the motor for adjusting the nip pressure between the ink form roller 100 and the relief cylinder 101 is stored. In the memory M5, a reference nip pressure between the ink form roller 100 and the relief cylinder 101 is stored. In the memory M6, an output of the A/D converter connected to the potentiometer 23 for the motor for adjusting the nip pressure between the relief cylinder 101 and the blanket cylinder 102 is stored. In the memory M7, a reference nip pressure between the relief cylinder 101 and the blanket cylinder 102 is stored. In the memory M8, an output of the A/D converter connected to the potentiometer 26 for the motor for adjusting the printing pressure between the blanket cylinder 102 and the impression cylinder 103 is stored. In the memory M9, a reference printing pressure between the blanket cylinder 102 and the impression cylinder 103 is stored. In the memory M10, the total number Mmax of printing units is stored. In the memory M11, an output of the A/D converter connected to the printing press temperature meter 17 is stored. In the memory M12, a temperature of the printing press (hereinafter, referred to as the printing press temperature) is stored. In the memory M13, a conversion table between the printing press temperature and the compensation amount for the nip pressure between the ink form roller 100 and the relief cylinder 101 is stored. In the memory M14, a compensation amount for the nip pressure between the ink form roller 100 and the relief cylinder 101 is stored. In the memory M15, a conversion table between the printing press temperature and the compensation amount for the nip pressure between the relief cylinder 101 and the blanket cylinder 102 is stored. In the memory M16, a compensation amount for the nip pressure between the relief cylinder 101 and the blanket cylinder 102 is stored. In the memory M17, a conversion table between the printing press temperature and the compensation amount for the printing pressure between the blanket cylinder 102 and the impression cylinder 103 is stored. In the memory M18, a compensation amount for the printing pressure between the blanket cylinder 102 and the impression cylinder 103 is stored. In the memory M19, a target nip pressure between the ink form roller 100 and the relief cylinder 101 is stored. In the memory M20, a target output of the A/D converter connected to the potentiometer 20 for the motor for adjusting the nip pressure between the ink form roller 100 and the relief cylinder 101 is stored. In the memory M21, a target nip pressure between the relief cylinder 101 and the blanket cylinder 102 is stored. In the memory M22, a target output of the A/D converter connected to the potentiometer 23 for the motor for adjusting the nip pressure between the relief cylinder 101 and the blanket cylinder 102 is stored. In the memory M23, a target printing pressure between the blanket cylinder 102 and the impression cylinder 103 is stored. In the memory M24, a target output of the A/D converter connected to the potentiometer 26 for the motor for adjusting the printing pressure between the blanket cylinder 102 and the impression cylinder 103 is stored.

The CPU 10 obtains various kinds of information which are inputted thereto via the I/O interfaces 16, and 31 to 34, and operates in accordance with a program stored in the ROM 12, while accessing the RAM 11 as well as the memories M1 to M24. The input device 13 is provided with various kinds of input devices including an input unit of the ink color ICm of the printing unit M, a printing-unit selecting switch, a switch for selecting the adjustment of the nip pressure between the ink form roller 100 and the relief cylinder 101, a pressure-adjustment completing switch, an up button, a down button, a switch for selecting the adjustment of the nip pressure between the relief cylinder 101 and the blanket cylinder 102, a switch for selecting the adjustment of the printing pressure between the blanket cylinder 102 and the impression cylinder 103, a final-printing starting button, and a final-printing completing button.

Next, the operation of the contact-pressure adjusting system for a liquid application machine according to the first embodiment of the present invention will be described. Each of FIGS. 4A to 4D, 5A and 5B, and 6A to 6C shows an operational flowchart of the contact-pressure adjusting system 1 for a liquid application machine according to the first embodiment of the present invention. Hereinafter, the content of the processing of each step will be described.

In Step P1, the CPU 10 initializes each memory. Upon completion of the processing of Step P1, the CPU 10 executes Step P2.

In Step P2, the CPU 10 determines whether or not an ink color ICm of the printing unit M has been inputted, by the operator, to the input unit of the ink color ICm of the printing unit M, which is provided to the input device 13. When the ink color ICm of the printing unit M has been inputted by the operator, the CPU 10 executes Step P3. On the other hand, when the ink color ICm of the printing unit M has not been inputted by the operator, the CPU 10 skips Step P3, and then executes Step P4.

In Step P3, the CPU 10 reads the ink color ICm of the printing unit M, and then stores the ink color ICm in the memory M1. Upon completion of the processing of Step P3, the CPU 10 executes Step P4.

In Step P4, the CPU 10 determines whether or not the printing-unit selecting switch, which is provided to the input device 13, has been turned ON by the operator. When the printing-unit selecting switch has been turned ON, the CPU 10 executes Step P5. On the other hand, when the printing-unit selecting switch has not been turned ON, the CPU 10 skips Step P5, and then executes Step P6.

In Step P5, the CPU 10 stores the selected printing unit number M in the memory M2. Upon completion of the processing of Step P5, the CPU 10 executes Step P6.

In Step P6, the CPU 10 determines whether or not the switch for selecting the adjustment of the nip pressure between the ink form roller and the relief cylinder, which switch is provided to the input device 13, has been turned ON by the operator. When the switch for selecting the adjustment of the nip pressure between the ink form roller and the relief cylinder has been turned ON, the CPU 10 executes Step P7. On the other hand, when the switch for selecting the adjustment of the nip pressure between the ink form roller and the relief cylinder has not been turned ON, the CPU 10 skips Steps P7 to P17, and then executes Step P18.

In Step P7, the CPU 10 determines whether or not the pressure-adjustment completing switch, which is provided to the input device 13, has been turned ON by the operator. When the pressure-adjustment completing switch has been turned ON, the CPU 10 skips Steps P8 to P17, and then executes Step P18. On the other hand, when the pressure-adjustment completing switch has not been turned ON, the CPU 10 executes Step P8.

In Step P8, the CPU 10 determines whether or not the up button, which is provided to the input device 13, has been turned ON by the operator. When the up button has been turned ON, the CPU 10 executes Step P9. On the other hand, when the up button has not been turned ON, the CPU 10 skips Steps P9 to P12, and then executes Step P13.

In Step P9, the CPU 10 reads the selected printing unit number M stored in the memory M2. Upon completion of the processing of Step P9, the CPU 10 executes Step P10.

In Step P10, the CPU 10 outputs a normal rotation instruction to the motor driver 19 for adjusting the nip pressure between the ink form roller and the relief cylinder of the printing unit M. Upon completion of the processing of Step P10, the CPU 10 executes Step P11.

In Step P11, the CPU 10 determines whether or not the up button, which is provided to the input device 13, has been turned OFF by the operator. When the up button has been turned OFF, the CPU 10 executes Step P12. On the other hand, when the up button has not been turned OFF, the CPU 10 executes Step P11 again.

In Step P12, the CPU 10 stops the output of the normal rotation instruction to the motor driver 19 for adjusting the nip pressure between the ink form roller and the relief cylinder of the printing unit M. Upon completion of the processing of Step P12, the CPU 10 executes Step P13.

In Step P13, the CPU 10 determines whether or not the down button, which is provided to the input device 13, has been turned ON by the operator. When the down button has been turned ON, the CPU 10 executes Step P14. On the other hand, when the down button has not been turned ON, the CPU 10 executes Step P7.

In Step P14, the CPU 10 reads the selected printing unit number M stored in the memory M2. Upon completion of the processing of Step P14, the CPU 10 executes Step P15.

In Step P15, the CPU 10 outputs a reverse rotation instruction to the motor driver 19 for adjusting the nip pressure between the ink form roller and the relief cylinder of the printing unit M. Upon completion of the processing of Step P15, the CPU 10 executes Step P16.

In Step P16, the CPU 10 determines whether or not the down button, which is provided to the input device 13, has been turned OFF by the operator. When the down button has been turned OFF, the CPU 10 executes Step P17. On the other hand, when the down button has not been turned OFF, the CPU 10 executes Step P16 again.

In Step P17, the CPU 10 stops the output of the reverse rotation instruction to the motor driver 19 for adjusting the nip pressure between the ink form roller and the relief cylinder of the printing unit M. Upon completion of the processing of Step P17, the CPU 10 executes Step P7.

In Step P18, the CPU 10 determines whether or not the switch for selecting the adjustment of the nip pressure between the relief cylinder and the blanket cylinder, which switch is provided to the input device 13, has been turned ON by the operator. When the switch for selecting the adjustment of the nip pressure between the relief cylinder and the blanket cylinder has been turned ON, the CPU 10 executes Step P19. On the other hand, when the switch for selecting the adjustment of the nip pressure between the relief cylinder and the blanket cylinder has not been turned ON, the CPU 10 skips Steps P19 to P29, and then executes Step P30.

In Step P19, the CPU 10 determines whether or not the pressure-adjustment completing switch, which is provided to the input device 13, has been turned ON by the operator. When the pressure-adjustment completing switch has been turned ON, the CPU 10 skips Steps P20 to P29, and then executes Step P30. On the other hand, when the pressure-adjustment completing switch has not been turned ON, the CPU 10 executes Step P20.

In Step P20, the CPU 10 determines whether or not the up button, which is provided to the input device 13, has been turned ON by the operator. When the up button has been turned ON, the CPU 10 executes Step P21. On the other hand, when the up button has not been turned ON, the CPU 10 skips Steps P21 to P24, and then executes Step P25.

In Step P21, the CPU 10 reads the selected printing unit number M from the memory M2. Upon completion of the processing of Step P21, the CPU 10 executes Step P22.

In Step P22, the CPU 10 outputs a normal rotation instruction to the motor driver 22 for adjusting the nip pressure between the relief cylinder and the blanket cylinder of the printing unit M. Upon completion of the processing of Step P22, the CPU 10 executes Step P23.

In Step P23, the CPU 10 determines whether or not the up button, which is provided to the input device 13, has been turned OFF by the operator. When the up button has been turned OFF, the CPU 10 executes Step P24. On the other hand, when the up button has not been turned OFF, the CPU 10 executes Step P23 again.

In Step P24, the CPU 10 stops the output of the normal rotation instruction to the motor driver 22 for adjusting the nip pressure between the relief cylinder and the blanket cylinder of the printing unit M. Upon completion of the processing of Step P24, the CPU 10 executes Step P25.

In Step P25, the CPU 10 determines whether or not the down button provided to input device 13 has been turned ON. When the down button has been turned ON, the CPU 10 executes Step P26. On the other hand, when the down button has not been turned ON, the CPU 10 executes Step P19.

In Step P26, the CPU 10 reads the selected printing unit number M from the memory M2. Upon completion of the processing of Step P26, the CPU 10 executes Step P27.

In Step P27, the CPU 10 outputs a reverse rotation instruction to the motor driver 22 for adjusting the nip pressure between the relief cylinder and the blanket cylinder of the printing unit M. Upon completion of the processing of Step P27, the CPU 10 executes Step P28.

In Step P28, the CPU 10 determines whether or not the down button, which is provided to the input device 13, has been turned OFF by the operator. When the down button has been turned OFF, the CPU 10 executes Step P29. On the other hand, when the down button has not been turned OFF, the CPU 10 executes Step P28 again.

In Step P29, the CPU 10 stops the output of the reverse rotation instruction to the motor driver 22 for adjusting the nip pressure between the relief cylinder and the blanket cylinder of the printing unit M. Upon completion of the processing of Step P29, the CPU 10 executes Step P19.

In Step P30, the CPU 10 determines whether or not the switch for selecting the adjustment of the printing pressure between the blanket cylinder and the impression cylinder, which switch is provided to the input device 13, has been turned ON by the operator. When the switch for selecting the adjustment of the printing pressure between the blanket cylinder and the impression cylinder has been turned ON, the CPU 10 executes Step P31. On the other hand, when the switch for selecting the adjustment of the printing pressure between the blanket cylinder and the impression cylinder has not been turned ON, the CPU 10 skips Steps P31 to P41, and then executes Step P42.

In Step P31, the CPU 10 determines whether or not the pressure-adjustment completing switch, which is provided to the input device 13, has been turned ON by the operator. When the pressure-adjustment completing switch has been turned ON, the CPU 10 skips Steps P32 to P41, and then executes Step P42. On the other hand, when the pressure-adjustment completing switch has not been turned ON, the CPU 10 executes Step P32.

In Step P32, the CPU 10 determines whether or not the up button, which is provided to the input device 13, has been turned ON by the operator. When the up button has been turned ON, the CPU 10 executes Step P33. On the other hand, when the up button has not been turned ON, the CPU 10 skips Steps P33 to P36, and then executes Step P37.

In Step P33, the CPU 10 reads the selected printing unit number M from the memory M2. Upon completion of the processing of Step P33, the CPU 10 executes Step P34.

In Step P34, the CPU 10 outputs a normal rotation instruction to the motor driver 25 for adjusting the printing pressure between the blanket cylinder and the impression cylinder of the printing unit M. Upon completion of the processing of Step P34, the CPU 10 executes Step P35.

In Step P35, the CPU 10 determines whether or not the up button, which is provided to the input device 13, has been turned OFF by the operator. When the up button has been turned OFF, the CPU 10 executes Step P36. On the other hand, when the up button has not been turned OFF, the CPU 10 executes Step P35 again.

In Step P36, the CPU 10 stops the output of the normal rotation instruction to the motor driver 25 for adjusting the printing pressure between the blanket cylinder and the impression cylinder of the printing unit M. Upon completion of the processing of Step P36, the CPU 10 executes Step P37.

In Step P37, the CPU 10 determines whether or not the down button, which is provided to the input device 13, has been turned ON by the operator. When the down button has been turned ON, the CPU 10 executes Step P38. On the other hand, when the down button has not been turned ON, the CPU 10 executes Step P31.

In Step P38, the CPU 10 reads the selected printing unit number M from the memory M2. Upon completion of the processing of Step P38, the CPU 10 executes Step P39.

In Step P39, the CPU 10 outputs a reverse rotation instruction to the motor driver 25 for adjusting the printing pressure between the blanket cylinder and the impression cylinder of the printing unit M. Upon completion of the processing of Step P39, the CPU 10 executes Step P40.

In Step P40, the CPU 10 determines whether or not the down button, which is provided to the input device 13, has been turned OFF by the operator. When the down button has been turned OFF, the CPU 10 executes Step P41. On the other hand, when the down button has not been turned OFF, the CPU 10 executes Step P40 again.

In Step P41, the CPU 10 stops the output of the reverse rotation instruction to the motor driver 25 for adjusting the printing pressure between the blanket cylinder and the impression cylinder of the printing unit M. Upon completion of the processing of Step P41, the CPU 10 executes Step P31. With the foregoing steps, the adjustment of each contact-pressure adjusting means of each printing unit M before starting the final printing is performed by manual operation of the operator.

In Step P42, the CPU 10 determines whether or not the final-printing starting button, which is provided to the input device 13, has been turned ON by the operator. When the final-printing starting button has been turned ON, the CPU 10 executes Step P43. On the other hand, when the final-printing starting button has not been turned ON, the CPU 10 executes Step P2.

In Step P43, the CPU 10 writes 1 in the count value M, which is stored in the memory M3. Upon completion of the processing of Step P43, the CPU 10 executes Step P44.

In Step P44, the CPU 10 reads the output of the A/D converter connected to the potentiometer 20 for the motor for adjusting the nip pressure between the ink form roller and the relief cylinder of the printing unit M. The CPU 10 then stores the read value in the memory M4. Upon completion of the processing of Step P44, the CPU 10 executes Step P45.

In Step P45, the CPU 10 calculates a reference nip pressure between the ink form roller and the relief cylinder of the printing unit M, from the output of the A/D converter connected to the potentiometer 20 for the motor for adjusting the nip pressure between the ink form roller and the relief cylinder of the printing unit M. The CPU 10 then stores the result of the calculation in the memory M5. Upon completion of the processing of Step P45, the CPU 10 executes Step P46.

In Step P46, the CPU 10 reads the output of the A/D converter connected to the potentiometer 23 for the motor for adjusting the nip pressure between the relief cylinder and the blanket cylinder of the printing unit M. The CPU 10 then stores the read value in the memory M6. Upon completion of the processing of Step P46, the CPU 10 executes Step P47.

In Step P47, the CPU 10 calculates a reference nip pressure between the relief cylinder and the blanket cylinder of the printing unit M, from the output of the A/D converter connected to the potentiometer 23 for the motor for adjusting the nip pressure between the relief cylinder and the blanket cylinder of the printing unit M. The CPU 10 then stores the result of the calculation in the memory M7. Upon completion of the processing of Step P47, the CPU 10 executes Step P48.

In Step P48, the CPU 10 reads the output of the A/D converter connected to the potentiometer 26 for the motor for adjusting the printing pressure between the blanket cylinder and the impression cylinder of the printing unit M. The CPU 10 then stores the read value in the memory M8. Upon completion of the processing of Step P48, the CPU 10 executes Step P49.

In Step P49, the CPU 10 calculates a reference printing pressure between the blanket cylinder and the impression cylinder of the printing unit M, from the output of the A/D converter connected to the potentiometer 26 for the motor for adjusting the printing pressure between the blanket cylinder and the impression cylinder of the printing unit M. The CPU 10 then stores the result of the calculation in the memory M9. Upon completion of the processing of Step P49, the CPU 10 executes Step P50.

In Step P50, the CPU 10 adds 1 to the count value M, which is stored in the memory M3, and then overwrites the count value M. Upon completion of the processing of Step P50, the CPU 10 executes Step P51.

In Step P51, the CPU 10 reads the total number Mmax of printing units, which is stored in the memory M10. Upon completion of the processing of Step P51, the CPU 10 executes Step P52.

In Step P52, the CPU 10 determines whether or not the count value M, which is stored in the memory M3, is larger than the total number Mmax of printing units. When the count value M is larger than the total number Mmax of printing units, the CPU 10 executes Step P53. On the other hand, when the count value M is not larger than the total number Mmax of printing units, the CPU 10 executes Step P44. With the foregoing steps, the position of each contact-pressure adjusting means of each printing unit M at the time of starting the final printing is stored as a reference position.

In Step P53, the CPU 10 writes 1 in the count value M, which is stored in the memory M3. Upon completion of the processing of Step P53, the CPU 10 executes Step P54.

In Step P54, the CPU 10 reads the output of the A/D converter connected to the printing press temperature meter 17 of the printing unit M. The CPU 10 then stores the read value in the memory M11. Upon completion of the processing of Step P54, the CPU 10 executes Step P55.

In Step P55, the CPU 10 calculates the printing press temperature of the printing unit M, from the output of the A/D converter connected to the printing press temperature meter 17 of the printing unit M. The CPU 10 then stores the result of the calculation in the memory M12. Upon completion of the processing of Step P55, the CPU 10 executes Step P56.

In Step P56, the CPU 10 reads the ink color ICm of the printing unit M, which is stored in the memory M1. Upon completion of the processing of Step P56, the CPU 10 executes Step P57.

In Step P57, the CPU 10 reads the conversion table between the printing press temperature and the compensation amount for the nip pressure between the ink form roller and the relief cylinder for the ink color ICm, which is stored in the memory M13. Upon completion of the processing of Step P57, the CPU 10 executes Step P58.

In Step P58, the CPU 10 obtains a compensation amount for the nip pressure between the ink form roller and the relief cylinder, from the printing press temperature of the printing unit M, by using the conversion table between the printing press temperature and the compensation amount for the nip pressure between the ink form roller and the relief cylinder for the ink color ICm. The CPU 10 then stores the obtained compensation amount in the memory M14. Upon completion of the processing of Step P58, the CPU 10 executes Step P59.

In Step P59, the CPU 10 reads the conversion table between the printing press temperature and the compensation amount for the nip pressure between the relief cylinder and the blanket cylinder for the ink color ICm, which is stored in the memory M15. Upon completion of the processing of Step P59, the CPU 10 executes Step P60.

In Step P60, the CPU 10 obtains a compensation amount for the nip pressure between the relief cylinder and the blanket cylinder, from the printing press temperature of the printing unit M, by using the conversion table between the printing press temperature and the compensation amount for the nip pressure between the relief cylinder and the blanket cylinder for the ink color ICm. The CPU 10 then stores the obtained compensation amount in the memory M16. Upon completion of the processing of Step P60, the CPU 10 executes Step P61.

In Step P61, the CPU 10 reads the conversion table between the printing press temperature and the compensation amount for the printing pressure between the blanket cylinder and the impression cylinder for the ink color ICm, which is stored in the memory M17. Upon completion of the processing of Step P61, the CPU 10 executes Step P62.

In Step P62, the CPU 10 obtains a compensation amount for the printing pressure between the blanket cylinder and the impression cylinder, from the printing press temperature of the printing unit M, by using the conversion table between the printing press temperature and the compensation amount for the printing pressure between the blanket cylinder and the impression cylinder for the ink color ICm. The CPU 10 then stores the obtained compensation amount in the memory M18. Upon completion of the processing of Step P62, the CPU 10 executes Step P63.

In Step P63, the CPU 10 reads the reference nip pressure between the ink form roller and the relief cylinder of the printing unit M, which is stored in the memory M5. Upon completion of the processing of Step P63, the CPU 10 executes Step P64.

In Step P64, the CPU 10 reads the compensation amount for the nip pressure between the ink form roller and the relief cylinder of the printing unit M, which is stored in the memory M14. Upon completion of the processing of Step P64, the CPU 10 executes Step P65.

In Step P65, the CPU 10 calculates a target nip pressure between the ink form roller and the relief cylinder by adding the compensation amount for the nip pressure between the ink form roller and the relief cylinder of the printing unit M to the reference nip pressure between the ink form roller and the relief cylinder of the printing unit M. The CPU 10 then stores the result of the calculation in the memory M19. Upon completion of the processing of Step P65, the CPU 10 executes Step P66.

In Step P66, the CPU 10 calculates a target output of the A/D converter connected to the potentiometer 20 for the motor for adjusting the nip pressure between the ink form roller and the relief cylinder, from the target nip pressure between the ink form roller and the relief cylinder of the printing unit M. The CPU 10 then stores the result of the calculation in the memory M20. Upon completion of the processing of Step P66, the CPU 10 executes Step P67.

In Step P67, the CPU 10 reads the output of the A/D converter connected to the potentiometer 20 for the motor for adjusting the nip pressure between the ink form roller and the relief cylinder of the printing unit M. The CPU 10 then stores the read value in the memory M4. Upon completion of the processing of Step P67, the CPU 10 executes Step P68.

In Step P68, the CPU 10 determines whether or not the output of the A/D converter connected to the potentiometer 20 for the motor for adjusting the nip pressure between the ink form roller and the relief cylinder of the printing unit M, which is stored in the memory M4, is equal to the target output of the A/D converter connected to the potentiometer 20 for the motor for adjusting the nip pressure between the ink form roller and the relief cylinder of the printing unit M, which is stored in the memory M20.

When the output of the A/D converter connected to the potentiometer 20 for the motor for adjusting the nip pressure between the ink form roller and the relief cylinder of the printing unit M, which is stored in the memory M4, is equal to the target output of the A/D converter connected to the potentiometer 20 for the motor for adjusting the nip pressure between the ink form roller and the relief cylinder of the printing unit M, which is stored in the memory M20,the CPU 10 skips Steps P69 to P77, and then executes Step P78.

On the other hand, when the output of the A/D converter connected to the potentiometer 20 for the motor for adjusting the nip pressure between the ink form roller and the relief cylinder of the printing unit M, which is stored in the memory M4, is not equal to the target output of the A/D converter connected to the potentiometer 20 for the motor for adjusting the nip pressure between the ink form roller and the relief cylinder of the printing unit M, which is stored in the memory M20, the CPU 10 executes Step P69.

In Step P69, the CPU 10 determines whether or not the target output of the A/D converter connected to the potentiometer 20 for the motor for adjusting the nip pressure between the ink form roller and the relief cylinder of the printing unit M, which is stored in the memory M20, is larger than the output of the A/D converter connected to the potentiometer 20 for the motor for adjusting the nip pressure between the ink form roller and the relief cylinder of the printing unit M, which is stored in the memory M4.

When the target output of the A/D converter connected to the potentiometer 20 for the motor for adjusting the nip pressure between the ink form roller and the relief cylinder of the printing unit M, which is stored in the memory M20 is larger than the output of the A/D converter connected to the potentiometer 20 for the motor for adjusting the nip pressure between the ink form roller and the relief cylinder of the printing unit M, which is stored in the memory M4, the CPU 10 executes Step P70.

When the target output of the A/D converter connected to the potentiometer 20 for the motor for adjusting the nip pressure between the ink form roller and the relief cylinder of the printing unit M, which is stored in the memory M20 is not larger than the output of the A/D converter connected to the potentiometer 20 for the motor for adjusting the nip pressure between the ink form roller and the relief cylinder of the printing unit M, which is stored in the memory M4, the CPU 10 executes Step P74.

In Step P70, the CPU 10 outputs a normal rotation instruction to the motor driver 19 for adjusting the nip pressure between the ink form roller and the relief cylinder of the printing unit M. Upon completion of the processing of Step P70, the CPU 10 executes Step P71.

In Step P71, the CPU 10 reads the output of the A/D converter connected to the potentiometer 20 for the motor for adjusting the nip pressure between the ink form roller and the relief cylinder of the printing unit M. The CPU 10 then stores the read value in the memory M4. Upon completion of the processing of Step P71, the CPU 10 executes Step P72.

In Step P72, the CPU 10 determines whether or not the output of the A/D converter connected to the potentiometer 20 for the motor for adjusting the nip pressure between the ink form roller and the relief cylinder of the printing unit M, which is stored in the memory M4, is equal to the target output of the A/D converter connected to the potentiometer 20 for the motor for adjusting the nip pressure between the ink form roller and the relief cylinder of the printing unit M, which is stored in the memory M20.

When the output of the A/D converter connected to the potentiometer 20 for the motor for adjusting the nip pressure between the ink form roller and the relief cylinder of the printing unit M, which is stored in the memory M4, is equal to the target output of the A/D converter connected to the potentiometer 20 for the motor for adjusting the nip pressure between the ink form roller and the relief cylinder of the printing unit M, which is stored in the memory M20, the CPU 10 executes Step P73.

On the other hand, when the output of the A/D converter connected to the potentiometer 20 for the motor for adjusting the nip pressure between the ink form roller and the relief cylinder of the printing unit M, which is stored in the memory M4, is not equal to the target output of the A/D converter connected to the potentiometer 20 for the motor for adjusting the nip pressure between the ink form roller and the relief cylinder of the printing unit M, which is stored in the memory M20, the CPU 10 executes Step P71.

In Step P73, the CPU 10 stops the output of the normal rotation instruction to the motor driver 19 for adjusting the nip pressure between the ink form roller and the relief cylinder of the printing unit M. Upon completion of the processing of Step P73, the CPU 10 executes Step P78.

In Step P74, the CPU 10 outputs a reverse rotation instruction to the motor driver 19 for adjusting the nip pressure between the ink form roller and the relief cylinder of the printing unit M. Upon completion of the processing of Step P74, the CPU 10 executes Step P75.

In Step P75, the CPU 10 reads the output of the A/D converter connected to the potentiometer 20 for the motor for adjusting the nip pressure between the ink form roller and the relief cylinder of the printing unit M. The CPU 10 then stores the read value in the memory M4. Upon completion of the processing of Step P75, the CPU 10 executes Step P76.

In Step P76, the CPU 10 determines whether or not the output of the A/D converter connected to the potentiometer 20 for the motor for adjusting the nip pressure between the ink form roller and the relief cylinder of the printing unit M, which is stored in the memory M4, is equal to the target output of the A/D converter connected to the potentiometer 20 for the motor for adjusting the nip pressure between the ink form roller and the relief cylinder of the printing unit M, which is stored in the memory M20.

When the output of the A/D converter connected to the potentiometer 20 for the motor for adjusting the nip pressure between the ink form roller and the relief cylinder of the printing unit M, which is stored in the memory M4, is equal to the target output of the A/D converter connected to the potentiometer 20 for the motor for adjusting the nip pressure between the ink form roller and the relief cylinder of the printing unit M, which is stored in the memory M20, the CPU 10 executes Step P77.

On the other hand, when the output of the A/D converter connected to the potentiometer 20 for the motor for adjusting the nip pressure between the ink form roller and the relief cylinder of the printing unit M, which is stored in the memory M4, is not equal to the target output of the A/D converter connected to the potentiometer 20 for the motor for adjusting the nip pressure between the ink form roller and the relief cylinder of the printing unit M, which is stored in the memory M20, the CPU 10 executes Step P75.

In Step P77, the CPU 10 stops the output of the reverse rotation instruction to the motor driver 19 for adjusting the nip pressure between the ink form roller and the relief cylinder of the printing unit M. Upon completion of the processing of Step P77, the CPU 10 executes Step P78.

In Step P78, the CPU 10 reads the reference nip pressure between the relief cylinder and the blanket cylinder of the printing unit M, which is stored in the memory M7. Upon completion of the processing of Step P78, the CPU 10 executes Step P79.

In Step P79, the CPU 10 reads the compensation amount for the nip pressure between the relief cylinder and the blanket cylinder of the printing unit M, which is stored in the memory M16. Upon completion of the processing of Step P79, the CPU 10 executes Step P80.

In Step P80, the CPU 10 calculates a target nip pressure between the relief cylinder and the blanket cylinder by adding the compensation amount for the nip pressure between the relief cylinder and the blanket cylinder of the printing unit M to the reference nip pressure between the relief cylinder and the blanket cylinder of the printing unit M. The CPU 10 then stores the result of the calculation in the memory M21. Upon completion of the processing of Step P80, the CPU 10 executes Step P81.

In Step P81, the CPU 10 calculates a target output of the A/D converter connected to the potentiometer for the motor for adjusting the nip pressure between the relief cylinder and the blanket cylinder, from the target nip pressure between the relief cylinder and the blanket cylinder of the printing unit M. The CPU 10 then stores the result of the calculation in the memory M22 Upon completion of the processing of Step P81, the CPU 10 executes Step P82.

In Step P82, the CPU 10 reads the output of the A/D converter connected to the potentiometer 23 for the motor for adjusting the nip pressure between the relief cylinder and the blanket cylinder of the printing unit M. The CPU 10 then stores the read value in the memory M6. Upon completion of the processing of Step P82, the CPU 10 executes Step P83.

In Step P83, the CPU 10 determines whether or not the output of the A/D converter connected to the potentiometer 23 for the motor for adjusting the nip pressure between the relief cylinder and the blanket cylinder of the printing unit M, which is stored in the memory M6, is equal to the target output of the A/D converter connected to the potentiometer 23 for the motor for adjusting the nip pressure between the relief cylinder and the blanket cylinder of the printing unit M, which is stored in the memory M22.

When the output of the A/D converter connected to the potentiometer 23 for the motor for adjusting the nip pressure between the relief cylinder and the blanket cylinder of the printing unit M, which is stored in the memory M6, is equal to the target output of the A/D converter connected to the potentiometer 23 for the motor for adjusting the nip pressure between the relief cylinder and the blanket cylinder of the printing unit M, which is stored in the memory M22, the CPU 10 skips Steps P84 to P92, and then executes Step P93.

On the other hand, when the output of the A/D converter connected to the potentiometer 23 for the motor for adjusting the nip pressure between the relief cylinder and the blanket cylinder of the printing unit M, which is stored in the memory M6, is not equal to the target output of the A/D converter connected to the potentiometer for the motor for adjusting the nip pressure between the relief cylinder and the blanket cylinder of the printing unit M, which is stored in the memory M21, the CPU 10 executes Step P84.

In Step P84, the CPU 10 determines whether or not the target output of the A/D converter connected to the potentiometer for the motor for adjusting the nip pressure between the relief cylinder and the blanket cylinder, which is stored in the memory M22, is larger than the output of the A/D converter connected to the potentiometer 23 for the motor for adjusting the nip pressure between the relief cylinder and the blanket cylinder of the printing unit M, which is stored in the memory M6.

When the target output of the A/D converter connected to the potentiometer for the motor for adjusting the nip pressure between the relief cylinder and the blanket cylinder, which is stored in the memory M22, is larger than the output of the A/D converter connected to the potentiometer 23 for the motor for adjusting the nip pressure between the relief cylinder and the blanket cylinder of the printing unit M, which is stored in the memory M6, the CPU 10 executes Step P85.

On the other hand, when the target output of the A/D converter connected to the potentiometer for the motor for adjusting the nip pressure between the relief cylinder and the blanket cylinder, which is stored in the memory M22, is not larger than the output of the A/D converter connected to the potentiometer 23 for the motor for adjusting the nip pressure between the relief cylinder and the blanket cylinder of the printing unit M, which is stored in the memory M6, the CPU 10 executes Step P89.

In Step P85, the CPU 10 outputs a normal rotation instruction to the motor driver 22 for adjusting the nip pressure between the relief cylinder and the blanket cylinder of the printing unit M. Upon completion of the processing of Step P85, the CPU 10 executes Step P86.

In Step P86, the CPU 10 reads the output of the A/D converter connected to the potentiometer 23 for the motor for adjusting the nip pressure between the relief cylinder and the blanket cylinder of the printing unit M. The CPU 10 then stores the read value in the memory M6. Upon completion of the processing of Step P86, the CPU 10 executes Step P87.

In Step P87, the CPU 10 determines whether or not the output of the A/D converter connected to the potentiometer 23 for the motor for adjusting the nip pressure between the relief cylinder and the blanket cylinder of the printing unit M, which is stored in the memory M6, is equal to the target output of the A/D converter connected to the potentiometer 23 for the motor for adjusting the nip pressure between the relief cylinder and the blanket cylinder of the printing unit M, which is stored in the memory M22.

When the output of the A/D converter connected to the potentiometer 23 for the motor for adjusting the nip pressure between the relief cylinder and the blanket cylinder of the printing unit M, which is stored in the memory M6, is equal to the target output of the A/D converter connected to the potentiometer 23 for the motor for adjusting the nip pressure between the relief cylinder and the blanket cylinder of the printing unit M, which is stored in the memory M22, the CPU 10 executes Step P88.

On the other hand, when the output of the A/D converter connected to the potentiometer 23 for the motor for adjusting the nip pressure between the relief cylinder and the blanket cylinder of the printing unit M, which is stored in the memory M6, is not equal to the target output of the A/D converter connected to the potentiometer 23 for the motor for adjusting the nip pressure between the relief cylinder and the blanket cylinder of the printing unit M, which is stored in the memory M22, the CPU 10 executes Step P86.

In Step P88, the CPU 10 stops the output of the normal rotation instruction to the motor driver 22 for adjusting the nip pressure between the relief cylinder and the blanket cylinder of the printing unit M. Upon completion of the processing of Step P88, the CPU 10 executes Step P93.

In Step P89, the CPU 10 outputs a reverse rotation instruction to the motor driver 22 for adjusting the nip pressure between the relief cylinder and the blanket cylinder of the printing unit M. Upon completion of the processing of Step P89, the CPU 10 executes Step P90.

In Step P90, the CPU 10 reads the output of the A/D converter connected to the potentiometer 23 for the motor for adjusting the nip pressure between the relief cylinder and the blanket cylinder of the printing unit M. The CPU 10 then stores the read value in the memory M6. Upon completion of the processing of Step P90, the CPU 10 executes Step P91.

In Step P91, the CPU 10 determines whether or not the output of the A/D converter connected to the potentiometer 23 for the motor for adjusting the nip pressure between the relief cylinder and the blanket cylinder of the printing unit M, which is stored in the memory M6, is equal to the target output of the A/D converter connected to the potentiometer 23 for the motor for adjusting the nip pressure between the relief cylinder and the blanket cylinder of the printing unit M, which is stored in the memory M22.

When the output of the A/D converter connected to the potentiometer 23 for the motor for adjusting the nip pressure between the relief cylinder and the blanket cylinder of the printing unit M, which is stored in the memory M6, is equal to the target output of the A/D converter connected to the potentiometer 23 for the motor for adjusting the nip pressure between the relief cylinder and the blanket cylinder of the printing unit M, which is stored in the memory M22, the CPU 10 executes Step P92.

On the other hand, when the output of the A/D converter connected to the potentiometer 23 for the motor for adjusting the nip pressure between the relief cylinder and the blanket cylinder of the printing unit M, which is stored in the memory M6, is not equal to the target output of the A/D converter connected to the potentiometer 23 for the motor for adjusting the nip pressure between the relief cylinder and the blanket cylinder of the printing unit M, which is stored in the memory M22, the CPU 10 executes Step P90.

In Step P92, the CPU 10 stops the output of the reverse rotation instruction to the motor driver 22 for adjusting the nip pressure between the relief cylinder and the blanket cylinder of the printing unit M. Upon completion of the processing of Step P92, the CPU 10 executes Step P93.

In Step P93, the CPU 10 reads the reference printing pressure between the blanket cylinder and the impression cylinder of the printing unit M, which is stored in the memory M7. Upon completion of the processing of Step P93, the CPU 10 executes Step P94.

In Step P94, the CPU 10 reads the compensation amount for the printing pressure between the blanket cylinder and the impression cylinder of the printing unit M, which is stored in the memory M18. Upon completion of the processing of Step P94, the CPU 10 executes Step P95.

In Step P95, the CPU 10 calculates a target printing pressure between the blanket cylinder and the impression cylinder by adding the compensation amount for the printing pressure between the blanket cylinder and the impression cylinder of the printing unit M to the reference printing pressure between the blanket cylinder and the impression cylinder of the printing unit M. The CPU 10 then stores the result of the calculation in the memory M23. Upon completion of the processing of Step P95, the CPU 10 executes Step P96.

In Step P96, the CPU 10 calculates a target output of the A/D converter connected to the potentiometer 26 for the motor for adjusting the printing pressure between the blanket cylinder and the impression cylinder, from the target printing pressure between the blanket cylinder and the impression cylinder of the printing unit M. The CPU 10 then stores the result of the calculation in the memory M24. Upon completion of the processing of Step P96, the CPU 10 executes Step P97.

In Step P97, the CPU 10 reads the output of the A/D converter connected to the potentiometer 26 for the motor for adjusting the printing pressure between the blanket cylinder and the impression cylinder of the printing unit M. The CPU 10 then stores the read value in the memory M8. Upon completion of the processing of Step P97, the CPU 10 executes Step P98.

In Step P98, the CPU 10 determines whether or not the output of the A/D converter connected to the potentiometer 26 for the motor for adjusting the printing pressure between the blanket cylinder and the impression cylinder of the printing unit M, which is stored in the memory MS, is equal to the target output of the A/D converter connected to the potentiometer 26 for the motor for adjusting the printing pressure between the blanket cylinder and the impression cylinder of the printing unit M, which is stored in the memory M24.

When the output of the A/D converter connected to the potentiometer 26 for the motor for adjusting the printing pressure between the blanket cylinder and the impression cylinder of the printing unit M, which is stored in the memory M8, is equal to the target output of the A/D converter connected to the potentiometer 26 for the motor for adjusting the printing pressure between the blanket cylinder and the impression cylinder of the printing unit M, which is stored in the memory M24, the CPU 10 skips Steps P99 to P107, and then executes Step P108.

On the other hand, when the output of the A/D converter connected to the potentiometer 26 for the motor for adjusting the printing pressure between the blanket cylinder and the impression cylinder of the printing unit M, which is stored in the memory M8, is not equal to the target output of the A/D converter connected to the potentiometer 26 for the motor for adjusting the printing pressure between the blanket cylinder and the impression cylinder of the printing unit M, which is stored in the memory M24, the CPU 10 executes Step P99.

In Step P99, the CPU 10 determines whether or not the target output of the A/D converter connected to the potentiometer 26 for the motor for adjusting the printing pressure between the blanket cylinder and the impression cylinder of the printing unit M, which is stored in the memory M24, is larger than the output of the A/D converter connected to the potentiometer 26 for the motor for adjusting the printing pressure between the blanket cylinder and the impression cylinder of the printing unit M, which is stored in the memory M8.

When the target output of the A/D converter connected to the potentiometer 26 for the motor for adjusting the printing pressure between the blanket cylinder and the impression cylinder of the printing unit M, which is stored in the memory M24, is larger than the output of the A/D converter connected to the potentiometer 26 for the motor for adjusting the printing pressure between the blanket cylinder and the impression cylinder of the printing unit M, which is stored in the memory M8, the CPU 10 executes Step P100.

On the other hand, when the target output of the A/D converter connected to the potentiometer 26 for the motor for adjusting the printing pressure between the blanket cylinder and the impression cylinder of the printing unit M, which is stored in the memory M24, is not larger than the output of the A/D converter connected to the potentiometer 26 for the motor for adjusting the printing pressure between the blanket cylinder and the impression cylinder of the printing unit M, which is stored in the memory Mg, the CPU 10 executes Step P104.

In Step P100, the CPU 10 outputs a normal rotation instruction to the motor driver 25 for adjusting the printing pressure between the blanket cylinder and the impression cylinder of the printing unit M. Upon completion of the processing of Step P100, the CPU 10 executes Step P101.

In Step P101, the CPU 10 reads the output of the A/D converter connected to the potentiometer 26 for the motor for adjusting the printing pressure between the blanket cylinder and the impression cylinder of the printing unit M. The CPU 10 then stores the read value in the memory M8. Upon completion of the processing of Step P101, the CPU 10 executes Step P102.

In Step P102, the CPU 10 determines whether or not the output of the A/D converter connected to the potentiometer for the motor for adjusting the printing pressure between the blanket cylinder and the impression cylinder of the printing unit M, which is stored in the memory M8, is equal to the target output of the A/D converter connected to the potentiometer 26 for the motor for adjusting the printing pressure between the blanket cylinder and the impression cylinder of the printing unit M, which is stored in the memory M24.

When the output of the A/D converter connected to the potentiometer for the motor for adjusting the printing pressure between the blanket cylinder and the impression cylinder of the printing unit M, which is stored in the memory M8, is equal to the target output of the A/D converter connected to the potentiometer 26 for the motor for adjusting the printing pressure between the blanket cylinder and the impression cylinder of the printing unit M, which is stored in the memory M24, the CPU 10 executes Step P103.

On the other hand, when the output of the A/D converter connected to the potentiometer 26 for the motor for adjusting the printing pressure between the blanket cylinder and the impression cylinder of the printing unit M, which is stored in the memory M8, is not equal to the target output of the A/D converter connected to the potentiometer 26 for the motor for adjusting the printing pressure between the blanket cylinder and the impression cylinder of the printing unit M, which is stored in the memory M24, the CPU 10 executes Step P101.

In Step P103, the CPU 10 stops the output of the normal rotation instruction to the motor driver 25 for adjusting the printing pressure between the blanket cylinder and the impression cylinder of the printing unit M. Upon completion of the processing of Step P103, the CPU 10 executes Step P108.

In Step P104, the CPU 10 outputs a reverse rotation instruction to the motor driver 25 for adjusting the printing pressure between the blanket cylinder and the impression cylinder of the printing unit M. Upon completion of the processing of Step P104, the CPU 10 executes Step P105.

In Step P105, the CPU 10 reads the output of the A/D converter connected to the potentiometer 26 for the motor for adjusting the printing pressure between the blanket cylinder and the impression cylinder of the printing unit M. The CPU 10 then stores the read value in the memory M8. Upon completion of the processing of Step P105, the CPU 10 executes Step P106.

In Step P106, the CPU 10 determines whether or not the output of the A/D converter connected to the potentiometer 26 for the motor for adjusting the printing pressure between the blanket cylinder and the impression cylinder of the printing unit M, which is stored in the memory M8, is equal to the target output of the A/D converter connected to the potentiometer 26 for the motor for adjusting the printing pressure between the blanket cylinder and the impression cylinder of the printing unit M, which is stored in the memory M24.

When the output of the A/D converter connected to the potentiometer 26 for the motor for adjusting the printing pressure between the blanket cylinder and the impression cylinder of the printing unit M, which is stored in the memory M8, is equal to the target output of the A/D converter connected to the potentiometer 26 for the motor for adjusting the printing pressure between the blanket cylinder and the impression cylinder of the printing unit M, which is stored in the memory M24, the CPU 10 executes Step P107.

On the other hand, when the output of the A/D converter connected to the potentiometer 26 for the motor for adjusting the printing pressure between the blanket cylinder and the impression cylinder of the printing unit M, which is stored in the memory M8, is not equal to the target output of the A/D converter connected to the potentiometer 26 for the motor for adjusting the printing pressure between the blanket cylinder and the impression cylinder of the printing unit M, which is stored in the memory M24, the CPU 10 executes Step P105.

In Step P107, the CPU 10 stops the output of the reverse rotation instruction to the motor driver 25 for adjusting the printing pressure between the blanket cylinder and the impression cylinder of the printing unit M. Upon completion of the processing of Step P107, the CPU 10 executes Step P108.

In Step P108, the CPU 10 adds 1 to the count value M, which is stored in the memory M3, and then overwrites the count value M. Upon completion of the processing of Step P108, the CPU 10 executes Step P109.

In Step P109, the CPU 10 reads the total number Mmax of printing units, which is stored in the memory M10. Upon completion of the processing of Step P109, the CPU 10 executes Step P110.

In Step P110, the CPU 10 determines whether or not the count value M, which is stored in the memory M3, is larger than the total number Mmax of printing units. When the count value M, which is stored in the memory M3, is larger than the total number Mmax of printing units, the CPU 10 executes Step P111. On the other hand, when the count value M, which is stored in the memory M3, is not larger than the total number Mmax of printing unit, the CPU 10 executes Step P54. With the foregoing Steps, each contact-pressure adjusting means of each printing unit M is adjusted in accordance with the corresponding printing press temperature, which is measured by the printing press temperature meter 17 of the printing unit M.

In Step P111, the CPU 10 determines whether or not the final-printing completing button, which is provided to the input device 13, has been turned ON by the operator. When the final-printing completing button has been turned ON, the CPU 10 executes Step P1. On the other hand, when the final-printing completing button has not been turned ON, the CPU 10 executes Step P53.

Second Embodiment

A description will be given of a contact-pressure adjusting method and a contact-pressure adjusting system, for a liquid application machine, according to a second embodiment of the present invention. Note that, since the configuration of a printing press, to which the contact-pressure adjusting system for a liquid application machine according to the present embodiment is employed, is the same as that of the first embodiment, a description thereof will be omitted here.

Figure 7A:
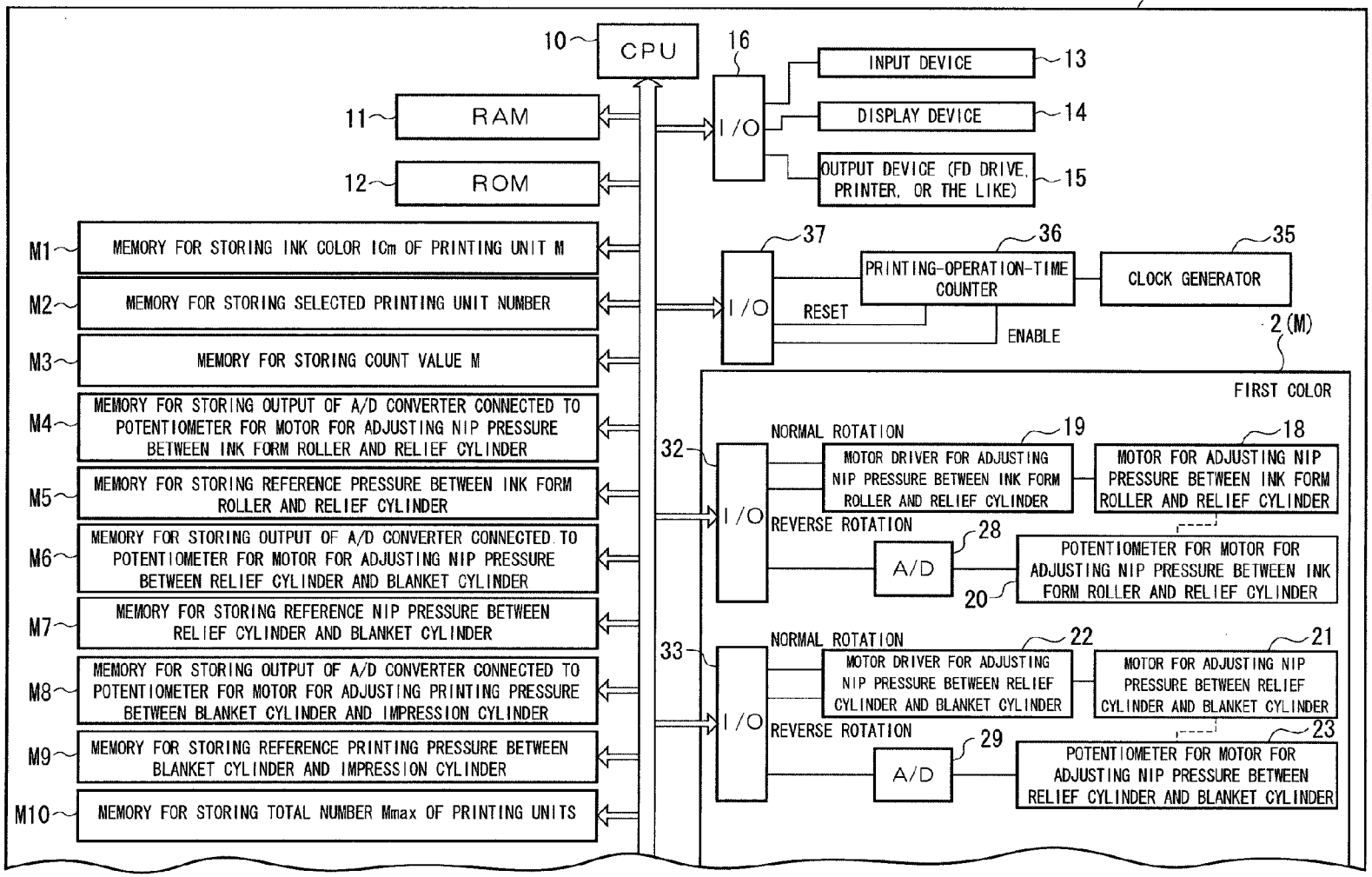
FIG. 7A shows a hardware block diagram of a contact-pressure adjusting system for a liquid application machine according to a second embodiment of the present invention.
Figure 8A:
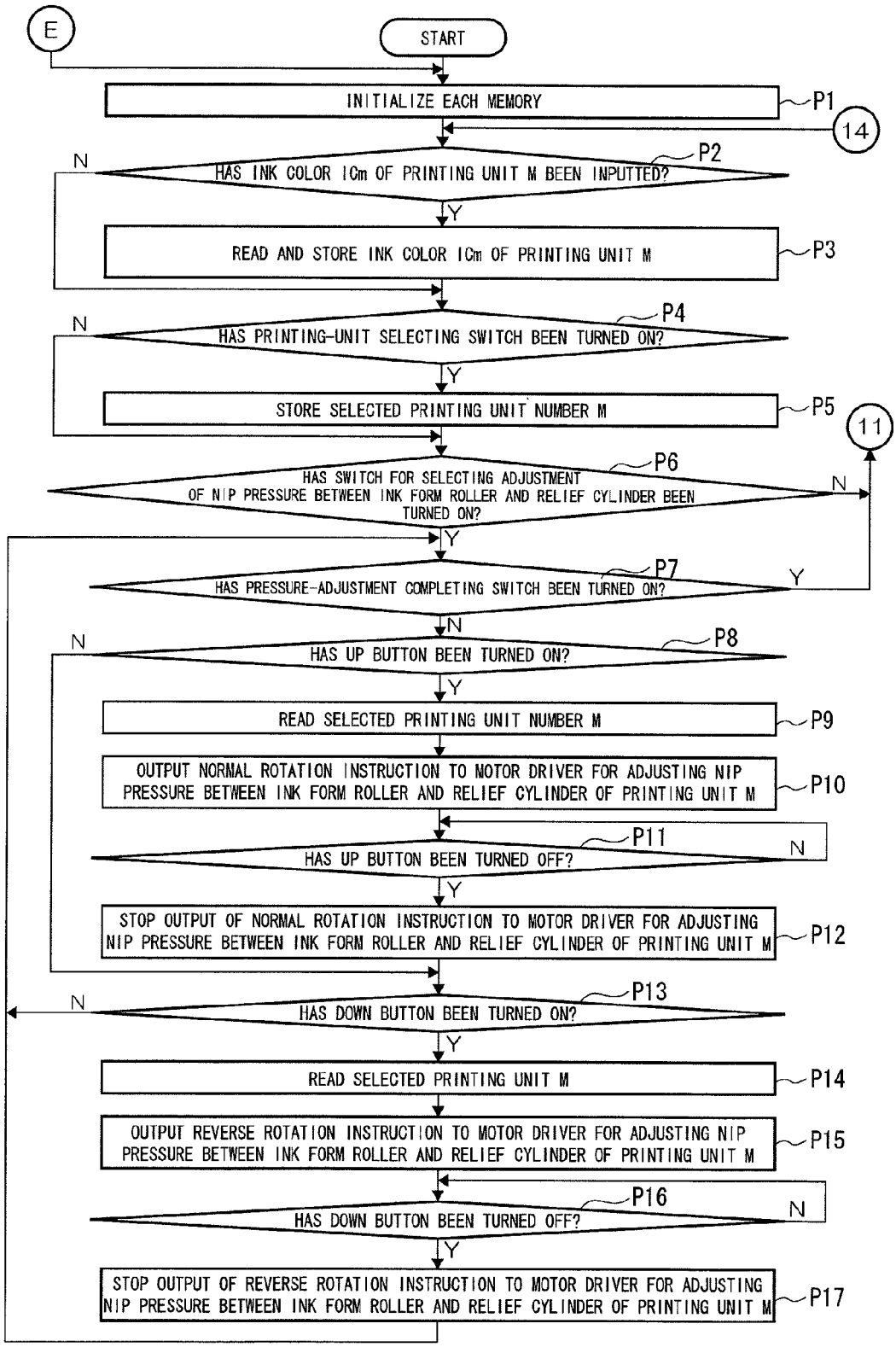
FIG. 8A shows an operational flowchart of the contact-pressure adjusting system for a liquid application machine according to the second embodiment.
Figure 8B:
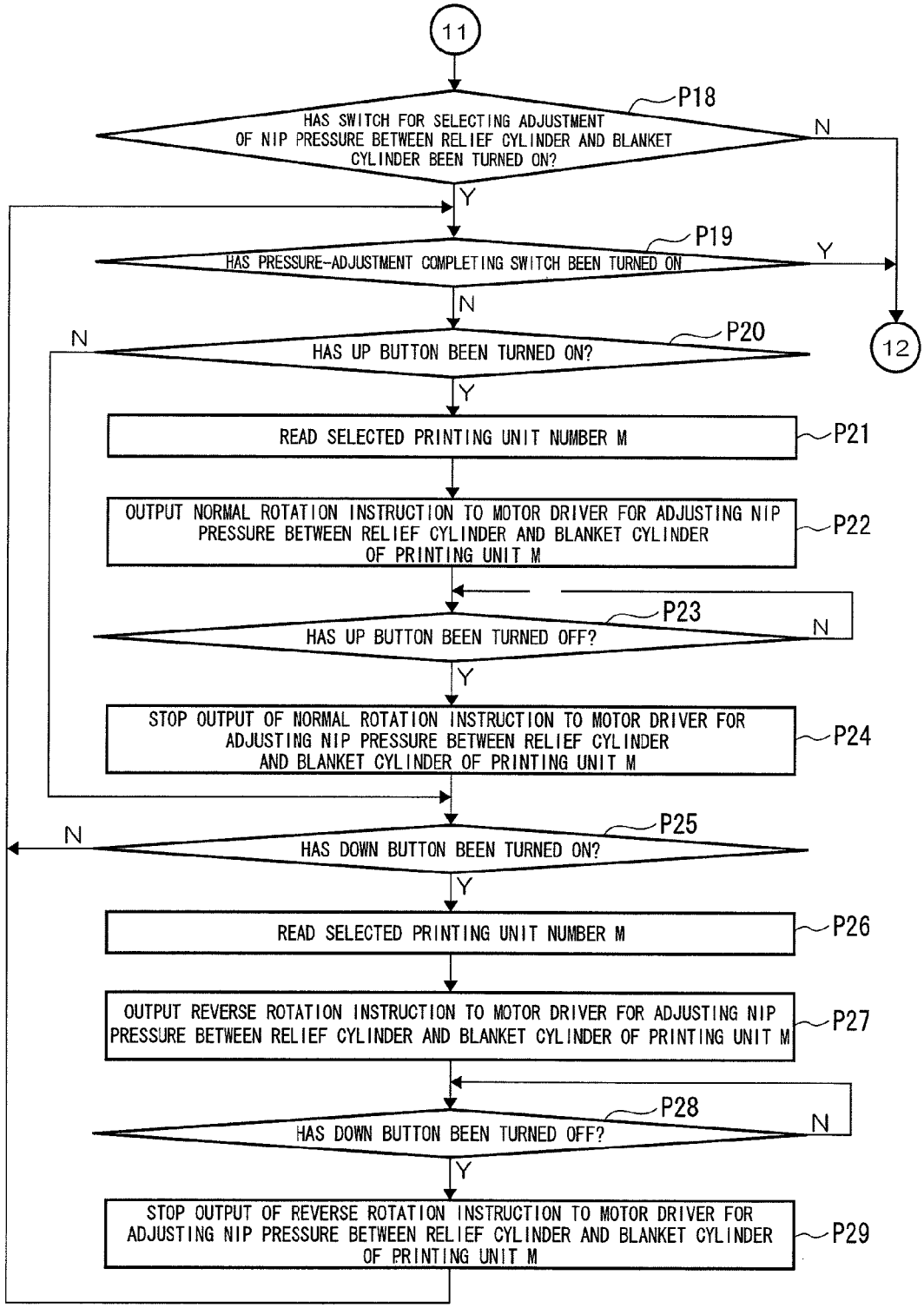
FIG. 8B shows an operational flowchart subsequent to that of FIG. 8A.
Figure 8C:
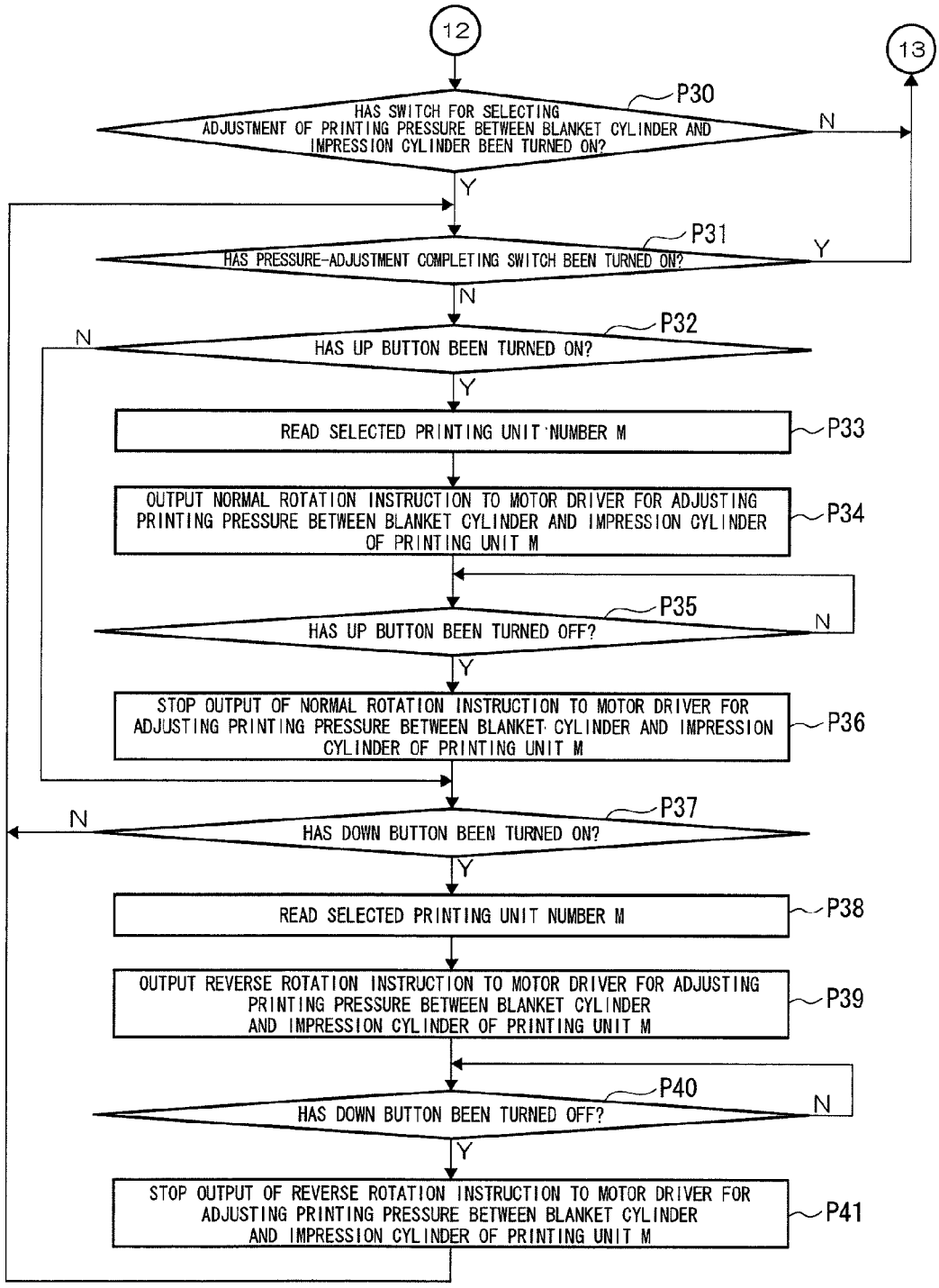
FIG. 8C shows an operational flowchart subsequent to that of FIG. 8B.
Figure 8D:
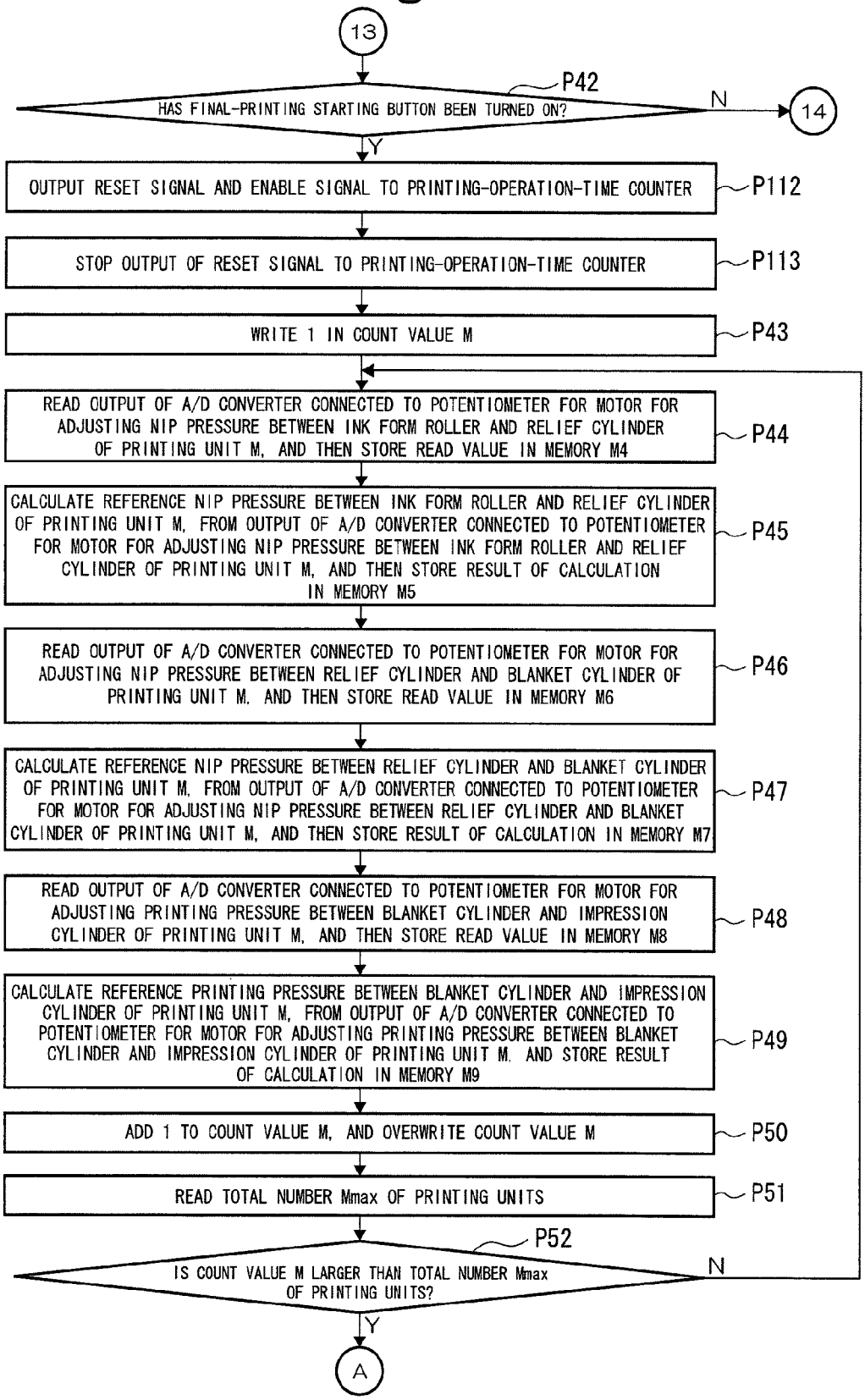
FIG. 8D shows an operational flowchart subsequent to that of FIG. 8C.
Figure 9A:
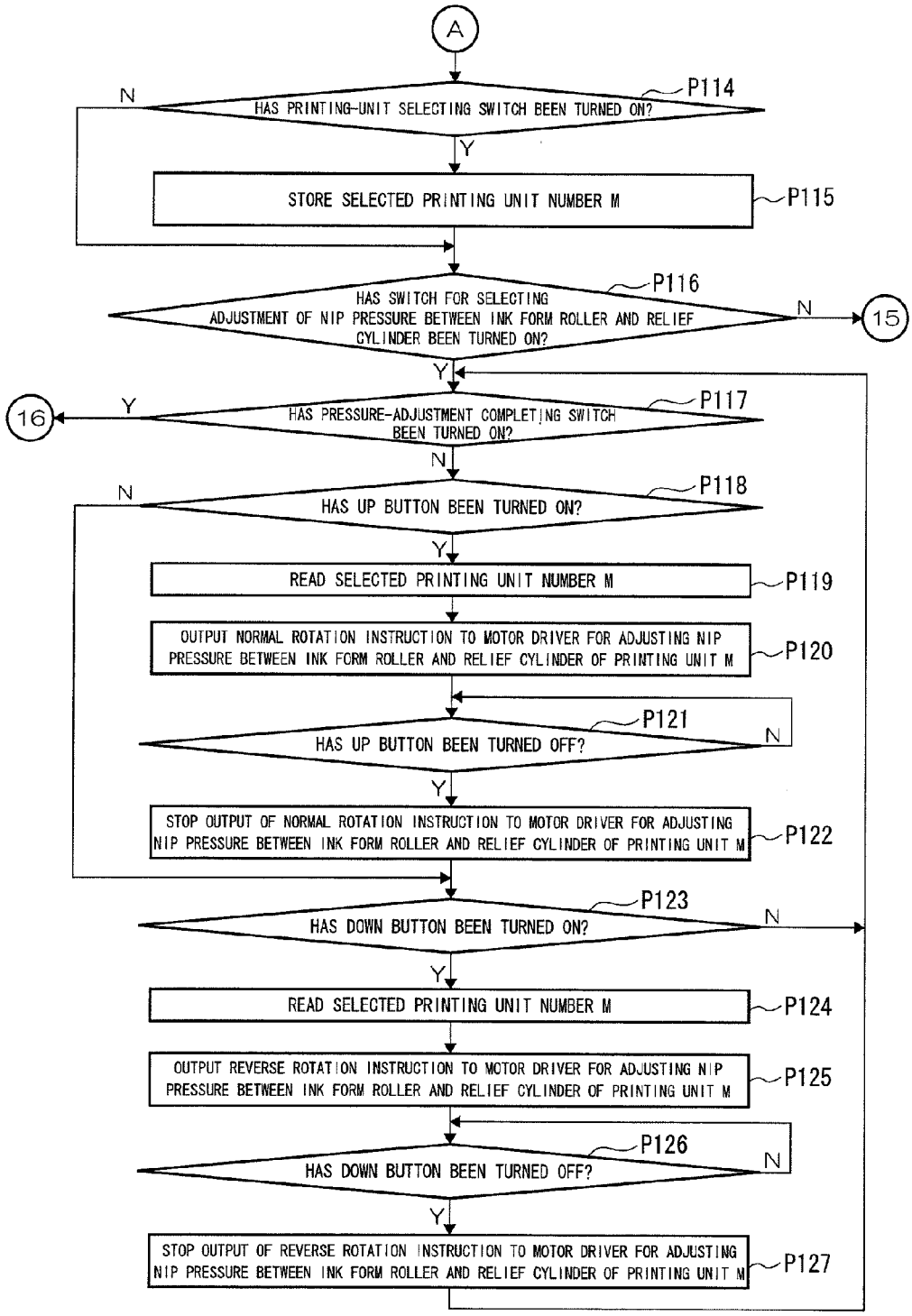
FIG. 9A shows an operational flowchart subsequent to that of FIG. 8D.
Figure 9B:
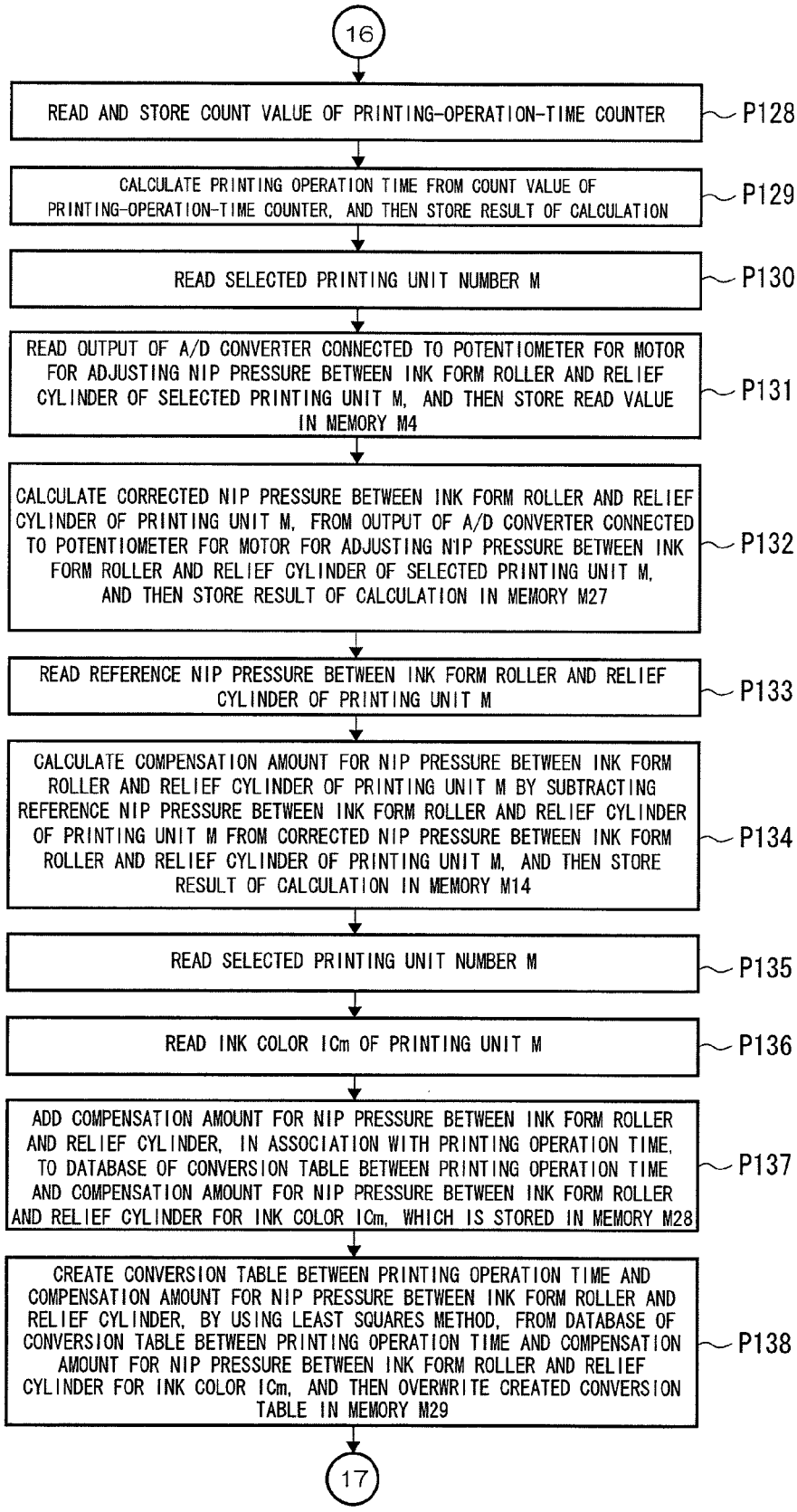
FIG. 9B shows an operational flowchart subsequent to that of FIG. 9A.
Figure 9C:
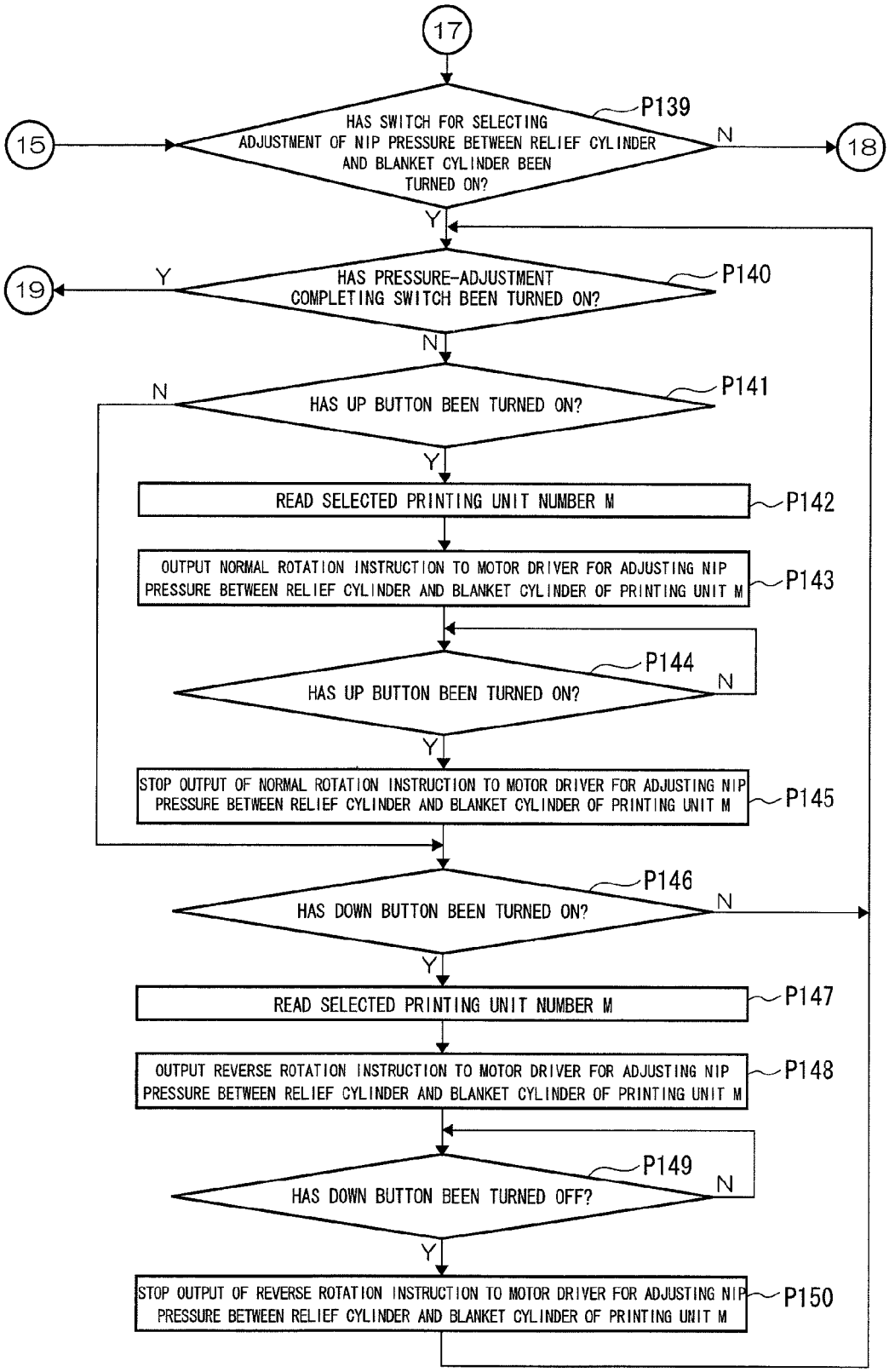
FIG. 9C shows an operational flowchart subsequent to that of FIG. 9B.
Figure 9D:
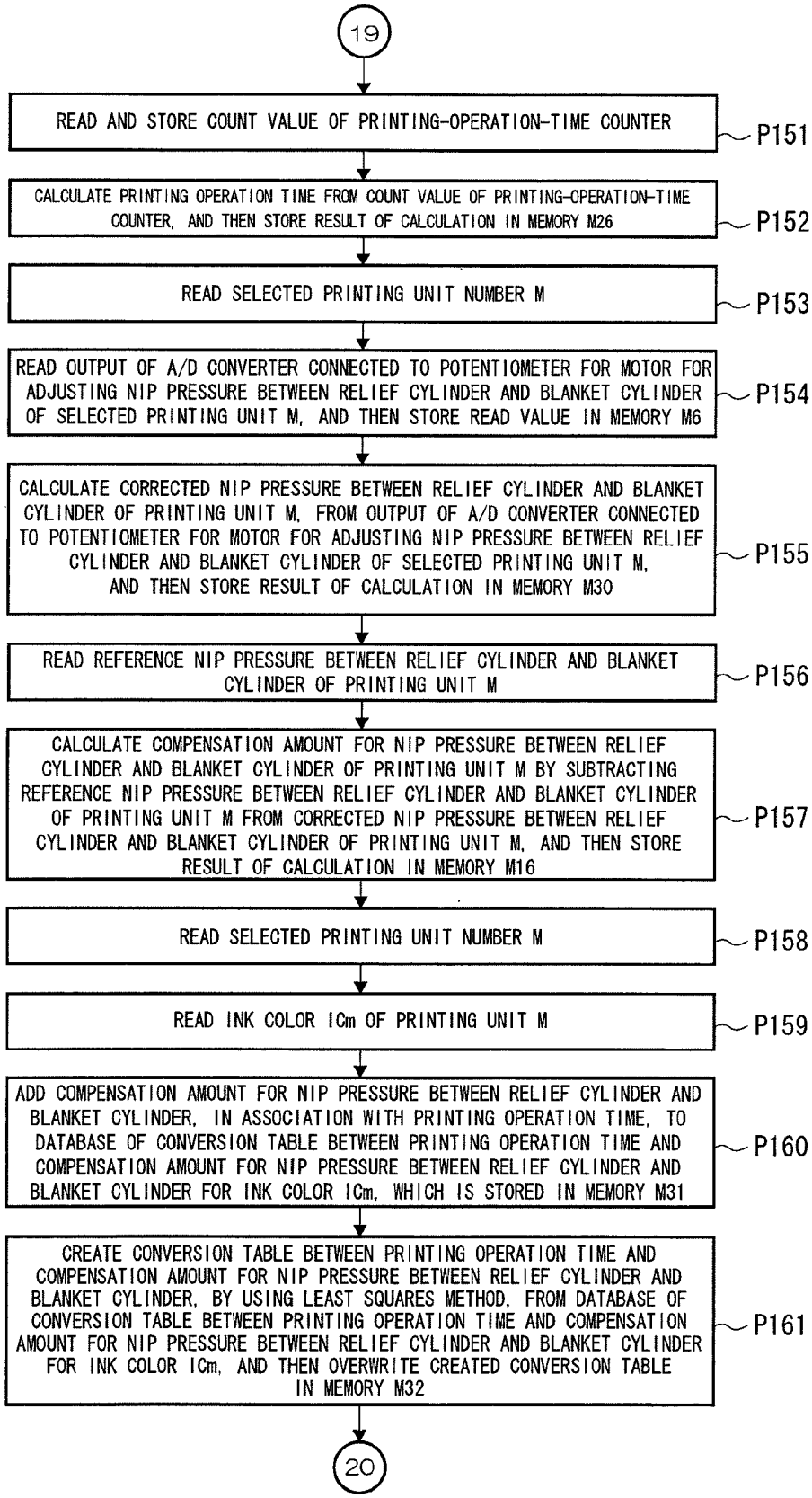
FIG. 9D shows an operational flowchart subsequent to that of FIG. 9C.
Figure 9E:
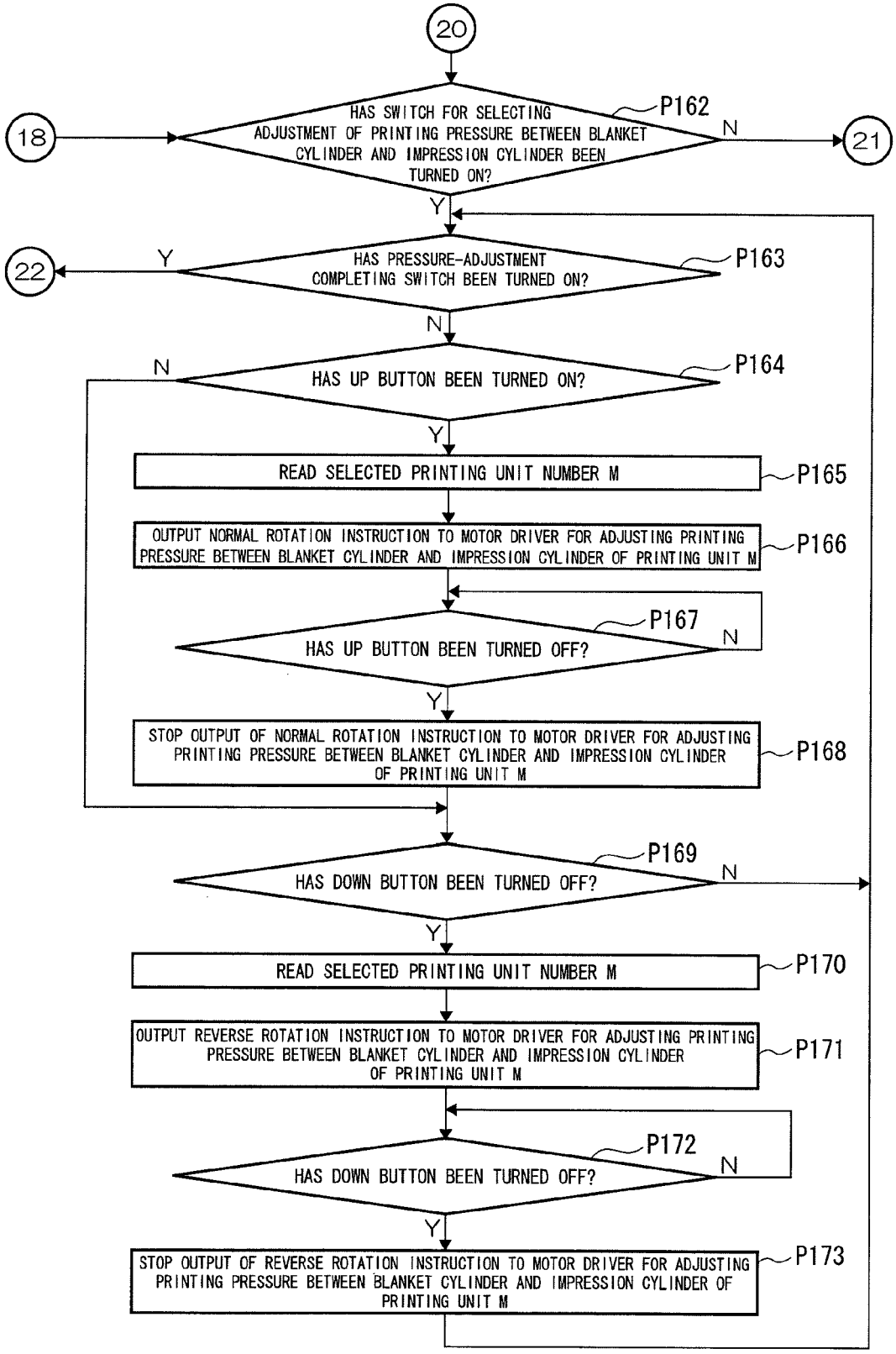
FIG. 9E shows an operational flowchart subsequent to that of FIG. 9D.
Figure 9F:
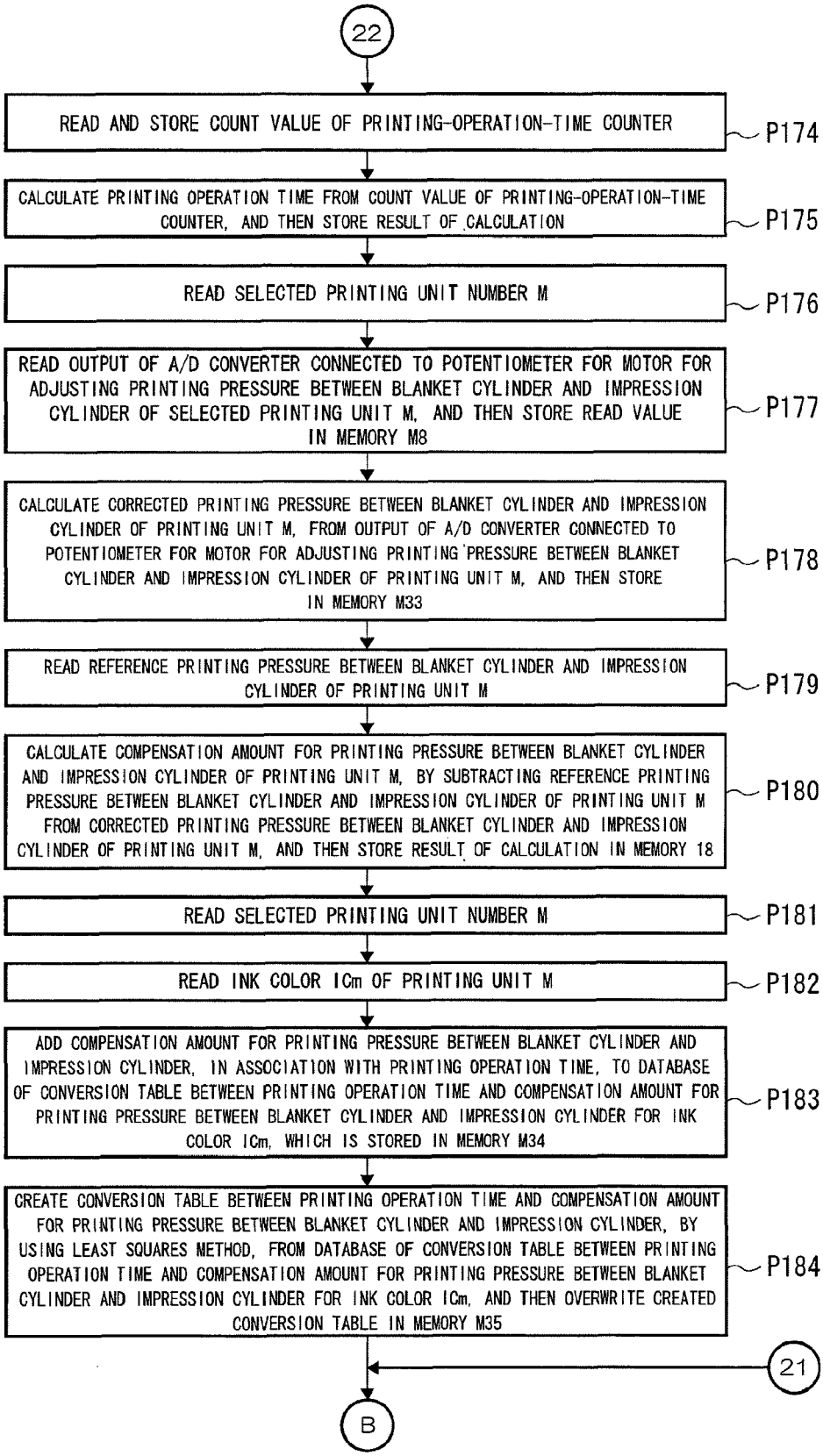
FIG. 9F shows an operational flowchart subsequent to that of FIG. 9E.
Figure 10A:
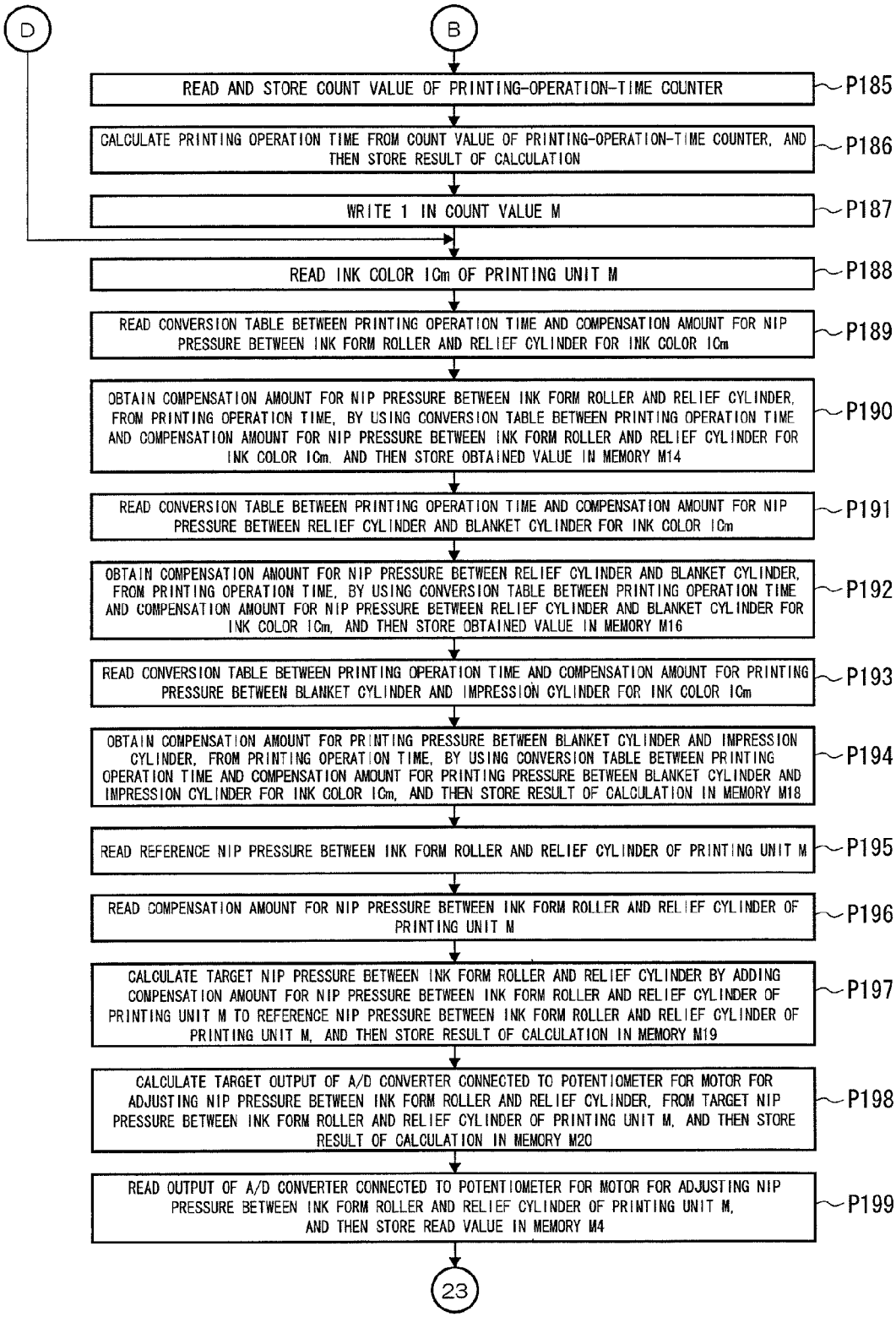
FIG. 10A shows an operational flowchart subsequent to that of FIG. 9F.
Figure 10B:
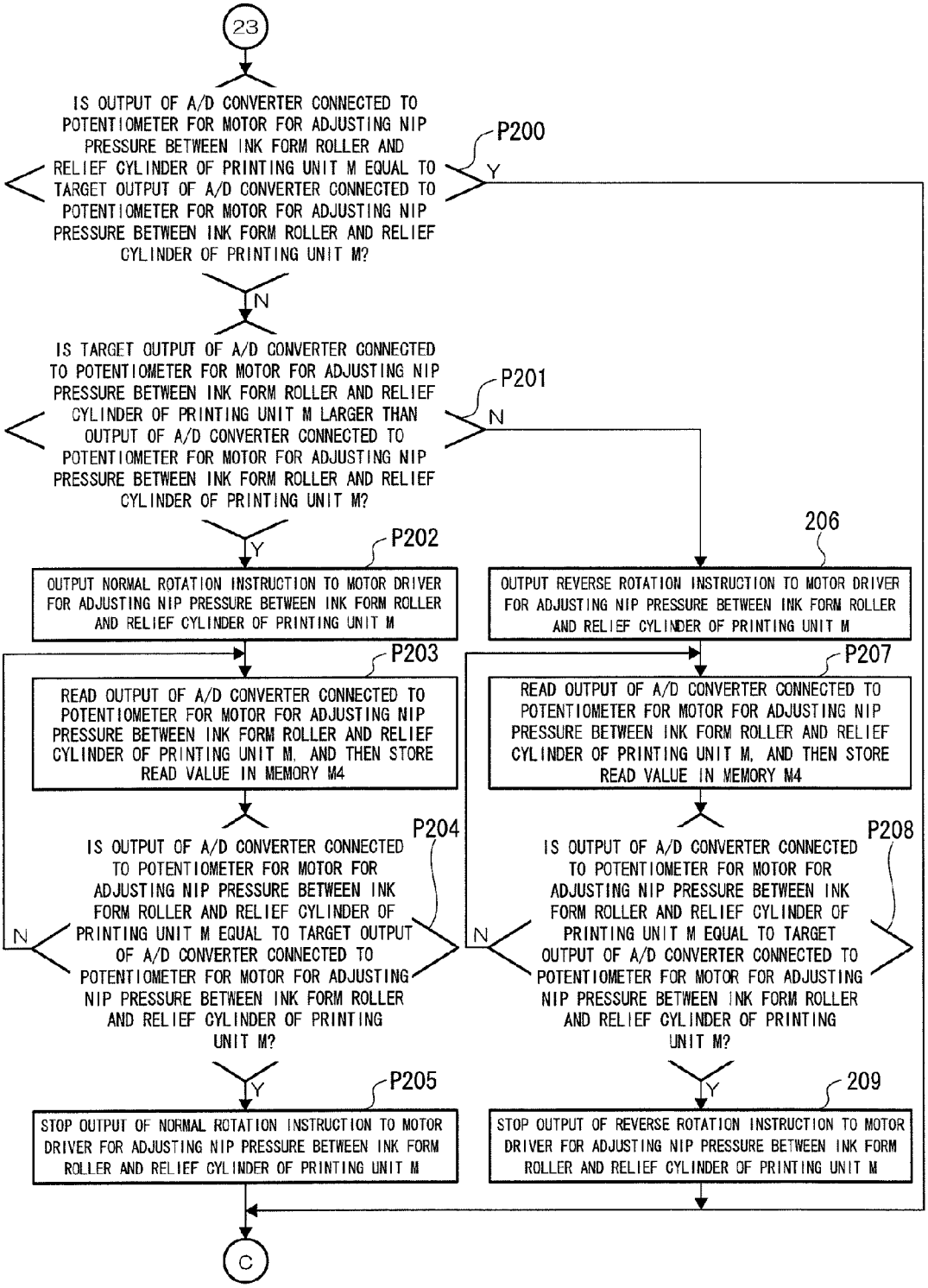
FIG. 10B shows an operational flowchart subsequent to that of FIG. 10A.
Figure 11A:
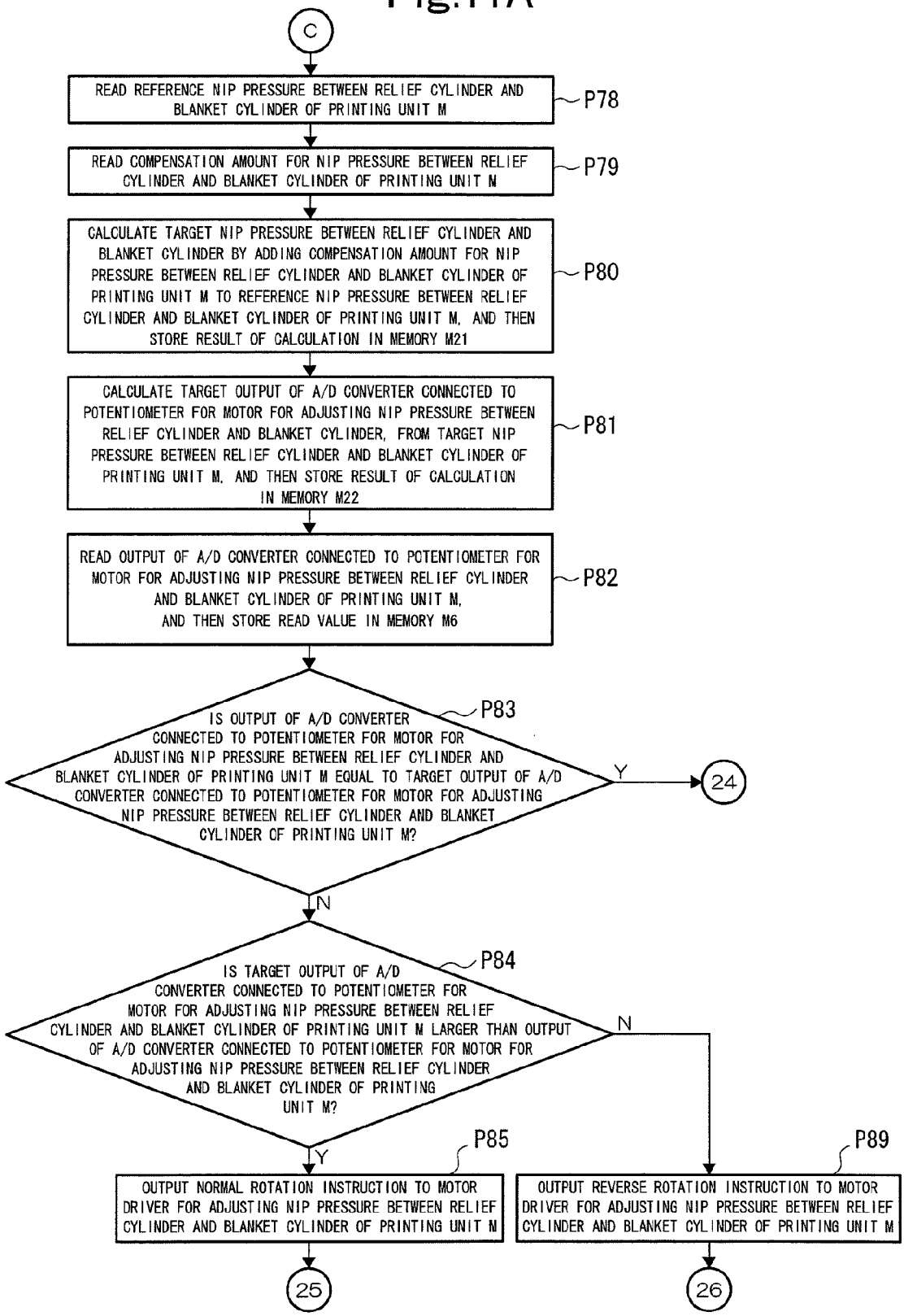
FIG. 11A shows an operational flowchart subsequent to that of FIG. 10B.
Figure 11B:
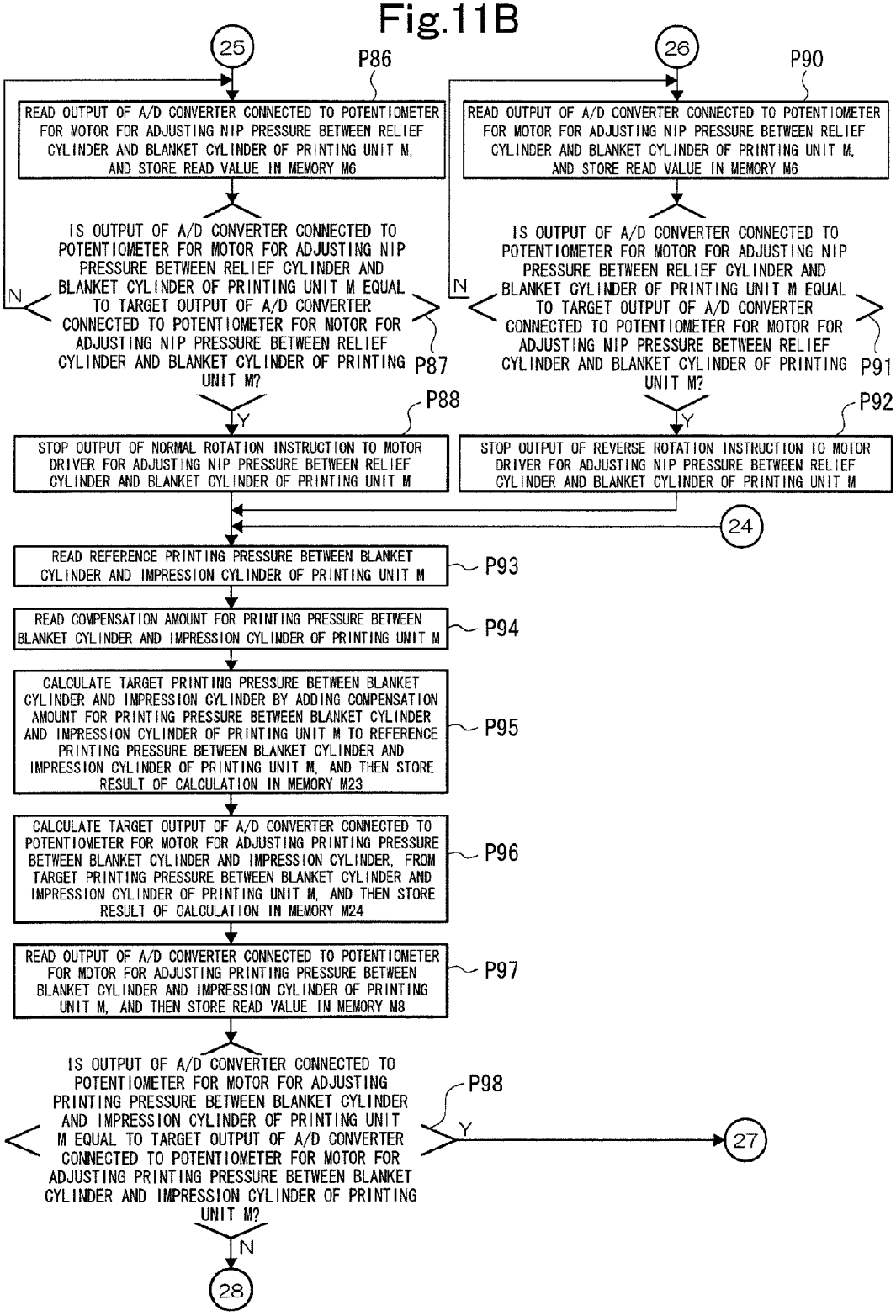
FIG. 11B shows an operational flowchart subsequent to that of FIG. 11A.
Figure 11C:
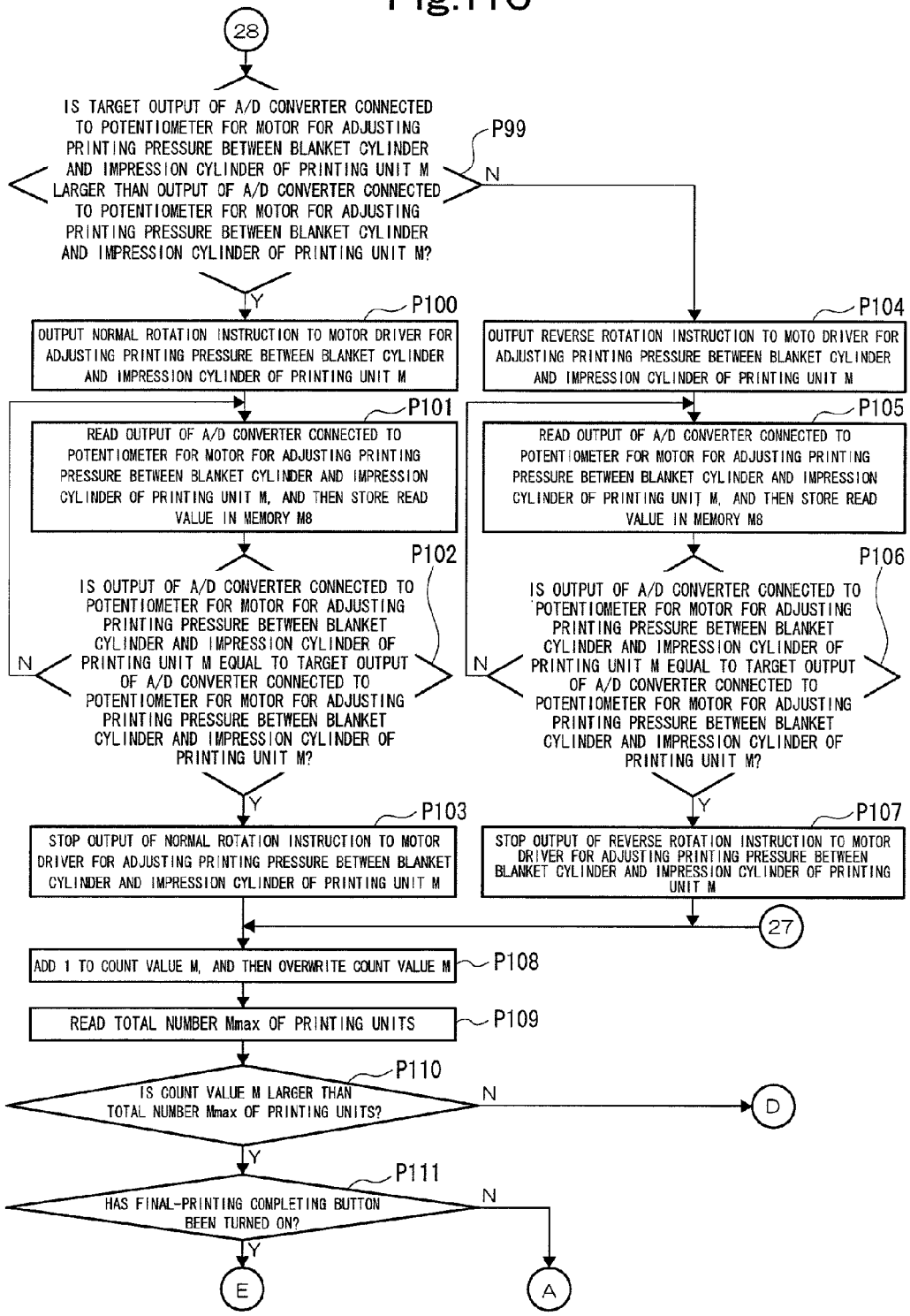
FIG. 11C shows an operational flowchart subsequent to that of FIG. 11B.

Next, a description will be given of the contact-pressure adjusting system for a liquid application machine according to the second embodiment of the present invention. FIGS. 7A and 7B show hardware block diagrams of the contact-pressure adjusting system for a liquid application machine according to the second embodiment of the present invention. As shown in FIGS. 7A and 7B, the contact-pressure adjusting system 1 for a liquid application machine includes a CPU 10, a RAM 11, a ROM 12, an input device 13, a display device 14, an output device (an FD drive, a printer or the like) 15, I/O (input/output) interfaces 16 and 37, a clock generator 35, a counter 36 for measuring the printing operation time (hereinafter, referred to as a printing-operation-time counter 36). The printing-operation-time counter 36 counts clock signals generated by the clock generator 35 at predetermined intervals (of one second, for example) after the printing press starts printing, so that the operating time of the printing press is measured.

In addition, the printing unit M includes a motor 18 for adjusting the nip pressure between the ink form roller 100 and the relief cylinder 101, a motor driver 19 for adjusting the nip pressure between the ink form roller 100 and the relief cylinder 101, a potentiometer 20 for the motor for adjusting the nip pressure between the ink form roller 100 and the relief cylinder 101, a motor 21 for adjusting the nip pressure between the relief cylinder 101 and the blanket cylinder 102, a motor driver 22 for adjusting the nip pressure between the relief cylinder 101 and the blanket cylinder 102, a potentiometer 23 for the motor for adjusting the nip pressure between the relief cylinder 101 and the blanket cylinder 102, a motor 24 for adjusting the printing pressure between the blanket cylinder 102 and the impression cylinder 103, a motor driver 25 for adjusting the printing pressure between the blanket cylinder 102 and the impression cylinder 103, a potentiometer 26 for the motor for adjusting the printing pressure between the blanket cylinder 102 and the impression cylinder 103, A/D (analog/digital) converters 28 to 30, I/O (input/output) interfaces 32 to 34.

In the printing press according to the present embodiment, inks of four colors are used. Accordingly, each of a printing unit 2 of the first color (for example, black), a printing unit 3 of the second color (for example, cyan), a printing unit 4 of the third color (for example, magenta), and a printing unit 5 of the fourth color (for example, yellow) includes the motor 18 for adjusting the nip pressure between the ink form roller 100 and the relief cylinder 101, the motor driver 19 for adjusting the nip pressure between the ink form roller 100 and the relief cylinder 101, the potentiometer 20 for the motor for adjusting the nip pressure between the ink form roller 100 and the relief cylinder 101, the motor 21 for adjusting the nip pressure between the relief cylinder 101 and the blanket cylinder 102, the motor driver 22 for adjusting the nip pressure between the relief cylinder 101 and the blanket cylinder 102, the potentiometer 23 for the motor for adjusting the nip pressure between the relief cylinder 101 and the blanket cylinder 102, the motor 24 for adjusting the printing pressure between the blanket cylinder 102 and the impression cylinder 103, the motor driver 25 for adjusting the printing pressure between the blanket cylinder 102 and the impression cylinder 103, the potentiometer 26 for the motor for adjusting the printing pressure between the blanket cylinder 102 and the impression cylinder 103, the A/D (analog/digital) converters 28 to 30, the I/O (input/output) interfaces 32 to 34. Although the inks of four colors are used in the present embodiment, the number of colors of inks to be used may be increased or decreased by increasing or decreasing the number of printing units.

Moreover, the contact-pressure adjusting system 1 includes memories M1 to M10, M14, M16, and M18 to M35. In the memory M1, an ink color ICm of the printing unit M is stored. In the memory M2, the selected printing unit number is stored. In the memory M3, a count value M is stored. In the memory M4, an output of the A/D converter connected to the potentiometer 20 for the motor for adjusting the nip pressure between the ink form roller 100 and the relief cylinder 101 is stored. In the memory M5, a reference nip pressure between the ink form roller 100 and the relief cylinder 101 is stored. In the memory M6, an output of the A/D converter connected to the potentiometer 23 for the motor for adjusting the nip pressure between the relief cylinder 101 and the blanket cylinder 102 is stored. In the memory M7, a reference nip pressure between the relief cylinder 101 and the blanket cylinder 102 is stored. In the memory M8, an output of the A/D converter connected to the potentiometer 26 for the motor for adjusting the printing pressure between the blanket cylinder 102 and the impression cylinder 103 is stored. In the memory M9, a reference printing pressure between the blanket cylinder 102 and the impression cylinder 103 is stored. In the memory M10, the total number Mmax of printing units is stored. In the memory M14, a compensation amount for the nip pressure between the ink form roller 100 and the relief cylinder 101 is stored. In the memory M16, a compensation amount for the nip pressure between the relief cylinder 101 and the blanket cylinder 102 is stored. In the memory M18, a compensation amount for the printing pressure between the blanket cylinder 102 and the impression cylinder 103 is stored. In the memory M19, a target nip pressure between the ink form roller 100 and the relief cylinder 101 is stored. In the memory M20, a target output of the A/D converter connected to the potentiometer 20 for the motor for adjusting the nip pressure between the ink form roller 100 and the relief cylinder 101 is stored. In the memory M21, a target nip pressure between the relief cylinder 101 and the blanket cylinder 102 is stored. In the memory M22, a target output of the A/D converter connected to the potentiometer 23 for the motor for adjusting the nip pressure between the relief cylinder 101 and the blanket cylinder 102 is stored. In the memory M23, a target printing pressure between the blanket cylinder 102 and the impression cylinder 103 is stored. In the memory M24, a target output of the A/D converter connected to the potentiometer 26 for the motor for adjusting the printing pressure between the blanket cylinder 102 and the impression cylinder 103 is stored. In the memory M25, a count value of the printing-operation-time counter 36 is stored. In the memory M26, a printing operation time is stored. In the memory M27, a corrected nip pressure between the ink form roller 100 and the relief cylinder 101 is stored. In the memory M28, a database of a conversion table between the printing operation time and the compensation amount for the nip pressure between the ink form roller 100 and the relief cylinder 101 is stored. In the memory M29, a conversion table between the printing operation time and the compensation amount for the nip pressure between the ink form roller 100 and the relief cylinder is stored. In the memory M30, a corrected nip pressure between the relief cylinder 101 and the blanket cylinder 102 is stored. In the memory M31, a data base of a conversion table between the printing operation time and the compensation amount for the nip pressure between the relief cylinder 101 and the blanket cylinder 102 is stored. In the memory M32, a conversion table between the printing operation time and a compensation amount for the nip pressure between the relief cylinder 101 and the blanket cylinder 102 is stored. In the memory M33, a corrected printing pressure between the blanket cylinder 102 and the impression cylinder 103 is stored. In the memory M34, a database of a conversion table between the printing operation time and the compensation amount for the printing pressure between the blanket cylinder 102 and the impression cylinder 103 is stored. In the memory M35, a conversion table between the printing operation time and a compensation amount for the printing pressure between the blanket cylinder 102 and the impression cylinder 103 is stored.

The CPU 10 obtains various kinds of information which are inputted thereto via the I/O interfaces 16, 32 to 34, and 37, and operates in accordance with a program stored in the ROM 12, while accessing the RAM 11 as well as the memories M1 to M10, M14, M16, M18, and M19 to M35. The input device 13 is provided with various kinds of input devices including an input unit of the ink color ICm of the printing unit M, a printing-unit selecting switch, a switch for selecting the adjustment of the nip pressure between the ink form roller 100 and the relief cylinder 101, a pressure-adjustment completing switch, an up button, a down button, a switch for selecting the adjustment of the nip pressure between the relief cylinder 101 and the blanket cylinder 102, a switch for selecting the adjustment of the printing pressure between the blanket cylinder 102 and the impression cylinder 103, a final-printing starting button, and a final-printing completing button.

Next, the operation of the contact-pressure adjusting system for a liquid application machine according to the second embodiment of the present invention will be described. Each of FIGS. 8A to 8D, 9A to 9F, 10A and 10B, and 11A to 11C shows an operational flowchart of the contact-pressure adjusting system 1 for a liquid application machine according to the second embodiment of the present invention. Hereinafter, the content of the processing of each step will be described.

Since the processing from Step P1 to Step P41 is the same as that of the first embodiment, a description thereof will be omitted.

In Step P42, the CPU 10 determines whether or not the final-printing starting button, which is provided to the input device 13, has been turned ON by the operator. When the final-printing starting button has been turned ON, the CPU 10 executes Step P112. ON the other hand, when the final-printing starting button has not been turned ON, the CPU 10 executes Step P2.

In Step P112, the CPU 10 outputs a reset signal and an enable signal to the printing-operation-time counter 36. Upon completion of the processing of Step P112, the CPU 10 executes Step P113.

In Step P113, the CPU 10 stops the output of the reset signal to the printing-operation-time counter 36. Upon completion of the processing of Step P113, the CPU 10 executes Step P43.

Since the processing from Step P43 to Step P51 is the same as that of the first embodiment, a description thereof will be omitted.

In Step P52, the CPU 10 determines whether or not the count value M, which is stored in the memory M3, is larger than the total number Mmax of printing units, which is stored in the memory M10. When the count value M is larger than the total number Mmax of printing units, the CPU 10 executes Step P114. On the other hand, when the count value M is not larger than the total number Mmax of printing units, the CPU 10 executes Step P44.

In Step P114, the CPU 10 determines whether or not the printing-unit selecting switch, which is provided to the input device 13, has been turned ON by the operator. When the printing-unit selecting switch has been turned ON, the CPU 10 executes Step P115. On the other hand, when the printing-unit selecting switch has not been turned ON, the CPU 10 skips Step P115, and then executes Step P116.

In Step P115, the CPU 10 stores the selected printing unit number M in the memory M2. Upon completion of the processing of Step P115, the CPU 10 executes Step P116.

In Step P116, the CPU 10 determines whether or not the switch for selecting the adjustment of the nip pressure between the ink form roller and the relief cylinder, which switch is provided to the input device 13, has been turned ON by the operator. When the switch for selecting the adjustment of the nip pressure between the ink form roller and the relief cylinder has been turned ON, the CPU 10 executes Step P117. On the other hand, when the switch for selecting the adjustment of the nip pressure between the ink form roller and the relief cylinder has not been turned ON, the CPU 10 skips Steps P117 to P138, and then executes Step P139.

In Step P117, the CPU 10 determines whether or not the pressure-adjustment completing switch, which is provided to the input device 13, has been turned ON by the operator. When the pressure-adjustment completing switch has been turned ON, the CPU 10 skips Steps P118 to P127, and then executes P128. On the other hand, when the pressure-adjustment completing switch has not been turned ON, the CPU 10 executes Step P118.

In Step P118, the CPU 10 determines whether or not the up button, which is provided to the input device 13, has been turned ON by the operator. When the up button has been turned ON, the CPU 10 executes Step P119. On the other hand, when the up button has not been turned ON, the CPU 10 skips Steps P119 to P122, and then executes Step P123.

In Step P119, the CPU 10 reads the selected printing unit number M from the memory M2. Upon completion of the processing of Step P119, the CPU 10 executes Step P120.

In Step P120, the CPU 10 outputs a normal rotation instruction to the motor driver 19 for adjusting the nip pressure between the ink form roller and the relief cylinder of the printing unit M. Upon completion of the processing of Step P120, the CPU 10 executes Step P121.

In Step P121, the CPU 10 determines whether or not the up button, which is provided to the input device 13, has been turned OFF by the operator. When the up button has been turned OFF, the CPU 10 executes Step P121. On the other hand, when the up button has not been turned OFF, the CPU 10 executes Step P121 again.

In Step P122, the CPU 10 stops the output of the normal rotation instruction to the motor driver 19 for adjusting the nip pressure between the ink form roller and the relief cylinder of the printing unit M. Upon completion of the processing of Step P122, the CPU 10 executes Step P123.

In Step P123, the CPU 10 determines whether or not the down button, which is provided to the input device 13, has been turned ON by the operator. When the down button has been turned ON, the CPU 10 executes P124. On the other hand, when the down button has not been turned ON, the CPU 10 executes Step P117.

In Step P124, the CPU 10 reads the selected printing unit number M from the memory M2. Upon completion of the processing of Step P124, the CPU 10 executes Step P125.

In Step P125, the CPU 10 outputs a reverse rotation instruction to the motor driver 19 for adjusting the nip pressure between the ink form roller and the relief cylinder of the printing unit M. Upon completion of the processing of Step P125, the CPU 10 executes Step P126.

In Step P126, the CPU 10 determines whether or not the down button, which is provided to the input device 13, has been turned OFF by the operator. When the down button has been turned OFF, the CPU 10 executes Step P127. On the other hand, when the down button has not been turned OFF, the CPU 10 executes Step P126 again.

In Step P127, the CPU 10 stops the output of the reverse rotation instruction to the motor driver 19 for adjusting the nip pressure between the ink form roller and the relief cylinder of the printing unit M. Upon completion of the processing of Step P127, the CPU 10 executes Step P117.

In Step P128, the CPU 10 reads the count value of the printing-operation-time counter 36, and then stores the read value in the memory M25. Upon completion of the processing of Step P128, the CPU 10 executes Step P129.

In Step P129, the CPU 10 calculates a printing operation time from the count value of the printing-operation-time counter 36, which is stored in the memory M25. The CPU 10 then stores the result of the calculation in the memory M26. Upon completion of the processing of Step P129, the CPU 10 executes Step P130.

In Step P130, the CPU 10 reads the selected printing unit number M, which is stored in the memory M2. Upon completion of the processing of Step P130, the CPU 10 executes Step P131.

In Step P131, the CPU 10 reads the output of the A/D converter connected to the potentiometer 20 for the motor for adjusting the nip pressure between the ink form roller and the relief cylinder of the selected printing unit M. The CPU 10 then stores the read value in the memory M4. Upon completion of the processing of Step P131, the CPU 10 executes Step P132.

In Step P132, the CPU 10 calculates a corrected nip pressure between the ink form roller and the relief cylinder of the printing unit M, from the output of the A/D converter connected to the potentiometer 20 for the motor for adjusting the nip pressure between the ink form roller and the relief cylinder of the printing unit M, which is stored in the memory M4. The CPU 10 then stores the result of the calculation in the memory M27. Upon completion of the processing of Step P132, the CPU 10 executes Step P133.

In Step P133, the CPU 10 reads the reference nip pressure between the ink form roller and the relief cylinder of the printing unit M, which is stored in the memory M5. Upon completion of the processing of Step P133, the CPU 10 executes Step P134.

In Step P134, the CPU 10 calculates a compensation amount for the nip pressure between the ink form roller and the relief cylinder of the printing unit M by subtracting the reference nip pressure between the ink form roller and the relief cylinder of the printing unit M from the corrected nip pressure between the ink form roller and the relief cylinder of the printing unit M. The CPU 10 then stores the result of the calculation in the memory M14. Upon completion of the processing of Step P134, the CPU 10 executes Step P135.

In Step P135, the CPU 10 reads the selected printing unit number M, which is stored in the memory M2. Upon completion of the processing of Step P135, the CPU 10 executes Step P136.

In Step P136, the CPU 10 reads the ink color ICm of the printing unit M, which is stored in the memory M1. Upon completion of the processing of Step P136, the CPU 10 executes Step P137.

In Step P137, the CPU 10 adds the compensation amount for the nip pressure between the ink form roller and the relief cylinder, in association with the printing operation time, to the database of a conversion table between the printing operation time and the compensation amount for the nip pressure between the ink form roller and the relief cylinder for the ink color ICm, which is stored in the memory M28. Upon completion of the processing of Step P137, the CPU 10 executes P138.

In Step P138, the CPU 10 creates a conversion table between the printing operation time and the compensation amount for the nip pressure between the ink form roller and the relief cylinder, by using the least squares method, from the database of a conversion table between the printing operation time and the compensation amount for the nip pressure between the ink form roller and the relief cylinder for the ink color ICm, which database is stored in the memory M29. The CPU 10 then overwrites the created conversion table in the memory M29. Upon completion of the processing of Step P138, the CPU 10 executes Step P139.

In Step P139, the CPU 10 determines whether or not the switch for selecting the adjustment of the nip pressure between the relief cylinder and the blanket cylinder, which switch is provided to the input device 13, has been turned ON by the operator. When the switch for selecting the adjustment of the nip pressure between the relief cylinder and the blanket cylinder has been turned ON, the CPU 10 executes Step P140. On the other hand, when the switch for selecting the adjustment of the nip pressure between the relief cylinder and the blanket cylinder has not been turned ON, the CPU 10 skips Steps P140 to P161, and then executes Step P162.

In Step P140, the CPU 10 determines whether or not the pressure-adjustment completing switch, which is provided to the input device 13, has been turned ON by the operator. When the pressure-adjustment completing switch has been turned ON, the CPU 10 skips Steps P141 to P150, and then executes Step P151. On the other hand, when the pressure-adjustment completing switch has not been turned ON, the CPU 10 executes Step P141.

In Step P141, the CPU 10 determines whether or not the up button, which is provided to the input device 13, has been turned ON by the operator. When the up button has been turned ON, the CPU 10 executes Step P142. On the other hand, when the up button has not been turned ON, the CPU 10 skips Steps P142 to P145, and then executes Step P146.

In Step P142, the CPU 10 reads the selected printing unit number M from the memory M2. Upon completion of the processing of Step P142, the CPU 10 executes Step P143.

In Step P143, the CPU 10 outputs a normal rotation instruction to the motor driver 22 for adjusting the nip pressure between the relief cylinder and the blanket cylinder of the printing unit M. Upon completion of the processing of Step P143, the CPU 10 executes Step P144.

In Step P144, the CPU 10 determines whether or not the up button, which is provided to the input device 13, has been turned OFF by the operator. When the up button has been turned OFF, the CPU 10 executes Step P145. On the other hand, when the up button has not been turned OFF, the CPU 10 executes P144 again.

In Step P145, the CPU 10 stops the output of the normal rotation instruction to the motor driver 22 for adjusting the nip pressure between the relief cylinder and the blanket cylinder of the printing unit M. Upon completion of the processing of Step P145, the CPU 10 executes Step P146.

In Step P146, the CPU 10 determines whether or not the down button, which is provided to the input device 13, has been turned ON by the operator. When the down button has been turned ON, the CPU 10 executes Step P147. On the other hand, when the down button has not been turned ON, the CPU 10 executes Step P140.

In Step P147, the CPU 10 reads the selected printing unit number M from the memory M2. Upon completion of the processing of Step P147, the CPU 10 executes Step P148.

In Step P148, the CPU 10 outputs a reverse rotation instruction to the motor driver 22 for adjusting the nip pressure between the relief cylinder and the blanket cylinder of the printing unit M. Upon completion of the processing of Step P148, the CPU 10 executes Step P149.

In Step P149, the CPU 10 determines whether or not the down button, which is provided to the input device 13, has been turned OFF by the operator. When the down button has been turned OFF, the CPU 10 executes Step P150. On the other hand, when the down button has not been turned OFF, the CPU 10 executes Step P149 again.

In Step P150, the CPU 10 stops the output of the reverse rotation instruction to the motor driver 22 for adjusting the nip pressure between the relief cylinder and the blanket cylinder of the printing unit M. Upon completion of the processing of Step P150, the CPU 10 executes Step P140.

In Step P151, the CPU 10 reads the count value of the printing-operation-time counter 36, and then stores the read value in the memory M25. Upon completion of the processing of Step P151, the CPU 10 executes Step P152.

In Step P152, the CPU 10 calculates the printing operation time from the count value of the printing-operation-time counter 36, which is stored in the memory M25. The CPU 10 then stores the result of the calculation in the memory M26. Upon completion of the processing of Step P152, the CPU 10 executes Step P153.

In Step P153, the CPU 10 reads the selected printing unit number M, which is stored in the memory M2. Upon completion of the processing of Step P153, the CPU 10 executes Step P154.

In Step P154, the CPU 10 reads the output of the A/D converter connected to the potentiometer 23 for the motor for adjusting the nip pressure between the relief cylinder and the blanket cylinder of the selected printing unit M. The CPU 10 then stores the read value in the memory M6. Upon completion of the processing of Step P154, the CPU 10 executes Step P155.

In Step P155, the CPU 10 calculates a corrected nip pressure between the relief cylinder and the blanket cylinder of the printing unit M, from the output of the A/D converter connected to the potentiometer 23 for the motor for adjusting the nip pressure between the relief cylinder and the blanket cylinder of the printing unit M, which is stored in the memory M6. The CPU 10 then stores the result of the calculation in the memory M30. Upon completion of the processing of Step P155, the CPU 10 executes Step P156.

In Step P156, the CPU 10 reads the reference nip pressure between the relief cylinder and the blanket cylinder of the printing unit M, which is stored in the memory M7. Upon completion of the processing of Step P156, the CPU 10 executes Step P157.

In Step P157, the CPU 10 calculates a compensation amount for the nip pressure between the relief cylinder and the blanket cylinder by subtracting the reference nip pressure between the relief cylinder and the blanket cylinder of the printing unit M from the corrected nip pressure between the relief cylinder and the blanket cylinder of the printing unit M. The CPU 10 then stores the result of the calculation in the memory M16. Upon completion of the processing of Step P157, the CPU 10 executes Step P158.

In Step P158, the CPU 10 reads the selected printing unit number M, which is stored in the memory M2. Upon completion of the processing of Step P158, the CPU 10 executes Step P159.

In Step P159, the CPU 10 reads the ink color ICm of the printing unit M, which is stored in the memory M1. Upon completion of the processing of Step P159, the CPU 10 executes Step P160.

In Step P160, the CPU 10 adds the compensation amount for the nip pressure between the relief cylinder and the blanket cylinder, in association with the printing operation time, to the database of a conversion table between the printing operation time and the compensation amount for the nip pressure between the relief cylinder and the blanket cylinder for the ink color ICm, which is stored in the memory M31. Upon completion of the processing of Step P160, the CPU 10 executes Step P161.

In Step P161, the CPU 10 creates a conversion table between the printing operation time and the compensation amount for the nip pressure between the relief cylinder and the blanket cylinder, by using the least squares method, from the database of a conversion table between the printing operation time and the compensation amount for the nip pressure between the relief cylinder and the blanket cylinder for the ink color ICm, which database is stored in the memory M31. The CPU 10 then overwrites the created conversion table in the memory M32. Upon completion of the processing of Step P161, the CPU 10 executes Step P162.

In Step P162, the CPU 10 determines whether or not the switch for selecting the adjustment of the printing pressure between the blanket cylinder and the impression cylinder, which switch is provided to the input device 13, has been turned ON by the operator. When the switch for selecting the adjustment of the printing pressure between the blanket cylinder and the impression cylinder has been turned ON, the CPU 10 executes Step P163. On the other hand, when the switch for selecting the adjustment of the printing pressure between the blanket cylinder and the impression cylinder has not been turned ON, the CPU 10 skips Steps P163 to P184, and then executes Step P185.

In Step P163, the CPU 10 determines whether or not the pressure-adjustment completing switch, which is provided to the input device 13, has been turned ON by the operator. When the pressure-adjustment completing switch has been turned ON, the CPU 10 skips Steps P164 to P173, and then executes Step P174. On the other hand, when the pressure-adjustment completing switch has not been turned ON, the CPU 10 executes Step P164.

In Step P164, the CPU 10 determines whether or not the up button, which is provided to the input device 13, has been turned ON by the operator. When the up button has been turned ON, the CPU 10 executes Step P165. On the other hand, when the up button has not been turned ON, the CPU 10 skips Steps P165 to P168, and then executes Step P169.

In Step P165, the CPU 10 reads the selected printing unit number M from the memory M2. Upon completion of the processing of Step P165, the CPU 10 executes Step P166.

In Step P166, the CPU 10 outputs a normal rotation instruction to the motor driver 25 for adjusting the printing pressure between the blanket cylinder and the impression cylinder of the printing unit M. Upon completion of the processing of Step P166, the CPU 10 executes Step P167.

In Step P167, the CPU 10 determines whether or not the up button, which is provided to the input device 13, has been turned OFF by the operator. When the up button has been turned OFF, the CPU 10 executes Step P168. On the other hand, when the up button has not been turned OFF, the CPU 10 executes Step P167 again.

In Step P168, the CPU 10 stops the output of the normal rotation instruction to the motor driver 25 for adjusting the printing pressure between the blanket cylinder and the impression cylinder of the printing unit M. Upon completion of the processing of Step P168, the CPU 10 executes Step P169.

In Step P169, the CPU 10 determines whether or not the down button, which is provided to the input device 13, has been turned ON by the operator. When the down button has been turned ON, the CPU 10 executes Step P170. On the other hand, when the down button has not been turned ON, the CPU 10 executes Step P163.

In Step P170, the CPU 10 reads the selected printing unit number M from the memory M2. Upon completion of the processing of Step P170, the CPU 10 executes Step P171.

In Step P171, the CPU 10 outputs a reverse rotation instruction to the motor driver 25 for adjusting the printing pressure between the blanket cylinder and the impression cylinder of the printing unit M. Upon completion of the processing of Step P171, the CPU 10 executes Step P172.

In Step P172, the CPU 10 determines whether or not the down button, which is provided to the input device 13, has been turned OFF by the operator. When the down button has been turned OFF, the CPU 10 executes Step P173. On the other hand, when the down button has not been turned OFF, the CPU 10 executes Step P172 again.

In Step P173, the CPU 10 stops the output of the reverse rotation instruction to the motor driver 25 for adjusting the printing pressure between the blanket cylinder and the impression cylinder of the printing unit M. Upon completion of the processing of Step P173, the CPU 10 executes Step P163.

In Step P174, the CPU 10 reads the count value of the printing-operation-time counter 36, and then stores the read value in the memory M25. Upon completion of the processing of Step P174, the CPU 10 executes Step P175.

In Step P175, the CPU 10 calculates the printing operation time, from the count value of the printing-operation-time counter 36, which is stored in the memory M25. The CPU 10 then stores the result of the calculation in the memory M26. Upon completion of the processing of Step P175, the CPU 10 executes Step P176.

In Step P176, the CPU 10 reads the selected printing unit number M, which is stored in the memory M2. Upon completion of the processing of Step P176, the CPU 10 executes Step P177.

In Step P177, the CPU 10 reads the output of the A/D converter connected to the potentiometer 26 for the motor for adjusting the printing pressure between the blanket cylinder and the impression cylinder of the selected printing unit M. The CPU 10 then stores the read value in the memory M8. Upon completion of the processing of Step P177, the CPU 10 executes Step P178.

In Step P178, the CPU 10 calculates a corrected printing pressure between the blanket cylinder and the impression cylinder of the printing unit M, from the output of the A/D converter connected to the potentiometer 26 for the motor for adjusting the printing pressure between the blanket cylinder and the impression cylinder of the printing unit M, which is stored in the memory Mg. The CPU 10 then stores the result of the calculation in the memory M33. Upon completion of the processing of Step P178, the CPU 10 executes Step P179.

In Step P179, the CPU 10 reads the reference printing pressure between the blanket cylinder and the impression cylinder of the printing unit M, which is stored in the memory M9. Upon completion of the processing of Step P179, the CPU 10 executes Step P180.

In Step P180, the CPU 10 calculates a compensation amount for the printing pressure between the blanket cylinder and the impression cylinder of the printing unit M by subtracting the reference printing pressure between the blanket cylinder and the impression cylinder of the printing unit M from the corrected printing pressure between the blanket cylinder and the impression cylinder of the printing unit M. The CPU 10 then stores the result of the calculation in the memory M18. Upon completion of the processing of Step P180, the CPU 10 executes Step P181.

In Step P181, the CPU 10 reads the selected printing unit number M, which is stored in the memory M2. Upon completion of the processing of Step P181, the CPU 10 executes Step P182.

In Step P182, the CPU 10 reads the ink color ICm of the printing unit M, which is stored in the memory M1. Upon completion of the processing of Step P182, the CPU 10 executes Step P183.

In Step P183, the CPU 10 adds the compensation amount for the printing pressure between the blanket cylinder and the impression cylinder, in association with the printing operation time, to the database of a conversion table between the printing operation time and the compensation amount for the printing pressure between the blanket cylinder and the impression cylinder for the ink color ICm, which is stored in the memory M34. Upon completion of the processing of Step P183, the CPU 10 executes Step P184.

In Step P184, the CPU 10 creates a conversion table between the printing operation time and the compensation amount for the printing pressure between the blanket cylinder and the impression cylinder, by using the least squares method, from the database of a conversion table between the printing operation time and the compensation amount for the printing pressure between the blanket cylinder and the impression cylinder for the ink color ICm, which database is stored in the memory M34. The CPU 10 then overwrites the created conversion table in the memory M35. Upon completion of the processing of Step P184, the CPU 10 executes Step P185. When one of the contact-pressure adjusting means of each printing unit M is manually adjusted by the operator during the final printing, a conversion table between the printing operation time and one of the nip pressures and the printing pressure for an ink color corresponding to the manually adjusted portion is rewritten in consideration of the result of the manual adjustment, in the foregoing steps.

In Step P185, the CPU 10 reads the count value of the printing-operation-time counter 36, and then stores the read value in the memory M25. Upon completion of the processing of Step P185, the CPU 10 executes Step P186.

In Step P186, the CPU 10 calculates the printing operation time from the count value of the printing-operation-time counter 36. The CPU 10 then stores the result of the calculation in the memory M26. Upon completion of the processing of Step P186, the CPU 10 executes Step P187.

In Step P187, the CPU 10 writes 1 in the count value M, which is stored in the memory M3. Upon completion of the processing of Step P187, the CPU 10 executes Step P188.

In Step P188, the CPU 10 reads the ink color ICm of the printing unit M, which is stored in the memory M1. Upon completion of the processing of Step P188, the CPU 10 executes Step P189.

In Step P189, the CPU 10 reads the conversion table between the printing operation time and the compensation amount for the nip pressure between the ink form roller and the relief cylinder for the ink color ICm, which conversion table is stored in the memory M29. Upon completion of the processing of Step P189, the CPU 10 executes Step P190.

In Step P190, the CPU 10 obtains a compensation amount for the nip pressure between the ink form roller and the relief cylinder, from the printing operation time, by using the conversion table between the printing operation time and the compensation amount for the nip pressure between the ink form roller and the relief cylinder for the ink color ICm. The CPU 10 then stores the obtained compensation amount in the memory M14. Upon completion of the processing of Step P190, the CPU 10 executes Step P191.

In Step P191, the CPU 10 reads the conversion table between the printing operation time and the compensation amount for the nip pressure between the relief cylinder and the blanket cylinder for the ink color ICm, which conversion table is stored in the memory M32. Upon completion of the processing of Step P191, the CPU 10 executes Step P192.

In Step P192, the CPU 10 obtains a compensation amount for the nip pressure between the relief cylinder and the blanket cylinder, from the printing operation time, by using the conversion table between the printing operation time and the compensation amount for the nip pressure between the relief cylinder and the blanket cylinder for the ink color ICm. The CPU 10 then stores the obtained compensation amount in the memory M16. Upon completion of the processing of Step P192, the CPU 10 executes Step P193.

In Step P193, the CPU 10 reads the conversion table between the printing operation time and the compensation amount for the printing pressure between the blanket cylinder and the impression cylinder for the ink color ICm, which conversion table is stored in the memory M35. Upon completion of the processing of Step P193, the CPU 10 executes Step P194.

In Step P194, the CPU 10 obtains a compensation amount for the printing pressure between the blanket cylinder and the impression cylinder, from the printing operation time, by using the conversion table between the printing operation time and the compensation amount for the printing pressure between the blanket cylinder and the impression cylinder for the ink color ICm. The CPU 10 then stores the obtained compensation amount in the memory M18. Upon completion of the processing of Step P194, the CPU 10 executes Step P195.

In Step P195, the CPU 10 reads the reference nip pressure between the ink form roller and the relief cylinder of the printing unit M, which is stored in the memory M5. Upon completion of the processing of Step P195, the CPU 10 executes Step P196.

In Step P196, the CPU 10 reads the compensation amount for the nip pressure between the ink form roller and the relief cylinder of the printing unit M, which is stored in the memory M14. Upon completion of the processing of Step P196, the CPU 10 executes Step P197.

In Step P197, the CPU 10 calculates a target nip pressure between the ink form roller and the relief cylinder by adding the compensation amount for the nip pressure between the ink form roller and the relief cylinder of the printing unit M to the reference nip pressure between the ink form roller and the relief cylinder of the printing unit M. The CPU 10 then stores the result of the calculation in the memory M19. Upon completion of the processing of Step P197, the CPU 10 executes Step P198.

In Step P198, the CPU 10 calculates a target output of the A/D converter connected to the potentiometer 20 for the motor for adjusting the nip pressure between the ink form roller and the relief cylinder, from the target nip pressure between the ink form roller and the relief cylinder of the printing unit M. The CPU 10 then stores the result of the calculation in the memory M20. Upon completion of the processing of Step P198, the CPU 10 executes Step P199.

In Step P199, the CPU 10 reads the output of the A/D converter connected to the potentiometer 20 for the motor for adjusting the nip pressure between the ink form roller and the relief cylinder of the printing unit M. The CPU 10 then stores the read value in the memory M4. Upon completion of the processing of Step P199, the CPU 10 executes Step P200.

In Step P200, the CPU 10 determines whether or not the output of the A/D converter connected to the potentiometer 20 for the motor for adjusting the nip pressure between the ink form roller and the relief cylinder of the printing unit M, which is stored in the memory M4, is equal to the target output of the A/D converter connected to the potentiometer 20 for the motor for adjusting the nip pressure between the ink form roller and the relief cylinder of the printing unit M, which is stored in the memory M20.

When the output of the A/D converter connected to the potentiometer 20 for the motor for adjusting the nip pressure between the ink form roller and the relief cylinder of the printing unit M, which is stored in the memory M4, is equal to the target output of the A/D converter connected to the potentiometer 20 for the motor for adjusting the nip pressure between the ink form roller and the relief cylinder of the printing unit M, which is stored in the memory M20, the CPU 10 skips Steps P201 to P209, and then executes Step P78.

On the other hand, when the output of the A/D converter connected to the potentiometer 20 for the motor for adjusting the nip pressure between the ink form roller and the relief cylinder of the printing unit M, which is stored in the memory M4, is not equal to the target output of the A/D converter connected to the potentiometer 20 for the motor for adjusting the nip pressure between the ink form roller and the relief cylinder of the printing unit M, which is stored in the memory M20, the CPU 10 executes Step P201.

In Step P201, the CPU 10 determines whether or not the target output of the A/D converter connected to the potentiometer 20 for the motor for adjusting the nip pressure between the ink form roller and the relief cylinder of the printing unit M, which is stored in the memory M20, is larger than the output of the A/D converter connected to the potentiometer 20 for the motor for adjusting the nip pressure between the ink form roller and the relief cylinder of the printing unit M, which is stored in the memory M4.

When the target output of the A/D converter connected to the potentiometer 20 for the motor for adjusting the nip pressure between the ink form roller and the relief cylinder of the printing unit M, which is stored in the memory M20, is larger than the output of the A/D converter connected to the potentiometer 20 for the motor for adjusting the nip pressure between the ink form roller and the relief cylinder of the printing unit M, which is stored in the memory M4, the CPU 10 executes Step P202.

On the other hand, when the target output of the A/D converter connected to the potentiometer 20 for the motor for adjusting the nip pressure between the ink form roller and the relief cylinder of the printing unit M, which is stored in the memory M20, is not larger than the output of the A/D converter connected to the potentiometer 20 for the motor for adjusting the nip pressure between the ink form roller and the relief cylinder of the printing unit M, which is stored in the memory M4, the CPU 10 executes Step P206.

In Step P202, the CPU 10 outputs a normal rotation instruction to the motor driver 19 for adjusting the nip pressure between the ink form roller and the relief cylinder of the printing unit M. Upon completion of the processing of Step P202, the CPU 10 executes Step P203.

In Step P203, the CPU 10 reads the output of the A/D converter connected to the potentiometer 20 for the motor for adjusting the nip pressure between the ink form roller and the relief cylinder of the printing unit M. The CPU 10 then stores the read value in the memory M4. Upon completion of the processing of Step P203, the CPU 10 executes Step P204.

In Step P204, the CPU 10 determines whether or not the output of the A/D converter connected to the potentiometer 20 for the motor for adjusting the nip pressure between the ink form roller and the relief cylinder of the printing unit M, which is stored in the memory M4, is equal to the target output of the A/D converter connected to the potentiometer 20 for the motor for adjusting the nip pressure between the ink form roller and the relief cylinder of the printing unit M, which is stored in the memory M20.

When the output of the A/D converter connected to the potentiometer 20 for the motor for adjusting the nip pressure between the ink form roller and the relief cylinder of the printing unit M, which is stored in the memory M4, is equal to the target output of the A/D converter connected to the potentiometer 20 for the motor for adjusting the nip pressure between the ink form roller and the relief cylinder of the printing unit M, which is stored in the memory M20, the CPU 10 executes Step P205.

On the other hand, when the output of the A/D converter connected to the potentiometer 20 for the motor for adjusting the nip pressure between the ink form roller and the relief cylinder of the printing unit M, which is stored in the memory M4, is not equal to the target output of the A/D converter connected to the potentiometer 20 for the motor for adjusting the nip pressure between the ink form roller and the relief cylinder of the printing unit M, which is stored in the memory M20, the CPU 10 executes Step P203.

In Step P205, the CPU 10 stops the output of the normal rotation instruction to the motor driver 19 for adjusting the nip pressure between the ink form roller and the relief cylinder of the printing unit M. Upon completion of the processing of Step P205, the CPU 10 executes Step P78.

In Step P206, the CPU 10 outputs a reverse rotation instruction to the motor driver 19 for adjusting the nip pressure between the ink form roller and the relief cylinder of the printing unit M. Upon completion of the processing of Step P206, the CPU 10 executes Step P207.

In Step P207, the CPU 10 reads the output of the A/D converter connected to the potentiometer 20 for the motor for adjusting the nip pressure between the ink form roller and the relief cylinder of the printing unit M. The CPU 10 then stores the read value in the memory M4. Upon completion of the processing of Step P207, the CPU 10 executes Step P208.

In Step P208, the CPU 10 determines whether or not the output of the A/D converter connected to the potentiometer 20 for the motor for adjusting the nip pressure between the ink form roller and the relief cylinder of the printing unit M, which is stored in the memory M4, is equal to the target output of the A/D converter connected to the potentiometer 20 for the motor for adjusting the nip pressure between the ink form roller and the relief cylinder of the printing unit M, which is stored in the memory M20.

When the output of the A/D converter connected to the potentiometer 20 for the motor for adjusting the nip pressure between the ink form roller and the relief cylinder of the printing unit M, which is stored in the memory M4, is equal to the target output of the A/D converter connected to the potentiometer 20 for the motor for adjusting the nip pressure between the ink form roller and the relief cylinder of the printing unit M, which is stored in the memory M20, the CPU 10 executes Step P209.

On the other hand, when the output of the A/D converter connected to the potentiometer 20 for the motor for adjusting the nip pressure between the ink form roller and the relief cylinder of the printing unit M, which is stored in the memory M4, is not equal to the target output of the A/D converter connected to the potentiometer 20 for the motor for adjusting the nip pressure between the ink form roller and the relief cylinder of the printing unit M, which is stored in the memory M20, the CPU 10 executes Step P207.

In Step P209, the CPU 10 stops the output of the reverse rotation instruction to the motor driver 19 for adjusting the nip pressure between the ink form roller and the relief cylinder of the printing unit M. Upon completion of the processing of Step P209, the CPU 10 executes Step P78.

Since the processing from Step P78 to Step P109 is the same as that of the first embodiment, a description thereof will be omitted.

In Step P110, the CPU 10 determines whether or not the count value M, which is stored in the memory M3, is larger than the total number Mmax of printing units, which is stored in the memory M10. When the count value M, which is stored in the memory M3, is larger than the total number Mmax of printing units, which is stored in the memory M10, the CPU 10 executes Step P111. On the other hand, when the count value M, which is stored in the memory M3, is not larger than the total number Mmax of printing units, which is stored in the memory M10, the CPU 10 executes Step P188.

In Step P111, the CPU 10 determines whether or not the final-printing completing button, which is provided to the input device 13, has been turned ON by the operator. When the final-printing completing button has been turned ON, the CPU 10 executes Step P1. On the other hand, when the final-printing completing button has not been turned ON, the CPU 10 executes Step P114.

Third Embodiment

A description will be given of a contact-pressure adjusting method and a contact-pressure adjusting system, for a liquid application machine, according to a third embodiment of the present invention. Note that, since the configuration of a printing press, to which the contact-pressure adjusting system for a liquid application machine according to the present embodiment is employed, is the same as that of the first embodiment, a description thereof will be omitted.

Figure 12A:
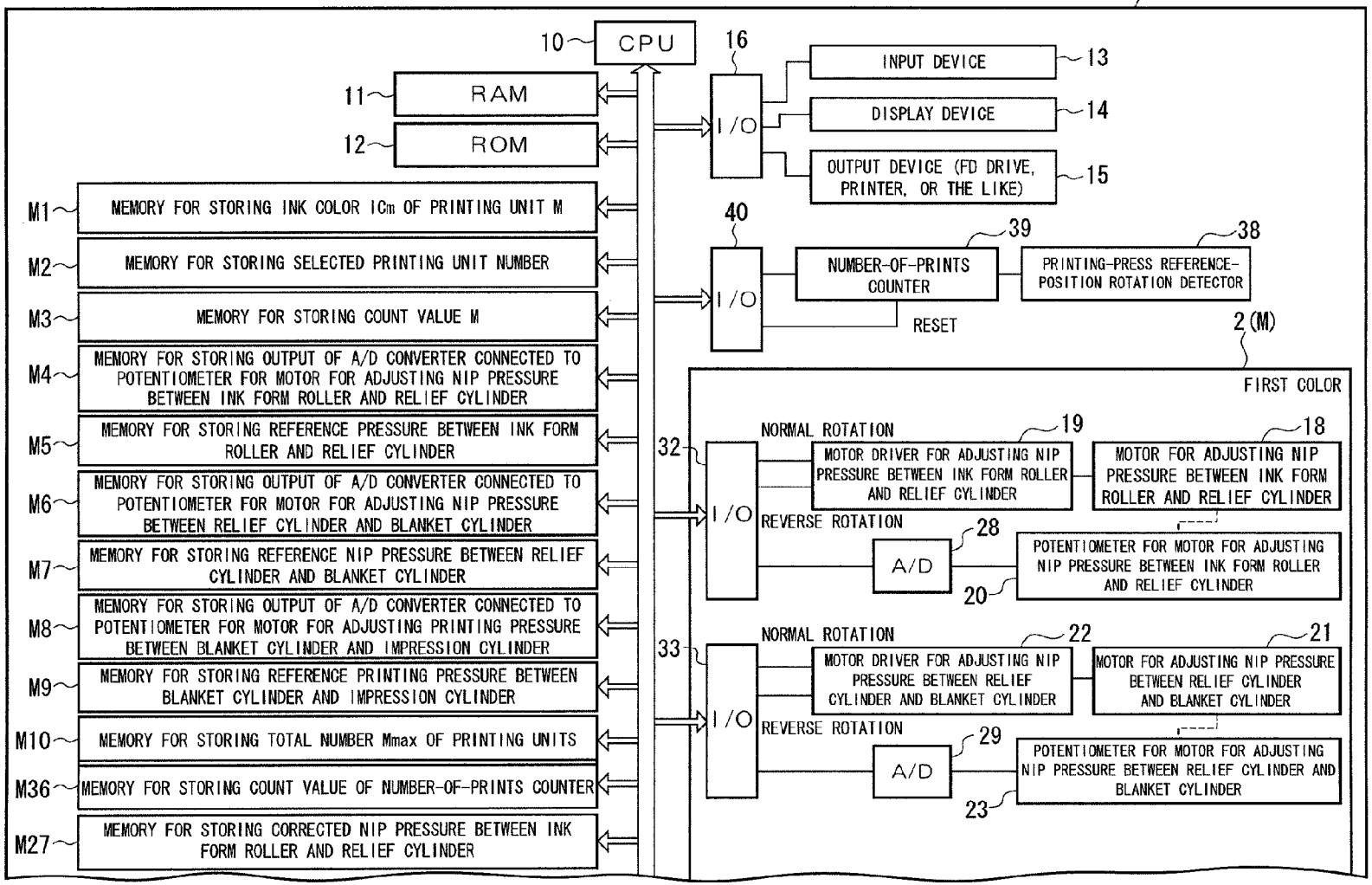
FIG. 12A shows a hardware block diagram of a contact-pressure adjusting system for a liquid application machine according to a third embodiment of the present invention.
Figure 12B:
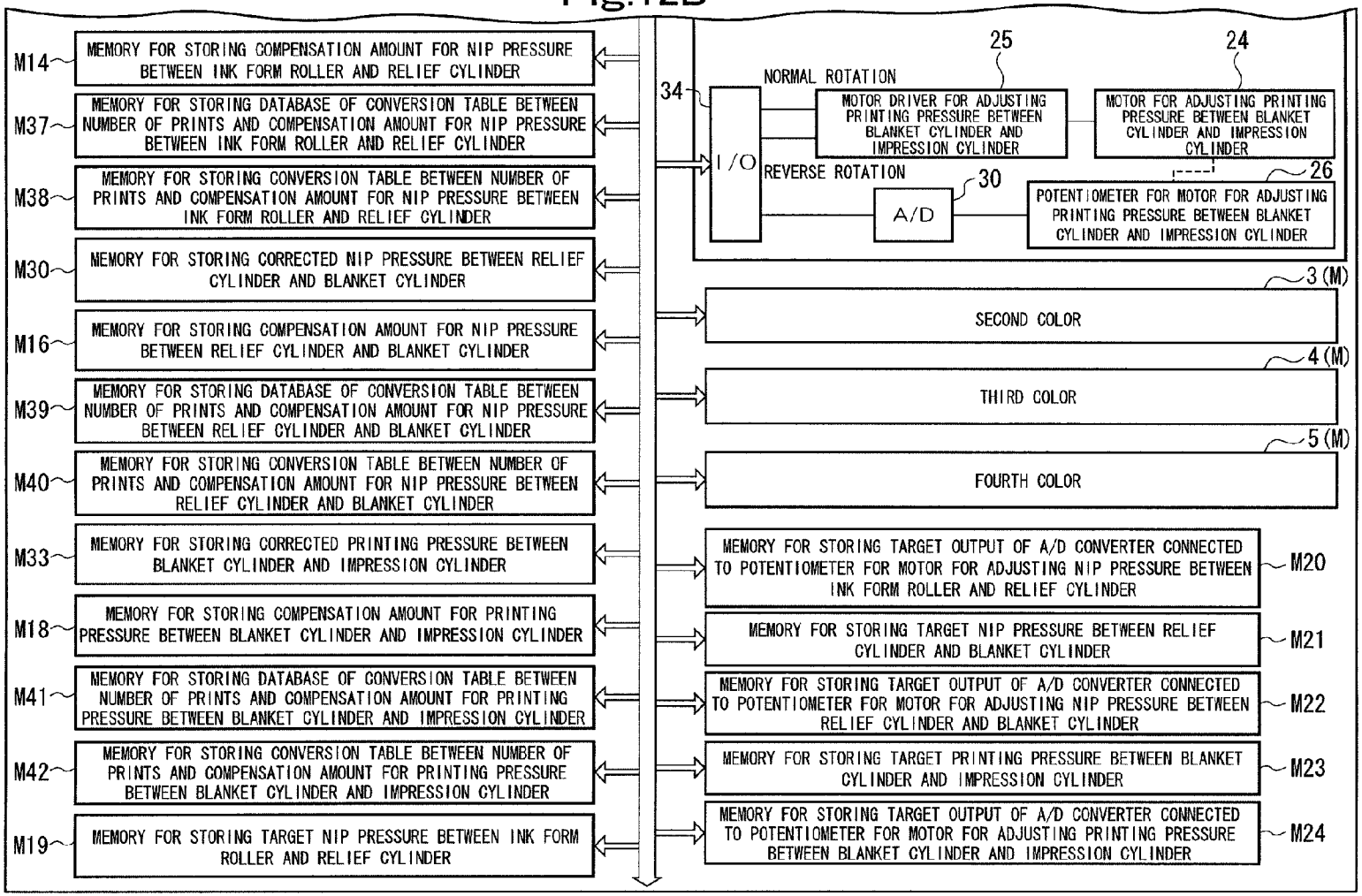
FIG. 12B shows a hardware block diagram continued from FIG. 12A.
Figure 13A:
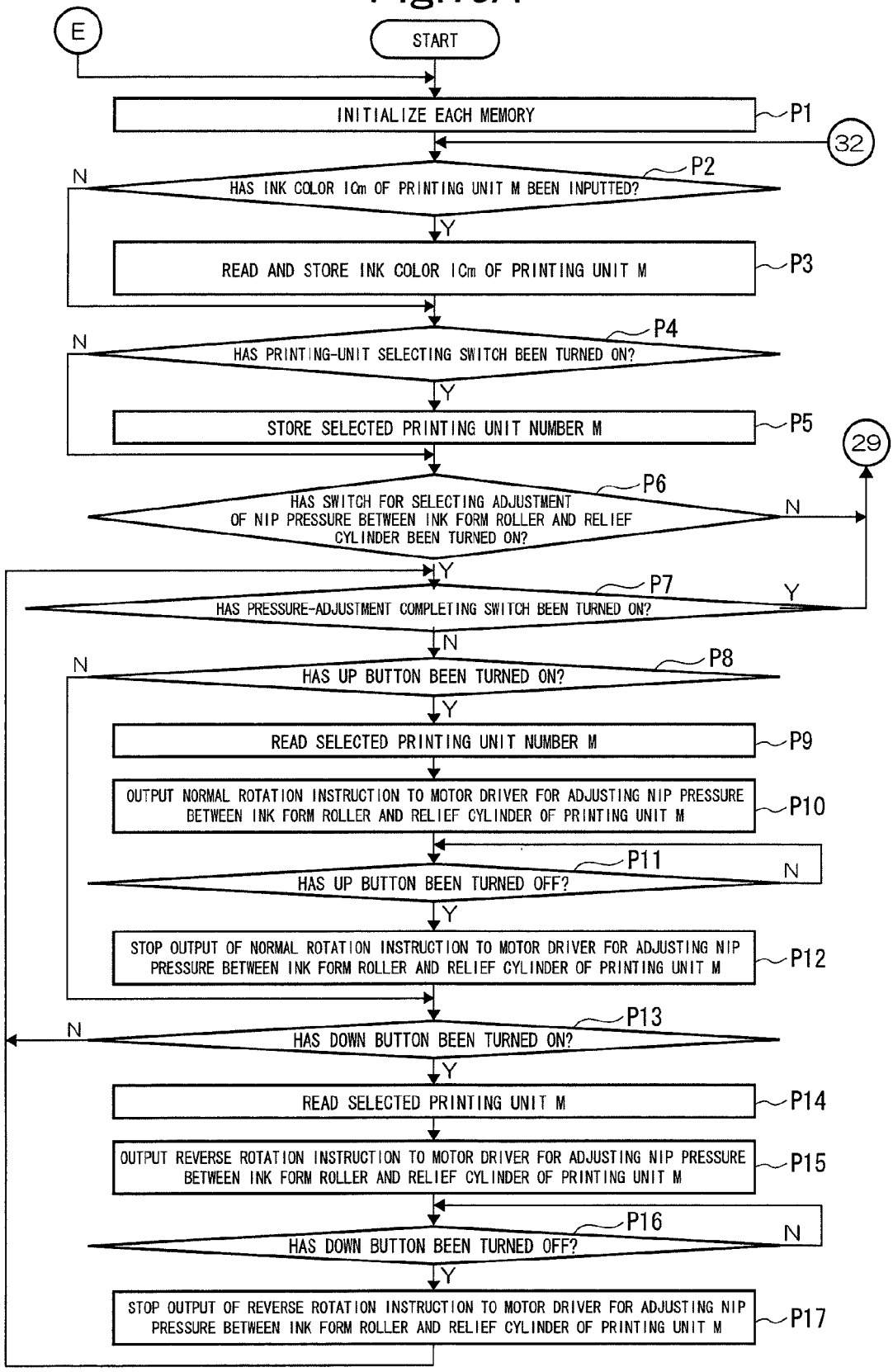
FIG. 13A shows an operational flowchart of the contact-pressure adjusting system for a liquid application machine according to the third embodiment of the present invention.
Figure 13B:
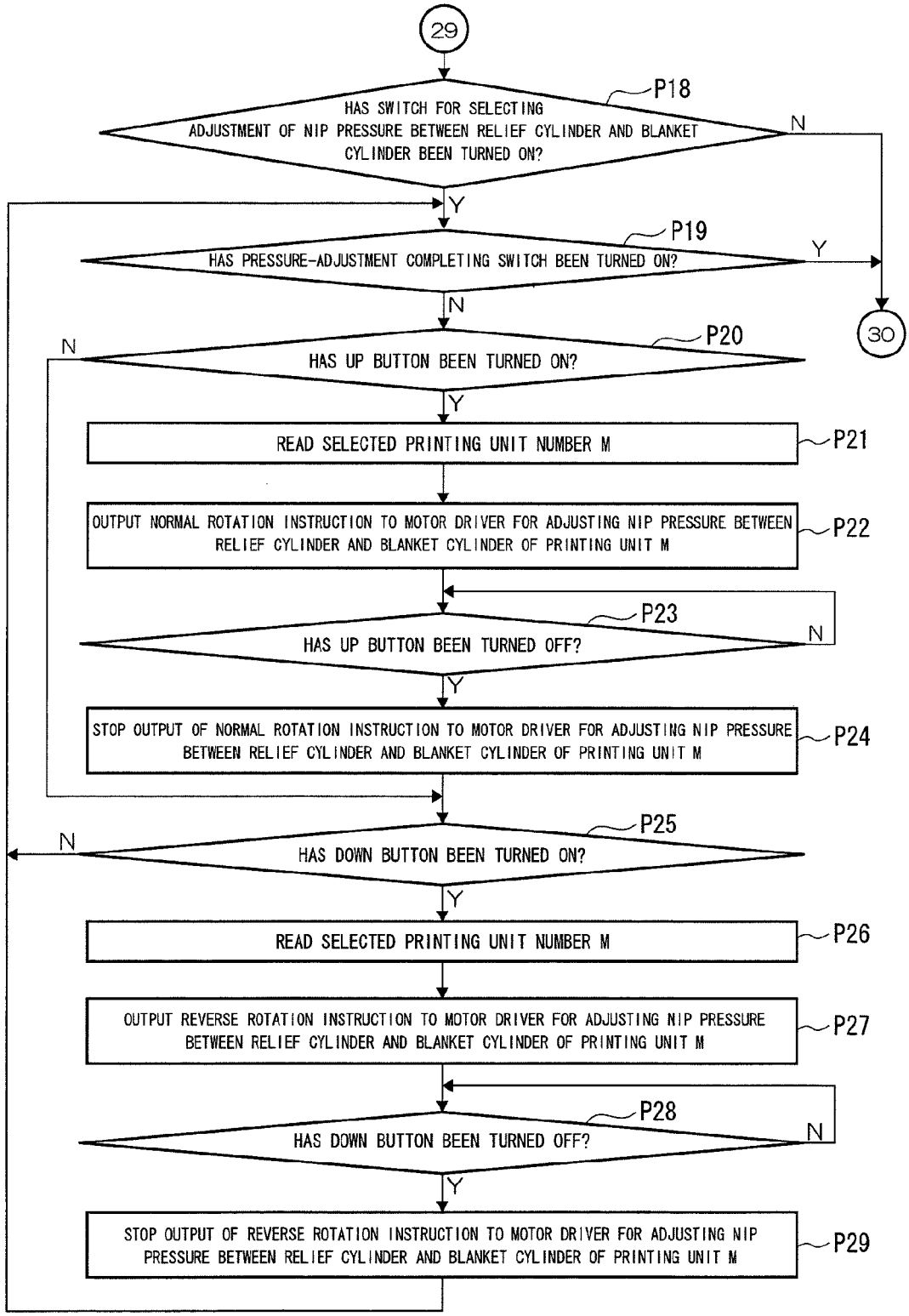
FIG. 13B shows an operational flowchart subsequent to that of FIG. 13A.
Figure 13C:
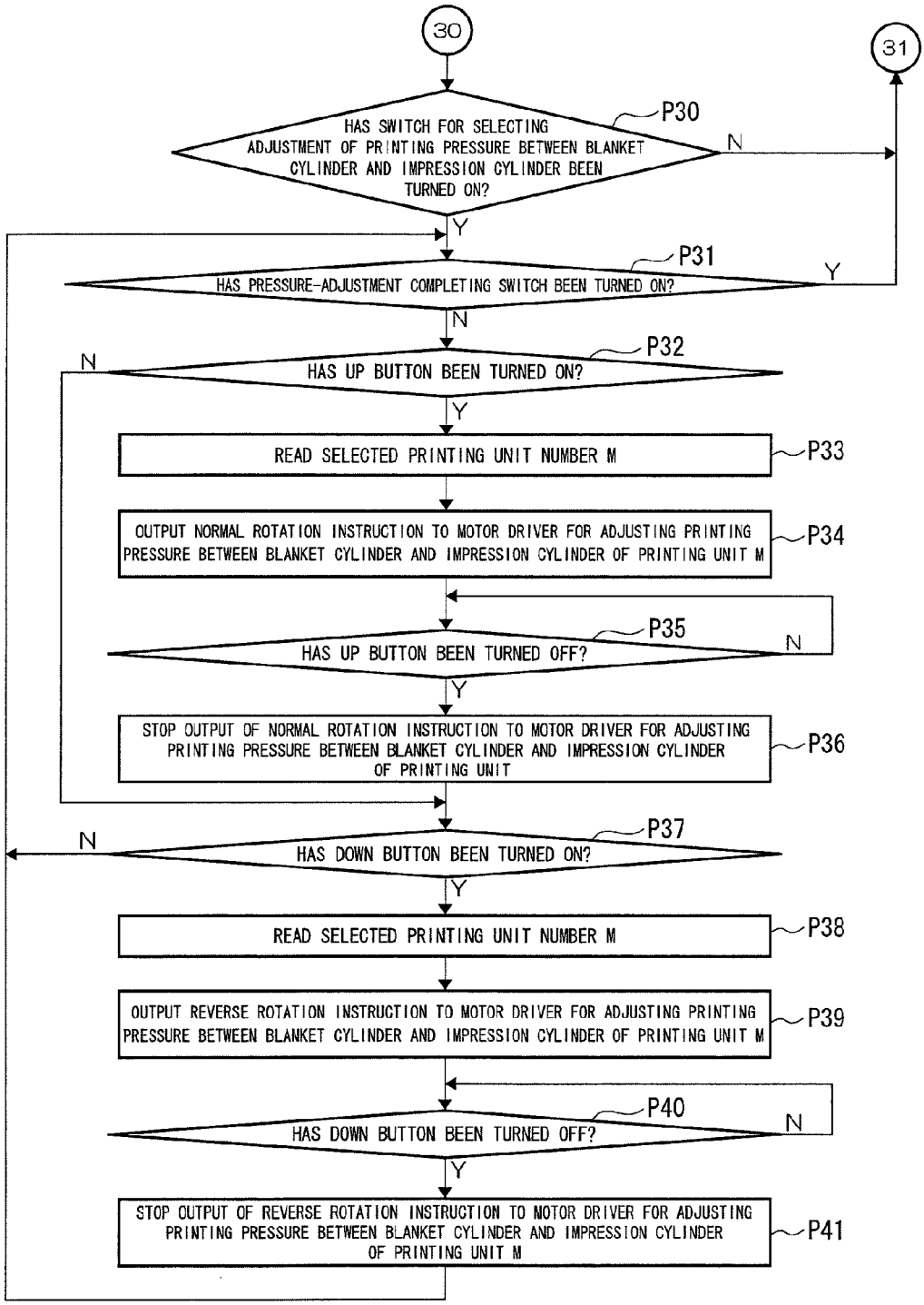
FIG. 13C shows an operational flowchart subsequent to that of FIG. 13B.
Figure 13D:
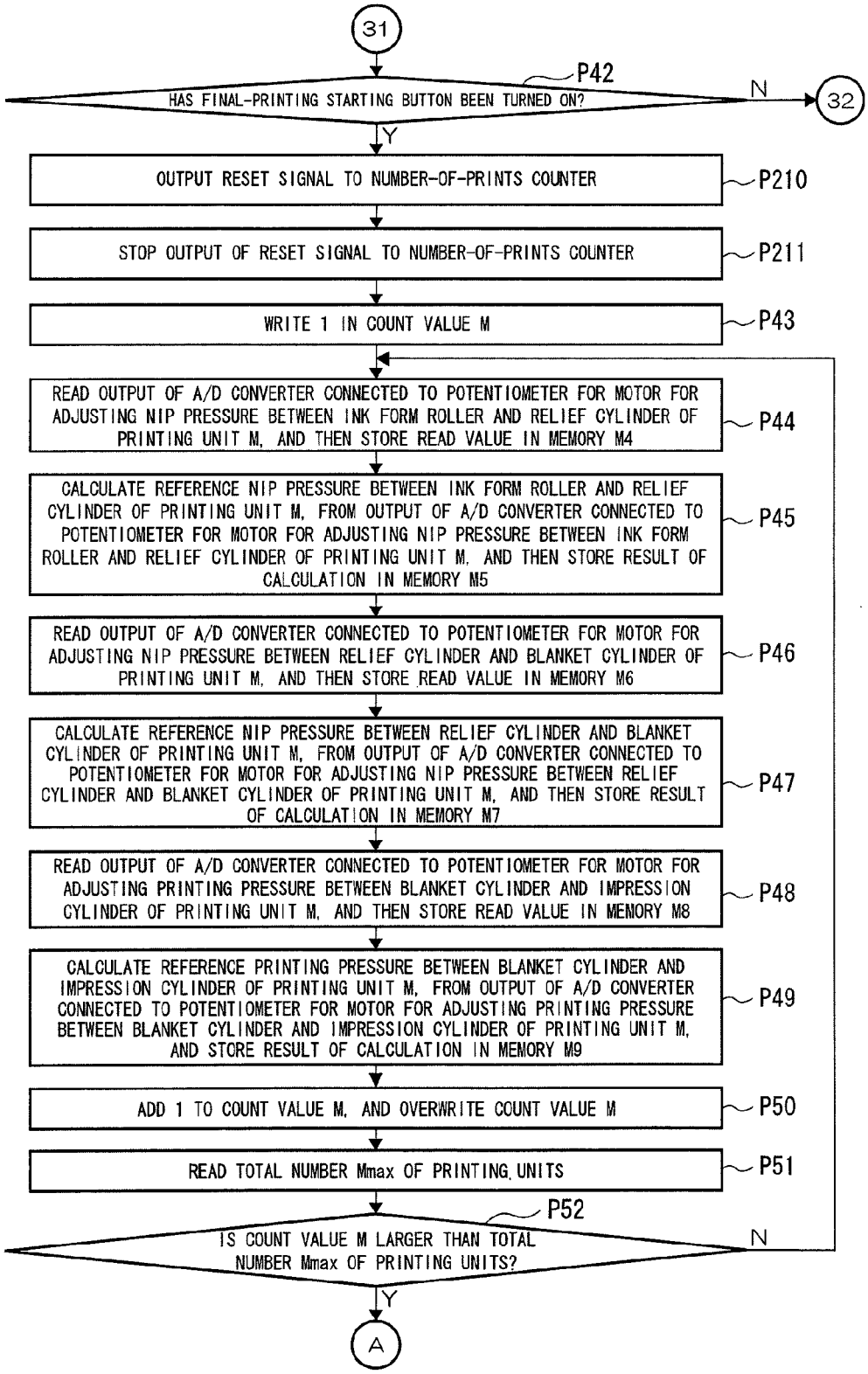
FIG. 13D shows an operational flowchart subsequent to that of FIG. 13C.
Figure 14A:
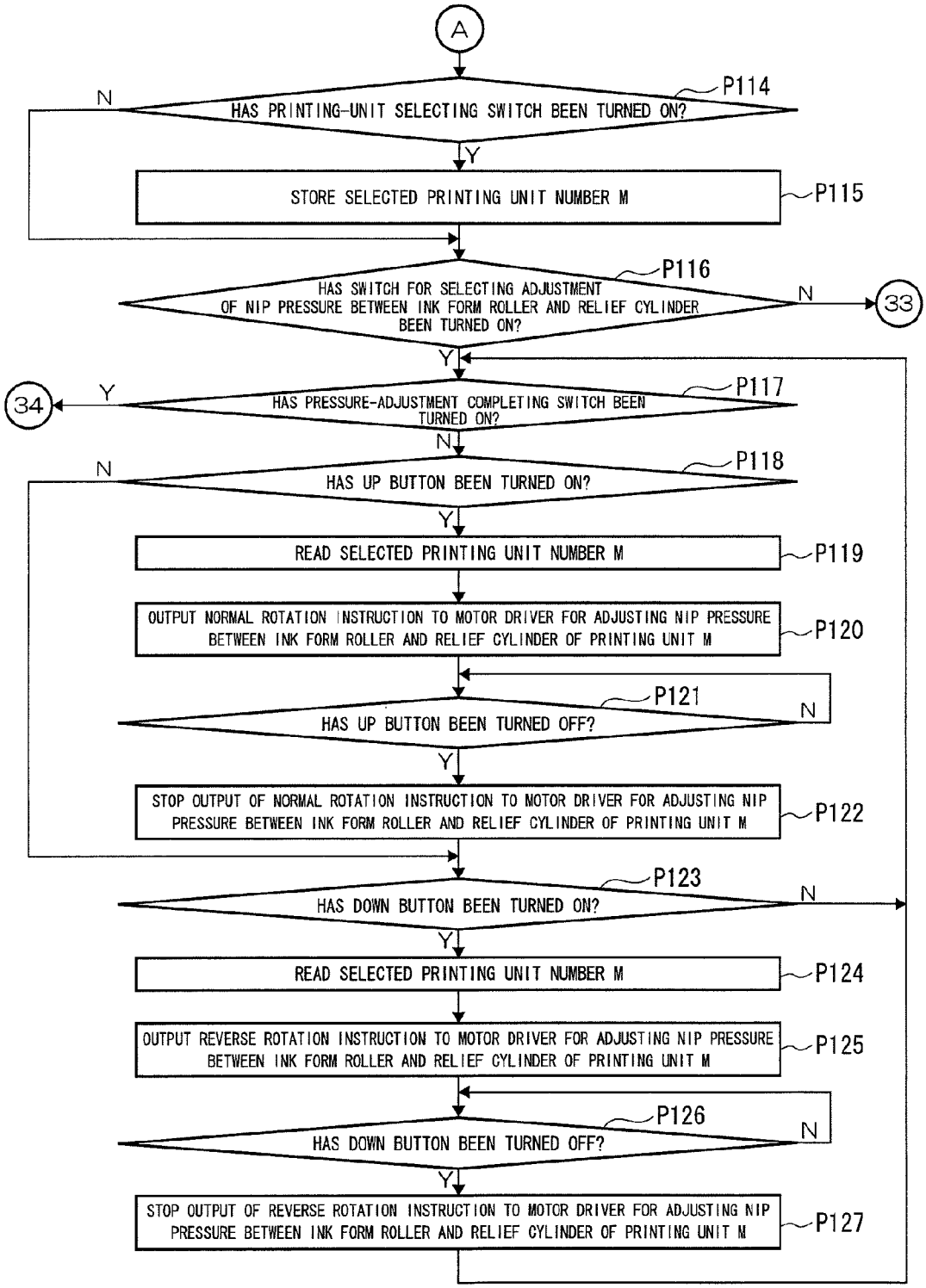
FIG. 14A shows an operational flowchart subsequent to that of FIG. 13D.
Figure 14B:
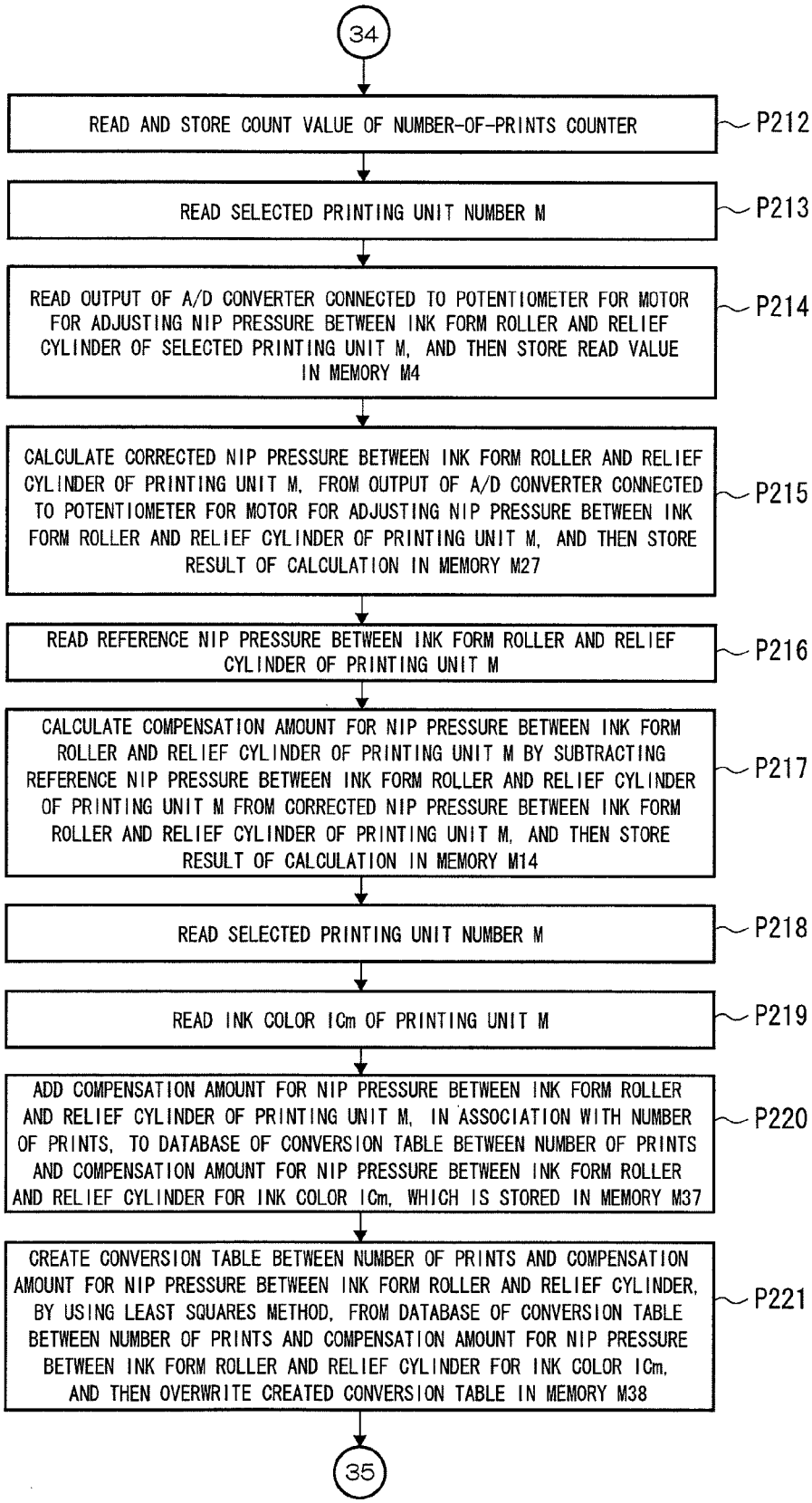
FIG. 14B shows an operational flowchart subsequent to that of FIG. 14A.
Figure 14C:
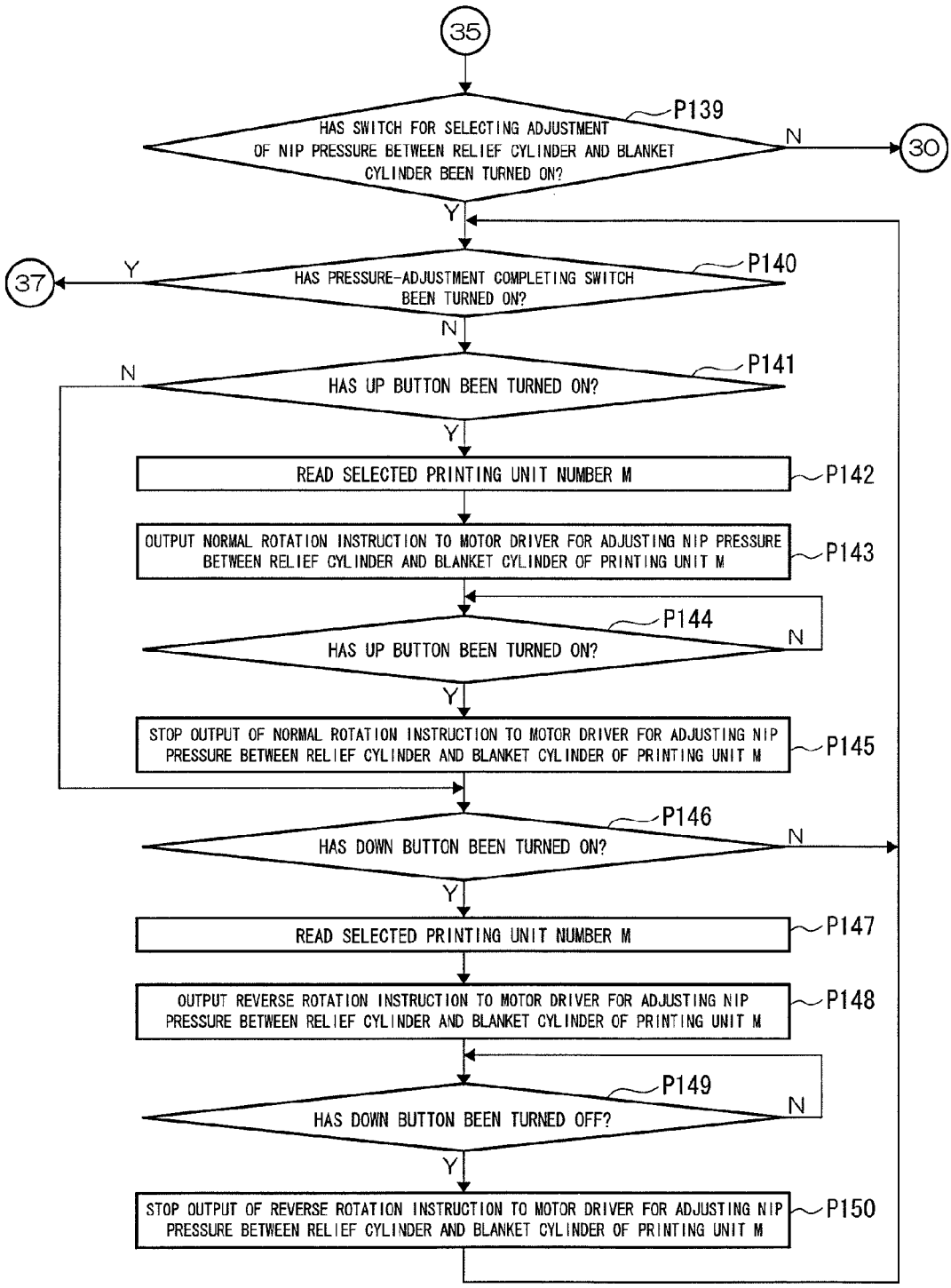
FIG. 14C shows an operational flowchart subsequent to that of FIG. 14B.
Figure 14D:
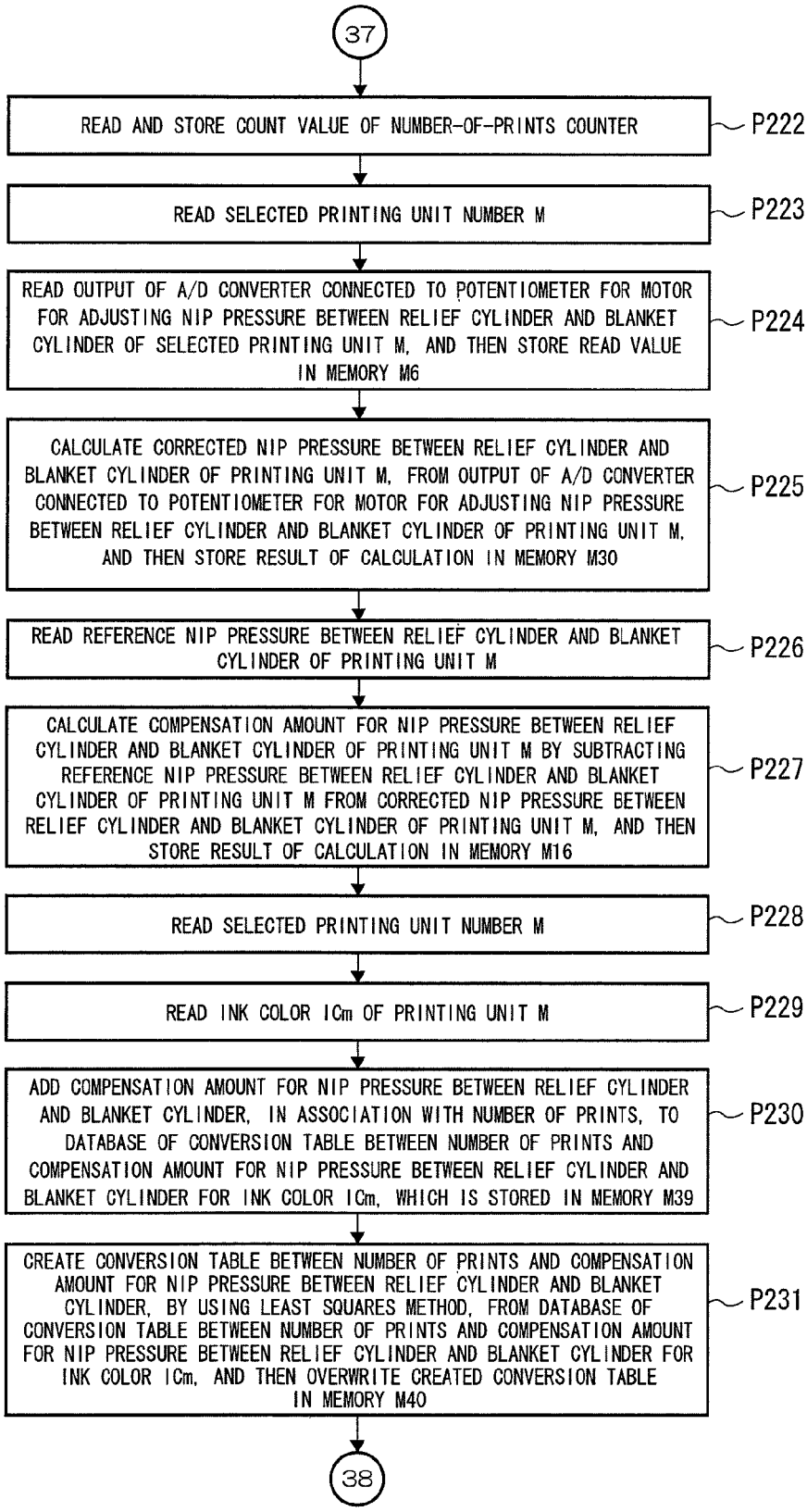
FIG. 14D shows an operational flowchart subsequent to that of FIG. 14C.
Figure 14E:
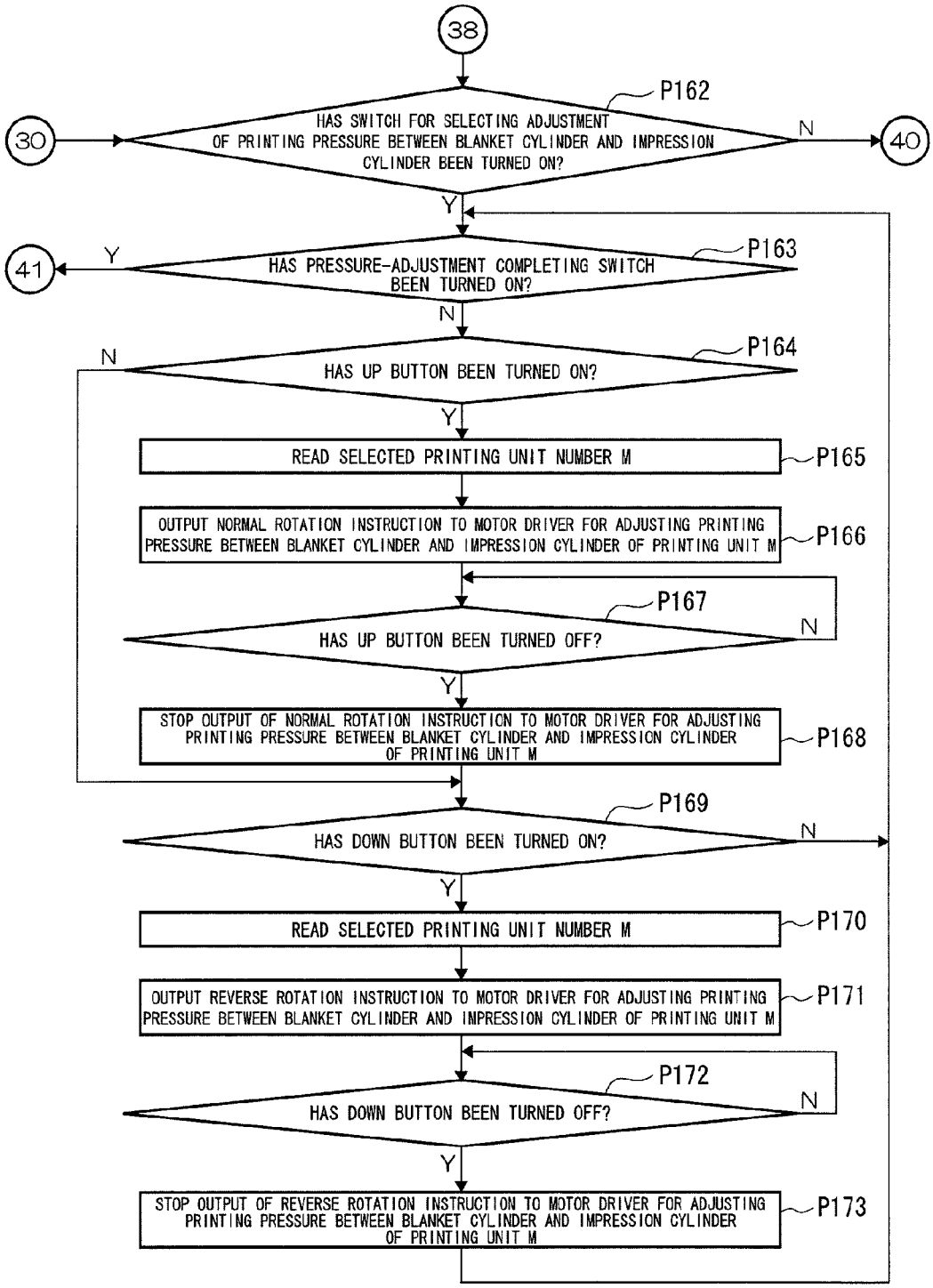
FIG. 14E shows an operational flowchart subsequent to that of FIG. 14D.
Figure 14F:
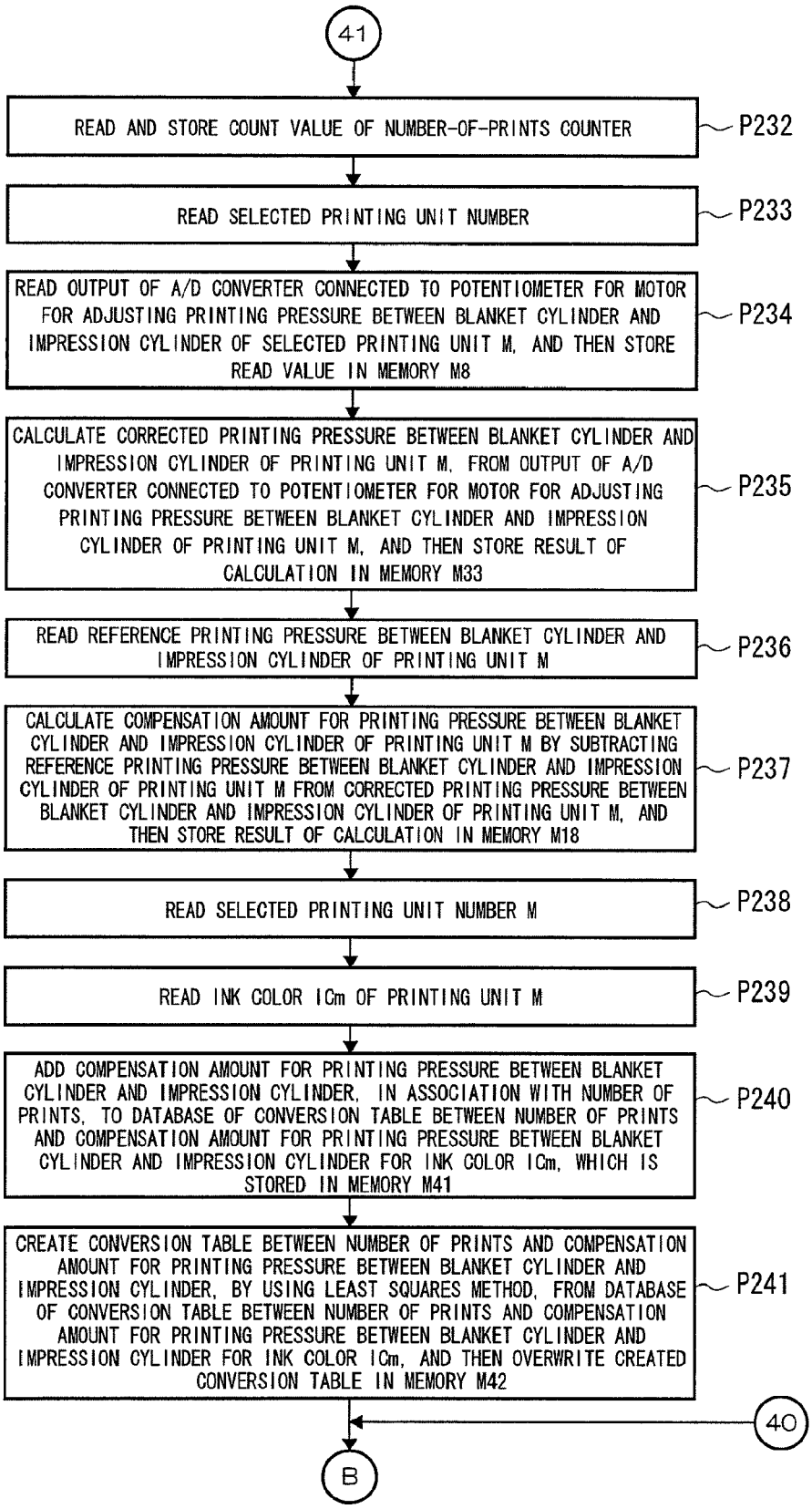
FIG. 14F shows an operational flowchart subsequent to that of FIG. 14E.
Figure 15A:
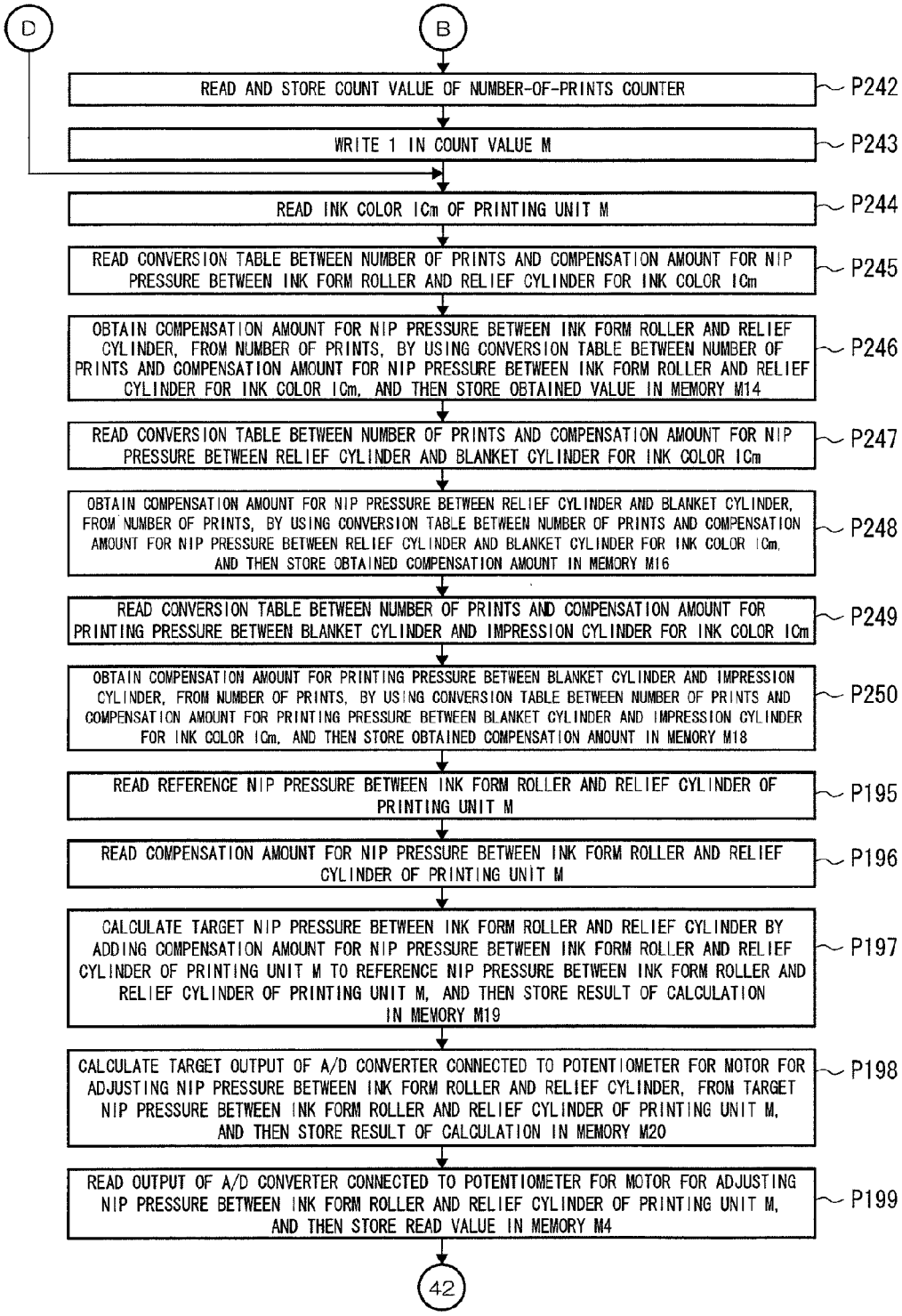
FIG. 15A shows an operational flowchart subsequent to that of FIG. 14F.
Figure 15B:
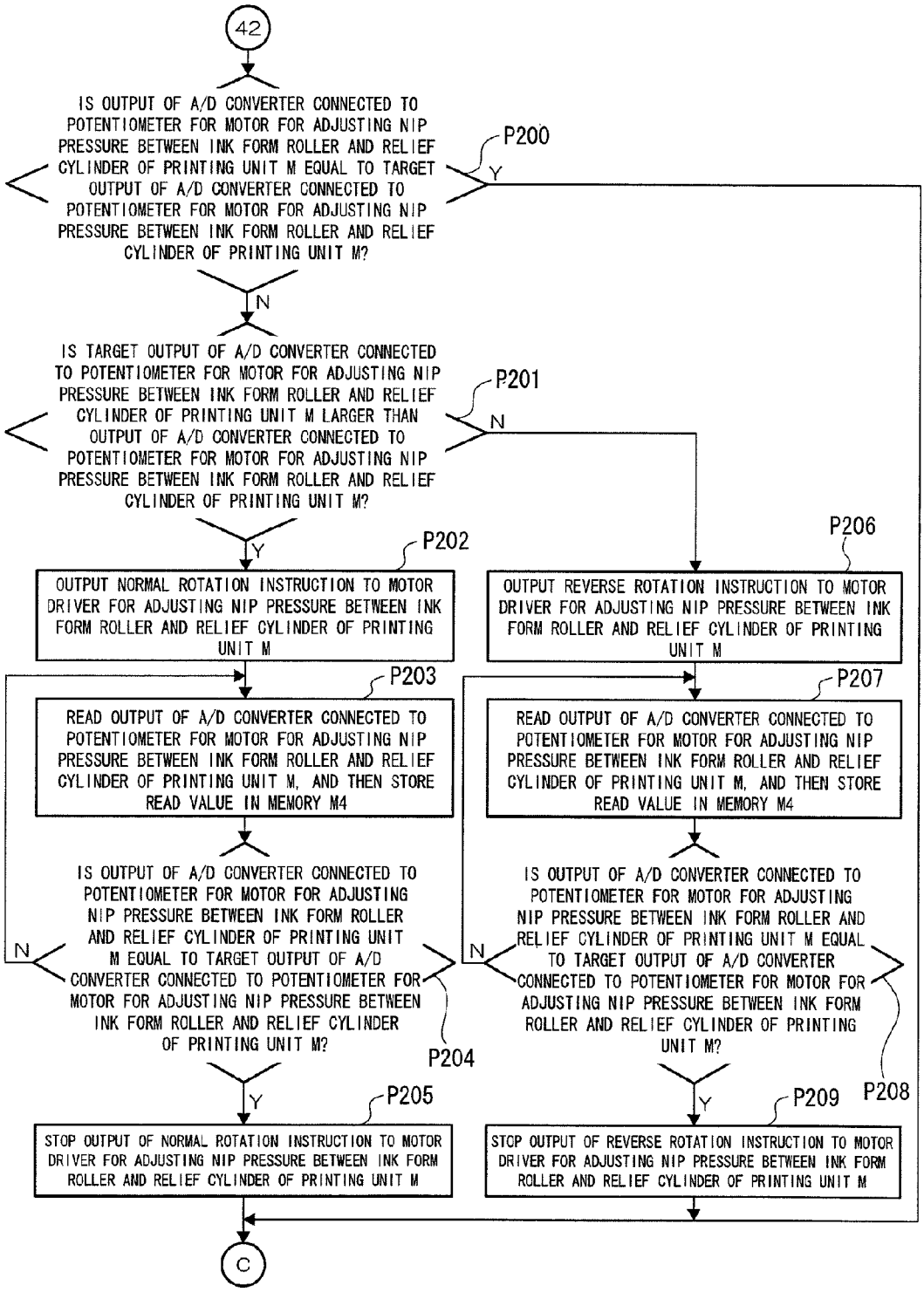
FIG. 15B shows an operational flowchart subsequent to that of FIG. 15A.
Figure 16A:
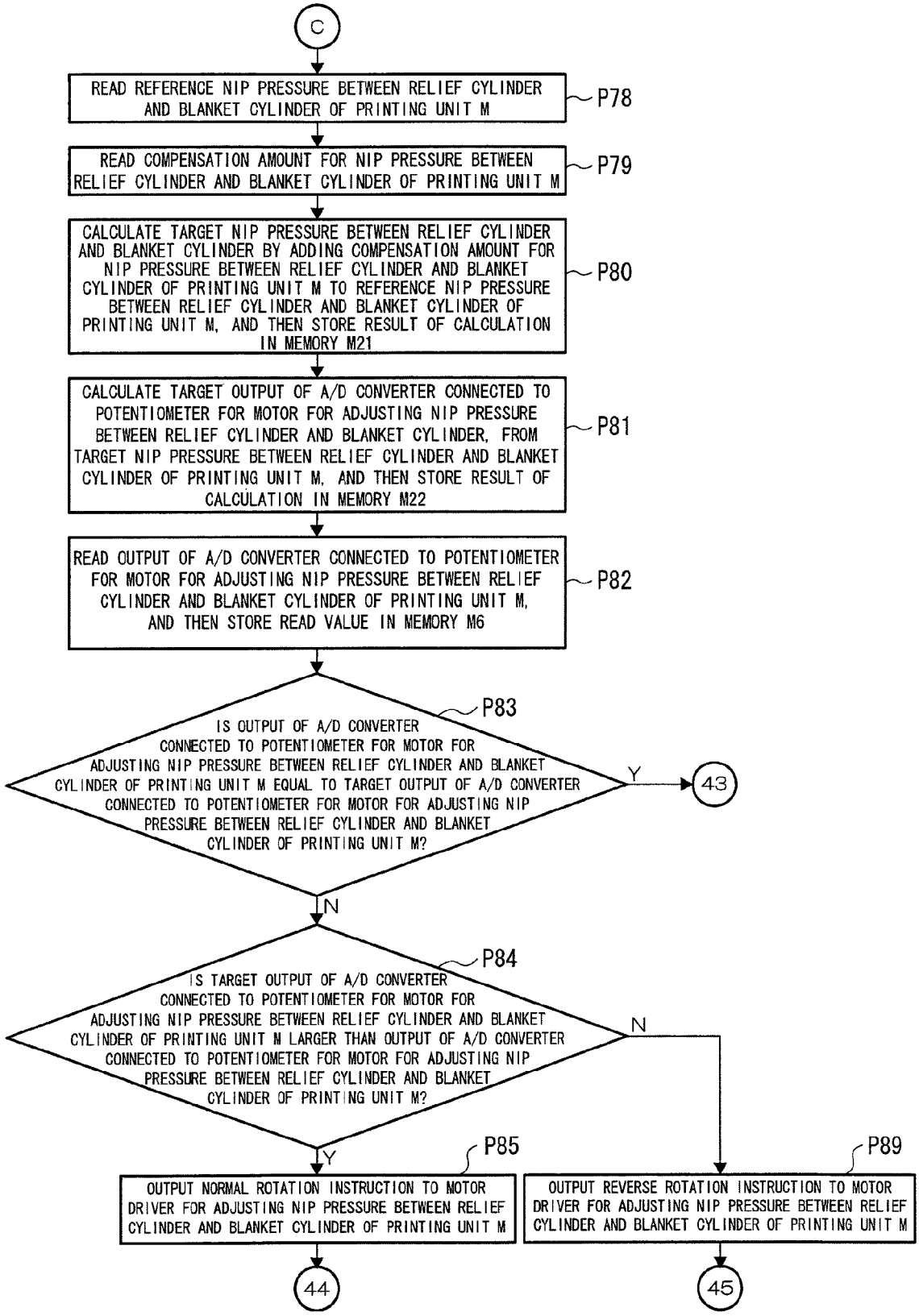
FIG. 16A shows an operational flowchart subsequent to that of FIG. 15B.
Figure 16B:
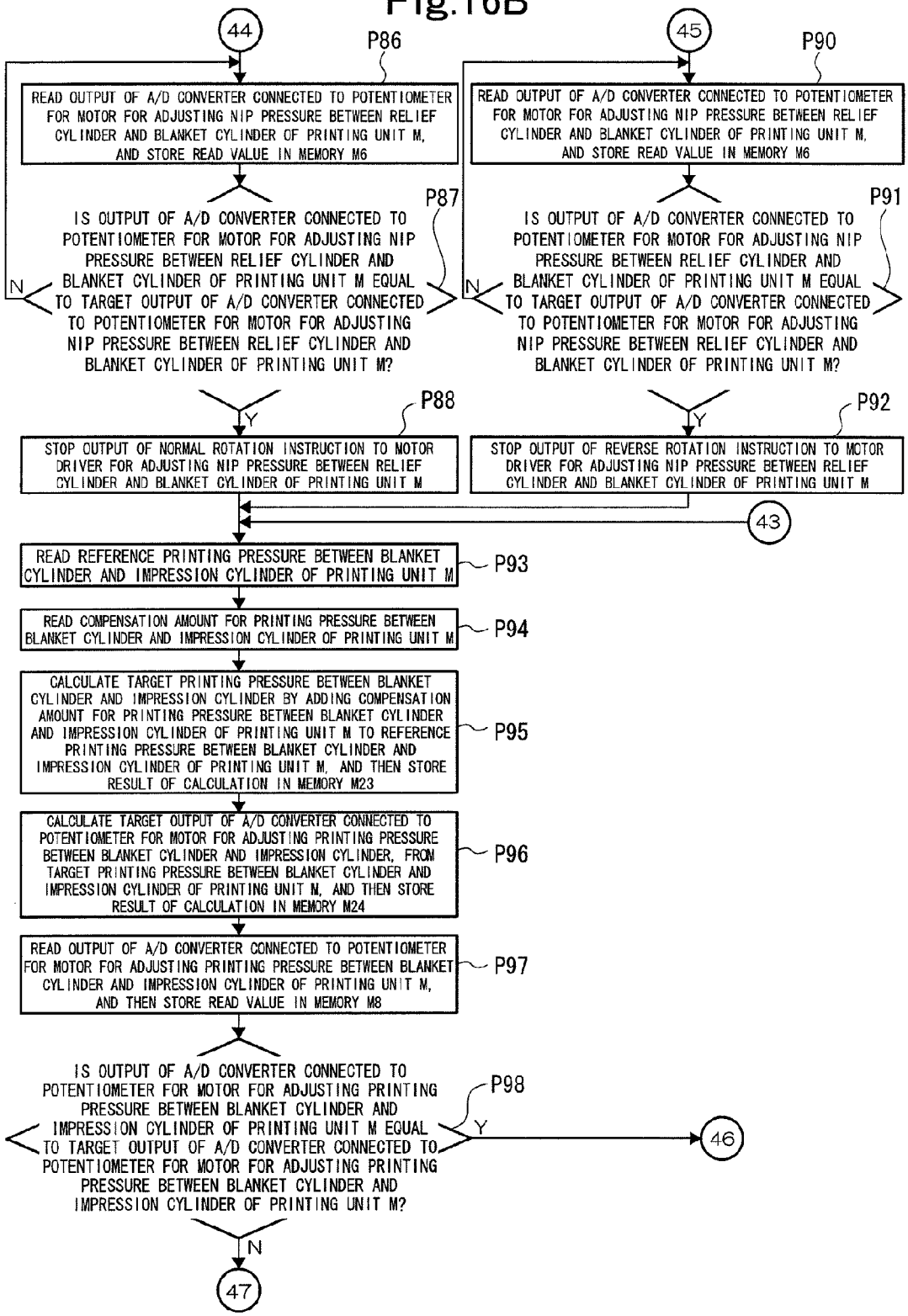
FIG. 16B shows an operational flowchart subsequent to that of FIG. 16A.
Figure 16C:
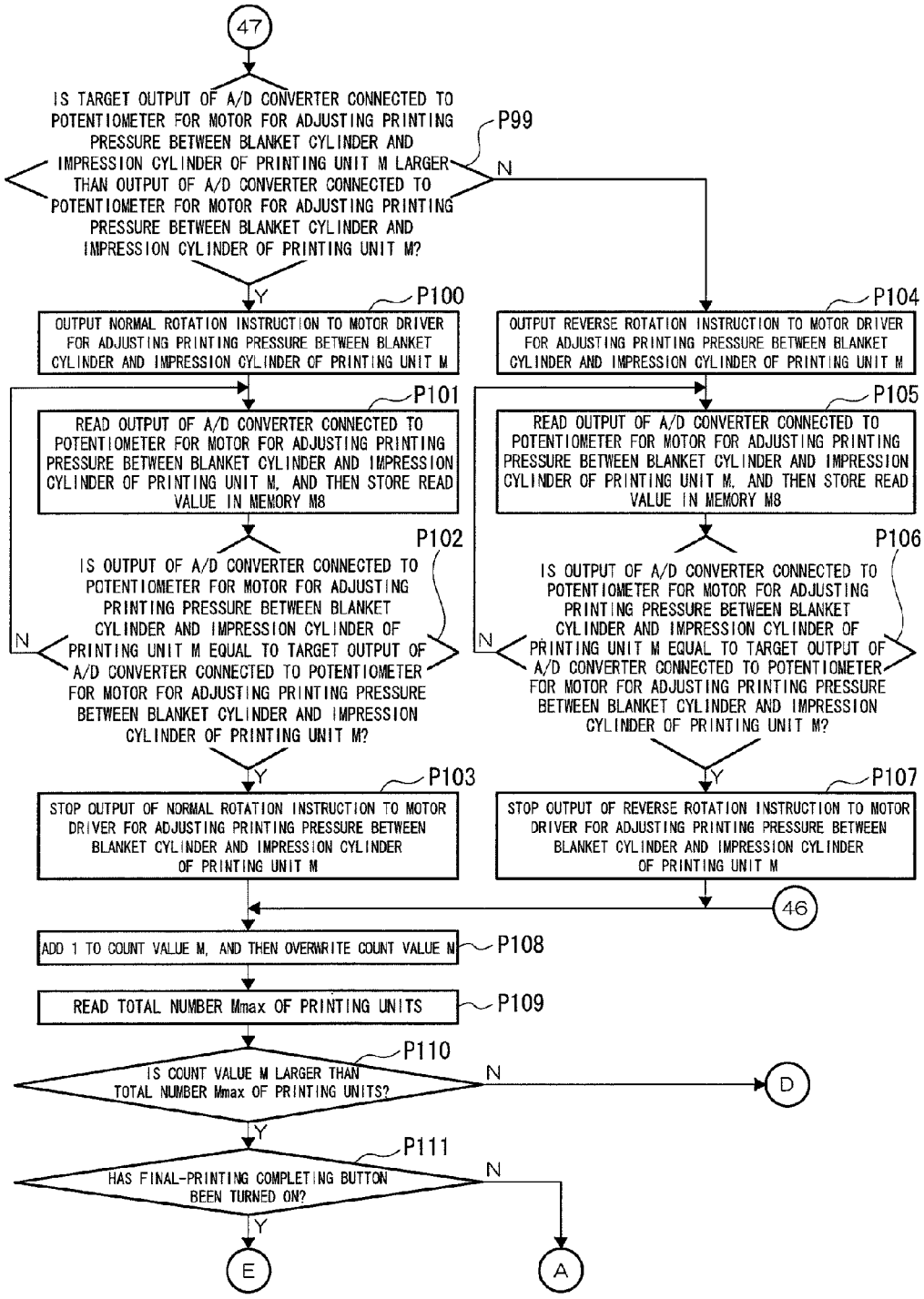
FIG. 16C shows an operational flowchart subsequent to that of FIG. 16B.

Next, a description will be given of the contact-pressure adjusting system for a liquid application machine according to the third embodiment of the present invention. FIGS. 12A and 12B show hardware block diagrams of the contact-pressure adjusting system for a liquid application machine according to the third embodiment of the present invention. As shown in FIGS. 12A and 12B, the contact-pressure adjusting system 1 for a liquid application machine includes a CPU 10, a RAM 11, a ROM 12, an input device 13, a display device 14, an output device (an FD drive, a printer or the like) 15, I/O (input/output) interfaces 16 and 40, a printing-press reference-position rotation detector 38, a counter 39 for counting the number of prints (hereinafter, referred to as a number-of-prints counter 39). The number-of-prints counter 39 counts count signals each generated by the printing-press reference-position rotation detector 38, which is mounted on the rotating shaft of the relief cylinder 101 for example, each time when one printing product is made by the printing press, so that the number of prints after the start of printing by the printing press is counted.

In addition, the printing unit M includes a motor 18 for adjusting the nip pressure between the ink form roller 100 and the relief cylinder 101, a motor driver 19 for adjusting the nip pressure between the ink form roller 100 and the relief cylinder 101, a potentiometer 20 for the motor for adjusting the nip pressure between the ink form roller 100 and the relief cylinder 101, a motor 21 for adjusting the nip pressure between the relief cylinder 101 and the blanket cylinder 102, a motor driver 22 for adjusting the nip pressure between the relief cylinder 101 and the blanket cylinder 102, a potentiometer 23 for the motor for adjusting the nip pressure between the relief cylinder 101 and the blanket cylinder 102, a motor 24 for adjusting the printing pressure between the blanket cylinder 102 and the impression cylinder 103, a motor driver 25 for adjusting the printing pressure between the blanket cylinder 102 and the impression cylinder 103, a potentiometer 26 for the motor for adjusting the printing pressure between the blanket cylinder 102 and the impression cylinder 103, A/D (analog/digital) converters 28 to 30, I/O (input/output) interfaces 32 to 34.

In the printing press according to the present embodiment, inks of four colors are used. Accordingly, each of a printing unit 2 of the first color (for example, black), a printing unit 3 of the second color (for example, cyan), a printing unit 4 of the third color (for example, magenta), and a printing unit 5 of the fourth color (for example, yellow) includes the motor 18 for adjusting the nip pressure between the ink form roller 100 and the relief cylinder 101, the motor driver 19 for adjusting the nip pressure between the ink form roller 100 and the relief cylinder 101, the potentiometer 20 for the motor for adjusting the nip pressure between the ink form roller 100 and the relief cylinder 101, the motor 21 for adjusting the nip pressure between the relief cylinder 101 and the blanket cylinder 102, the motor driver 22 for adjusting the nip pressure between the relief cylinder 101 and the blanket cylinder 102, the potentiometer 23 for the motor for adjusting the nip pressure between the relief cylinder 101 and the blanket cylinder 102, the motor 24 for adjusting the printing pressure between the blanket cylinder 102 and the impression cylinder 103, the motor driver 25 for adjusting the printing pressure between the blanket cylinder 102 and the impression cylinder 103, the potentiometer 26 for the motor for adjusting the printing pressure between the blanket cylinder 102 and the impression cylinder 103, the A/D (analog/digital) converters 28 to 30, I/O (input/output) interfaces 32 to 34. Although the inks of four colors are used in the present embodiment, the number of colors of inks to be used may be increased or decreased by increasing or decreasing the number of printing units.

Moreover, the contact-pressure adjusting system 1 includes memories M1 to M10, M14, M16, M18 to M24, M27, M30, M33, and M36 to M42. In the memory M1, an ink color ICm of the printing unit M is stored. In the memory M2, a selected printing unit number is stored. In the memory M3, a count value M is stored. In the memory M4, an output of the A/D converter connected to the potentiometer 20 for the motor for adjusting the nip pressure between the ink form roller 100 and the relief cylinder 101 is stored. In the memory M5, a reference nip pressure between the ink form roller 100 and the relief cylinder 101 is stored. In the memory M6, an output of the A/D converter connected to the potentiometer 23 for the motor for adjusting the nip pressure between the relief cylinder 101 and the blanket cylinder 102 is stored. In the memory M7, a reference nip pressure between the relief cylinder 101 and the blanket cylinder 102. In the memory M8, an output of the A/D converter connected to the potentiometer 26 for the motor for adjusting the printing pressure between the blanket cylinder 102 and the impression cylinder 103 is stored. In the memory M9, a reference printing pressure between the blanket cylinder 102 and the impression cylinder 103 is stored. In the memory M1, the total number Mmax of printing units is stored. In the memory M14, a compensation amount for the nip pressure between the ink form roller 100 and the relief cylinder 101 is stored. In the memory M16, a compensation amount for the nip pressure between the relief cylinder 101 and the blanket cylinder 102 is stored. In the memory M18, a compensation amount for the printing pressure between the blanket cylinder 102 and the impression cylinder 103 is stored. In the memory M19, a target nip pressure between the ink form roller 100 and the relief cylinder 101 is stored. In the memory M20, a target output of the A/D converter connected to the potentiometer 20 for the motor for adjusting the nip pressure between the ink form roller 100 and the relief cylinder 101 is stored. In the memory M21, a target nip pressure between the relief cylinder 101 and the blanket cylinder 102 is stored. In the memory M22, a target output of the A/D converter connected to the potentiometer 23 for the motor for adjusting the nip pressure between the relief cylinder 101 and the blanket cylinder 102 is stored. In the memory M23, a target printing pressure between the blanket cylinder 102 and the impression cylinder 103 is stored. In the memory M24, a target output of the A/D converter connected to the potentiometer 26 for the motor for adjusting the printing pressure between the blanket cylinder 102 and the impression cylinder 103 is stored. In the memory M27, a corrected nip pressure between the ink form roller 100 and the relief cylinder 101 is stored. In the memory M30, a corrected nip pressure between the relief cylinder 101 and the blanket cylinder 102. In the memory M33, a corrected printing pressure between the blanket cylinder 102 and the impression cylinder 103 is stored. In the memory M36, a count value of the number-of-prints counter 39 is stored. In the memory M37, a database of a conversion table between the number of prints and the compensation amount for the nip pressure between the ink form roller 100 and the relief cylinder 101 is stored. In the memory M38, a conversion table between the number of prints and the compensation amount for the nip pressure between the ink form roller 100 and the relief cylinder 101 is stored. In the memory M39, a database of a conversion table between the number of prints and the compensation amount for the nip pressure between the relief cylinder 101 and the blanket cylinder 102 is stored. In the memory M40, a conversion table between the number of prints and the compensation amount for the nip pressure between the relief cylinder 101 and the blanket cylinder 102 is stored. In the memory M41, a database of a conversion table between the number of prints and the compensation amount for the printing pressure between the blanket cylinder 102 and the impression cylinder 103 is stored. In the memory M42, a conversion table between the number of prints and the compensation amount for the printing pressure between the blanket cylinder 101 and the impression cylinder 103 is stored.

The CPU 10 obtains various kings of information which are inputted thereto via the I/O interfaces 16, 32 to 34, and 40, and operates in accordance with a program stored in the ROM 12, while accessing the RAM 11 as well as the memories M1 to M10, M14, M16, M18, M19 to M24, M27, M30, M33, and M36 to M42. The input device 13 is provided with various kinds of input devices including an input unit of the ink color ICm of the printing unit M, a printing-unit selecting switch, a switch for selecting the adjustment of the nip pressure between the ink form roller 100 and the relief cylinder 101, a pressure-adjustment completing switch, an up button, a down button, a switch for selecting the adjustment of the nip pressure between the relief cylinder 101 and the blanket cylinder 102, a switch for selecting the adjustment of the printing pressure between the blanket cylinder 102 and the impression cylinder 103, a final-printing starting button, and a final-printing completing button.

Next, the operation of the contact-pressure adjusting system for a liquid application machine according to the third embodiment of the present invention will be described. Each of FIGS. 13A to 13D, 14A to 14F, 15A and 15B, and 16A to 16C shows an operational flowchart of the contact-pressure adjusting system 1 for a liquid application machine according to the third embodiment of the present invention. Hereinafter, the content of the processing of each step will be described.

Since the processing from Step P1 to Step P41 is the same as that of the second embodiment, a description thereof will be omitted.

In Step P42, the CPU 10 determines whether or not the final-printing starting button, which is provided to the input device 13, has been turned ON by the operator. When the final-printing starting button has been turned ON, the CPU 10 executes Step P210. On the other hand, when the final-printing starting button has not been turned ON, the CPU 10 executes Step 2.

In Step P210, the CPU 10 outputs a reset signal to the number-of-prints counter 39. Upon completion of the processing of Step P210, the CPU 10 executes Step P211.

In Step P211, the CPU 10 stops the output of the reset signal to the number-of-prints counter 39. Upon completion of the processing of Step P211, the CPU 10 executes Step P43.

Since the processing from Step p43 to Step p52, and the processing from Step P114 to Step P116, are the same as those of the second embodiment, a description thereof will be omitted.

In Step P117, the CPU 10 determines whether or not the pressure-adjustment completing switch, which is provided to the input device 13, has been turned ON by the operator. When the pressure-adjustment completing switch has been turned ON, the CPU 10 skips Steps P118 to P127, and then executes Step P212. On the other hand, when the pressure-adjustment completing switch has not been turned ON, the CPU 10 executes Step P118.

Since the processing from Step P118 to Step P127 is the same as that of the second embodiment, a description thereof will be omitted.

In Step P212, the CPU 10 reads the count value of the number-of-prints counter 39, and then stores the read value in the memory M36. Upon completion of the processing of Step P212, the CPU 10 executes Step P213.

In Step P213, the CPU 10 reads the selected printing unit number M, which is stored in the memory M2. Upon completion of the processing of Step P213, the CPU 10 executes Step P214.

In Step P214, the CPU 10 reads the output of the A/D converter connected to the potentiometer 20 for the motor for adjusting the nip pressure between the ink form roller and the relief cylinder of the selected printing unit M. The CPU 10 then stores the read value in the memory M4. Upon completion of the processing of Step P214, the CPU 10 executes Step P215.

In Step P215, the CPU 10 calculates a corrected nip pressure between the ink form roller and the relief cylinder of the printing unit M, from the output of the A/D converter connected to the potentiometer 20 for the motor for adjusting the nip pressure between the ink form roller and the relief cylinder of the printing unit M, which is stored in the memory M4. The CPU 10 then stores the result of the calculation in the memory M27. Upon completion of the processing of Step P215, the CPU 10 executes Step P216.

In Step P216, the CPU 10 reads the reference nip pressure between the ink form roller and the relief cylinder of the printing unit M, which is stored in the memory M5. Upon completion of the processing of Step P216, the CPU 10 executes Step P217.

In Step P217, the CPU 10 calculates a compensation amount for the nip pressure between the ink form roller and the relief cylinder of the printing unit M by subtracting the reference nip pressure between the ink form roller and the relief cylinder of the printing unit M from the corrected nip pressure between the ink form roller and the relief cylinder of the printing unit M. The CPU 10 then stores the result of the calculation in the memory M14. Upon completion of the processing of Step P217, the CPU 10 executes Step P218.

In Step P218, the CPU 10 reads the selected printing unit number M, which is stored in the memory M2. Upon completion of the processing of Step P218, the CPU 10 executes Step P219.

In Step P219, the CPU 10 reads the ink color ICm of the printing unit M, which is stored in the memory M1. Upon completion of the processing of Step P219, the CPU 10 executes Step P220.

In Step P220, the CPU 10 adds the compensation amount for the nip pressure between the ink form roller and the relief cylinder, in association with the number of prints, to the database of a conversion table between the number of prints and the compensation amount for the nip pressure between the ink form roller and the relief cylinder for the ink color ICm, which is stored in the memory M37. Upon completion of the processing of Step P220, the CPU 10 executes Step P221.

In Step P221, the CPU 10 creates a conversion table between the number of prints and the compensation amount for the nip pressure between the ink form roller and the relief cylinder, by using the least squares method, from the database of a conversion table between the number of prints and the compensation amount for the nip pressure between the ink form roller and the relief cylinder for the ink color ICm. The CPU 10 then overwrites the created conversion table in the memory M38. Upon completion of the processing of Step P221, the CPU 10 executes Step P139.

In Step P139, the CPU 10 determines whether or not the switch for selecting the adjustment of the nip pressure between the relief cylinder and the blanket cylinder, which switch is provided to the input device 13, has been turned ON by the operator. When the switch for selecting the adjustment of the nip pressure between the relief cylinder and the blanket cylinder has been turned ON, the CPU 10 executes Step P140. On the other hand, when the switch for selecting the adjustment of the nip pressure between the relief cylinder and the blanket cylinder has not been turned ON, the CPU 10 skips Steps P140 to P150 and Steps P222 to P231, and then executes Step P162.

In Step P140, the CPU 10 determines whether or not the pressure-adjustment completing switch, which is provided to the input device 13, has been turned ON by the operator. When the pressure-adjustment completing switch has been turned ON, the CPU 10 skips Steps P141 to P150, and then executes Step P222. On the other hand, when the pressure-adjustment completing switch has not been turned ON, the CPU 10 executes Step P141.

Since the processing from Step P141 to Step P150 is the same as that of the second embodiment, a description thereof will be omitted.

In Step P222, the CPU 10 reads the count value of the number-of-prints counter 39, and then stores the read value in the memory M36. Upon completion of the processing of Step P222, the CPU 10 executes Step P223.

In Step P223, the CPU 10 reads the selected printing unit number M, which is stored in the memory M2. Upon completion of the processing of Step P223, the CPU 10 executes Step P224.

In Step P224, the CPU 10 reads the output of the A/D converter connected to the potentiometer 23 for the motor for adjusting the nip pressure between the relief cylinder and the blanket cylinder of the selected printing unit M. The CPU 10 then stores the read value in the memory M6. Upon completion of the processing of Step P224, the CPU 10 executes Step P225.

In Step P225, the CPU 10 calculates a corrected nip pressure between the relief cylinder and the blanket cylinder of the printing unit M, from the output of the A/D converter connected to the potentiometer 23 for the motor for adjusting the nip pressure between the relief cylinder and the blanket cylinder of the printing unit M, which is stored in the memory M6. The CPU 10 then stores the result of the calculation in the memory M30. Upon completion of the processing of Step P225, the CPU 10 executes Step P226.

In Step P226, the CPU 10 reads the reference nip pressure between the relief cylinder and the blanket cylinder of the printing unit M, which is stored in the memory M7. Upon completion of the processing of Step P226, the CPU 10 executes Step P227.

In Step P227, the CPU 10 calculates a compensation amount for the nip pressure between the relief cylinder and the blanket cylinder of the printing unit M by subtracting the reference nip pressure between the relief cylinder and the blanket cylinder of the printing unit M from the corrected nip pressure between the relief cylinder and the blanket cylinder of the printing unit M. The CPU 10 then stores the result of the calculation in the memory M16. Upon completion of the processing of Step P227, the CPU 10 executes Step P228.

In Step P228, the CPU 10 reads the selected printing unit number M, which is stored in the memory M2. Upon completion of the processing of Step P228, the CPU 10 executes Step P229.

In Step P229, the CPU 10 reads the ink color ICm of the printing unit M, which is stored in the memory M1. Upon completion of the processing of Step P229, the CPU 10 executes Step P230.

In Step P230, the CPU 10 adds the compensation amount for the nip pressure between the relief cylinder and the blanket cylinder, in association with the number of prints, to the database of a conversion table between the number of prints and the compensation amount for the nip pressure between the relief cylinder and the blanket cylinder for the ink color ICm, which is stored in the memory M39. Upon completion of the processing of Step P230, the CPU 10 executes Step P231.

In Step P231, the CPU 10 creates a conversion table between the number of prints and the compensation amount for the nip pressure between the relief cylinder and the blanket cylinder, by using the least squares method, from the database of a conversion table between the number of prints and the compensation amount for the nip pressure between the relief cylinder and the blanket cylinder for the ink color ICm. The CPU 10 then overwrites the created conversion table in the memory M40. Upon completion of the processing of Step P231, the CPU 10 executes Step P162.

In Step P162, the CPU 10 determines whether or not the switch for selecting the adjustment of the printing pressure between the blanket cylinder and the impression cylinder, which switch is provided to the input device 13, has been turned ON by the operator. When the switch for selecting the adjustment of the printing pressure between the blanket cylinder and the impression cylinder has been turned ON, the CPU 10 executes Step P163. On the other hand, when the switch for selecting the adjustment of the printing pressure between the blanket cylinder and the impression cylinder has not been turned ON, the CPU 10 skips Steps P163 to P173 and P232 to P241, and then executes Step P242.

In Step P163, the CPU 10 determines whether or not the pressure-adjustment completing switch, which is provided to the input device 13, has been turned ON by the operator. When the pressure-adjustment completing switch has been turned ON, the CPU 10 skips Step P164 to Step P173, and then executes Step P232. On the other hand, when the pressure-adjustment completing switch has not been turned ON, the CPU 10 executes Step P164.

Since the processing from Step P164 to Step P173 is the same as that of the second embodiment, a description thereof will be omitted.

In Step P232, the CPU 10 reads the count value of the number-of-prints counter 39, and then stores the read value in the memory M36. Upon completion of the processing of Step P232, the CPU 10 executes Step P233.

In Step P233, the CPU 10 reads the selected printing unit number M, which is stored in the memory M2. Upon completion of the processing of Step P233, the CPU 10 executes P234.

In Step P234, the CPU 10 reads the output of the A/D converter connected to the potentiometer 26 for the motor for adjusting the printing pressure between the blanket cylinder and the impression cylinder of the selected printing unit M. The CPU 10 then stores the read value in the memory M8. Upon completion of the processing of Step P234, the CPU 10 executes Step P235.

In Step P235, the CPU 10 calculates a corrected printing pressure between the blanket cylinder and the impression cylinder of the printing unit M, from the output of the A/D converter connected to the potentiometer 26 for the motor for adjusting the printing pressure between the blanket cylinder and the impression cylinder of the printing unit M, which is stored in the memory M8. The CPU 10 then stores the result of the calculation in the memory M33. Upon completion of the processing of Step P235, the CPU 10 executes Step P236.

In Step P236, the CPU 10 reads the reference printing pressure between the blanket cylinder and the impression cylinder of the printing unit M, which is stored in the memory M9. Upon completion of the processing of Step P236, the CPU 10 executes Step P237.

In Step P237, the CPU 10 calculates a compensation amount for the printing pressure between the blanket cylinder and the impression cylinder of the printing unit M by subtracting the reference printing pressure between the blanket cylinder and the impression cylinder of the printing unit M from the corrected printing pressure between the blanket cylinder and the impression cylinder of the printing unit M. The CPU 10 then stores the result of the calculation in the memory M18. Upon completion of the processing of Step P237, the CPU 10 executes Step P238.

In Step P238, the CPU 10 reads the selected printing unit number M, which is stored in the memory M2. Upon completion of the processing of Step P238, the CPU 10 executes Step P239.

In Step P239, the CPU 10 reads the ink color ICm of the printing unit M, which is stored in the memory M1. Upon completion of the processing of Step P239, the CPU 10 executes Step P240.

In Step P240, the CPU 10 adds the compensation amount for the printing pressure between the blanket cylinder and the impression cylinder, in association with the number of prints, to the database of a conversion table between the number of prints and the compensation amount for the printing pressure between the blanket cylinder and the impression cylinder for the ink color ICm, which database is stored in the memory M41. Upon completion of the processing of Step P240, the CPU 10 executes Step P241.

In Step P241, the CPU 10 creates a conversion table between the number of prints and the compensation amount for the printing pressure between the blanket cylinder and the impression cylinder, by using the least squares method, from the database of a conversion table between the number of prints and the compensation amount for the printing pressure between the blanket cylinder and the impression cylinder for the ink color ICm. The CPU 10 then overwrites the created conversion table in the memory M42. Upon completion of the processing of Step P241, the CPU 10 executes Step P242. When one of the contact-pressure adjusting means of each printing unit M is manually adjusted by the operator during the final printing, a conversion table between the number of prints and one of the nip pressures and the printing pressure for an ink color corresponding to the manually adjusted portion is rewritten in consideration of the result of the manual adjustment, in the foregoing steps.

In Step P242, the CPU 10 reads the count value of the number-of-prints counter 39, and the stores the read value in the memory M36. Upon completion of the processing of Step P242, the CPU 10 executes Step P243.

In Step P243, the CPU 10 writes 1 in the count value M, which is stored in the memory M3. Upon completion of the processing of Step P243, the CPU 10 executes Step P244.

In Step P244, the CPU 10 reads the ink color ICm of the printing unit M, which is stored in the memory M1. Upon completion of the processing of Step P244, the CPU 10 executes Step P245.

In Step P245, the CPU 10 reads the conversion table between the number of prints and the compensation amount for the nip pressure between the ink form roller and the relief cylinder for the ink color ICm, which conversion table is stored in the memory M38. Upon completion of the processing of Step P245, the CPU 10 executes Step P246.

In Step P246, the CPU 10 obtains a compensation amount for the nip pressure between the ink form roller and the relief cylinder, from the number of prints, by using the conversion table between the number of prints and the compensation amount for the nip pressure between the ink form roller and the relief cylinder for the ink color ICm. The CPU 10 then stores the obtained compensation amount in the memory M14. Upon completion of the processing of Step P246, the CPU 10 executes Step P247.

In Step P247, the CPU 10 reads the conversion table between the number of prints and the compensation amount for the nip pressure between the relief cylinder and the blanket cylinder for the ink color ICm, which conversion table is stored in the memory M40. Upon completion of the processing of Step P247, the CPU 10 executes Step P248.

In Step P248, the CPU 10 obtains a compensation amount for the nip pressure between the relief cylinder and the blanket cylinder, from the number of prints, by using the conversion table between the number of prints and the compensation amount for the nip pressure between the relief cylinder and the blanket cylinder for the ink color ICm. The CPU 10 then stores the obtained compensation amount in the memory M16. Upon completion of the processing of Step P248, the CPU 10 executes Step P249.

In Step P249, the CPU 10 reads the conversion table between the number of prints and the compensation amount for the printing pressure between the blanket cylinder and the impression cylinder for the ink color ICm, which conversion table is stored in the memory M42. Upon completion of the processing of Step P249, the CPU 10 executes Step P250.

In Step P250, the CPU 10 obtains a compensation amount for the printing pressure between the blanket cylinder and the impression cylinder, from the number of prints, by using the conversion table between the number of prints and the compensation amount for the printing pressure between the blanket cylinder and the impression cylinder for the ink color ICm. The CPU 10 then stores the obtained compensation amount in the memory M18. Upon completion of the processing of Step P250, the CPU 10 executes Step P195.

Since the processing from Step P195 to Step P209 and Step P78 to Step P109 is the same as that of the second embodiment, a description thereof will be omitted.

In Step P110, the CPU 10 determines whether or not the count value M, which is stored in the memory M3, is larger than the total number Mmax of printing units, which is stored in the memory M10. When the count value M, which is stored in the memory M3, is larger than the total number Mmax of printing units, which is stored in the memory M10, the CPU 10 executes Step P111. On the other hand, when the count value M, which is stored in the memory M3, is not larger than the total number Mmax of printing units, which is stored in the memory M10, the CPU 10 executes Step P244.

In Step P111, the CPU 10 determines whether or not the final-printing completing button, which is provided to the input device 13, has been turned ON by the operator. When the final-printing completing button has been turned ON, the CPU 10 executes Step P1. On the other hand, when the final-printing completing button has not been turned ON, the CPU 10 executes Step P114.

Fourth Embodiment

Figure 17:
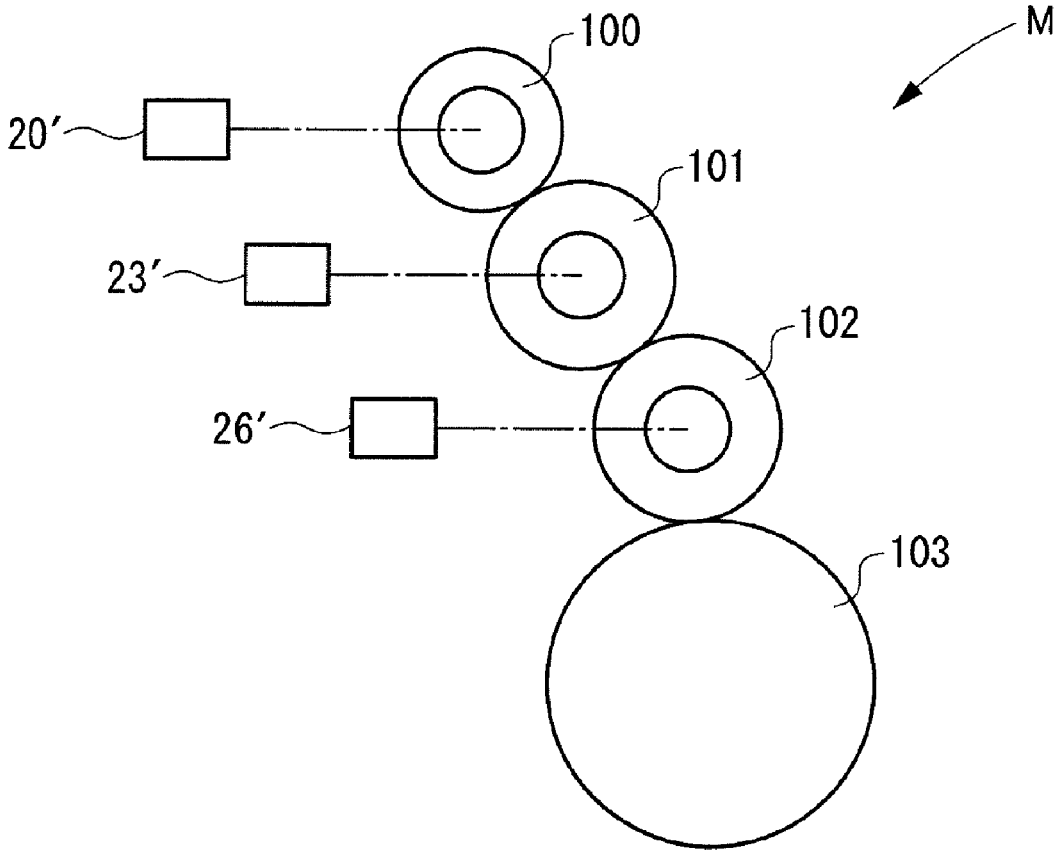
FIG. 17 shows a schematic view of the inside of a printing press to which a contact-pressure adjusting system for a liquid application machine according to a fourth embodiment of the present invention is employed.

A description will be given of a contact-pressure adjusting method and a contact-pressure adjusting system, for a liquid application machine, according to a fourth embodiment of the present invention. FIG. 17 shows a schematic view of the inside of a printing press to which the contact-pressure adjusting system for a liquid application machine according to the fourth embodiment of the present invention is employed. As shown in FIG. 17, the printing press according to the present embodiment includes an ink form roller 100, a relief cylinder 101, a blanket cylinder 102, and an impression cylinder 103, for each printing unit M. The ink form roller 100 evenly applies ink to an image area on a plate. The relief cylinder 101 includes the plate with protruding portions which are brought into contact with the ink form roller 100 to function as the image area. The blanket cylinder 102 is in contact with the relief cylinder 101, so that ink on the image area on the plate surface is transferred to the blanket cylinder 102. The impression cylinder 103 applies a printing pressure to a printing product that is in contact with the blanket cylinder 102.

The ink form roller 100 is provided with a potentiometer 20' for displaying a position for adjusting the nip pressure between the ink form roller 100 and the relief cylinder 101 for the purpose of detecting the nip pressure between the ink form roller 100 and the relief cylinder 101. The relief cylinder 101 is provided with a potentiometer 23' for displaying a position for adjusting the nip pressure between the relief cylinder 101 and the blanket cylinder 102 for the purpose of detecting the nip pressure between the relief cylinder 101 and the blanket cylinder 102. The blanket cylinder 102 is provided with a potentiometer 26' for displaying a position for adjusting the printing pressure between the blanket cylinder 102 and the impression cylinder 103 for the purpose of detecting the printing pressure between the blanket cylinder 102 and the impression cylinder 103.

Figure 18A:
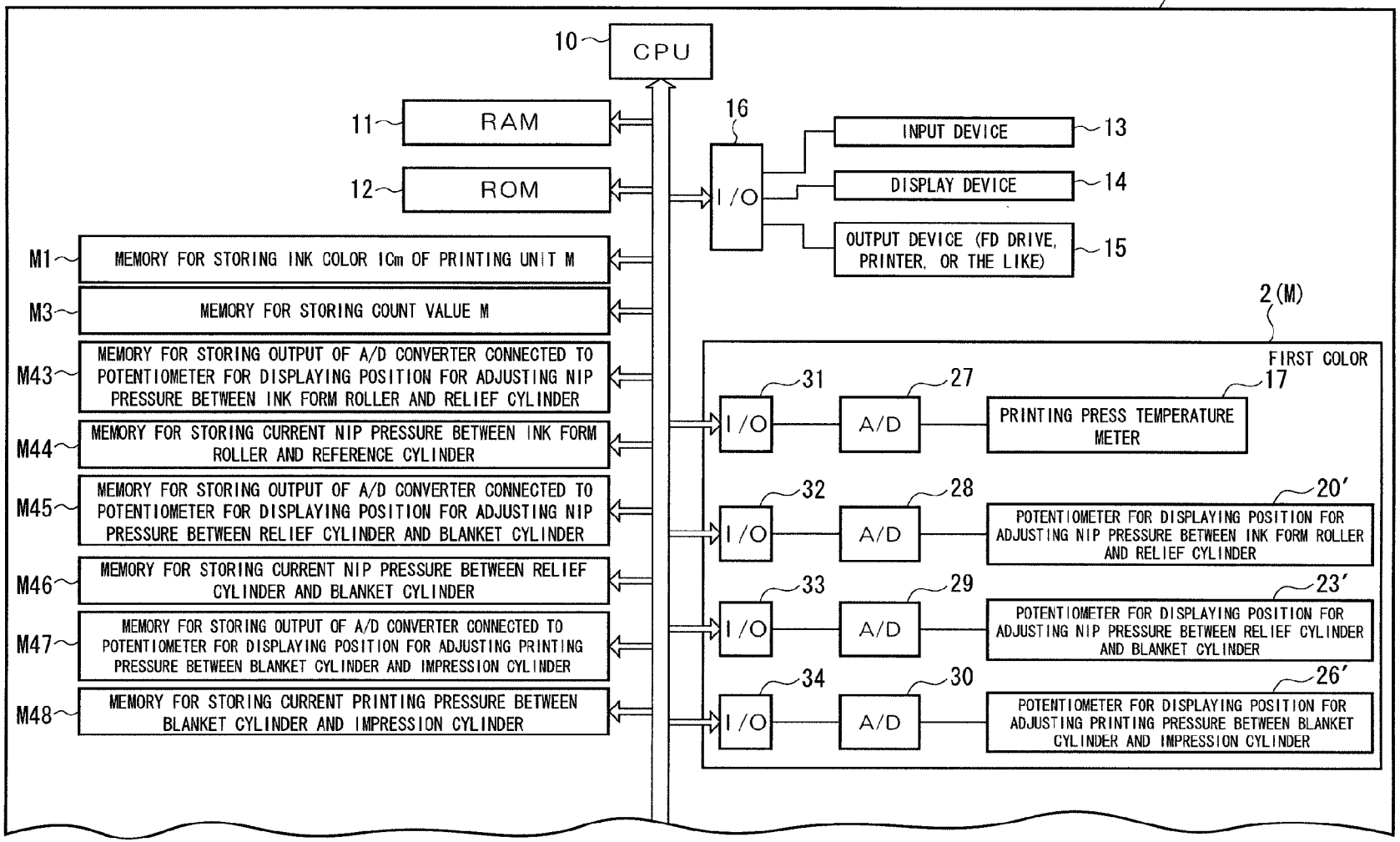
FIG. 18A shows a hardware block diagram of the contact-pressure adjusting system for a liquid application machine according to the fourth embodiment of the present invention.
Figure 18B:
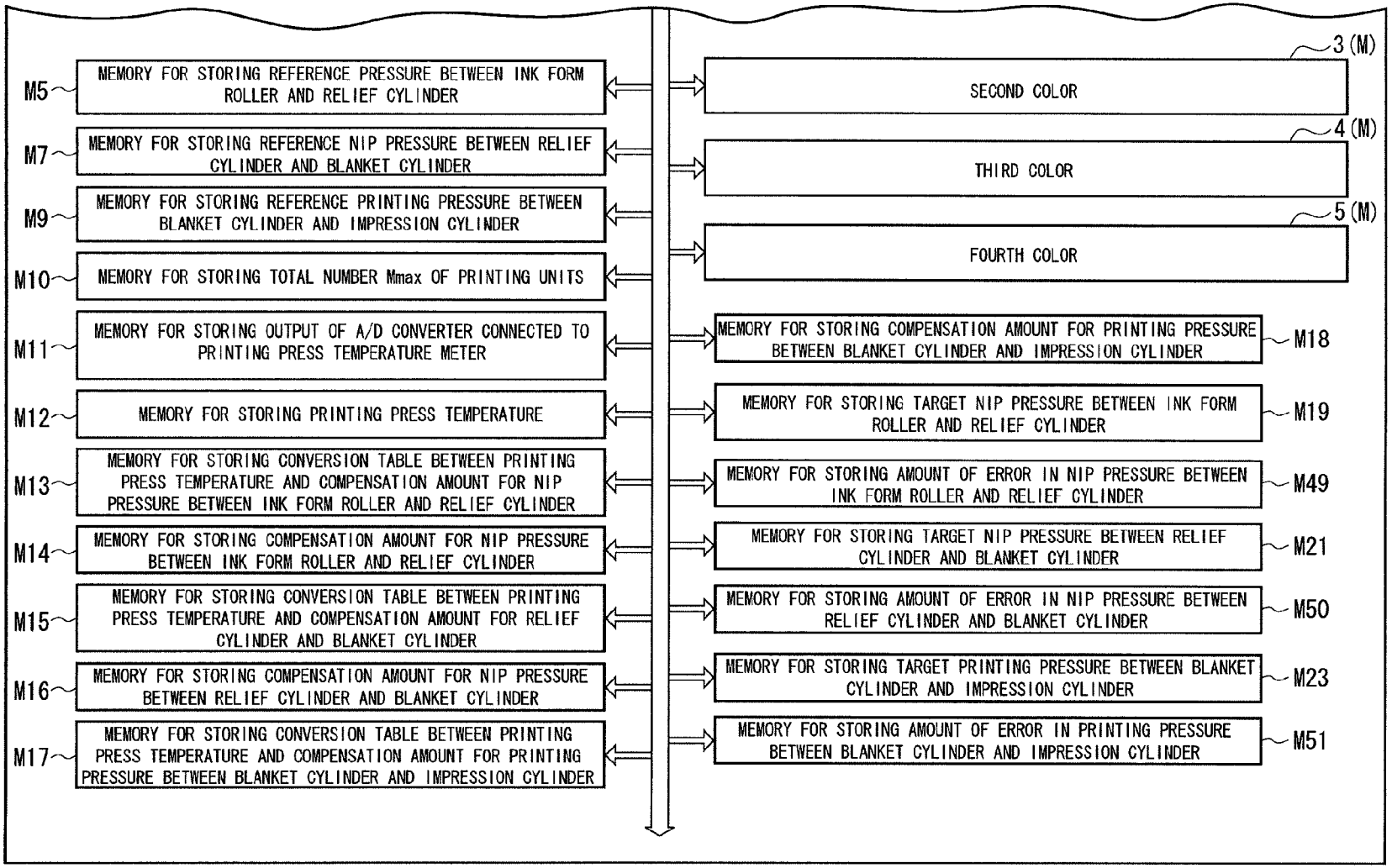
FIG. 18B shows a hardware block diagram continued from FIG. 18A.
Figure 19A:
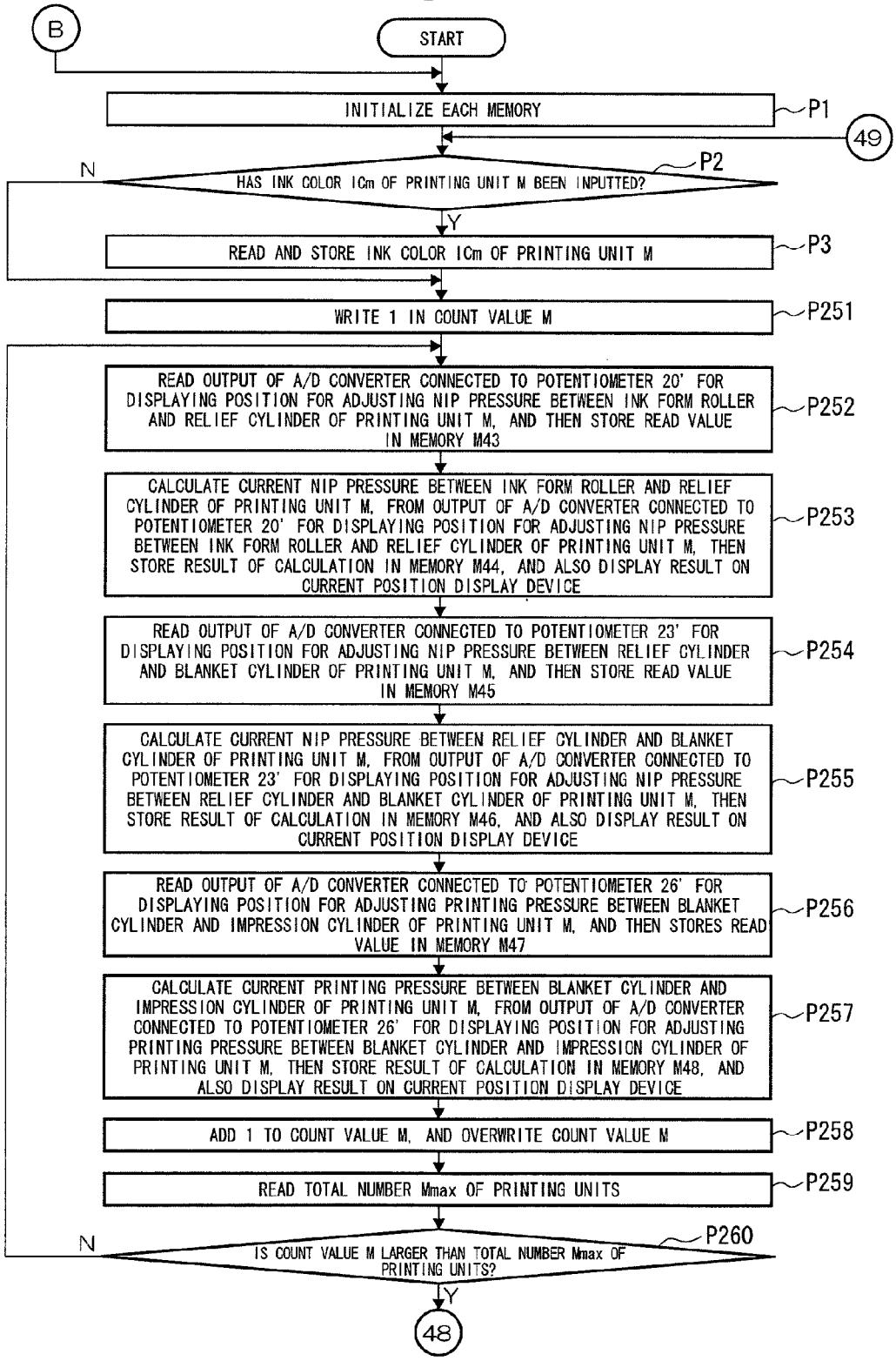
FIG. 19A shows an operational flowchart of the contact-pressure adjusting system for a liquid application machine according to the fourth embodiment of the present invention.
Figure 19B:
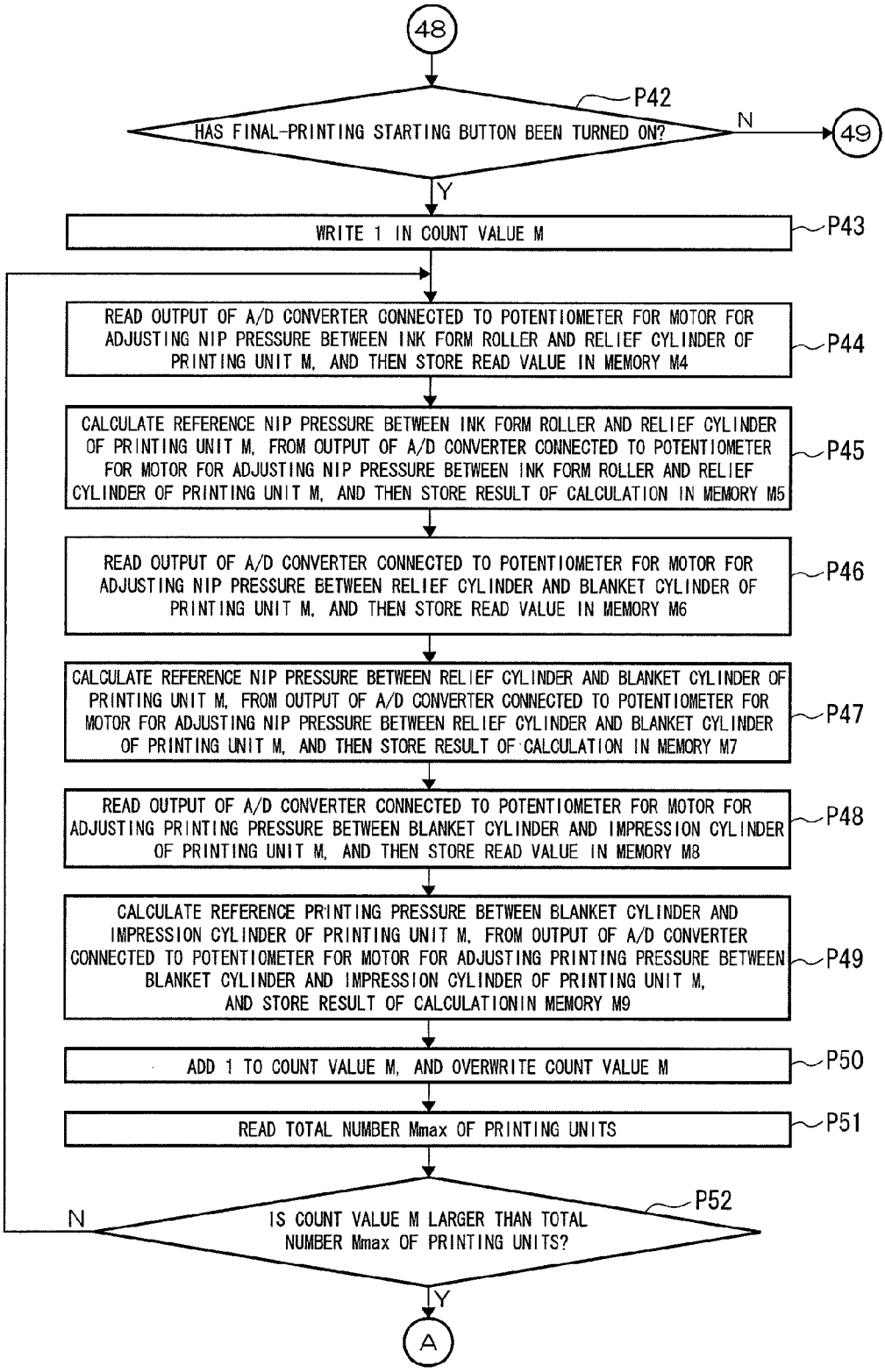
FIG. 19B shows an operational flowchart subsequent to that of FIG. 19A.
Figure 20A:
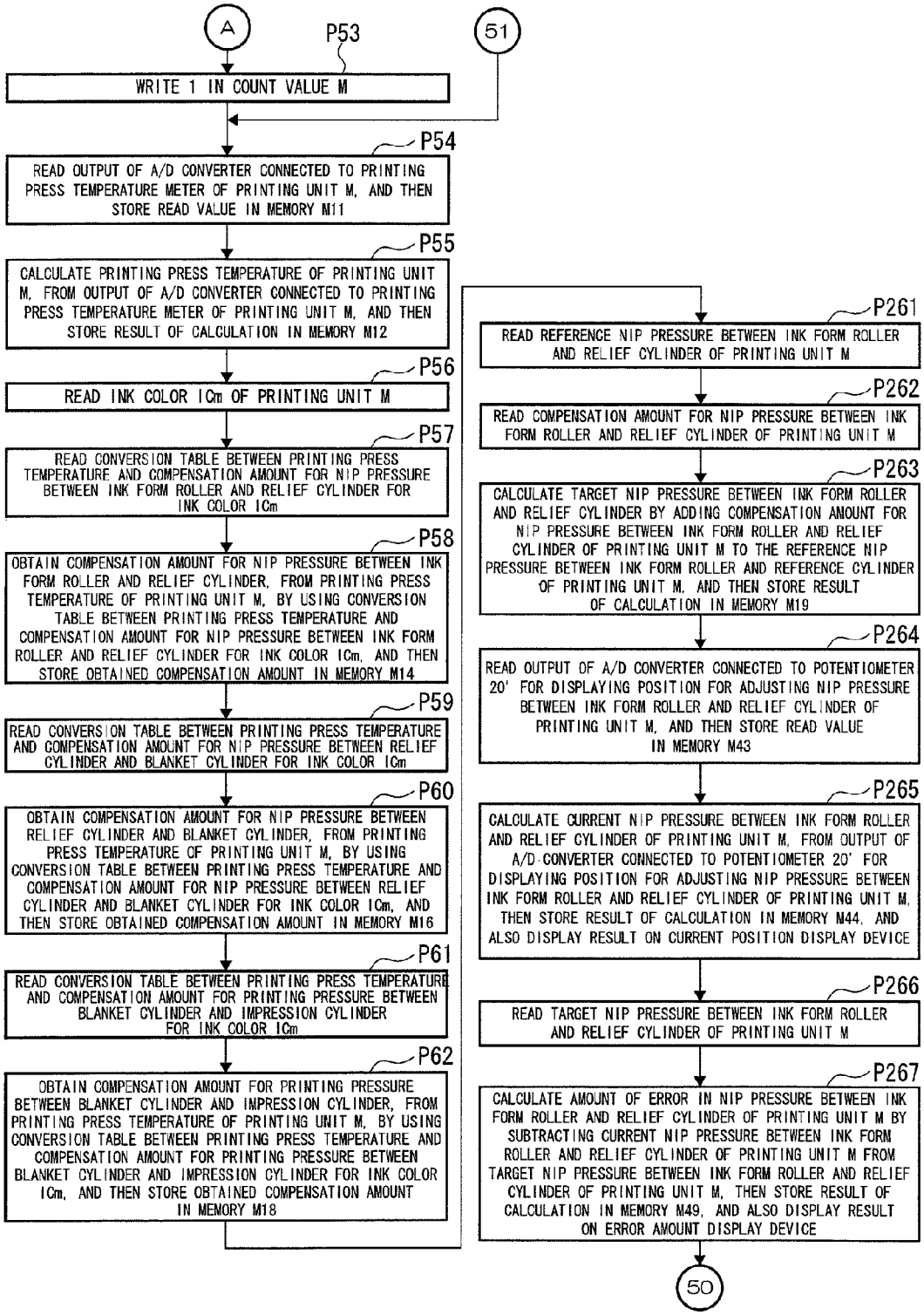
FIG. 20A shows an operational flowchart subsequent to that of FIG. 19B.
Figure 20B:
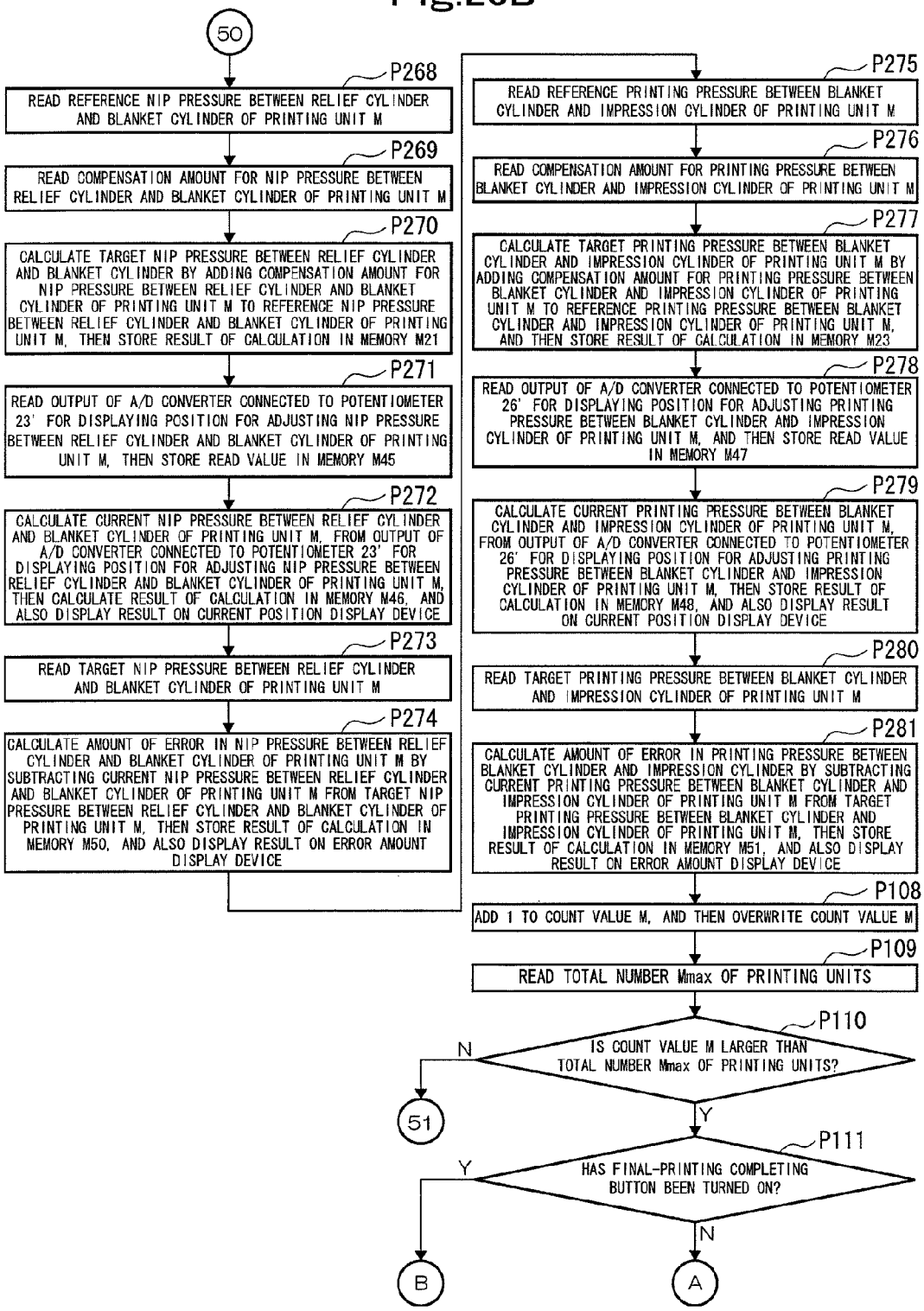
FIG. 20B shows an operational flowchart subsequent to that of FIG. 20A.

Next, a description will be given of a contact-pressure adjusting system for a liquid application machine according to the fourth embodiment of the present invention. FIGS. 18A and 18B show hardware block diagrams of the contact-pressure adjusting system for a liquid application machine according to the fourth embodiment of the present invention. As shown in FIGS. 18A and 18B, the contact-pressure adjusting system 1 includes a CPU 10, a RAM 11, a ROM 12, an input device 13, a display device 14, an output device (an FD drive, a printer or the like) 15, and an I/O (input/output) interface 16.

In addition, the printing unit M includes the potentiometer 20' for displaying a position for adjusting the nip pressure between the ink form roller 100 and the relief cylinder 101, the potentiometer 23' for displaying a position for adjusting the nip pressure between the relief cylinder 101 and the blanket cylinder 102, the potentiometer 26' for displaying a position for adjusting the printing pressure between the blanket cylinder 102 and the impression cylinder 103, A/D (analog/digital) converters 27 to 30, I/O (input/output) interfaces 31 to 34. On the display device 14, displayed are values obtained respectively from the potentiometer 20' for displaying a position for adjusting the nip pressure between the ink form roller 100 and the relief cylinder 101, the potentiometer 23' for displaying a position for adjusting the nip pressure between the relief cylinder 101 and the blanket cylinder 102, and the potentiometer 26' for displaying a position for adjusting the printing pressure between the blanket cylinder 102 and the impression cylinder 103. Note that, in this embodiment, the operator manually adjusts the nip pressures and the printing pressure while monitoring the values of the nip pressures and the printing pressure, which are displayed by the display device 14.

In the printing press according to the present embodiment, inks of four colors are used. Accordingly, each of a printing unit 2 of the first color (for example, black), a printing unit 3 of the second color (for example, cyan), a printing unit 4 of the third color (for example, magenta), and a printing unit 5 of the fourth color (for example, yellow) includes the printing press temperature meter 17, the potentiometer 20' for displaying a position for adjusting the nip pressure between the ink form roller 100 and the relief cylinder 101, the potentiometer 23' for displaying a position for adjusting the nip pressure between the relief cylinder 101 and the blanket cylinder 102, the potentiometer 26' for displaying a position for adjusting the printing pressure between the blanket cylinder 102 and the impression cylinder 103, the A/D (analog/digital) converters 27 to 30, and the I/O (input/output) interfaces 31 to 34. Although the inks of four colors are used in the present embodiment, the number of colors of inks to be used may be increased or decreased by increasing or decreasing the number of printing units.

Moreover, the contact-pressure adjusting system 1 includes memories M1, M3, M5, M7, M9 to M19, M21, M23, and M43 to M51. In the memory M1, an ink color ICm of the printing unit M is stored. In the memory M3, a count value M is stored. In the memory M5, a reference nip pressure between the ink form roller 100 and the relief cylinder 101 is stored. In the memory M7, a reference nip pressure between the relief cylinder 101 and the blanket cylinder 102 is stored. In the memory M9, a reference printing pressure between the blanket cylinder 102 and the impression cylinder 103 is stored. In the memory M10, the total number Mmax of printing units is stored. In the memory M11, an output of the A/D converter connected to the printing press temperature meter 17 is stored. In the memory M12, a printing press temperature is stored. In the memory M13, a conversion table between the printing press temperature and the compensation amount for the nip pressure between the ink form roller 100 and the relief cylinder 101 is stored. In the memory M14, a compensation amount for the nip pressure between the ink form roller 100 and the relief cylinder 101 is stored. In the memory M15, a conversion table between the printing press temperature and the compensation amount for the nip pressure between the relief cylinder 101 and the blanket cylinder 102 is stored. In the memory M16, a compensation amount for the nip pressure between the relief cylinder 101 and the blanket cylinder 102 is stored. In the memory M17, a conversion table between the printing press temperature and the compensation amount for the printing pressure between the blanket cylinder 102 and the impression cylinder 103 is stored. In the memory M18, a compensation amount for the printing pressure between the blanket cylinder 102 and the impression cylinder 103 is stored. In the memory M19, a target nip pressure between the ink form roller 100 and the relief cylinder 101 is stored. In the memory M21, a target nip pressure between the relief cylinder 101 and the blanket cylinder 102 is stored. In the memory M23, a target printing pressure between the blanket cylinder 102 and the impression cylinder 103 is stored. In the memory M43, an output of the A/D converter connected to the potentiometer for displaying a position for adjusting the nip pressure between the ink form roller 100 and the relief cylinder 101 is stored. In the memory M44, a current nip pressure between the ink form roller 100 and the reference cylinder 101 is stored. In the memory M45, an output of the A/D converter connected to the potentiometer for displaying a position for adjusting the nip pressure between the relief cylinder 101 and the blanket cylinder 102 is stored. In the memory M46, a current nip pressure between the relief cylinder 101 and the blanket cylinder 102 is stored. In the memory M47, an output of the A/D converter connected to the potentiometer for displaying a position for adjusting the printing pressure between the blanket cylinder 102 and the impression cylinder 103 is stored. In the memory M48, a current printing pressure between the blanket cylinder 102 and the impression cylinder 103 is stored. In the memory M49, an amount of error in the nip pressure between the ink form roller 100 and the relief cylinder 101 is stored. In the memory M50, an amount of error in the nip pressure between the relief cylinder 101 and the blanket cylinder 102 is stored. In the memory M51, an amount of error in the printing pressure between the blanket cylinder 102 and the impression cylinder 103 is stored.

The CPU 10 obtains various kinds of information which are inputted thereto via the I/O interfaces 16, and 31 to 34, and operates in accordance with a program stored in the ROM 12, while accessing the RAM 11 as well as the memories M1, M3, M5, M7, M9 to M19, M21, M23, and M43 to M51. The input device 13 is provided with various kinds of input devices including an input unit of the ink color ICm of the printing unit M, a final-printing starting button, and a final-printing completing button.

Next, the operation of the contact-pressure adjusting system for a liquid application machine according to the fourth embodiment of the present invention will be described. Each of FIGS. 19A, 19B, 20A and 20B shows an operational flowchart of the contact-pressure adjusting system 1 for a liquid application machine according to the fourth embodiment of the present invention. Hereinafter, the content of the processing of each step will be described.

In Step P1, the CPU 10 initializes each memory. Upon completion of the processing of Step P1, the CPU 10 executes Step P2.

In Step P2, the CPU 10 determines whether or not an ink color ICm of the printing unit M has been inputted, by the operator, to the input unit of the ink color ICm of the printing unit M, which is inputted to the input device 13. When the ink color ICm of the printing unit M has been inputted by the operator, the CPU 10 executes Step P3. On the other hand, when the ink color ICm of the printing unit M has not been inputted by the operator, the CPU 10 executes Step P2 again.

In Step P3, the CPU 10 reads the ink color ICm of the printing unit M, and then stores the ink color ICm in the memory M1. Upon completion of the processing of Step P3, the CPU 10 executes Step P251.

In Step P251, the CPU 10 writes 1 in the count value M, which is stored in the memory M3. Upon completion of the processing of Step P251, the CPU 10 executes Step P252.

In Step P252, the CPU 10 reads the output of the A/D converter connected to the potentiometer 20' for displaying a position for adjusting the nip pressure between the ink form roller and the relief cylinder of the printing unit M. The CPU 10 then stores the read value in the memory M43. Upon completion of the processing of Step P252, the CPU 10 executes Step P253.

In Step P253, the CPU 10 calculates a current nip pressure between the ink form roller and the relief cylinder of the printing unit M, from the output of the A/D converter connected to the potentiometer 20' for displaying a position for adjusting the nip pressure between the ink form roller and the relief cylinder of the printing unit M. The CPU 10 then stores the result of the calculation in the memory M44, and also displays the result on a current position display device. Upon completion of the processing of Step P253, the CPU 10 executes Step P254.

In Step P254, the CPU 10 reads the output of the A/D converter connected to the potentiometer 23' for displaying a position for adjusting the nip pressure between the relief cylinder and the blanket cylinder of the printing unit M. The CPU 10 then stores the read value in the memory M45. Upon completion of the processing of Step P254, the CPU 10 executes Step P255.

In Step P255, the CPU 10 calculates a current nip pressure between the relief cylinder and the blanket cylinder of the printing unit M, from the output of the A/D converter connected to the potentiometer 23' for displaying a position for adjusting the nip pressure between the relief cylinder and the blanket cylinder of the printing unit M. The CPU 10 then stores the result of the calculation in the memory M46, and also displays the result on the current position display device. Upon completion of the processing of Step P255, the CPU 10 executes Step P256.

In Step P256, the CPU 10 reads the output of the A/D converter connected to the potentiometer 26' for displaying a position for adjusting the printing pressure between the blanket cylinder and the impression cylinder of the printing unit M. The CPU 10 then stores the read value in the memory M47. Upon completion of the processing of Step P256, the CPU 10 executes Step P257.

In Step P257, the CPU 10 calculates a current printing pressure between the blanket cylinder and the impression cylinder of the printing unit M, from the output of the A/D converter connected to the potentiometer 26' for displaying a position for adjusting the printing pressure between the blanket cylinder and the impression cylinder of the printing unit M. The CPU 10 then stores the result of the calculation in the memory M48, and also displays the result on the current position display device. Upon completion of the processing of Step P257, the CPU 10 executes Step P258.

In Step P258, the CPU 10 adds 1 to the count value M, which is stored in the memory M3, and then overwrites the count value M. Upon completion of the processing of Step P258, the CPU 10 executes Step P259.

In Step P259, the CPU 10 reads the total number Mmax of printing units from the memory M10. Upon completion of the processing of Step P259, the CPU 10 executes Step P260.

In Step P260, the CPU 10 determines whether or not the count value M, which is stored in the memory M3, is larger than the total number Mmax of printing units, which is stored in the memory M10. When the count value M, which is stored in the memory M3, is larger than the total number Mmax of printing units, which is stored in the memory M10, the CPU 10 executes Step P42. On the other hand, when the count value M, which is stored in the memory M3, is not larger than the total number Mmax of printing units, which is stored in the memory M10, the CPU 10 executes Step P252.

Since the processing from Step P42 to Step P61 is the same as that of the first embodiment, a description thereof will be omitted.

In Step P62, the CPU 10 obtains a compensation amount for the printing pressure between the blanket cylinder and the impression cylinder, from the printing press temperature of the printing unit M, by using the conversion table between the printing press temperature and the compensation amount for the printing pressure between the blanket cylinder and the impression cylinder for the ink color ICm. The CPU 10 then stores the obtained compensation amount in the memory M18. Upon completion of the processing of Step P62, the CPU 10 executes Step P261.

In Step P261, the CPU 10 reads the reference nip pressure between the ink form roller and the relief cylinder of the printing unit M, which is stored in the memory M5. Upon completion of the processing of Step P261, the CPU 10 executes Step P262.

In Step P262, the CPU 10 reads the compensation amount for the nip pressure between the ink form roller and the relief cylinder of the printing unit M, which is stored in the memory M14. Upon completion of the processing of Step P262, the CPU 10 executes Step P263.

In Step P263, the CPU 10 calculates a target nip pressure between the ink form roller and the relief cylinder by adding the compensation amount for the nip pressure between the ink form roller and the relief cylinder of the printing unit M to the reference nip pressure between the ink form roller and the reference cylinder of the printing unit M. The CPU 10 then stores the result of the calculation in the memory M19. Upon completion of the processing of Step P263, the CPU 10 executes Step P264.

In Step P264, the CPU 10 reads the output of the A/D converter connected to the potentiometer 20' for displaying a position for adjusting the nip pressure between the ink form roller and the relief cylinder of the printing unit M. The CPU 10 then stores the read value in the memory M43. Upon completion of the processing of Step P264, the CPU 10 executes Step P265.

In Step P265, the CPU 10 calculates a current nip pressure between the ink form roller and the relief cylinder of the printing unit M, from the output of the A/D converter connected to the potentiometer 20' for displaying a position for adjusting the nip pressure between the ink form roller and the relief cylinder of the printing unit M. The CPU 10 then stores the result of the calculation in the memory M44, and also displays the result on the current position display device. Upon completion of the processing of Step P265, the CPU 10 executes Step P266.

In Step P266, the CPU 10 reads the target nip pressure between the ink form roller and the relief cylinder of the printing unit M, which is stored in the memory M19. Upon completion of the processing of Step P266, the CPU 10 executes Step P267.

In Step P267, the CPU 10 calculates an amount of error in the nip pressure between the ink form roller and the relief cylinder of the printing unit M by subtracting the current nip pressure between the ink form roller and the relief cylinder of the printing unit M from the target nip pressure between the ink form roller and the relief cylinder of the printing unit M. The CPU 10 then stores the result of the calculation in the memory M49, and also displays the result on an error amount display device.

In Step P268, the CPU 10 reads the reference nip pressure between the relief cylinder and the blanket cylinder of the printing unit M, which is stored in the memory M7. Upon completion of the processing of Step P268, the CPU 10 executes Step P269.

In Step P269, the CPU 10 reads the compensation amount for the nip pressure between the relief cylinder and the blanket cylinder of the printing unit M, which is stored in the memory M16. Upon completion of the processing of Step P269, the CPU 10 executes Step P270.

In Step P270, the CPU 10 calculates a target nip pressure between the relief cylinder and the blanket cylinder by adding the compensation amount for the nip pressure between the relief cylinder and the blanket cylinder of the printing unit M to the reference nip pressure between the relief cylinder and the blanket cylinder of the printing unit M. The CPU 10 then stores the result of the calculation in the memory M21. Upon completion of the processing of Step P270, the CPU 10 executes Step P271.

In Step P271, the CPU 10 reads the output of the A/D converter connected to the potentiometer 23' for displaying a position for adjusting the nip pressure between the relief cylinder and the blanket cylinder of the printing unit M. The CPU 10 then stores the read value in the memory M45. Upon completion of the processing of Step P271, the CPU 10 executes Step P272.

In Step P272, the CPU 10 calculates a current nip pressure between the relief cylinder and the blanket cylinder of the printing unit M, from the output of the A/D converter connected to the potentiometer 23' for displaying a position for adjusting the nip pressure between the relief cylinder and the blanket cylinder of the printing unit M. The CPU 10 then calculates the result of the calculation in the memory M46, and also displays the result on the current position display device.

In Step P273, the CPU 10 reads the target nip pressure between the relief cylinder and the blanket cylinder of the printing unit M. Upon completion of the processing of Step P273, the CPU 10 executes Step P274.

In Step P274, the CPU 10 calculates an amount of error in the nip pressure between the relief cylinder and the blanket cylinder of the printing unit M by subtracting the current nip pressure between the relief cylinder and the blanket cylinder of the printing unit M from the target nip pressure between the relief cylinder and the blanket cylinder of the printing unit M. The CPU 10 then stores the result of the calculation in the memory M50, and also displays the result on the error amount display device. Upon completion of the processing of Step P274, the CPU 10 executes Step P275.

In Step P275, the CPU 10 reads the reference printing pressure between the blanket cylinder and the impression cylinder of the printing unit M, which is stored in the memory M9. Upon completion of the processing of Step P275, the CPU 10 executes Step P276.

In Step P276, the CPU 10 reads the compensation amount for the printing pressure between the blanket cylinder and the impression cylinder of the printing unit M, which is stored in the memory M18. Upon completion of the processing of Step P276, the CPU 10 executes Step P277.

In Step P277, the CPU 10 calculates a target printing pressure between the blanket cylinder and the impression cylinder of the printing unit M by adding the compensation amount for the printing pressure between the blanket cylinder and the impression cylinder of the printing unit M to the reference printing pressure between the blanket cylinder and the impression cylinder of the printing unit M. The CPU 10 then stores the result of the calculation in the memory M23, Upon completion of the processing of Step P277, the CPU 10 executes Step P278.

In Step P278, the CPU 10 reads the output of the A/D converter connected to the potentiometer 26' for displaying a position for adjusting the printing pressure between the blanket cylinder and the impression cylinder of the printing unit M. The CPU 10 then stores the read value in the memory M47. Upon completion of the processing of Step P278, the CPU 10 executes Step P279.

In Step P279, the CPU 10 calculates a current printing pressure between the blanket cylinder and the impression cylinder of the printing unit M, from the output of the A/D converter connected to the potentiometer 26' for displaying a position for adjusting the printing pressure between the blanket cylinder and the impression cylinder of the printing unit M The CPU 10 then stores the result of the calculation in the memory M48, and also displays the result on the current position display device. Upon completion of the processing of Step P279, the CPU 10 executes Step P280.

In Step P280, the CPU 10 reads the target printing pressure between the blanket cylinder and the impression cylinder of the printing unit M. Upon completion of the processing of Step P280, the CPU 10 executes Step P281.

In Step P281, the CPU 10 calculates an amount of error in the printing pressure between the blanket cylinder and the impression cylinder by subtracting the current printing pressure between the blanket cylinder and the impression cylinder of the printing unit M from the target printing pressure between the blanket cylinder and the impression cylinder of the printing unit M. The CPU 10 then stores the result of the calculation in the memory M51, and also displays the result on the error amount display device. Upon completion of the processing of Step P281, the CPU 10 executes Step P108.

Since the processing from Step P108 to Step P111 is the same as that of the first embodiment, a description thereof will be omitted. Note that, in the fourth embodiment, in practice, the operator manually adjusts the nip pressures and the printing pressure while monitoring the values displayed on the error amount display device and the current position display device.

Fifth Embodiment

Figure 21:
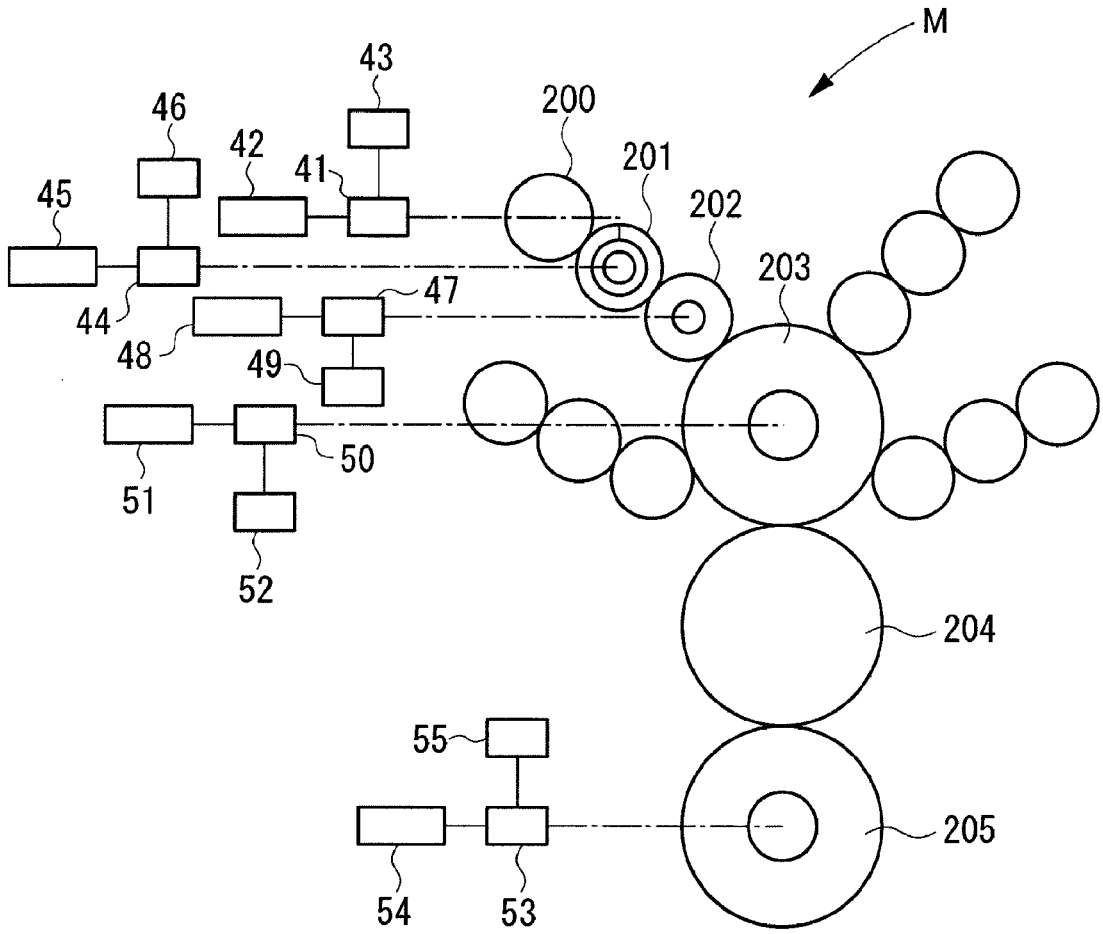
FIG. 21 shows a schematic view of the inside of a printing press to which a contact-pressure adjusting system for a liquid application machine according to a fifth embodiment of the present invention is employed.

A description will be given of a contact-pressure adjusting method and a contact-pressure adjusting system, for a liquid application machine, according to a fifth embodiment of the present invention. FIG. 21 shows a schematic view of the inside of a printing press to which the contact-pressure adjusting system, for a liquid application machine, according to the fifth embodiment of the present invention is employed. As shown in FIG. 21, the printing press according to the present embodiment includes an ink fountain roller 200, an ink form roller 201, a pattern roller 202, a blanket cylinder 203, an intaglio cylinder 204, and an impression cylinder 205, for each ink supply unit M. The ink fountain roller 200 draws ink from an ink fountain (not illustrated) in which the ink is stored. The ink form roller 201 is in contact with the ink fountain roller 200, and evenly applies ink onto an image area on a plate. The pattern roller 202 includes the plate with protruding portions which are brought into contact with the ink form roller 201 to function as the image area. The blanket cylinder 203 is a collecting cylinder, and is in contact with the pattern roller 202, so that ink on the image area on the plate surface is transferred onto the blanket cylinder 203. The intaglio cylinder 204 is in contact with the blanket cylinder 203. The impression cylinder 205 applies a printing pressure to a printing product that is in contact with the intaglio cylinder 204. Note that, the contact-pressure adjusting method for adjusting a nip pressure or a printing pressure, according to the present embodiment, is the same as the contact-pressure adjusting method described in the first embodiment.

The ink form roller 201 is provided with a motor 41 for adjusting the nip pressure between the ink fountain roller 200 and the ink form roller 201 for the purpose of adjusting the nip pressure between the ink fountain roller 200 and the ink form roller 201. The motor 41 for adjusting the nip pressure between the ink fountain roller 200 and the ink form roller 201 is controlled by a motor driver 42 for adjusting the nip pressure between the ink fountain roller 200 and the ink form roller 201. In addition, the motor 41 for adjusting the nip pressure between the ink fountain roller 200 and the ink form roller 201 is provided with a potentiometer 43 for the motor for adjusting the nip pressure between the ink fountain roller 200 and the ink form roller 201 for the purpose of detecting the nip pressure between the ink fountain roller 200 and the ink form roller 201.

In addition, the ink form roller 201 is provided with a motor 44 for adjusting the nip pressure between the ink form roller 201 and the pattern roller 202 for the purpose of adjusting the nip pressure between the ink form roller 201 and the pattern roller 202. The motor 44 for adjusting the nip pressure between the ink form roller 201 and the pattern roller 202 is controlled by a motor driver 45 for adjusting the nip pressure between the ink form roller 201 and the pattern roller 202. In addition, the motor 44 for adjusting the nip pressure between the ink form roller 201 and the pattern roller 202 is provided with a potentiometer 46 for the motor for adjusting the nip pressure between the ink form roller 201 and the pattern roller 202 for the purpose of detecting the nip pressure between the ink form roller 201 and the pattern roller 202.

The pattern roller 202 is provided with a motor 47 for adjusting the nip pressure between the pattern roller 202 and the blanket cylinder 203 for the purpose of adjusting the nip pressure between the pattern roller 202 and the blanket cylinder 203. The motor 47 for adjusting the nip pressure between the pattern roller 202 and the blanket cylinder 203 is controlled by a motor driver 48 for adjusting the nip pressure between the pattern roller 202 and the blanket cylinder 203. In addition, the motor 47 for adjusting the nip pressure between the pattern roller 202 and the blanket cylinder 203 is provided with a potentiometer 49 for the motor for adjusting the nip pressure between the pattern roller 202 and the blanket cylinder 203 for the purpose of detecting the nip pressure between the pattern roller 202 and the blanket cylinder 203.

The blanket cylinder 203 is provided with a motor 50 for adjusting the nip pressure between the blanket cylinder 203 and the intaglio cylinder 204 for the purpose of adjusting the nip pressure between the blanket cylinder 203 and the intaglio cylinder 204. The motor 50 for adjusting the nip pressure between the blanket cylinder 203 and the intaglio cylinder 204 is controlled by a motor driver 51 for adjusting the nip pressure between the blanket cylinder 203 and the intaglio cylinder 204. In addition, the motor 50 for adjusting the nip pressure between the blanket cylinder 203 and the intaglio cylinder 204 is provided with a potentiometer 52 for the motor for adjusting the nip pressure between the blanket cylinder 203 and the intaglio cylinder 204 for the purpose of detecting the nip pressure between the blanket cylinder 203 and the intaglio cylinder 204.

The impression cylinder 205 is provided with a motor 53 for adjusting the printing pressure between the intaglio cylinder 204 and the impression cylinder 205 for the purpose of adjusting the printing pressure between the intaglio cylinder 204 and the impression cylinder 205. The motor 53 for adjusting the printing pressure between the intaglio cylinder 204 and the impression cylinder 20 is controlled by a motor driver 54 for adjusting the printing pressure between the intaglio cylinder 204 and the impression cylinder 205. In addition, the motor 53 for adjusting the printing pressure between the intaglio cylinder 204 and the impression cylinder 205 is provided with a potentiometer 55 for the motor for adjusting the printing pressure between the intaglio cylinder 204 and the impression cylinder 205 for the purpose of detecting the printing pressure between the intaglio cylinder 204 and the impression cylinder 205.

Figure 22A:
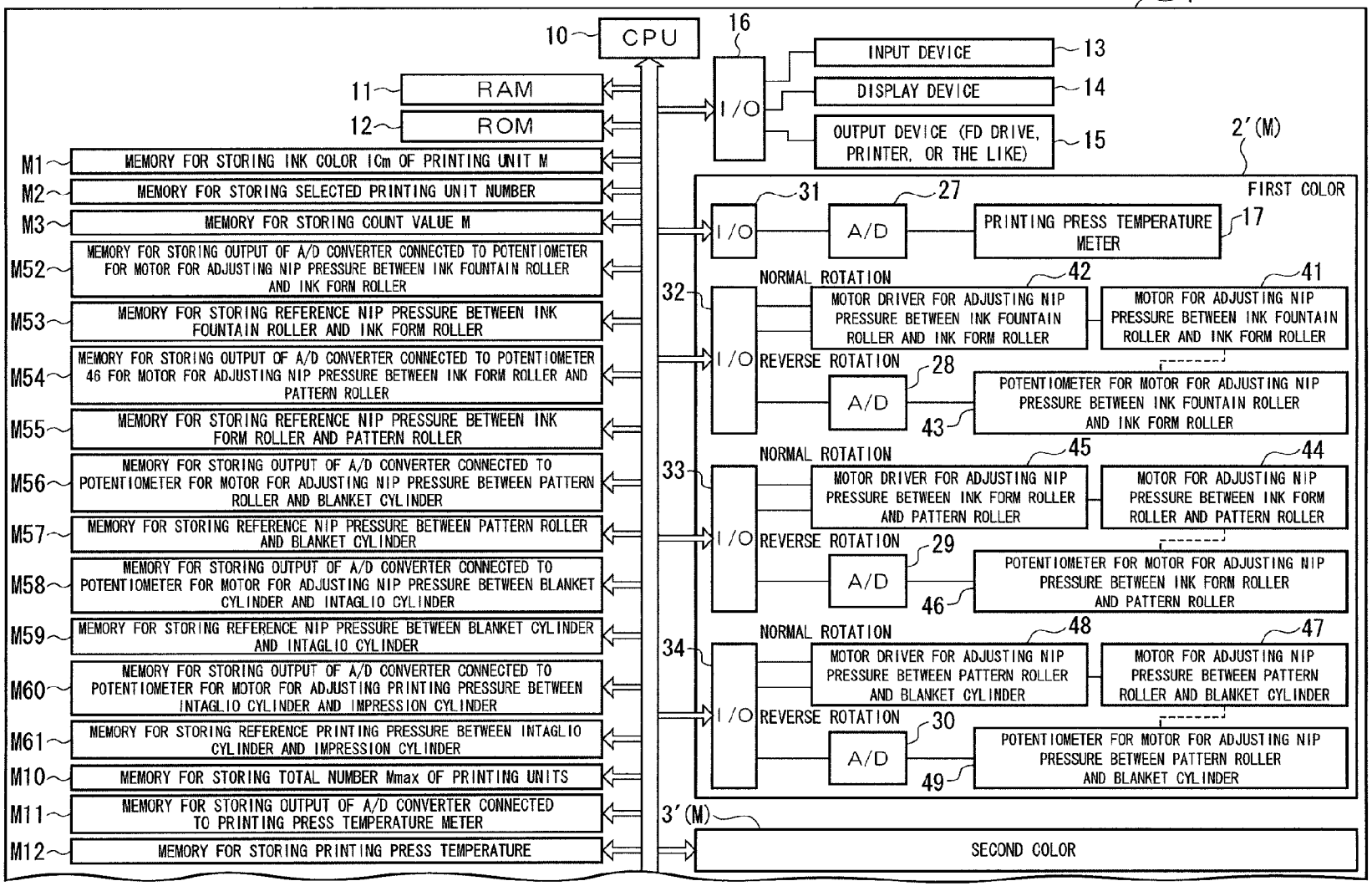
FIG. 22A shows a hardware block diagram of the contact-pressure adjusting system for a liquid application machine according to the fifth embodiment of the present invention.
Figure 22B:
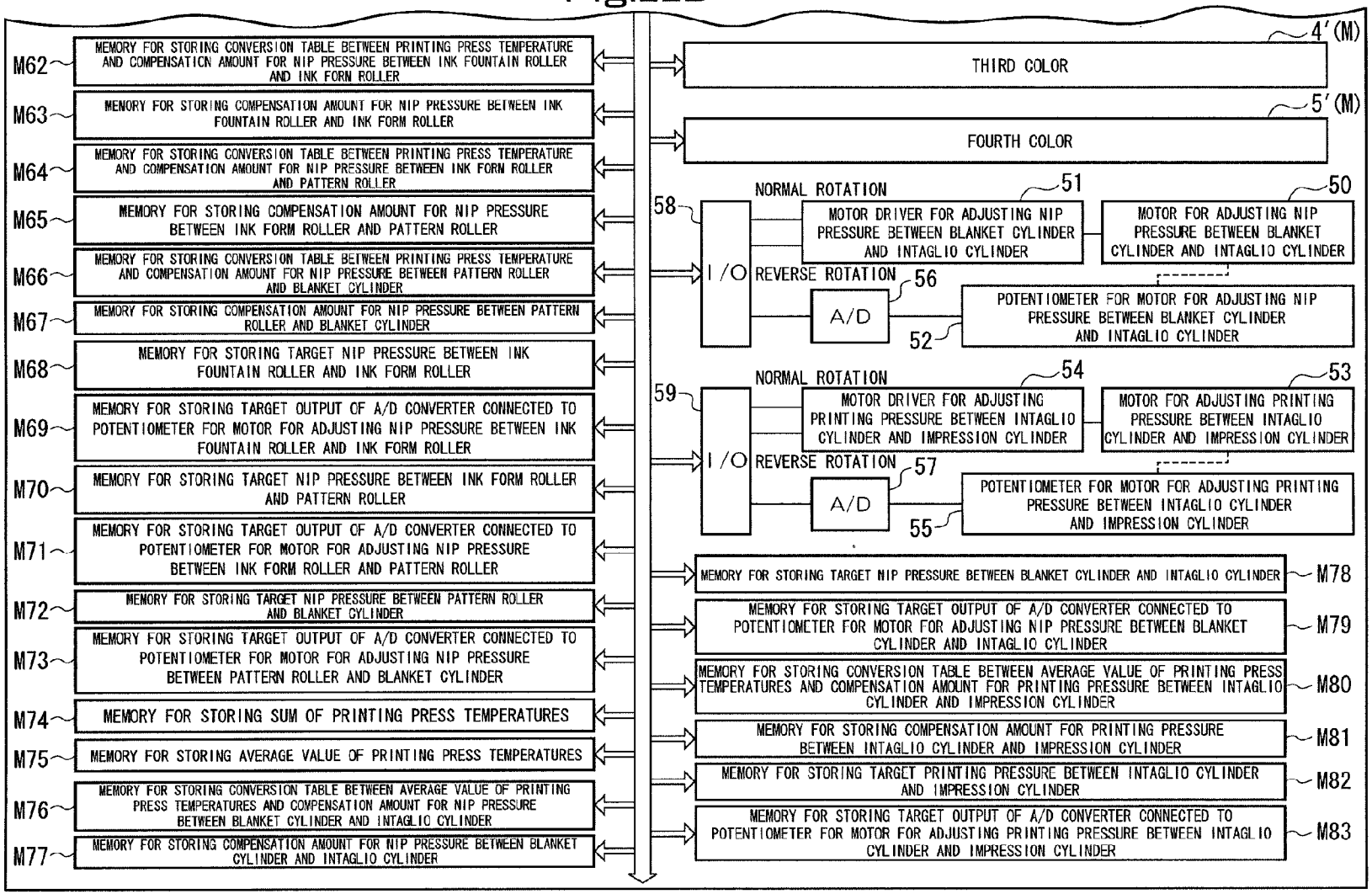
FIG. 22B shows a hardware block diagram continued from FIG. 22A.
Figure 23A:
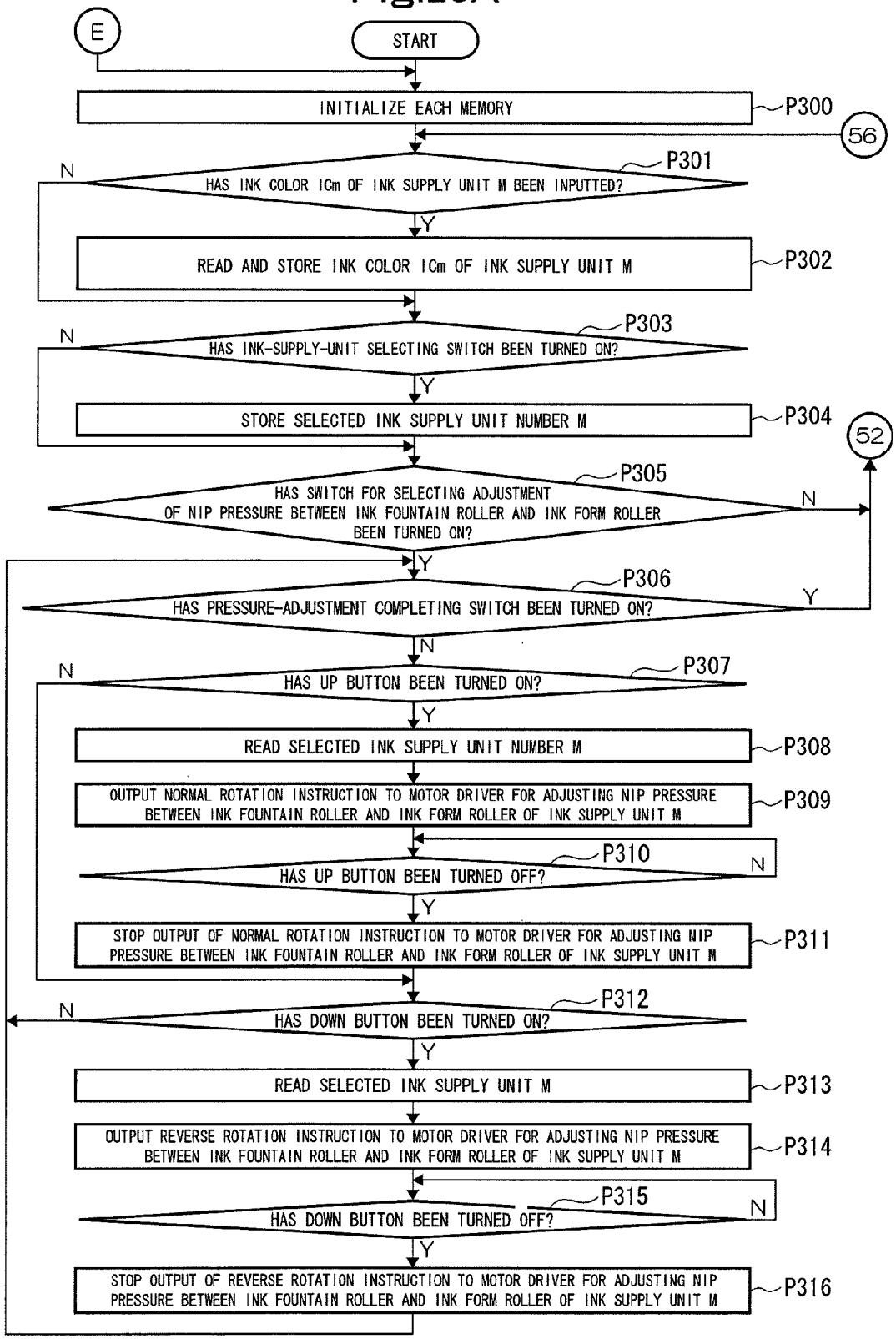
FIG. 23A shows an operational flowchart of the contact-pressure adjusting system for a liquid application machine according to the fifth embodiment of the present invention.
Figure 23B:
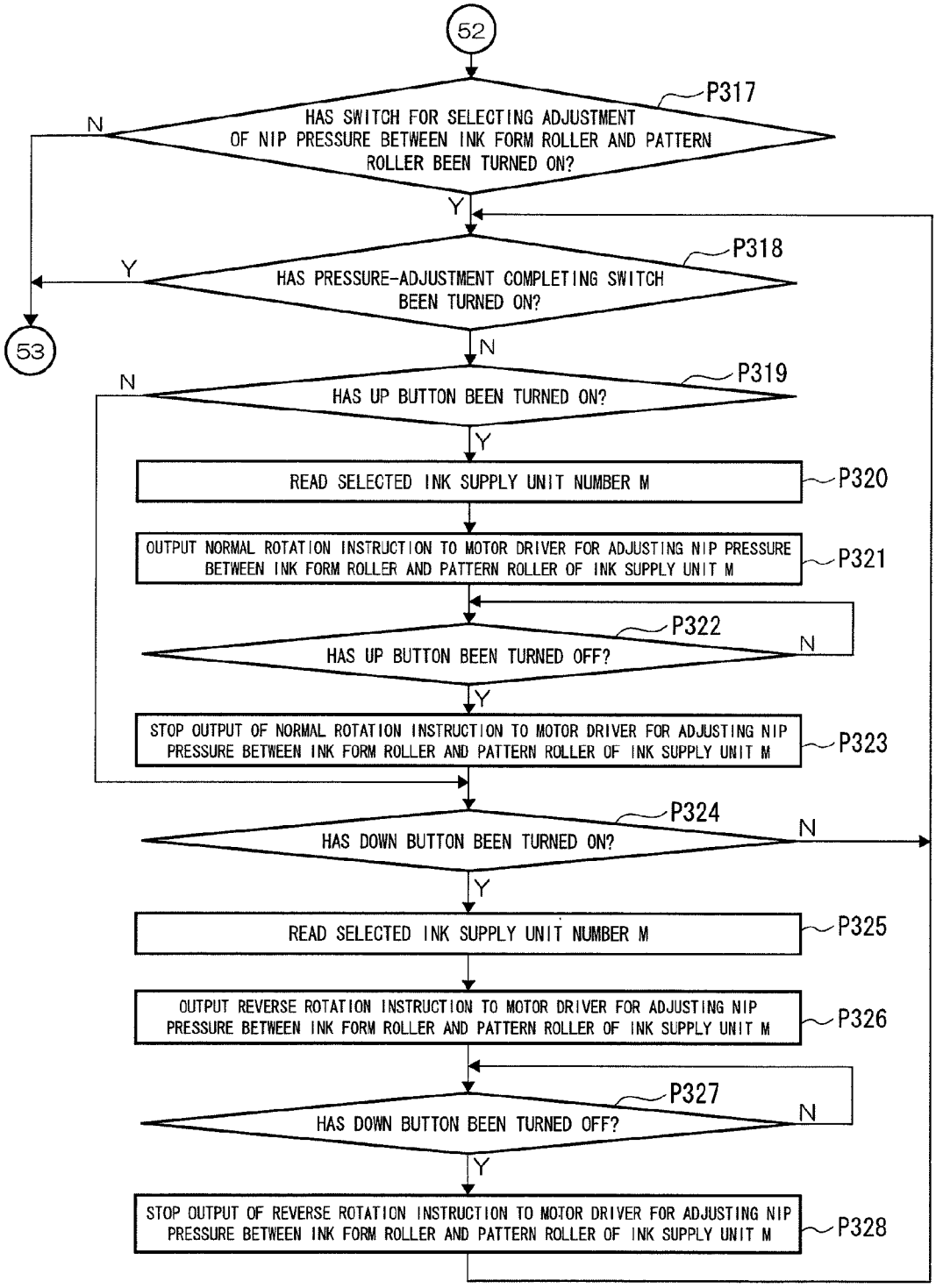
FIG. 23B shows an operational flowchart subsequent to that of FIG. 23A.
Figure 23C:
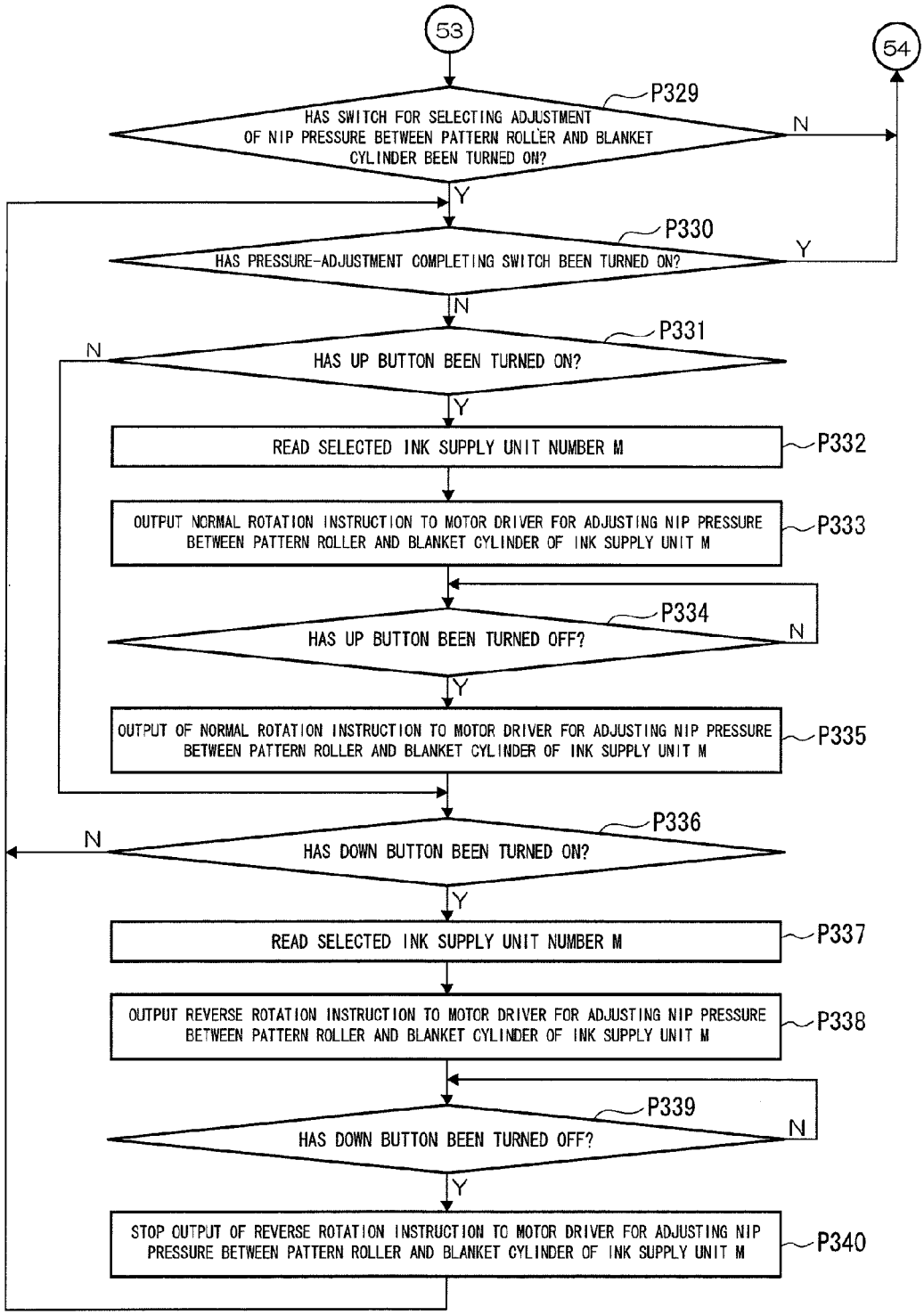
FIG. 23C shows an operational flowchart subsequent to that of FIG. 23B.
Figure 23D:
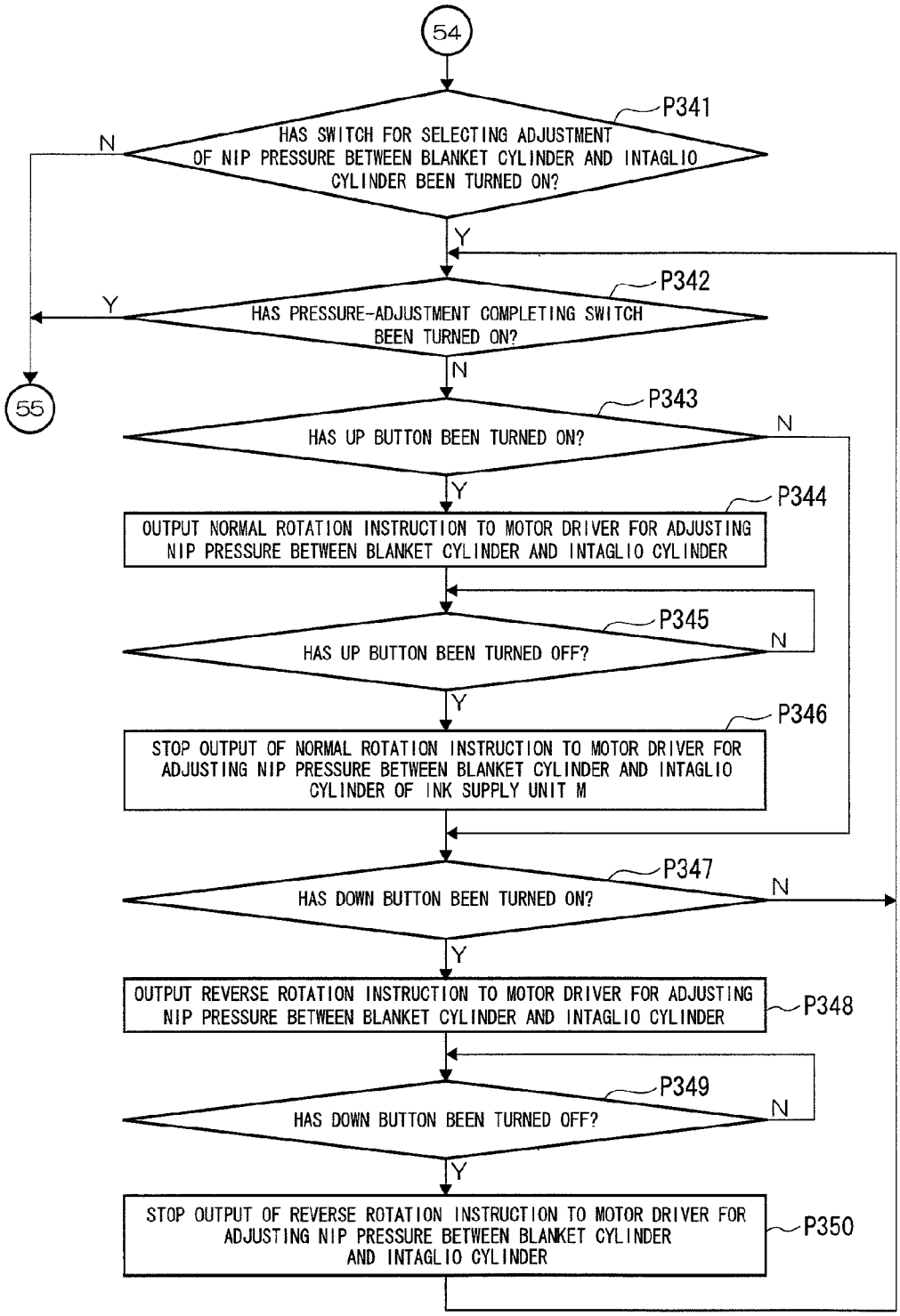
FIG. 23D shows an operational flowchart subsequent to that of FIG. 23C.
Figure 23E:
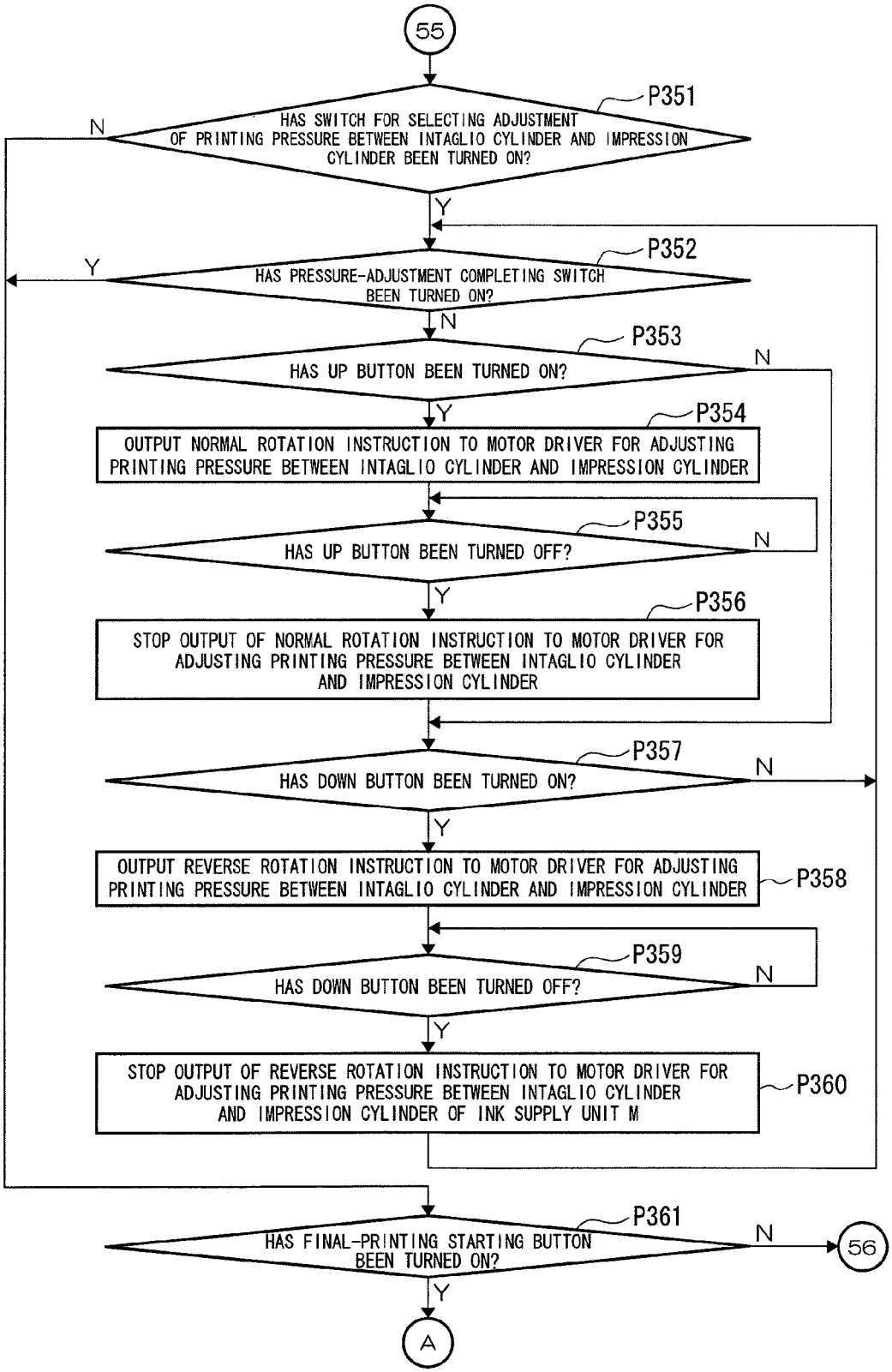
FIG. 23E shows an operational flowchart subsequent to that of FIG. 23D.
Figure 24A:
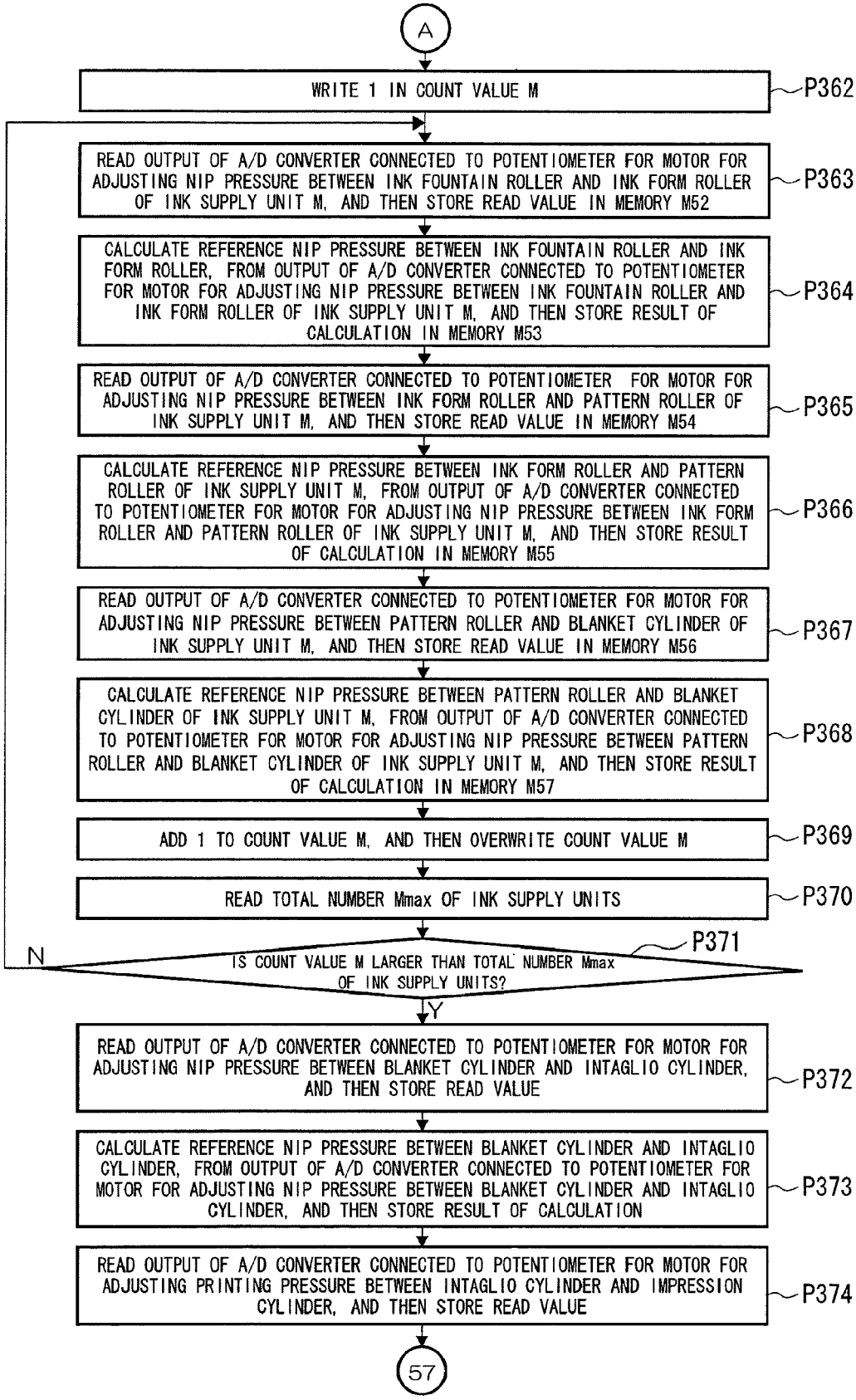
FIG. 24A shows an operational flowchart subsequent to that of FIG. 23E.
Figure 24B:
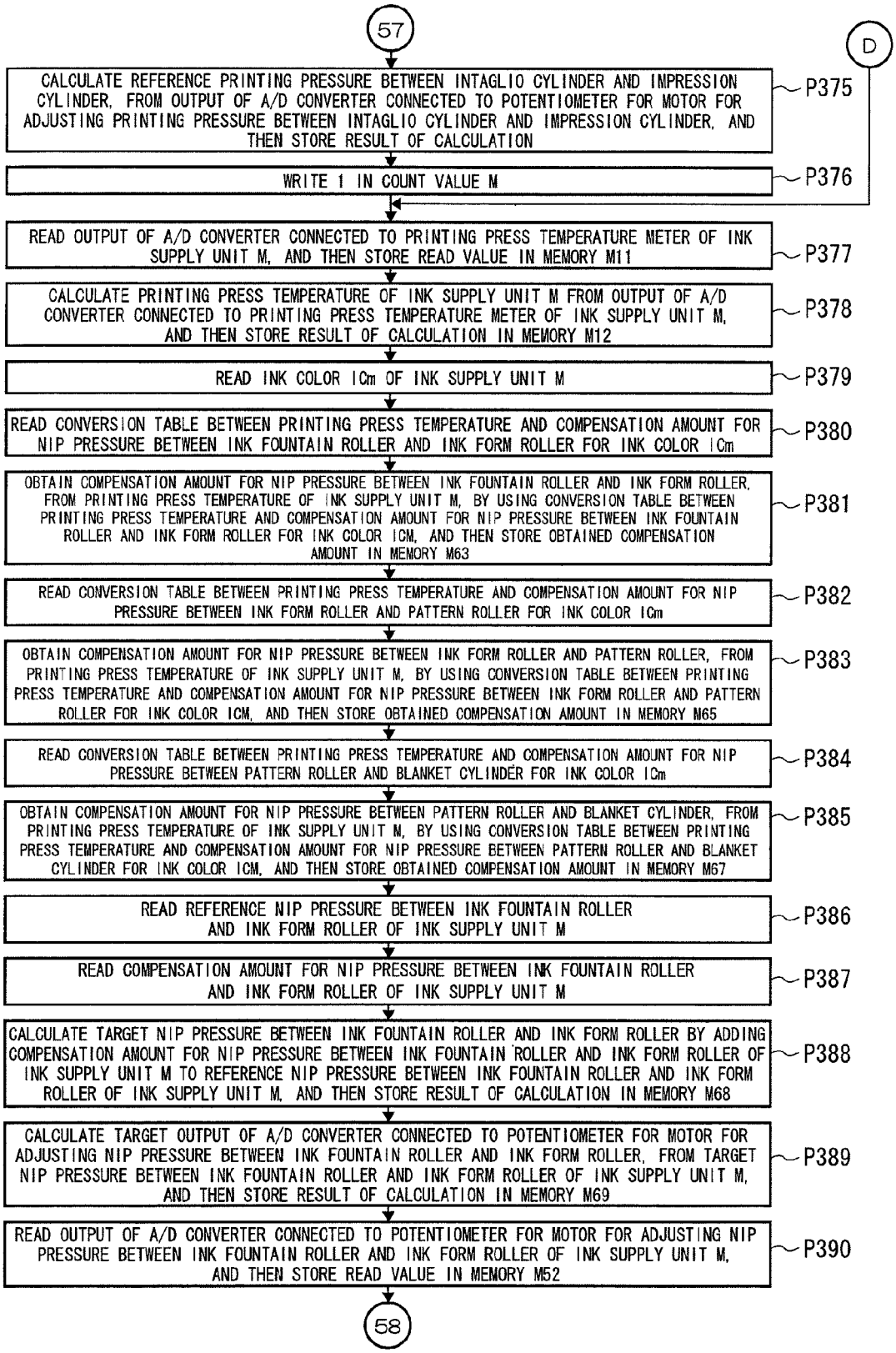
FIG. 24B shows an operational flowchart subsequent to that of FIG. 24A.
Figure 24C:
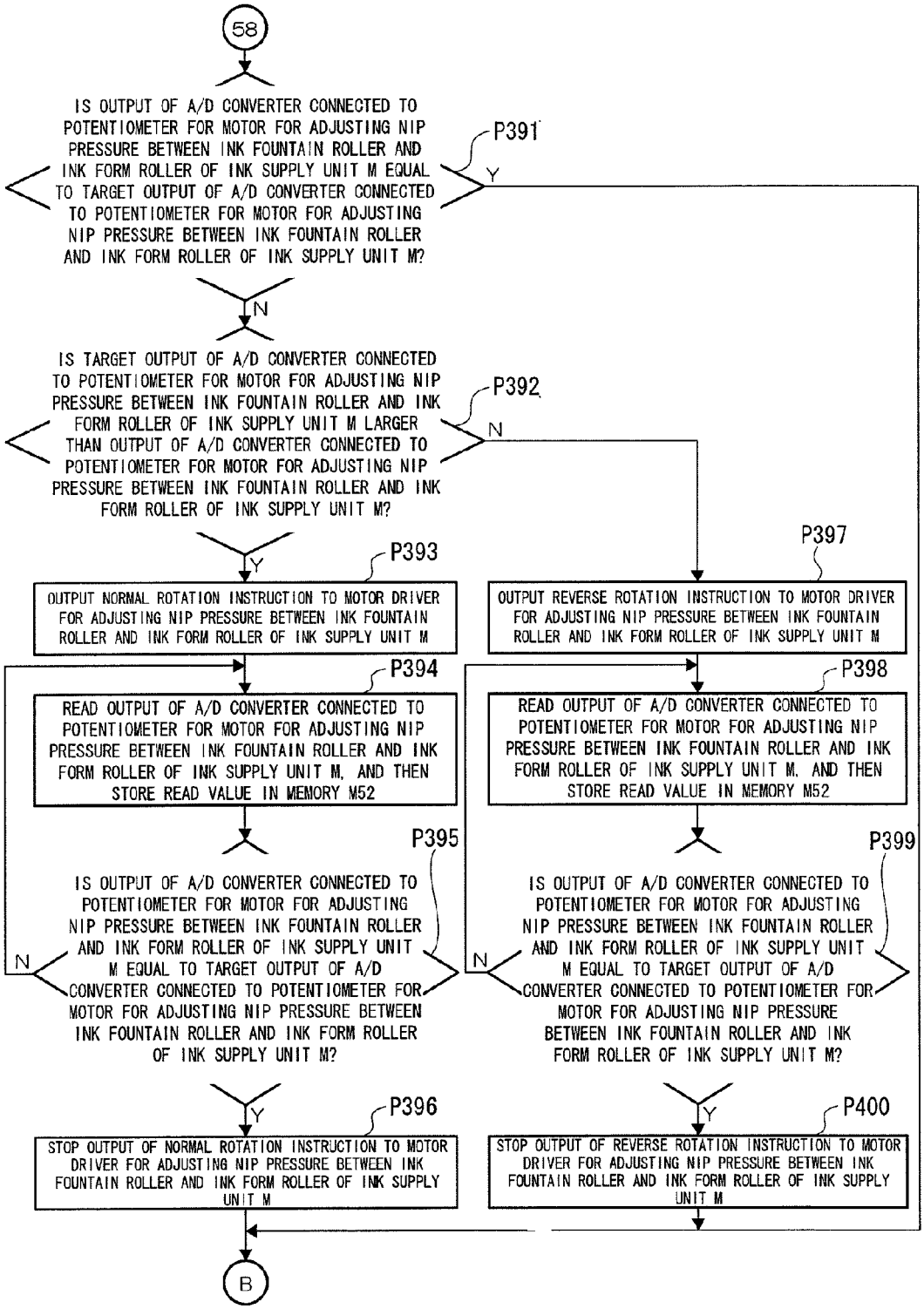
FIG. 24C shows an operational flowchart subsequent to that of FIG. 24B.
Figure 25A:
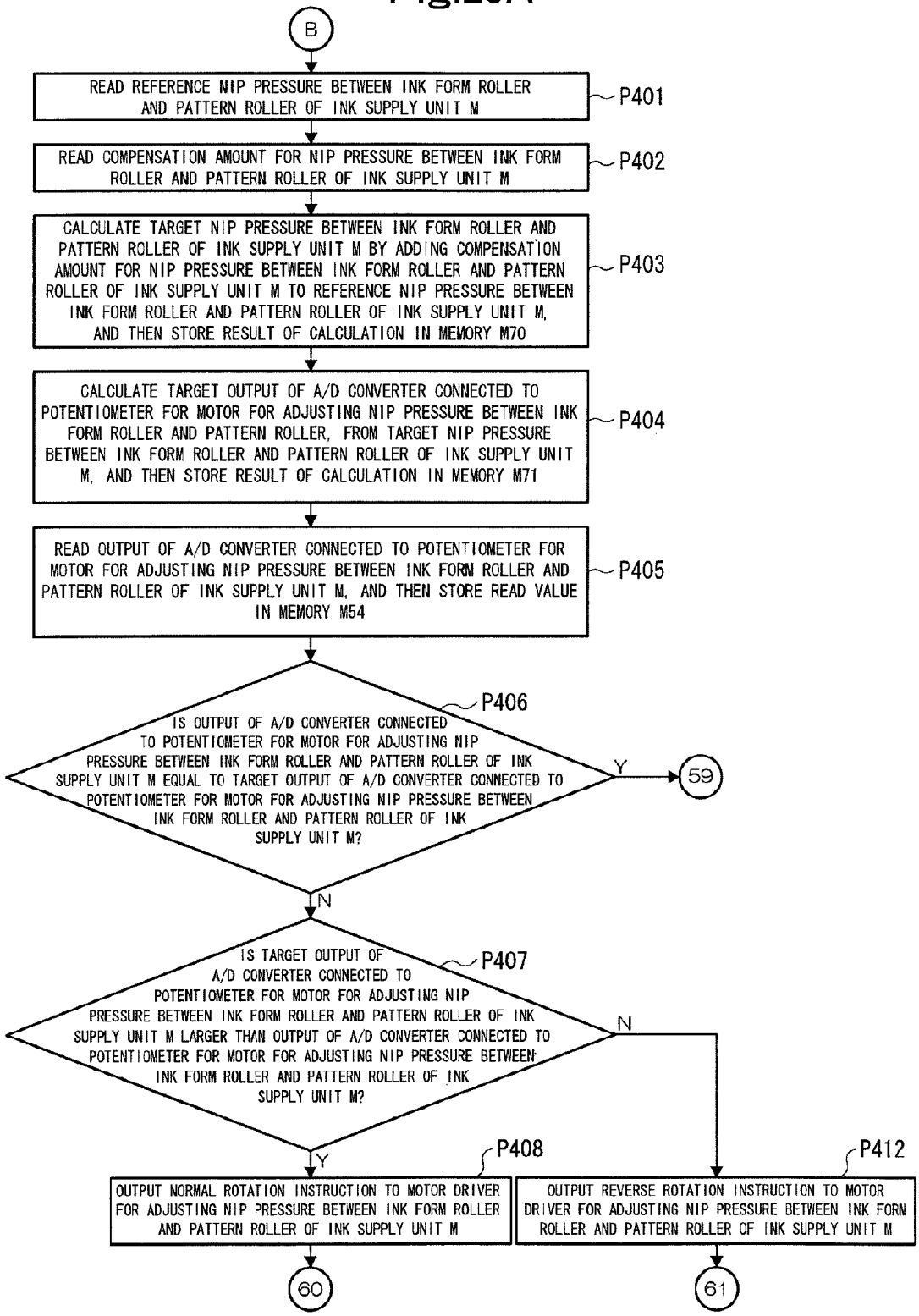
FIG. 25A shows an operational flowchart subsequent to that of FIG. 24C.
Figure 25B:
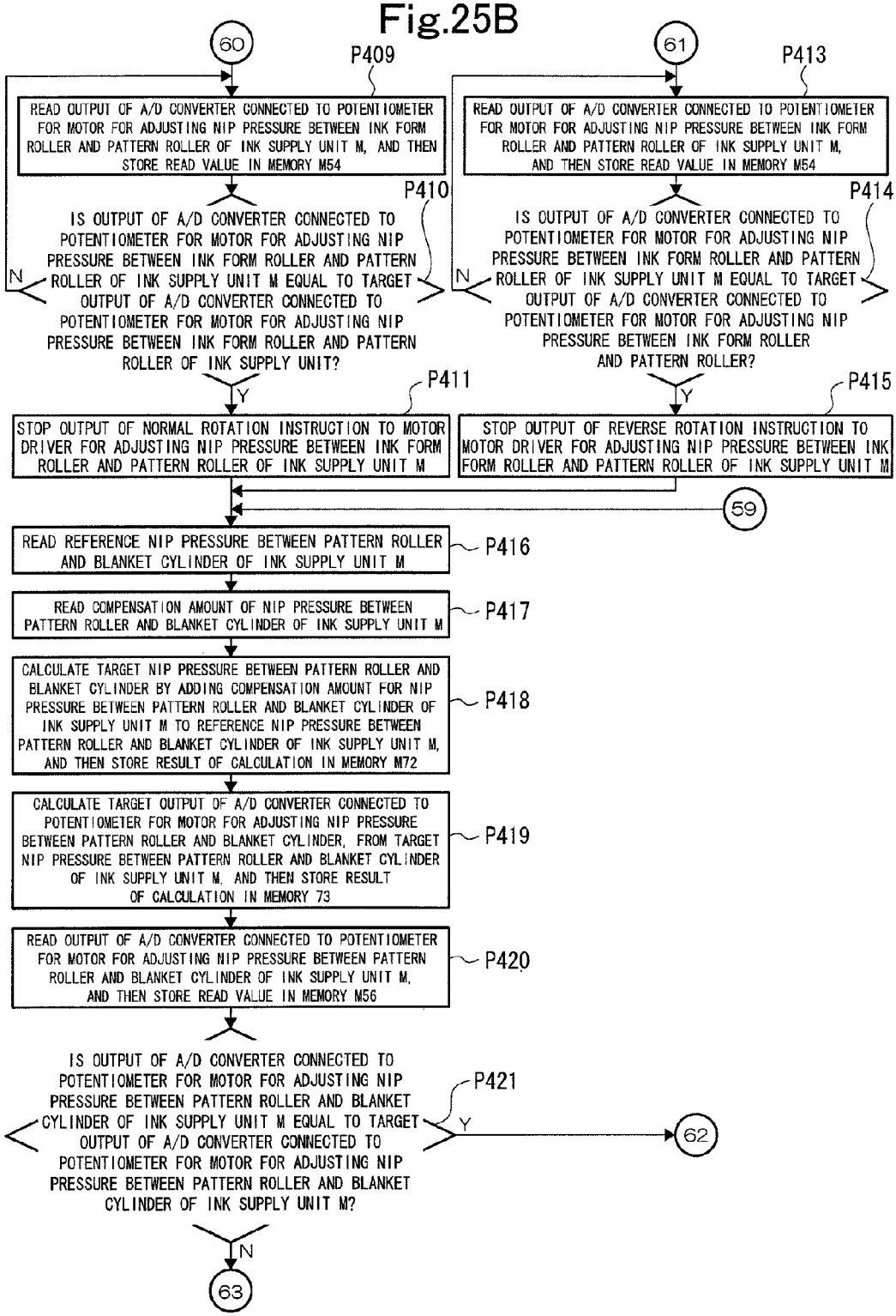
FIG. 25B shows an operational flowchart subsequent to that of FIG. 25A.
Figure 25C:
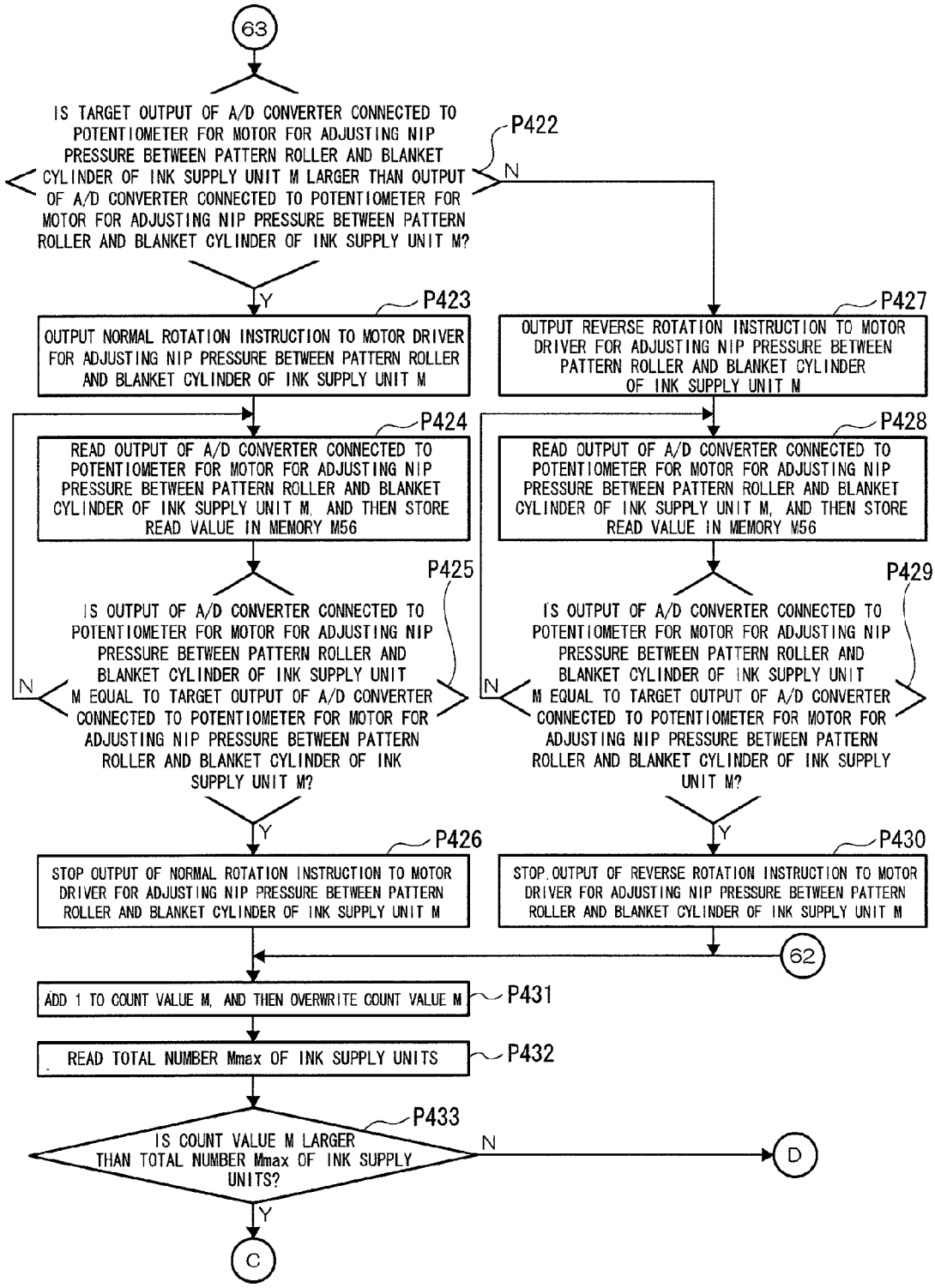
FIG. 25C shows an operational flowchart subsequent to that of FIG. 25B.
Figure 26A:
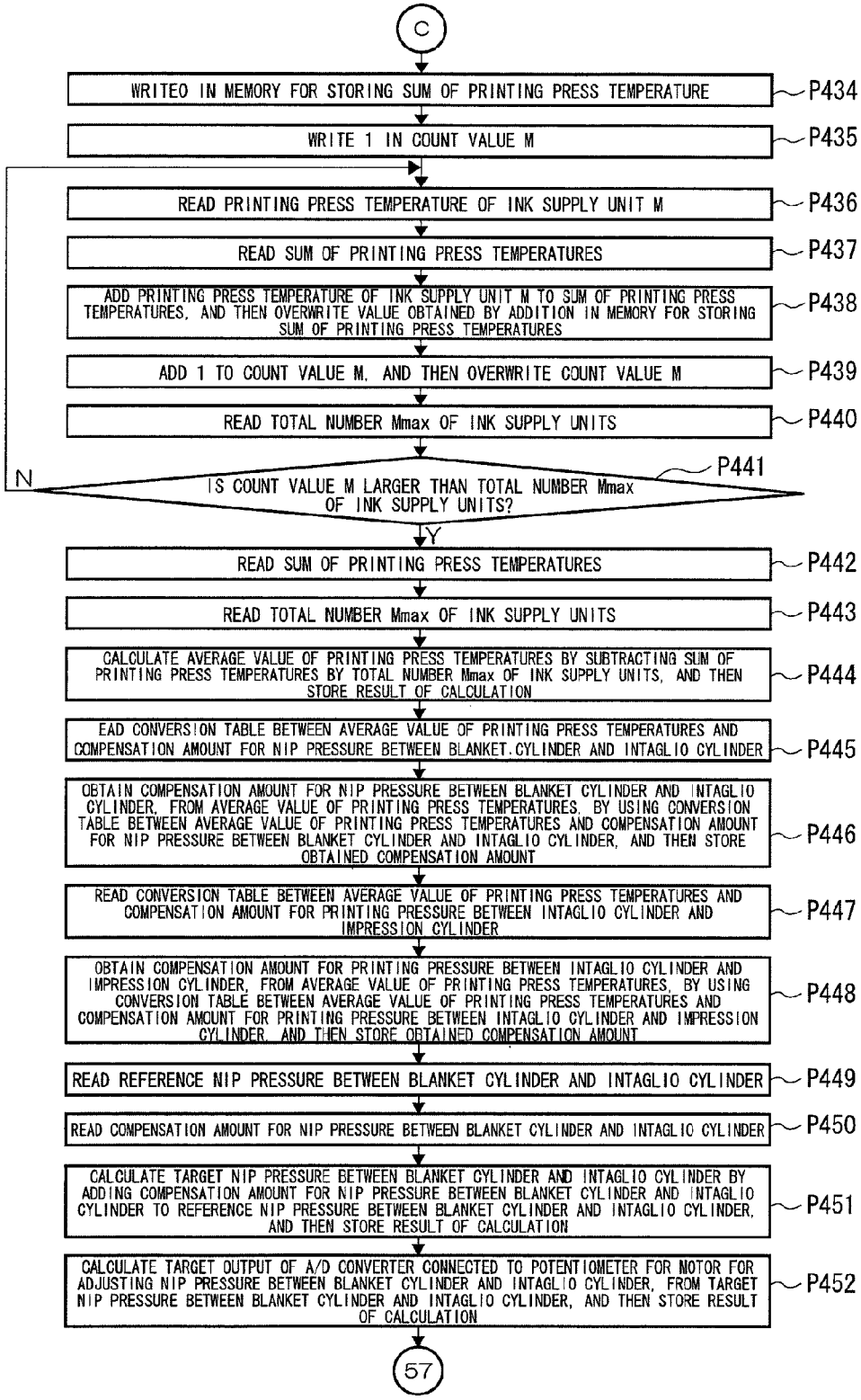
FIG. 26A shows an operational flowchart subsequent to that of FIG. 25C.
Figure 26B:
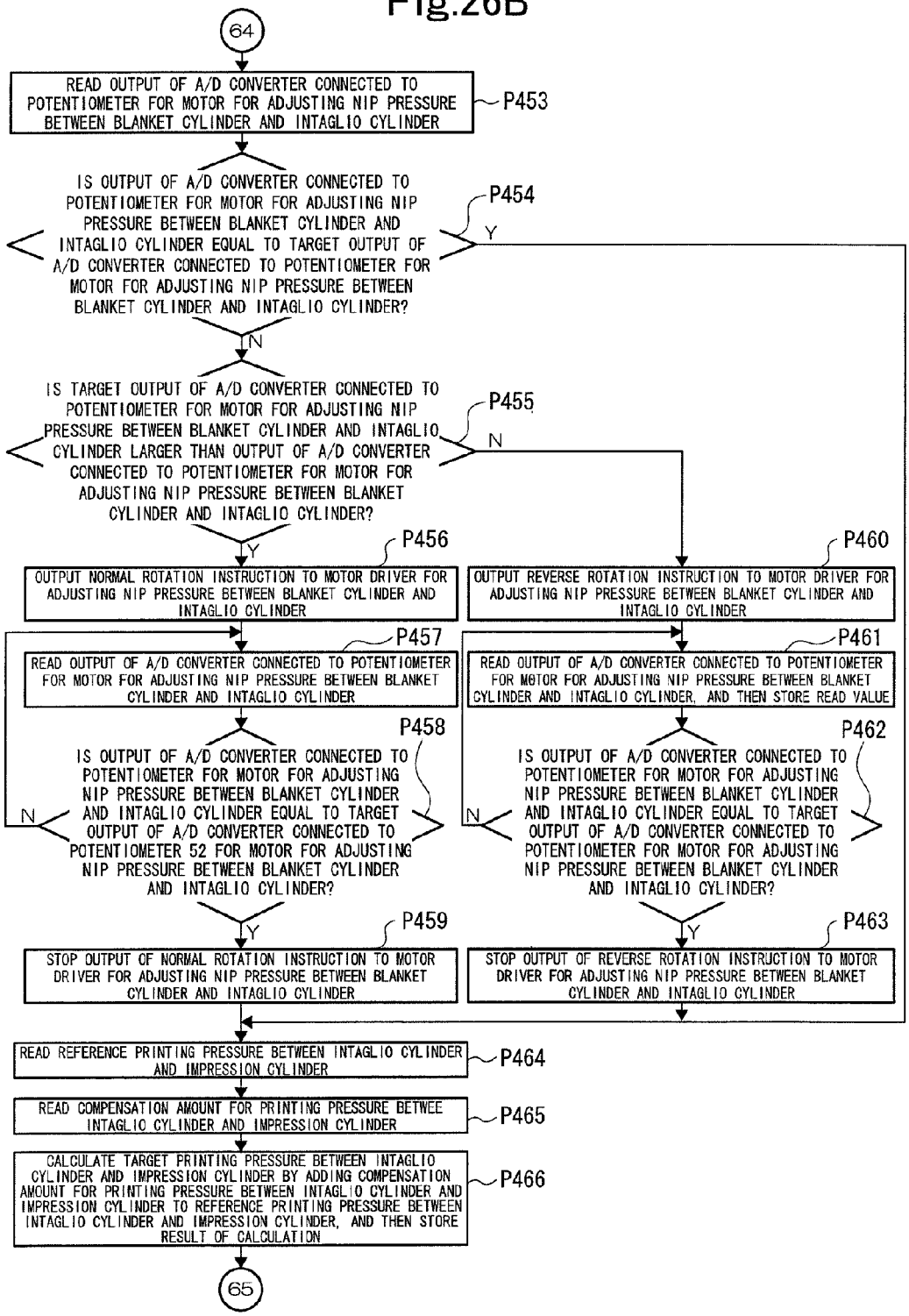
FIG. 26B shows an operational flowchart subsequent to that of FIG. 26A.
Figure 26C:
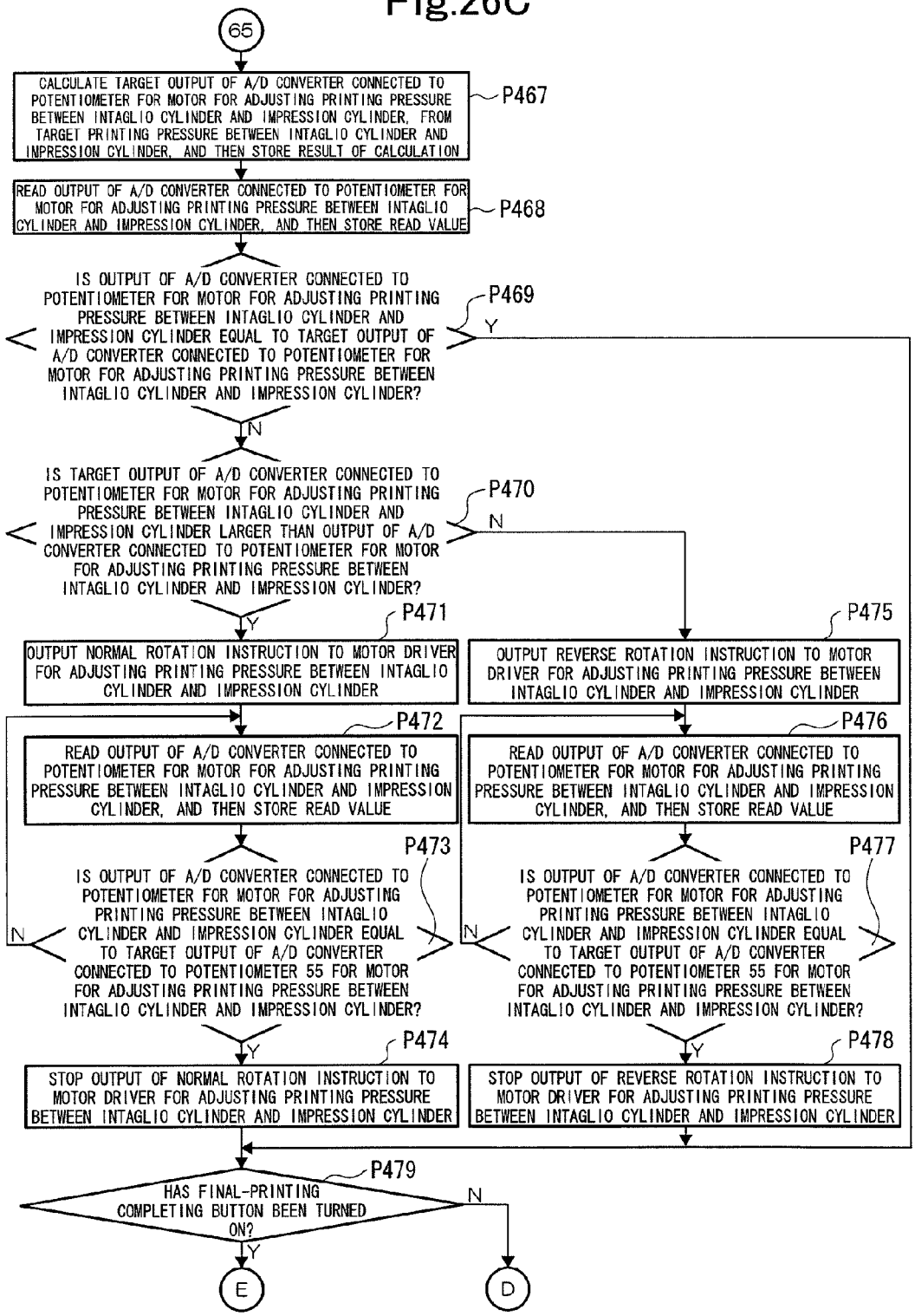
FIG. 26C shows an operational flowchart subsequent to that of FIG. 26B.

Next, a description will be given of a contact-pressure adjusting system for a liquid application machine according to the fifth embodiment of the present invention. FIGS. 22A and 22B show hardware block diagrams of the contact-pressure adjusting system for a liquid application machine according to the fifth embodiment of the present invention. As shown in FIGS. 22A and 22B, the contact-pressure adjusting system 1 includes a CPU 10, a RAM 11, a ROM 12, an input device 13, a display device 14, an output device (an FD drive, a printer or the like) 15, and an I/O (input/output) interface 16.

In addition, the ink supply unit M includes a printing press temperature meter 17, the motor 41 for adjusting the nip pressure between the ink fountain roller 200 and the ink form roller 201, the motor driver 42 for adjusting the nip pressure between the ink fountain roller 200 and the ink form roller 201, the potentiometer 43 for the motor for adjusting the nip pressure between the ink fountain roller 200 and the ink form roller 201, the motor 44 for adjusting the nip pressure between the ink form roller 201 and the pattern roller 202, the motor driver 45 for adjusting the nip pressure between the ink form roller 201 and the pattern roller 202, the potentiometer 46 for the motor for adjusting the nip pressure between the ink form roller 201 and the pattern roller 202, the motor 47 for adjusting the nip pressure between the pattern roller 202 and the blanket cylinder 203, the motor driver 48 for adjusting the nip pressure between the pattern roller 202 and the blanket cylinder 203, the potentiometer 49 for the motor for adjusting the nip pressure between the pattern roller 202 and the blanket cylinder 203, A/D (analog/digital) converters 27 to 30, and I/O (input/output) interfaces 31 to 34.

In the printing press according to the present embodiment, inks of four colors are used. Accordingly, each of an ink supply unit 2' of the first color (for example, black), an ink supply unit 3' of the second color (for example, cyan), an ink supply unit 4' of the third color (for example, magenta), and an ink supply unit 5' of the fourth color (for example, yellow) includes the printing press temperature meter 17, the motor 41 for adjusting the nip pressure between the ink fountain roller 200 and the ink form roller 201, the motor driver 42 for adjusting the nip pressure between the ink fountain roller 200 and the ink form roller 201, the potentiometer 43 for the motor for adjusting the nip pressure between the ink fountain roller 200 and the ink form roller 201, the motor 44 for adjusting the nip pressure between the ink form roller 201 and the pattern roller 202, the motor driver 45 for adjusting the nip pressure between the ink form roller 201 and the pattern roller 202, the potentiometer 46 for the motor for adjusting the nip pressure between the ink form roller 201 and the pattern roller 202, the motor 47 for adjusting the nip pressure between the pattern roller 202 and the blanket cylinder 203, the motor driver 48 for adjusting the nip pressure between the pattern roller 202 and the blanket cylinder 203, the potentiometer 49 for the motor for adjusting the nip pressure between the pattern roller 202 and the blanket cylinder 203, the A/D (analog/digital) converters 27 to 30, and the I/O (input/output) interfaces 31 to 34. Although the inks of four colors are used in the present embodiment, the number of colors of inks to be used may be increased or decreased by increasing or decreasing the number of ink supply units.

Moreover, the contact-pressure adjusting system 1 includes the motor 50 for adjusting the nip pressure between the blanket cylinder 203 and the intaglio cylinder 204, the motor driver 51 for adjusting the nip pressure between the blanket cylinder 203 and the intaglio cylinder 204, the potentiometer 52 for the motor for adjusting the nip pressure between the blanket cylinder 203 and the intaglio cylinder 204, the motor 53 for adjusting the printing pressure between the intaglio cylinder 204 and the impression cylinder 205, the motor driver 54 for adjusting the printing pressure between the intaglio cylinder 204 and the impression cylinder 205, the potentiometer 55 for the motor for adjusting the printing pressure between the intaglio cylinder 204 and the impression cylinder 205, A/D (analog/digital) converters 56 and 57, and I/O (input/output) interfaces 58 and 59.

Furthermore, the contact-pressure adjusting system 1 includes memories M1 to M3, M10 to M12, and M52 to M83. In the memory M1, an ink color ICm of the ink supply unit M is stored. In the memory M2, a selected ink supply unit number is stored. In the memory M3, a count value M is stored. In the memory M10, the total number Mmax of ink supply units is stored. In the memory M1, an output of the A/D converter connected to the printing press temperature meter is stored. In the memory M12, a printing press temperature is stored. In the memory M52, an output of the A/D converter connected to the potentiometer 43 for the motor for adjusting the nip pressure between the ink fountain roller 200 and the ink form roller 201 is stored. In the memory M53, a reference nip pressure between the ink fountain roller 200 and the ink form roller 201 is stored. In the memory M54, an output of the A/D converter connected to the potentiometer 46 for the motor for adjusting the nip pressure between the ink form roller 201 and the pattern roller 202 is stored. In the memory M55, a reference nip pressure between the ink form roller 201 and the pattern roller 202 is stored. In the memory M56, an output of the A/D converter connected to the potentiometer 49 for the motor for adjusting the nip pressure between the pattern roller 202 and the blanket cylinder 203 is stored. In the memory M57, a reference nip pressure between the pattern roller 202 and the blanket cylinder 203 is stored. In the memory M58, an output of the A/D converter connected to the potentiometer 52 for the motor for adjusting the nip pressure between the blanket cylinder 203 and the intaglio cylinder 204 is stored. In the memory M59, a reference nip pressure between the blanket cylinder 203 and the intaglio cylinder 204 is stored. In the memory M60, an output of the A/D converter connected to the potentiometer 55 for the motor for adjusting the printing pressure between the intaglio cylinder 204 and the impression cylinder 205 is stored. In the memory M61, a reference printing pressure between the intaglio cylinder 204 and the impression cylinder 205 is stored. In the memory M62, a conversion table between the printing press temperature and the compensation amount for the nip pressure between the ink fountain roller 200 and the ink form roller 201 is stored. In the memory M63, a compensation amount for the nip pressure between the ink fountain roller 200 and the ink form roller 201 is stored. In the memory M64, a conversion table between the printing press temperature and the compensation amount for the nip pressure between the ink form roller 201 and the pattern roller 202 is stored. In the memory M65, a compensation amount for the nip pressure between the ink form roller 201 and the pattern roller 202 is stored. In the memory M66, a conversion table between the printing press temperature and the compensation amount for the nip pressure between the pattern roller 202 and the blanket cylinder 203 is stored. In the memory M67, a compensation amount for the nip pressure between the pattern roller 202 and the blanket cylinder 203 is stored. In the memory M68, a target nip pressure between the ink fountain roller 200 and the ink form roller 201 is stored. In the memory M69, a target output of the A/D converter connected to the potentiometer 43 for the motor for adjusting the nip pressure between the ink fountain roller 200 and the ink form roller 201 is stored. In the memory M70, a target nip pressure between the ink form roller 201 and the pattern roller 202 is stored. In the memory M71, a target output of the A/D converter connected to the potentiometer 46 for the motor for adjusting the nip pressure between the ink form roller 201 and the pattern roller 202 is stored. In the memory M72, a target nip pressure between the pattern roller 202 and the blanket cylinder 203 is stored. In the memory M73, a target output of the A/D converter connected to the potentiometer 49 for the motor for adjusting the nip pressure between the pattern roller 202 and the blanket cylinder 203 is stored. In the memory M74, the sum of the printing press temperatures is stored. In the memory M75, the average value of the printing press temperatures is stored. In the memory M76, a conversion table between the average value of the printing press temperatures and the compensation amount for the nip pressure between the blanket cylinder 203 and the intaglio cylinder 204 is stored. In the memory M77, a compensation amount for the nip pressure between the blanket cylinder 203 and the intaglio cylinder 204 is stored. In the memory M78, a target nip pressure between the blanket cylinder 203 and the intaglio cylinder 204 is stored. In the memory M79, a target output of the A/D converter connected to the potentiometer 52 for the motor for adjusting the nip pressure between the blanket cylinder 203 and the intaglio cylinder 204 is stored. In the memory M80, a conversion table between the average value of the printing press temperatures and the compensation amount for the printing pressure between the intaglio cylinder 204 and the impression cylinder 205 is stored. In the memory M81, a compensation amount for the printing pressure between the intaglio cylinder 204 and the impression cylinder 205 is stored. In the memory M82, a target printing pressure between the intaglio cylinder 204 and the impression cylinder 205 is stored. In the memory M83, a target output of the A/D converter connected to the potentiometer 55 for the motor for adjusting the printing pressure between the intaglio cylinder 204 and the impression cylinder 205 is stored.

The CPU 10 obtains various kinds of information which are inputted thereto via the I/O interfaces 16, 31 to 34, 58, and 59, and operates in accordance with a program stored in the ROM 12, while accessing the RAM 11 as well as the memories M1 to M3, M10 to M12, and M52 to M83. The input device 13 is provided with various kinds of input devices including an input unit of the ink color ICm of the ink supply unit M, an ink-supply-unit selecting switch, a switch for selecting the adjustment of the nip pressure between the ink fountain roller 200 and the ink form roller 201, a pressure-adjustment completing switch, an up button, a down button, a switch for selecting the adjustment of the nip pressure between the ink form roller 201 and the pattern roller 202, a switch for selecting the adjustment of the nip pressure between the pattern roller 202 and the blanket cylinder 203, a switch for selecting the adjustment of the nip pressure between the blanket cylinder 203 and the intaglio cylinder 204, a switch for selecting the adjustment of the printing pressure between the intaglio cylinder 204 and the impression cylinder 205, a final-printing starting button, a final-printing completing button.

Next, the operation of the contact-pressure adjusting system for a liquid application machine according to the fifth embodiment of the present invention will be described. Each of FIGS. 23A to 23E, 24A to 24C, 25A to 25C, and 26A to 26C shows an operational flowchart of the contact-pressure adjusting system 1 for a liquid application machine according to the fifth embodiment of the present invention. Hereinafter, the content of the processing of each step will be described.

In Step P300, the CPU 10 initializes each memory. Upon completion of the processing of Step P300, the CPU 10 executes P301.

In Step P301, the CPU 10 determines whether or not an ink color ICm of the ink supply unit M has been inputted, by the operator, to the input unit of the ink color ICm of the ink supply unit M, which is provided to the input device 13. When the ink color ICm of the ink supply unit M has been inputted by the operator, the CPU 10 executes Step P302. On the other hand, when the ink color ICm of the ink supply unit M has not been inputted by the operator, the CPU 10 skips Step P302, and then executes P303.

In Step P302, the CPU 10 reads the ink color ICm of the ink supply unit M, and then stores the ink color ICm in the memory M1. Upon completion of the processing of Step P302, the CPU 10 executes Step P303.

In Step P303, the CPU 10 determines whether or not the ink-supply-unit selecting switch, which is provided to the input device 13, has been turned ON by the operator. When the ink-supply-unit selecting switch has been turned ON, the CPU 10 executes Step P304. On the other hand, when the ink-supply-unit selecting switch has not been turned ON, the CPU 10 skips Step P304, and then executes Step P305.

In Step P304, the CPU 10 stores the selected ink supply unit number M in the memory M2. Upon completion of the processing of Step P304, the CPU 10 executes Step P305.

In Step P305, the CPU 10 determines whether or not the switch for selecting the adjustment of the nip pressure between the ink fountain roller and the ink form roller, which is provided to the input device 13, has been turned ON by the operator. When the switch for selecting the adjustment of the nip pressure between the ink fountain roller and the ink form roller has been turned ON, the CPU 10 executes Step P306. On the other hand, when the switch for selecting the adjustment of the nip pressure between the ink fountain roller and the ink form roller has not been turned ON, the CPU 10 skips Step P316, and then executes Step P317.

In Step P306, the CPU 10 determines whether or not the pressure-adjustment completing switch, which is provided to the input device 13, has been turned ON by the operator. When the pressure-adjustment completing switch has been turned ON, the CPU 10 skips Steps P307 to P316, and then executes Step P317. On the other hand, when the pressure-adjustment completing switch has not been turned ON, the CPU 10 executes Step P307.

In Step P307, the CPU 10 determines whether or not the up button, which is provided to the input device 13, has been turned ON by the operator. When the up button has been turned ON, the CPU 10 executes Step P308. On the other hand, when the up button has not been turned ON, the CPU 10 skips Steps P308 to P311, and then executes Step P312.

In Step P308, the CPU 10 reads the selected ink supply unit number M stored in the memory M2. Upon completion of the processing of Step P308, the CPU 10 executes Step P309.

In Step P309, the CPU 10 outputs a normal rotation instruction to the motor driver 42 for adjusting the nip pressure between the ink fountain roller and the ink form roller of the ink supply unit M. Upon completion of the processing of Step P309, the CPU 10 executes Step P310.

In Step P310, the CPU 10 determines whether or not the up button, which is provided to the input device 13, has been turned OFF by the operator. When the up button has been turned OFF, the CPU 10 executes Step P311. On the other hand, when the up button has not been turned OFF, the CPU 10 executes Step P310 again.

In Step P311, the CPU 10 stops the output of the normal rotation instruction to the motor driver 42 for adjusting the nip pressure between the ink fountain roller and the ink form roller of the ink supply unit M. Upon completion of the processing of Step P311, the CPU 10 executes Step P312.

In Step P312, the CPU 10 determines whether or not the down button, which is provided to the input device 13, has been turned ON by the operator. When the down button has been turned ON, the CPU 10 executes Step P313. On the other hand, when the down button has not been turned ON, the CPU 10 executes Step P306.

In Step P313, the CPU 10 reads the selected ink supply unit M stored in the memory M2. Upon completion of the processing of Step P313, the CPU 10 executes Step P314.

In Step P314, the CPU 10 outputs a reverse rotation instruction to the motor driver 42 for adjusting the nip pressure between the ink fountain roller and the ink form roller of the ink supply unit M. Upon completion of the processing of Step P314, the CPU 10 executes Step P315.

In Step P315, the CPU 10 determines whether or not the down button, which is provided to the input device 13, has been turned OFF by the operator. When the down button has been turned OFF, the CPU 10 executes Step P316. On the other hand, when the down button has not been turned OFF, the CPU 10 executes Step P315 again.

In Step P316, the CPU 10 stops the output of the reverse rotation instruction to the motor driver 42 for adjusting the nip pressure between the ink fountain roller and the ink form roller of the ink supply unit M. Upon completion of the processing of Step P316, the CPU 10 executes Step P306.

In Step P317, the CPU 10 determines whether or not the switch for selecting the adjustment of the nip pressure between the ink form roller and the pattern roller, which is provided to the input device 13, has been turned ON by the operator. When the switch for selecting the adjustment of the nip pressure between the ink form roller and the pattern roller has been turned ON, the CPU 10 executes Step P318. On the other hand, when the switch for selecting the adjustment of the nip pressure between the ink form roller and the pattern roller has not been turned ON, the CPU 10 skips Steps P318 to P328, and then executes Step P329.

In Step P318, the CPU 10 determines whether or not the pressure-adjustment completing switch, which is provided to the input device 13, has been turned ON by the operator. When the pressure-adjustment completing switch has been turned ON, the CPU 10 skips Steps P319 to P328, and then executes Step P329. On the other hand, when the pressure-adjustment completing switch has not been turned ON, the CPU 10 executes Step P319.

In Step P319, the CPU 10 determines whether or not the up button, which is provided to the input device 13, has been turned ON by the operator. When the up button has been turned ON, the CPU 10 executes Step P320. On the other hand, when the up button has not been turned ON, the CPU 10 skips Steps P320 to P323, and then executes Step P324.

In Step P320, the CPU 10 reads the selected ink supply unit number M from the memory M2. Upon completion of the processing of Step P320, the CPU 10 executes Step P321.

In Step P321, the CPU 10 outputs a normal rotation instruction to the motor driver 45 for adjusting the nip pressure between the ink form roller and the pattern roller of the ink supply unit M. Upon completion of the processing of Step P321, the CPU 10 executes Step P322.

In Step P322, the CPU 10 determines whether or not the up button, which is provided to the input device 13, has been turned OFF by the operator. When the up button has been turned OFF, the CPU 10 executes Step P323. On the other hand when the up button has not been turned OFF, the CPU 10 executes Step P322 again.

In Step P323, the CPU 10 stops the output of the normal rotation instruction to the motor driver 45 for adjusting the nip pressure between the ink form roller and the pattern roller of the ink supply unit M. Upon completion of the processing of Step P323, the CPU 10 executes Step P324.

In Step P324, the CPU 10 determines whether or not the down button, which is provided to the input device 13, has been turned ON by the operator. When the down button has been turned ON, the CPU 10 executes Step P325. On the other hand, when the down button has not been turned ON, the CPU 10 executes Step P318.

In Step P325, the CPU 10 reads the selected ink supply unit number M from the memory M2. Upon completion of the processing of Step P325, the CPU 10 executes Step P326.

In Step P326, the CPU 10 outputs a reverse rotation instruction to the motor driver 45 for adjusting the nip pressure between the ink form roller and the pattern roller of the ink supply unit M. Upon completion of the processing of Step P326, the CPU 10 executes Step P327.

In Step P327, the CPU 10 determines whether or not the down button, which is provided to the input device 13, has been turned OFF by the operator. When the down button has been turned OFF, the CPU 10 executes Step P328. On the other hand, when the down button has not been turned OFF, the CPU 10 executes Step P327 again.

In Step P328, the CPU 10 stops the output of the reverse rotation instruction to the motor driver 45 for adjusting the nip pressure between the ink form roller and the pattern roller of the ink supply unit M. Upon completion of the processing of Step P328, the CPU 10 executes Step P318.

In Step P329, the CPU 10 determines whether or not the switch for selecting the adjustment of the nip pressure between the pattern roller and the blanket cylinder, which is provided to the input device 13, has been turned ON by the operator. When the switch for selecting the adjustment of the nip pressure between the pattern roller and the blanket cylinder has been turned ON, the CPU 10 executes Step P330. On the other hand, when the switch for selecting the adjustment of the nip pressure between the pattern roller and the blanket cylinder has not been turned ON, the CPU 10 skips Steps P330 to P340, and then executes Step P341.

In Step P330, the CPU 10 determines whether or not the pressure-adjustment completing switch, which is provided to the input device 13, has been turned ON by the operator. When the pressure-adjustment completing switch has been turned ON, the CPU 10 skips Steps P331 to P340, and then executes Step P340. On the other hand, when the pressure-adjustment completing switch has not been turned ON, the CPU 10 executes Step P331.

In Step P331, the CPU 10 determines whether or not the up button, which is provided to the input device 13, has been turned ON by the operator. When the up button has been turned ON, the CPU 10 executes Step P332. On the other hand, when the up button has not been turned ON, the CPU 10 skips Steps P332 to P335, and then executes Step P336.

In Step P332, the CPU 10 reads the selected ink supply unit number M from the memory M2. Upon completion of the processing of Step P332, the CPU 10 executes Step P333.

In Step P333, the CPU 10 outputs a normal rotation instruction to the motor driver 48 for adjusting the nip pressure between the pattern roller and the blanket cylinder of the ink supply unit M. Upon completion of the processing of Step P333, the CPU 10 executes Step P334.

In Step P334, the CPU 10 determines whether or not the up button, which is provided to the input device 13, has been turned OFF by the operator. When the up button has been turned OFF, the CPU 10 executes Step P335. On the other hand, when the up button has not been turned OFF, the CPU 10 executes Step P334 again.

In Step P335, the CPU 10 stops the output of the normal rotation instruction to the motor driver 48 for adjusting the nip pressure between the pattern roller and the blanket cylinder of the ink supply unit M. Upon completion of the processing of Step P335, the CPU 10 executes Step P336.

In Step P336, the CPU 10 determines whether or not the down button, which is provided to the input device 13, has been turned ON by the operator. When the down button has been turned ON, the CPU 10 executes Step P337. On the other hand, when the down button has not been turned ON, the CPU 10 executes Step P330.

In Step P337, the CPU 10 reads the selected ink supply unit number M from the memory M2. Upon completion of the processing of Step P337, the CPU 10 executes Step P338.

In Step P338, the CPU 10 outputs a reverse rotation instruction to the motor driver 48 for adjusting the nip pressure between the pattern roller and the blanket cylinder of the ink supply unit M. Upon completion of the processing of Step P338, the CPU 10 executes Step P339.

In Step P339, the CPU 10 determines whether or not the down button, which is provided to the input device 13, has been turned OFF by the operator. When the down button has been turned OFF, the CPU 10 executes Step P340. On the other hand, when the down button has not been turned OFF, the CPU 10 executes Step P339 again.

In Step P340, the CPU 10 stops the output of the reverse rotation instruction to the motor driver 48 for adjusting the nip pressure between the pattern roller and the blanket cylinder of the ink supply unit M. Upon completion of the processing of Step P340, the CPU 10 executes Step P330.

In Step P341, the CPU 10 determines whether or not the switch for selecting the adjustment of the nip pressure between the blanket cylinder and the intaglio cylinder, which is provided to the input device 13, has been turned ON by the operator. When the switch for selecting the adjustment of the nip pressure between the blanket cylinder and the intaglio cylinder has been turned ON, the CPU 10 executes Step P342. On the other hand, when the switch for selecting the adjustment of the nip pressure between the blanket cylinder and the intaglio cylinder has not been turned ON, the CPU 10 skips Steps P342 to P350, and then executes Step P351.

In Step P342, the CPU 10 determines whether or not the pressure-adjustment completing switch, which is provided to the input device 13, has been turned ON by the operator. When the pressure-adjustment completing switch has been turned ON, the CPU 10 skips Steps P343 to P350, and then executes Step P351. On the other hand, when the pressure-adjustment completing switch has not been turned ON, the CPU 10 executes Step P343.

In Step P343, the CPU 10 determines whether or not the up button, which is provided to the input device 13, has been turned ON by the operator. When the up button has been turned ON, the CPU 10 executes Step P344. On the other hand, when the up button has not been turned ON, the CPU 10 skips Steps P344 to P346, and then executes Step P347.

In Step P344, the CPU 10 outputs a normal rotation instruction to the motor driver 51 for adjusting the nip pressure between the blanket cylinder and the intaglio cylinder. Upon completion of the processing of Step P344, the CPU 10 executes Step P345.

In Step P345, the CPU 10 determines whether or not the up button, which is provided to the input device 13, has been turned OFF by the operator. When the up button has been turned OFF, the CPU 10 executes Step P346. On the other hand, when the up button has not been turned OFF, the CPU 10 executes P345 again.

In Step P346, the CPU 10 stops the output of the normal rotation instruction to the motor driver 51 for adjusting the nip pressure between the blanket cylinder and the intaglio cylinder of the ink supply unit M. Upon completion of the processing of Step P346, the CPU 10 executes Step P347.

In Step P347, the CPU 10 determines whether or not the down button, which is provided to the input device 13, has been turned ON by the operator. When the down button has been turned ON, the CPU 10 executes Step P348. On the other hand, when the down button has not been turned ON, the CPU 10 executes Step P342.

In Step P348, the CPU 10 outputs a reverse rotation instruction to the motor driver 51 for adjusting the nip pressure between the blanket cylinder and the intaglio cylinder. Upon completion of the processing of Step P348, the CPU 10 executes Step P349.

In Step P349, the CPU 10 determines whether or not the down button, which is provided to the input device 13, has been turned OFF by the operator. When the down button has been turned OFF, the CPU 10 executes Step P350. On the other hand, when the down button has not been turned OFF, the CPU 10 executes Step P349 again.

In Step P350, the CPU 10 stops the output of the reverse rotation instruction to the motor driver 51 for adjusting the nip pressure between the blanket cylinder and the intaglio cylinder. Upon completion of the processing of Step P350, the CPU 10 executes Step P342.

In Step P351, the CPU 10 determines whether or not the switch for selecting the adjustment of the printing pressure between the intaglio cylinder and the impression cylinder, which is provided to the input device 13, has been turned ON by the operator. When the switch for selecting the adjustment of the printing pressure between the intaglio cylinder and the impression cylinder has been turned ON, the CPU 10 executes Step P352. On the other hand, when the switch for selecting the adjustment of the printing pressure between the intaglio cylinder and the impression cylinder has not been turned ON, the CPU 10 skips Steps P352 to P360, and then executes Step P361.

In Step P352, the CPU 10 determines whether or not the pressure-adjustment completing switch, which is provided to the input device 13, has been turned ON by the operator. When the pressure-adjustment completing switch has been turned ON, the CPU 10 skips Steps P353 to Step P360, and then executes Step P361. On the other hand, when the pressure-adjustment completing switch has not been turned ON, the CPU 10 executes Step P353.

In Step P353, the CPU 10 determines whether or not the up button, which is provided to the input device 13, has been turned ON by the operator. When the up button has been turned ON, the CPU 10 executes Step P354. On the other hand, when the up button has not been turned ON, the CPU 10 skips Steps P354 to P356, and then executes Step P357.

In Step P354, the CPU 10 outputs a normal rotation instruction to the motor driver 54 for adjusting the printing pressure between the intaglio cylinder and the impression cylinder. Upon completion of the processing of Step P354, the CPU 10 executes Step P355.

In Step P355, the CPU 10 determines whether or not the up button, which is provided to the input device 13, has been turned OFF by the operator. When the up button has been turned OFF, the CPU 10 executes Step P356. On the other hand, when the up button has not been turned OFF, the CPU 10 executes Step P355 again.

In Step P356, the CPU 10 stops the output of the normal rotation instruction to the motor driver 54 for adjusting the printing pressure between the intaglio cylinder and the impression cylinder. Upon completion of the processing of Step P356, the CPU 10 executes Step P357.

In Step P357, the CPU 10 determines whether or not the down button, which is provided to the input device 13, has been turned ON by the operator. When the down button has been turned ON, the CPU 10 executes Step P358. On the other hand, when the down button has not been turned ON, the CPU 10 executes Step P352.

In Step P358, the CPU 10 outputs a reverse rotation instruction to the motor driver 54 for adjusting the printing pressure between the intaglio cylinder and the impression cylinder. Upon completion of the processing of Step P358, the CPU 10 executes Step P359.

In Step P359, the CPU 10 determines whether or not the down button, which is provided to the input device 13, has been turned OFF by the operator. When the down button has been turned OFF, the CPU 10 executes Step P360. On the other hand, when the down button has not been turned OFF, the CPU 10 executes Step P359 again.

In Step P360, the CPU 10 stops the output of the reverse rotation instruction to the motor driver 54 for adjusting the printing pressure between the intaglio cylinder and the impression cylinder of the ink supply unit M. Upon completion of the processing of Step P360, the CPU 10 executes Step P352. With the foregoing steps, the adjustment of each contact-pressure adjusting means of each ink supply unit M before starting the final printing is performed by manual operation of the operator.

In Step P361, the CPU 10 determines whether or not the final-printing starting button, which is provided to the input device 13, has been turned ON by the operator. When the final-printing starting button has been turned ON, the CPU 10 executes Step P362. On the other hand, when the final-printing starting button has not been turned ON, the CPU 10 executes Step P301.

In Step P362, the CPU 10 writes 1 in the count value M, which is stored in the memory M3. Upon completion of the processing of Step P362, the CPU 10 executes Step P363.

In Step P363, the CPU 10 reads the output of the A/D converter connected to the potentiometer 43 for the motor for adjusting the nip pressure between the ink fountain roller and the ink form roller of the ink supply unit M. The CPU 10 then stores the read value in the memory M52. Upon completion of the processing of Step P363, the CPU 10 executes Step P364.

In Step P364, the CPU 10 calculates a reference nip pressure between the ink fountain roller and the ink form roller, from the output of the A/D converter connected to the potentiometer 43 for the motor for adjusting the nip pressure between the ink fountain roller and the ink form roller of the ink supply unit M. The CPU 10 then stores the result of the calculation in the memory M53. Upon completion of the processing of Step P364, the CPU 10 executes Step P365.

In Step P365, the CPU 10 reads the output of the A/D converter connected to the potentiometer 46 for the motor for adjusting the nip pressure between the ink form roller and the pattern roller of the ink supply unit M. The CPU 10 then stores the read value in the memory M54. Upon completion of the processing of Step P365, the CPU 10 executes Step P366.

In Step P366, the CPU 10 calculates a reference nip pressure between the ink form roller and the pattern roller of the ink supply unit M, from the output of the A/D converter connected to the potentiometer 46 for the motor for adjusting the nip pressure between the ink form roller and the pattern roller of the ink supply unit M. The CPU 10 then stores the result of the calculation in the memory M55. Upon completion of the processing of Step P366, the CPU 10 executes Step P367.

In Step P367, the CPU 10 reads the output of the A/D converter connected to the potentiometer 49 for the motor for adjusting the nip pressure between the pattern roller and the blanket cylinder of the ink supply unit M. The CPU 10 then stores the read value in the memory M56. Upon completion of the processing of Step P367, the CPU 10 executes Step P368.

In Step P368, the CPU 10 calculates a reference nip pressure between the pattern roller and the blanket cylinder of the ink supply unit M, from the output of the A/D converter connected to the potentiometer 49 for the motor for adjusting the nip pressure between the pattern roller and the blanket cylinder of the ink supply unit M. The CPU 10 then stores the result of the calculation in the memory M57. Upon completion of the processing of Step P368, the CPU 10 executes Step P369.

In Step P369, the CPU 10 adds 1 to the count value M, which is stored in the memory M3, and then overwrites the count value M. Upon completion of the processing of Step P369, the CPU 10 executes Step P370.

In Step P370, the CPU 10 reads the total number Mmax of ink supply units, which is stored in the memory M10. Upon completion of the processing of Step P370, the CPU 10 executes Step P371.

In Step P371, the CPU 10 determines whether or not the count value M, which is stored in the memory M3, is larger than the total number Mmax of ink supply units. When the count value M, which is stored in the memory M3, is larger than the total number Mmax of ink supply units, the CPU 10 executes Step P372. On the other hand, when the count value M, which is stored in the memory M3, is not larger than the total number Mmax of ink supply units, the CPU 10 executes Step P363.

In Step P372, the CPU 10 reads the output of the A/D converter connected to the potentiometer 52 for the motor for adjusting the nip pressure between the blanket cylinder and the intaglio cylinder. The CPU 10 then stores the read value in the memory M58. Upon completion of the processing of Step P372, the CPU 10 executes Step P373.

In Step P373, the CPU 10 calculates a reference nip pressure between the blanket cylinder and the intaglio cylinder, from the output of the A/D converter connected to the potentiometer 52 for the motor for adjusting the nip pressure between the blanket cylinder and the intaglio cylinder. The CPU 10 then stores the result of the calculation in the memory M59. Upon completion of the processing of Step P373, the CPU 10 executes Step P374.

In Step P374, the CPU 10 reads the output of the A/D converter connected to the potentiometer 55 for the motor for adjusting the printing pressure between the intaglio cylinder and the impression cylinder. The CPU 10 then stores the read value in the memory M60. Upon completion of the processing of Step P374, the CPU 10 executes Step P375.

In Step P375, the CPU 10 calculates a reference printing pressure between the intaglio cylinder and the impression cylinder, from the output of the A/D converter connected to the potentiometer 55 for the motor for adjusting the printing pressure between the intaglio cylinder and the impression cylinder. The CPU 10 then stores the result of the calculation in the memory M61. Upon completion of the processing of Step P375, the CPU executes Step P376. With the foregoing steps, the position of each contact-pressure adjusting means of each ink supply unit M at the time of starting the final printing is stored as a reference position.

In Step P376, the CPU 10 writes 1 in the count value M, which is stored in the memory M3. Upon completion of the processing of Step P376, the CPU 10 executes Step P377.

In Step P377, the CPU 10 reads the output of the A/D converter connected to the printing press temperature meter 17 of the ink supply unit M. The CPU 10 then stores the read value in the memory M11. Upon completion of the processing of Step P377, the CPU 10 executes Step P378.

In Step P378, the CPU 10 calculates a printing press temperature of the ink supply unit M from the output of the A/D converter connected to the printing press temperature meter 17 of the ink supply unit M. The CPU 10 then stores the result of the calculation in the memory M12. Upon completion of the processing of Step P378, the CPU 10 executes Step P379.

In Step P379, the CPU 10 reads the ink color ICm of the ink supply unit M, which is stored in the memory M1. Upon completion of the processing of Step P379, the CPU 10 executes Step P380.

In Step P380, the CPU 10 reads the conversion table between the printing press temperature and the compensation amount for the nip pressure between the ink fountain roller and the ink form roller for the ink color ICm, which is stored in the memory M62. Upon completion of the processing of Step P380, the CPU 10 executes Step P381.

In Step P381, the CPU 10 obtains a compensation amount for the nip pressure between the ink fountain roller and the ink form roller, from the printing press temperature of the ink supply unit M, by using the conversion table between the printing press temperature and the compensation amount for the nip pressure between the ink fountain roller and the ink form roller for the ink color ICm. The CPU 10 then stores the obtained compensation amount in the memory M63. Upon completion of the processing of Step P381, the CPU 10 executes Step P382.

In Step P382, the CPU 10 reads the conversion table between the printing press temperature and the compensation amount for the nip pressure between the ink form roller and the pattern roller for the ink color ICm, which conversion table is stored in the memory M64. Upon completion of the processing of Step P382, the CPU 10 executes Step P383.

In Step P383, the CPU 10 obtains a compensation amount for the nip pressure between the ink form roller and the pattern roller, from the printing press temperature of the ink supply unit M, by using the conversion table between the printing press temperature and the compensation amount for the nip pressure between the ink form roller and the pattern roller for the ink color ICm. The CPU 10 then stores the obtained compensation amount in the memory M65. Upon completion of the processing of Step P383, the CPU 10 executes Step P384.

In Step P384, the CPU 10 reads the conversion table between the printing press temperature and the compensation amount for the nip pressure between the pattern roller and the blanket cylinder for the ink color ICm, which conversion table is stored in the memory M66. Upon completion of the processing of Step P384, the CPU 10 executes Step P385.

In Step P385, the CPU 10 obtains a compensation amount for the nip pressure between the pattern roller and the blanket cylinder, from the printing press temperature of the ink supply unit M, by using the conversion table between the printing press temperature and the compensation amount for the nip pressure between the pattern roller and the blanket cylinder for the ink color ICm. The CPU 10 then stores the obtained compensation amount in the memory M67. Upon completion of the processing of Step P385, the CPU 10 executes Step P386.

In Step P386, the CPU 10 reads the reference nip pressure between the ink fountain roller and the ink form roller of the ink supply unit M, which is stored in the memory M53. Upon completion of the processing of Step P386, the CPU 10 executes Step P387.

In Step P387, the CPU 10 reads the compensation amount for the nip pressure between the ink fountain roller and the ink form roller of the ink supply unit M, which is stored in the memory M63. Upon completion of the processing of Step P387, the CPU 10 executes Step P388.

In Step P388, the CPU 10 calculates a target nip pressure between the ink fountain roller and the ink form roller by adding the compensation amount for the nip pressure between the ink fountain roller and the ink form roller of the ink supply unit M to the reference nip pressure between the ink fountain roller and the ink form roller of the ink supply unit M. The CPU 10 then stores the result of the calculation in the memory M68. Upon completion of the processing of Step P388, the CPU 10 executes Step P389.

In Step P389, the CPU 10 calculates a target output of the A/D converter connected to the potentiometer 43 for the motor for adjusting the nip pressure between the ink fountain roller and the ink form roller, from the target nip pressure between the ink fountain roller and the ink form roller of the ink supply unit M. The CPU 10 then stores the result of the calculation in the memory M69. Upon completion of the processing of Step P389, the CPU 10 executes Step P390.

In Step P390, the CPU 10 reads the output of the A/D converter connected to the potentiometer 43 for the motor for adjusting the nip pressure between the ink fountain roller and the ink form roller of the ink supply unit M. The CPU 10 then stores the read value in the memory M52. Upon completion of the processing of Step P390, the CPU 10 executes Step P391.

In Step P391, the CPU 10 determines whether or not the output of the A/D converter connected to the potentiometer 43 for the motor for adjusting the nip pressure between the ink fountain roller and the ink form roller of the ink supply unit M, which is stored in the memory M52, is equal to the target output of the A/D converter connected to the potentiometer 43 for the motor for adjusting the nip pressure between the ink fountain roller and the ink form roller of the ink supply unit M, which is stored in the memory M69.

When the output of the A/D converter connected to the potentiometer 43 for the motor for adjusting the nip pressure between the ink fountain roller and the ink form roller of the ink supply unit M, which is stored in the memory M52, is equal to the target output of the A/D converter connected to the potentiometer 43 for the motor for adjusting the nip pressure between the ink fountain roller and the ink form roller of the ink supply unit M, which is stored in the memory M69, the CPU 10 skips Steps P392 to P400, and then executes Step P401.

On the other hand, when the output of the A/D converter connected to the potentiometer 43 for the motor for adjusting the nip pressure between the ink fountain roller and the ink form roller of the ink supply unit M, which is stored in the memory M52, is not equal to the target output of the A/D converter connected to the potentiometer 43 for the motor for adjusting the nip pressure between the ink fountain roller and the ink form roller of the ink supply unit M, which is stored in the memory M69, the CPU 10 executes Step P392.

In Step P392, the CPU 10 determines whether or not the target output of the A/D converter connected to the potentiometer 43 for the motor for adjusting the nip pressure between the ink fountain roller and the ink form roller of the ink supply unit M, which is stored in the memory M69, is larger than the output of the A/D converter connected to the potentiometer 43 for the motor for adjusting the nip pressure between the ink fountain roller and the ink form roller of the ink supply unit M, which is stored in the memory M52.

When the target output of the A/D converter connected to the potentiometer 43 for the motor for adjusting the nip pressure between the ink fountain roller and the ink form roller of the ink supply unit M, which is stored in the memory M69, is larger than the output of the A/D converter connected to the potentiometer 43 for the motor for adjusting the nip pressure between the ink fountain roller and the ink form roller of the ink supply unit M, which is stored in the memory M52, the CPU 10 executes Step P393.

On the other hand, when the target output of the A/D converter connected to the potentiometer 43 for the motor for adjusting the nip pressure between the ink fountain roller and the ink form roller of the ink supply unit M, which is stored in the memory M69, is not larger than the output of the A/D converter connected to the potentiometer 43 for the motor for adjusting the nip pressure between the ink fountain roller and the ink form roller of the ink supply unit M, which is stored in the memory M52, the CPU 10 executes Step P397.

In Step P393, the CPU 10 outputs a normal rotation instruction to the motor driver 42 for adjusting the nip pressure between the ink fountain roller and the ink form roller of the ink supply unit M. Upon completion of the processing of Step P393, the CPU 10 executes Step P394.

In Step P394, the CPU 10 reads the output of the A/D converter connected to the potentiometer 43 for the motor for adjusting the nip pressure between the ink fountain roller and the ink form roller of the ink supply unit M. The CPU 10 then stores the read value in the memory M52. Upon completion of the processing of Step P394, the CPU 10 executes Step P395.

In Step P395, the CPU 10 determines whether or not the output of the A/D converter connected to the potentiometer 43 for the motor for adjusting the nip pressure between the ink fountain roller and the ink form roller of the ink supply unit M, which is stored in the memory M52, is equal to the target output of the A/D converter connected to the potentiometer 43 for the motor for adjusting the nip pressure between the ink fountain roller and the ink form roller of the ink supply unit M, which is stored in the memory M69.

When the output of the A/D converter connected to the potentiometer 43 for the motor for adjusting the nip pressure between the ink fountain roller and the ink form roller of the ink supply unit M, which is stored in the memory M52, is equal to the target output of the A/D converter connected to the potentiometer 43 for the motor for adjusting the nip pressure between the ink fountain roller and the ink form roller of the ink supply unit M, which is stored in the memory M69, the CPU 10 executes Step P396.

On the other hand, when the output of the A/D converter connected to the potentiometer 43 for the motor for adjusting the nip pressure between the ink fountain roller and the ink form roller of the ink supply unit M, which is stored in the memory M52, is not equal to the target output of the A/D converter connected to the potentiometer 43 for the motor for adjusting the nip pressure between the ink fountain roller and the ink form roller of the ink supply unit M, which is stored in the memory M69, the CPU 10 executes Step P394.

In Step P396, the CPU 10 stops the output of the normal rotation instruction to the motor driver 42 for adjusting the nip pressure between the ink fountain roller and the ink form roller of the ink supply unit M. Upon completion of the processing of Step P396, the CPU 10 executes Step P401.

In Step P397, the CPU 10 outputs a reverse rotation instruction to the motor driver 42 for adjusting the nip pressure between the ink fountain roller and the ink form roller of the ink supply unit M. Upon completion of the processing of Step P397, the CPU 10 executes Step P398.

In Step P398, the CPU 10 reads the output of the A/D converter connected to the potentiometer 43 for the motor for adjusting the nip pressure between the ink fountain roller and the ink form roller of the ink supply unit M. The CPU 10 then stores the read value in the memory M52. Upon completion of the processing of Step P398, the CPU 10 executes Step P399.

In Step P399, the CPU 10 determines whether or not the output of the A/D converter connected to the potentiometer 43 for the motor for adjusting the nip pressure between the ink fountain roller and the ink form roller of the ink supply unit M, which is stored in the memory M52, is equal to the target output of the A/D converter connected to the potentiometer 43 for the motor for adjusting the nip pressure between the ink fountain roller and the ink form roller of the ink supply unit M, which is stored in the memory M69.

When the output of the A/D converter connected to the potentiometer 43 for the motor for adjusting the nip pressure between the ink fountain roller and the ink form roller of the ink supply unit M, which is stored in the memory M52, is equal to the target output of the A/D converter connected to the potentiometer 43 for the motor for adjusting the nip pressure between the ink fountain roller and the ink form roller of the ink supply unit M, which is stored in the memory M69, the CPU 10 executes Step P400.

On the other hand, when the output of the A/D converter connected to the potentiometer 43 for the motor for adjusting the nip pressure between the ink fountain roller and the ink form roller of the ink supply unit M, which is stored in the memory M52, is not equal to the target output of the A/D converter connected to the potentiometer 43 for the motor for adjusting the nip pressure between the ink fountain roller and the ink form roller of the ink supply unit M, which is stored in the memory M69, the CPU 10 executes Step P398.

In Step P400, the CPU 10 stops the output of the reverse rotation instruction to the motor driver 42 for adjusting the nip pressure between the ink fountain roller and the ink form roller of the ink supply unit M, so as to stop the motor for adjusting the nip pressure between the ink fountain roller and the ink form roller of the ink supply unit M. Upon completion of the processing of Step P400, the CPU 10 executes Step P401.

In Step P401, the CPU 10 reads the reference nip pressure between the ink form roller and the pattern roller of the ink supply unit M, which is stored in the memory M55. Upon completion of the processing of Step P401, the CPU 10 executes Step P402.

In Step P402, the CPU 10 reads the compensation amount for the nip pressure between the ink form roller and the pattern roller of the ink supply unit M, which is stored in the memory M65. Upon completion of the processing of Step P402, the CPU 10 executes Step P403.

In Step P403, the CPU 10 calculates a target nip pressure between the ink form roller and the pattern roller of the ink supply unit M by adding the compensation amount for the nip pressure between the ink form roller and the pattern roller of the ink supply unit M to the reference nip pressure between the ink form roller and the pattern roller of the ink supply unit M. The CPU 10 then stores the result of the calculation in the memory M70. Upon completion of the processing of Step P403, the CPU 10 executes Step P404.

In Step P404, the CPU 10 calculates a target output of the A/D converter connected to the potentiometer 46 for the motor for adjusting the nip pressure between the ink form roller and the pattern roller, from the target nip pressure between the ink form roller and the pattern roller of the ink supply unit M. The CPU 10 then stores the result of the calculation in the memory M71. Upon completion of the processing of Step P404, the CPU 10 executes Step P405.

In Step P405, the CPU 10 reads the output of the A/D converter connected to the potentiometer 46 for the motor for adjusting the nip pressure between the ink form roller and the pattern roller of the ink supply unit M. The CPU 10 then stores the read value in the memory M54. Upon completion of the processing of Step P405, the CPU 10 executes Step P406.

In Step P406, the CPU 10 determines whether or not the output of the A/D converter connected to the potentiometer 46 for the motor for adjusting the nip pressure between the ink form roller and the pattern roller of the ink supply unit M, which is stored in the memory M54, is equal to the target output of the A/D converter connected to the potentiometer 46 for the motor for adjusting the nip pressure between the ink form roller and the pattern roller of the ink supply unit M, which is stored in the memory M71.

When the output of the A/D converter connected to the potentiometer 46 for the motor for adjusting the nip pressure between the ink form roller and the pattern roller of the ink supply unit M, which is stored in the memory M54, is equal to the target output of the A/D converter connected to the potentiometer 46 for the motor for adjusting the nip pressure between the ink form roller and the pattern roller of the ink supply unit M, which is stored in the memory M71, the CPU 10 skips Steps P407 to P415, and then executes Step P416.

On the other hand, when the output of the A/D converter connected to the potentiometer 46 for the motor for adjusting the nip pressure between the ink form roller and the pattern roller of the ink supply unit M, which is stored in the memory M54, is not equal to the target output of the A/D converter connected to the potentiometer 46 for the motor for adjusting the nip pressure between the ink form roller and the pattern roller of the ink supply unit M, which is stored in the memory M71, the CPU 10 executes Step P407.

In Step P407, the CPU 10 determines whether or not the target output of the A/D converter connected to the potentiometer 46 for the motor for adjusting the nip pressure between the ink form roller and the pattern roller of the ink supply unit M, which is stored in the memory M71, is larger than the output of the A/D converter connected to the potentiometer 46 for the motor for adjusting the nip pressure between the ink form roller and the pattern roller of the ink supply unit M, which is stored in the memory M54.

When the target output of the A/D converter connected to the potentiometer 46 for the motor for adjusting the nip pressure between the ink form roller and the pattern roller of the ink supply unit M, which is stored in the memory M71, is larger than the output of the A/D converter connected to the potentiometer 46 for the motor for adjusting the nip pressure between the ink form roller and the pattern roller of the ink supply unit M, which is stored in the memory M54, the CPU 10 executes Step P408.

On the other hand, when the target output of the A/D converter connected to the potentiometer 46 for the motor for adjusting the nip pressure between the ink form roller and the pattern roller of the ink supply unit M, which is stored in the memory M71, is not larger than the output of the A/D converter connected to the potentiometer 46 for the motor for adjusting the nip pressure between the ink form roller and the pattern roller of the ink supply unit M, which is stored in the memory M54, the CPU 10 executes Step P412.

In Step P408, the CPU 10 outputs a normal rotation instruction to the motor driver 45 for adjusting the nip pressure between the ink form roller and the pattern roller of the ink supply unit M. Upon completion of the processing of Step P408, the CPU 10 executes Step P409.

In Step P409, the CPU 10 reads the output of the A/D converter connected to the potentiometer 46 for the motor for adjusting the nip pressure between the ink form roller and the pattern roller of the ink supply unit M. The CPU 10 then stores the read value in the memory M54. Upon completion of the processing of Step P409, the CPU 10 executes Step P410.

In Step P410, the CPU 10 determines whether or not the output of the A/D converter connected to the potentiometer 46 for the motor for adjusting the nip pressure between the ink form roller and the pattern roller of the ink supply unit M, which is stored in the memory M54, is equal to the target output of the A/D converter connected to the potentiometer 46 for the motor for adjusting the nip pressure between the ink form roller and the pattern roller of the ink supply unit, which is stored in the memory M71.

When the output of the A/D converter connected to the potentiometer 46 for the motor for adjusting the nip pressure between the ink form roller and the pattern roller of the ink supply unit M, which is stored in the memory M54, is equal to the target output of the A/D converter connected to the potentiometer 46 for the motor for adjusting the nip pressure between the ink form roller and the pattern roller of the ink supply unit, which is stored in the memory M71, the CPU 10 executes Step P411.

On the other hand, when the output of the A/D converter connected to the potentiometer 46 for the motor for adjusting the nip pressure between the ink form roller and the pattern roller of the ink supply unit M, which is stored in the memory M54, is not equal to the target output of the A/D converter connected to the potentiometer 46 for the motor for adjusting the nip pressure between the ink form roller and the pattern roller of the ink supply unit, which is stored in the memory M71, the CPU 10 executes Step P409.

In Step P411, the CPU 10 stops the output of the normal rotation instruction to the motor driver 45 for adjusting the nip pressure between the ink form roller and the pattern roller of the ink supply unit M. Upon completion of the processing of Step P411, the CPU 10 executes Step P416.

In Step P412, the CPU 10 outputs a reverse rotation instruction to the motor driver 45 for adjusting the nip pressure between the ink form roller and the pattern roller of the ink supply unit M. Upon completion of the processing of Step P412, the CPU 10 executes Step P413.

In Step P413, the CPU 10 reads the output of the A/D converter connected to the potentiometer 46 for the motor for adjusting the nip pressure between the ink form roller and the pattern roller of the ink supply unit M. The CPU 10 then stores the read value in the memory M54. Upon completion of the processing of Step P413, the CPU 10 executes Step P414.

In Step P414, the CPU 10 determines whether or not the output of the A/D converter connected to the potentiometer 46 for the motor for adjusting the nip pressure between the ink form roller and the pattern roller of the ink supply unit M, which is stored in the memory M54, is equal to the target output of the A/D converter connected to the potentiometer 46 for the motor for adjusting the nip pressure between the ink form roller and the pattern roller, which is stored in the memory M71.

When the output of the A/D converter connected to the potentiometer 46 for the motor for adjusting the nip pressure between the ink form roller and the pattern roller of the ink supply unit M, which is stored in the memory M54, is equal to the target output of the A/D converter connected to the potentiometer 46 for the motor for adjusting the nip pressure between the ink form roller and the pattern roller, which is stored in the memory M71, the CPU 10 executes Step P415.

On the other hand, when the output of the A/D converter connected to the potentiometer 46 for the motor for adjusting the nip pressure between the ink form roller and the pattern roller of the ink supply unit M, which is stored in the memory M54, is not equal to the target output of the A/D converter connected to the potentiometer 46 for the motor for adjusting the nip pressure between the ink form roller and the pattern roller, which is stored in the memory M71, the CPU 10 executes Step P413.

In Step P415, the CPU 10 stops the output of the reverse rotation instruction to the motor driver 45 for adjusting the nip pressure between the ink form roller and the pattern roller of the ink supply unit M. Upon completion of the processing of Step P415, the CPU 10 executes Step P416.

In Step P416, the CPU 10 reads the reference nip pressure between the pattern roller and the blanket cylinder of the ink supply unit M, which is stored in the memory M57. Upon completion of the processing of Step P416, the CPU 10 executes Step P417.

In Step P417, the CPU 10 reads the compensation amount of the nip pressure between the pattern roller and the blanket cylinder of the ink supply unit M, which is stored in the memory M67. Upon completion of the processing of Step P417, the CPU 10 executes Step P418.

In Step P418, the CPU 10 calculates a target nip pressure between the pattern roller and the blanket cylinder by adding the compensation amount for the nip pressure between the pattern roller and the blanket cylinder of the ink supply unit M to the reference nip pressure between the pattern roller and the blanket cylinder of the ink supply unit M. The CPU 10 then stores the result of the calculation in the memory M72. Upon completion of the processing of Step P418, the CPU 10 executes Step P419.

In Step P419, the CPU 10 calculates a target output of the A/D converter connected to the potentiometer 49 for the motor for adjusting the nip pressure between the pattern roller and the blanket cylinder, from the target nip pressure between the pattern roller and the blanket cylinder of the ink supply unit M. The CPU 10 then stores the result of the calculation in the memory 73. Upon completion of the processing of Step P419, the CPU 10 executes Step P420.

In Step P420, the CPU 10 reads the output of the A/D converter connected to the potentiometer 49 for the motor for adjusting the nip pressure between the pattern roller and the blanket cylinder of the ink supply unit M. The CPU 10 then stores the read value in the memory M56. Upon completion of the processing of Step P420, the CPU 10 executes Step P421.

In Step P421, the CPU 10 determines whether or not the output of the A/D converter connected to the potentiometer 49 for the motor for adjusting the nip pressure between the pattern roller and the blanket cylinder of the ink supply unit M, which is stored in the memory M56, is equal to the target output of the A/D converter connected to the potentiometer 49 for the motor for adjusting the nip pressure between the pattern roller and the blanket cylinder of the ink supply unit M, which is stored in the memory M73.

When the output of the A/D converter connected to the potentiometer 49 for the motor for adjusting the nip pressure between the pattern roller and the blanket cylinder of the ink supply unit M, which is stored in the memory M56, is equal to the target output of the A/D converter connected to the potentiometer 49 for the motor for adjusting the nip pressure between the pattern roller and the blanket cylinder of the ink supply unit M, which is stored in the memory M73, the CPU 10 skips Steps P422 to P430, and then executes Step P431.

On the other hand, when the output of the A/D converter connected to the potentiometer 49 for the motor for adjusting the nip pressure between the pattern roller and the blanket cylinder of the ink supply unit M, which is stored in the memory M56, is not equal to the target output of the A/D converter connected to the potentiometer 49 for the motor for adjusting the nip pressure between the pattern roller and the blanket cylinder of the ink supply unit M, which is stored in the memory M73, the CPU 10 executes Step P422.

In Step P422, the CPU 10 determines whether or not the target output of the A/D converter connected to the potentiometer 49 for the motor for adjusting the nip pressure between the pattern roller and the blanket cylinder of the ink supply unit M, which is stored in the memory M73, is larger than the output of the A/D converter connected to the potentiometer 49 for the motor for adjusting the nip pressure between the pattern roller and the blanket cylinder of the ink supply unit M, which is stored in the memory M56.

When the target output of the A/D converter connected to the potentiometer 49 for the motor for adjusting the nip pressure between the pattern roller and the blanket cylinder of the ink supply unit M, which is stored in the memory M73, is larger than the output of the A/D converter connected to the potentiometer 49 for the motor for adjusting the nip pressure between the pattern roller and the blanket cylinder of the ink supply unit M, which is stored in the memory M56, the CPU 10 executes Step P423.

On the other hand, when the target output of the A/D converter connected to the potentiometer 49 for the motor for adjusting the nip pressure between the pattern roller and the blanket cylinder of the ink supply unit M, which is stored in the memory M73, is not larger than the output of the A/D converter connected to the potentiometer 49 for the motor for adjusting the nip pressure between the pattern roller and the blanket cylinder of the ink supply unit M, which is stored in the memory M56, the CPU 10 executes Step P427.

In Step P423, the CPU 10 outputs a normal rotation instruction to the motor driver 48 for adjusting the nip pressure between the pattern roller and the blanket cylinder of the ink supply unit M. Upon completion of the processing of Step P423, the CPU 10 executes Step P424.

In Step P424, the CPU 10 reads the output of the A/D converter connected to the potentiometer 49 for the motor for adjusting the nip pressure between the pattern roller and the blanket cylinder of the ink supply unit M. The CPU 10 then stores the read value in the memory M56. Upon completion of the processing of Step P424, the CPU 10 executes Step P425.

In Step P425, the CPU 10 determines whether or not the output of the A/D converter connected to the potentiometer 49 for the motor for adjusting the nip pressure between the pattern roller and the blanket cylinder of the ink supply unit M, which is stored in the memory M56, is equal to the target output of the A/D converter connected to the potentiometer 49 for the motor for adjusting the nip pressure between the pattern roller and the blanket cylinder of the ink supply unit M, which is stored in the memory M73.

When the output of the A/D converter connected to the potentiometer 49 for the motor for adjusting the nip pressure between the pattern roller and the blanket cylinder of the ink supply unit M, which is stored in the memory M56, is equal to the target output of the A/D converter connected to the potentiometer 49 for the motor for adjusting the nip pressure between the pattern roller and the blanket cylinder of the ink supply unit M, which is stored in the memory M73, the CPU 10 executes Step P426.

On the other hand, when the output of the A/D converter connected to the potentiometer 49 for the motor for adjusting the nip pressure between the pattern roller and the blanket cylinder of the ink supply unit M, which is stored in the memory M56, is not equal to the target output of the A/D converter connected to the potentiometer 49 for the motor for adjusting the nip pressure between the pattern roller and the blanket cylinder of the ink supply unit M, which is stored in the memory M73, the CPU 10 executes Step P424.

In Step P426, the CPU 10 stops the output of the normal rotation instruction to the motor driver 48 for adjusting the nip pressure between the pattern roller and the blanket cylinder of the ink supply unit M. Upon completion of the processing of Step P426, the CPU 10 executes Step P431.

In Step P427, the CPU 10 outputs a reverse rotation instruction to the motor driver 48 for adjusting the nip pressure between the pattern roller and the blanket cylinder of the ink supply unit M.

In Step P428, the CPU 10 reads the output of the A/D converter connected to the potentiometer 49 for the motor for adjusting the nip pressure between the pattern roller and the blanket cylinder of the ink supply unit M. The CPU 10 then stores the read value in the memory M56. Upon completion of the processing of Step P428, the CPU 10 executes Step P429.

In Step P429, the CPU 10 determines whether or not the output of the A/D converter connected to the potentiometer 49 for the motor for adjusting the nip pressure between the pattern roller and the blanket cylinder of the ink supply unit M, which is stored in the memory M56, is equal to the target output of the A/D converter connected to the potentiometer 49 for the motor for adjusting the nip pressure between the pattern roller and the blanket cylinder of the ink supply unit M, which is stored in the memory M73.

When the output of the A/D converter connected to the potentiometer 49 for the motor for adjusting the nip pressure between the pattern roller and the blanket cylinder of the ink supply unit M, which is stored in the memory M56, is equal to the target output of the A/D converter connected to the potentiometer 49 for the motor for adjusting the nip pressure between the pattern roller and the blanket cylinder of the ink supply unit M, which is stored in the memory M73, the CPU 10 executes Step P430.

On the other hand, when the output of the A/D converter connected to the potentiometer 49 for the motor for adjusting the nip pressure between the pattern roller and the blanket cylinder of the ink supply unit M, which is stored in the memory M56, is not equal to the target output of the A/D converter connected to the potentiometer 49 for the motor for adjusting the nip pressure between the pattern roller and the blanket cylinder of the ink supply unit M, which is stored in the memory M73, the CPU 10 executes Step P428.

In Step P430, the CPU 10 stops the output of the reverse rotation instruction to the motor driver 48 for adjusting the nip pressure between the pattern roller and the blanket cylinder of the ink supply unit M. Upon completion of the processing of Step P430, the CPU 10 executes Step P431.

In Step P431, the CPU 10 adds 1 to the count value M, which is stored in the memory M3, and then overwrites the count value M. Upon completion of the processing of Step P431, the CPU 10 executes Step P432.

In Step P432, the CPU 10 reads the total number Mmax of ink supply units, which is stored in the memory M10. Upon completion of the processing of Step P432, the CPU 10 executes Step P433.

In Step P433, the CPU 10 determines whether or not the count value M, which is stored in the memory M3, is larger than the total number Mmax of ink supply units. When the count value M, which is stored in the memory M3, is larger than the total number Mmax of ink supply units, the CPU 10 executes Step P434. On the other hand, when the count value M, which is stored in the memory M3, is not larger than the total number Mmax of ink supply units, the CPU 10 executes Step P377.

In Step P434, the CPU 10 writes 0 in the memory M74 for storing the sum of the printing press temperature. Upon completion of the processing of Step P434, the CPU 10 executes Step P435.

In Step P435, the CPU 10 writes 1 in the count value M, which is stored in the memory M3. Upon completion of the processing of Step P435, the CPU 10 executes Step P436.

In Step P436, the CPU 10 reads the printing press temperature of the ink supply unit M, which is stored in the memory M12. Upon completion of the processing of Step P436, the CPU 10 executes Step P437.

In Step P437, the CPU 10 reads the sum of the printing press temperatures, which is stored in the memory M74. Upon completion of the processing of Step P437, the CPU 10 executes Step P438.

In Step P438, the CPU 10 adds the printing press temperature of the ink supply unit M to the sum of the printing press temperatures. The CPU 10 then overwrites the value obtained by the addition in the memory M74 for storing the sum of the printing press temperatures. Upon completion of the processing of Step P438, the CPU 10 executes Step P439.

In Step P439, the CPU 10 adds 1 to the count value M, which is stored in the memory M3, and then overwrites the count value M. Upon completion of the processing of Step P439, the CPU 10 executes Step P440.

In Step P440, the CPU 10 reads the total number Mmax of ink supply units from the memory M10. Upon completion of the processing of Step P440, the CPU 10 executes Step P441.

In Step P441, the CPU 10 determines whether or not the count value M, which is stored in the memory M3, is larger than the total number Mmax of ink supply units. When the count value M, which is stored in the memory M3, is larger than the total number Mmax of ink supply units, the CPU 10 executes Step P442. On the other hand, when the count value M, which is stored in the memory M3, is not larger than the total number Mmax of ink supply units, the CPU 10 executes Step P436.

In Step P442, the CPU 10 reads the sum of the printing press temperatures from the memory M74. Upon completion of the processing of Step P442, the CPU 10 executes Step P443.

In Step P443, the CPU 10 reads the total number Mmax of ink supply units from the memory M10. Upon completion of the processing of Step P443, the CPU 10 executes Step P444.

In Step P444, the CPU 10 calculates an average value of the printing press temperatures by subtracting the sum of the printing press temperatures by the total number Mmax of ink supply units. The CPU 10 then stores the result of the calculation in the memory M75. Upon completion of the processing of Step P444, the CPU 10 executes Step P445.

In Step P445, the CPU 10 reads the conversion table between the average value of the printing press temperatures and the compensation amount for the nip pressure between the blanket cylinder and the intaglio cylinder, which conversion table is stored in the memory M76. Upon completion of the processing of Step P445, the CPU 10 executes Step P446.

In Step P446, the CPU 10 obtains a compensation amount for the nip pressure between the blanket cylinder and the intaglio cylinder, from the average value of the printing press temperatures, by using the conversion table between the average value of the printing press temperatures and the compensation amount for the nip pressure between the blanket cylinder and the intaglio cylinder. The CPU 10 then stores the obtained compensation amount in the memory M77. Upon completion of the processing of Step P446, the CPU 10 executes Step P447.

In Step P447, the CPU 10 reads the conversion table between the average value of the printing press temperatures and the compensation amount for the printing pressure between the intaglio cylinder and the impression cylinder, which conversion table is stored in the memory M80. Upon completion of the processing of Step P447, the CPU 10 executes Step P448.

In Step P448, the CPU 10 obtains a compensation amount for the printing pressure between the intaglio cylinder and the impression cylinder, from the average value of the printing press temperatures, by using the conversion table between the average value of the printing press temperatures and the compensation amount for the printing pressure between the intaglio cylinder and the impression cylinder. The CPU 10 then stores the obtained compensation amount in the memory M81. Upon completion of the processing of Step P448, the CPU 10 executes Step P449.

In Step P449, the CPU 10 reads the reference nip pressure between the blanket cylinder and the intaglio cylinder, which is stored in the memory M59. Upon completion of the processing of Step P449, the CPU 10 executes Step P450.

In Step P450, the CPU 10 reads the compensation amount for the nip pressure between the blanket cylinder and the intaglio cylinder, which is stored in the memory M77. Upon completion of the processing of Step P450, the CPU 10 executes Step P451.

In Step P451, the CPU 10 calculates a target nip pressure between the blanket cylinder and the intaglio cylinder by adding the compensation amount for the nip pressure between the blanket cylinder and the intaglio cylinder to the reference nip pressure between the blanket cylinder and the intaglio cylinder. The CPU 10 then stores the result of the calculation in the memory M78. Upon completion of the processing of Step P451, the CPU 10 executes Step P452.

In Step P452, the CPU 10 calculates a target output of the A/D converter connected to the potentiometer 52 for the motor for adjusting the nip pressure between the blanket cylinder and the intaglio cylinder, from the target nip pressure between the blanket cylinder and the intaglio cylinder. The CPU 10 then stores the result of the calculation in the memory M79. Upon completion of the processing of Step P452, the CPU 10 executes Step P453.

In Step P453, the CPU 10 reads the output of the A/D converter connected to the potentiometer 52 for the motor for adjusting the nip pressure between the blanket cylinder and the intaglio cylinder. The CPU 10 then stores the read value in the memory M58. Upon completion of the processing of Step P453, the CPU 10 executes Step P454.

In Step P454, the CPU 10 determines whether or not the output of the A/D converter connected to the potentiometer 52 for the motor for adjusting the nip pressure between the blanket cylinder and the intaglio cylinder, which is stored in the memory M58, is equal to the target output of the A/D converter connected to the potentiometer 52 for the motor for adjusting the nip pressure between the blanket cylinder and the intaglio cylinder, which is stored in the memory M79.

When the output of the A/D converter connected to the potentiometer 52 for the motor for adjusting the nip pressure between the blanket cylinder and the intaglio cylinder, which is stored in the memory M58, is equal to the target output of the A/D converter connected to the potentiometer 52 for the motor for adjusting the nip pressure between the blanket cylinder and the intaglio cylinder, which is stored in the memory M79, the CPU 10 skips Steps P455 to P463, and then executes Step P464.

On the other hand, when the output of the A/D converter connected to the potentiometer 52 for the motor for adjusting the nip pressure between the blanket cylinder and the intaglio cylinder, which is stored in the memory M58, is not equal to the target output of the A/D converter connected to the potentiometer 52 for the motor for adjusting the nip pressure between the blanket cylinder and the intaglio cylinder, which is stored in the memory M79, the CPU 10 executes Step P455.

In Step P455, the CPU 10 determines whether or not the target output of the A/D converter connected to the potentiometer 52 for the motor for adjusting the nip pressure between the blanket cylinder and the intaglio cylinder, which is stored in the memory M79, is larger than the output of the A/D converter connected to the potentiometer 52 for the motor for adjusting the nip pressure between the blanket cylinder and the intaglio cylinder, which is stored in the memory M58.

When the target output of the A/D converter connected to the potentiometer 52 for the motor for adjusting the nip pressure between the blanket cylinder and the intaglio cylinder, which is stored in the memory M79, is larger than the output of the A/D converter connected to the potentiometer 52 for the motor for adjusting the nip pressure between the blanket cylinder and the intaglio cylinder, which is stored in the memory M58, the CPU 10 executes Step P456.

On the other hand, when the target output of the A/D converter connected to the potentiometer 52 for the motor for adjusting the nip pressure between the blanket cylinder and the intaglio cylinder, which is stored in the memory M79, is not larger than the output of the A/D converter connected to the potentiometer 52 for the motor for adjusting the nip pressure between the blanket cylinder and the intaglio cylinder, which is stored in the memory M58, the CPU 10 executes Step P460.

In Step P456, the CPU 10 outputs a normal rotation instruction to the motor driver 51 for adjusting the nip pressure between the blanket cylinder and the intaglio cylinder. Upon completion of the processing of Step P456, the CPU 10 executes Step P457.

In Step P457, the CPU 10 reads the output of the A/D converter connected to the potentiometer 52 for the motor for adjusting the nip pressure between the blanket cylinder and the intaglio cylinder. The CPU 10 then stores the read value in the memory M58. Upon completion of the processing of Step P457, the CPU 10 executes Step P458.

In Step P458, the CPU 10 determines whether or not the output of the A/D converter connected to the potentiometer 52 for the motor for adjusting the nip pressure between the blanket cylinder and the intaglio cylinder, which is stored in the memory M58, is equal to the target output of the A/D converter connected to the potentiometer 52 for the motor for adjusting the nip pressure between the blanket cylinder and the intaglio cylinder, which is stored in the memory M79.

When the output of the A/D converter connected to the potentiometer 52 for the motor for adjusting the nip pressure between the blanket cylinder and the intaglio cylinder, which is stored in the memory M58, is equal to the target output of the A/D converter connected to the potentiometer 52 for the motor for adjusting the nip pressure between the blanket cylinder and the intaglio cylinder, which is stored in the memory M79, the CPU 10 executes Step P459.

On the other hand, when the output of the A/D converter connected to the potentiometer 52 for the motor for adjusting the nip pressure between the blanket cylinder and the intaglio cylinder, which is stored in the memory M58, is not equal to the target output of the A/D converter connected to the potentiometer 52 for the motor for adjusting the nip pressure between the blanket cylinder and the intaglio cylinder, which is stored in the memory M79, the CPU 10 executes Step P457.

In Step P459, the CPU stops the output of the normal rotation instruction to the motor driver 51 for adjusting the nip pressure between the blanket cylinder and the intaglio cylinder. Upon completion of the processing of Step P459, the CPU 10 executes Step P464.

In Step P460, the CPU 10 outputs a reverse rotation instruction to the motor driver 51 for adjusting the nip pressure between the blanket cylinder and the intaglio cylinder. Upon completion of the processing of Step P460, the CPU 10 executes Step P461.

In Step P461, the CPU 10 reads the output of the A/D converter connected to the potentiometer 52 for the motor for adjusting the nip pressure between the blanket cylinder and the intaglio cylinder. The CPU 10 then stores the read value in the memory M58. Upon completion of the processing of Step P461, the CPU 10 executes Step P462.

In Step P462, the CPU 10 determines whether or not the output of the A/D converter connected to the potentiometer 52 for the motor for adjusting the nip pressure between the blanket cylinder and the intaglio cylinder, which is stored in the memory M58, is equal to the target output of the A/D converter connected to the potentiometer 52 for the motor for adjusting the nip pressure between the blanket cylinder and the intaglio cylinder, which is stored in the memory M79.

When the output of the A/D converter connected to the potentiometer 52 for the motor for adjusting the nip pressure between the blanket cylinder and the intaglio cylinder, which is stored in the memory M58, is equal to the target output of the A/D converter connected to the potentiometer 52 for the motor for adjusting the nip pressure between the blanket cylinder and the intaglio cylinder, which is stored in the memory M79, the CPU 10 executes Step P463.

On the other hand, when the output of the A/D converter connected to the potentiometer 52 for the motor for adjusting the nip pressure between the blanket cylinder and the intaglio cylinder, which is stored in the memory M58, is not equal to the target output of the A/D converter connected to the potentiometer 52 for the motor for adjusting the nip pressure between the blanket cylinder and the intaglio cylinder, which is stored in the memory M79, the CPU 10 executes Step P461.

In Step P463, the CPU 10 stops the output of the reverse rotation instruction to the motor driver 51 for adjusting the nip pressure between the blanket cylinder and the intaglio cylinder. Upon completion of the processing of Step P463, the CPU 10 executes Step P464.

In Step P464, the CPU 10 reads the reference printing pressure between the intaglio cylinder and the impression cylinder, which is stored in the memory M61. Upon completion of the processing of Step P464, the CPU 10 executes Step P465.

In Step P465, the CPU 10 reads the compensation amount for the printing pressure between the intaglio cylinder and the impression cylinder, which is stored in the memory M81. Upon completion of the processing of Step P465, the CPU 10 executes Step P466.

In Step P466, the CPU 10 calculates a target printing pressure between the intaglio cylinder and the impression cylinder by adding the compensation amount for the printing pressure between the intaglio cylinder and the impression cylinder to the reference printing pressure between the intaglio cylinder and the impression cylinder. The CPU 10 then stores the result of the calculation in the memory M82. Upon completion of the processing of Step P466, the CPU 10 executes Step P467.

In Step P467, the CPU 10 calculates a target output of the A/D converter connected to the potentiometer 55 for the motor for adjusting the printing pressure between the intaglio cylinder and the impression cylinder, from the target printing pressure between the intaglio cylinder and the impression cylinder. The CPU 10 then stores the result of the calculation in the memory M83. Upon completion of the processing of Step P467, the CPU 10 executes Step P468.

In Step P468, the CPU 10 reads the output of the A/D converter connected to the potentiometer 55 for the motor for adjusting the printing pressure between the intaglio cylinder and the impression cylinder. The CPU 10 then stores the read value in the memory M60. Upon completion of the processing of Step P468, the CPU 10 executes Step P469.

In Step P469, the CPU 10 determines whether or not the output of the A/D converter connected to the potentiometer 55 for the motor for adjusting the printing pressure between the intaglio cylinder and the impression cylinder, which is stored in the memory M60, is equal to the target output of the A/D converter connected to the potentiometer 55 for the motor for adjusting the printing pressure between the intaglio cylinder and the impression cylinder, which is stored in the memory M83.

When the output of the A/D converter connected to the potentiometer 55 for the motor for adjusting the printing pressure between the intaglio cylinder and the impression cylinder, which is stored in the memory M60, is equal to the target output of the A/D converter connected to the potentiometer 55 for the motor for adjusting the printing pressure between the intaglio cylinder and the impression cylinder, which is stored in the memory M83, the CPU 10 skips Steps P470 to P478, and then executes Step P479.

On the other hand, when the output of the A/D converter connected to the potentiometer 55 for the motor for adjusting the printing pressure between the intaglio cylinder and the impression cylinder, which is stored in the memory M60, is not equal to the target output of the A/D converter connected to the potentiometer 55 for the motor for adjusting the printing pressure between the intaglio cylinder and the impression cylinder, which is stored in the memory M83, the CPU 10 executes Step P470.

In Step P470, the CPU 10 determines whether or not the target output of the A/D converter connected to the potentiometer 55 for the motor for adjusting the printing pressure between the intaglio cylinder and the impression cylinder, which is stored in the memory M83, is larger than the output of the A/D converter connected to the potentiometer 55 for the motor for adjusting the printing pressure between the intaglio cylinder and the impression cylinder, which is stored in the memory M60.

When the target output of the A/D converter connected to the potentiometer 55 for the motor for adjusting the printing pressure between the intaglio cylinder and the impression cylinder, which is stored in the memory M83, is larger than the output of the A/D converter connected to the potentiometer 55 for the motor for adjusting the printing pressure between the intaglio cylinder and the impression cylinder, which is stored in the memory M60, the CPU 10 executes Step P471.

On the other hand, when the target output of the A/D converter connected to the potentiometer 55 for the motor for adjusting the printing pressure between the intaglio cylinder and the impression cylinder, which is stored in the memory M83, is not larger than the output of the A/D converter connected to the potentiometer 55 for the motor for adjusting the printing pressure between the intaglio cylinder and the impression cylinder, which is stored in the memory M60, the CPU 10 executes Step P475.

In Step P471, the CPU 10 outputs a normal rotation instruction to the motor driver 54 for adjusting the printing pressure between the intaglio cylinder and the impression cylinder. Upon completion of the processing of Step P471, the CPU 10 executes Step P472.

In Step P472, the CPU 10 reads the output of the A/D converter connected to the potentiometer 55 for the motor for adjusting the printing pressure between the intaglio cylinder and the impression cylinder. The CPU 10 then stores the read value in the memory M60. Upon completion of the processing of Step P472, the CPU 10 executes Step P473.

In Step P473, the CPU 10 determines whether or not the output of the A/D converter connected to the potentiometer 55 for the motor for adjusting the printing pressure between the intaglio cylinder and the impression cylinder, which is stored in the memory M60, is equal to the target output of the A/D converter connected to the potentiometer 55 for the motor for adjusting the printing pressure between the intaglio cylinder and the impression cylinder, which is stored in the memory M83.

When the output of the A/D converter connected to the potentiometer 55 for the motor for adjusting the printing pressure between the intaglio cylinder and the impression cylinder, which is stored in the memory M60, is equal to the target output of the A/D converter connected to the potentiometer 55 for the motor for adjusting the printing pressure between the intaglio cylinder and the impression cylinder, which is stored in the memory M83, the CPU 10 executes Step P474.

On the other hand, when the output of the A/D converter connected to the potentiometer 55 for the motor for adjusting the printing pressure between the intaglio cylinder and the impression cylinder, which is stored in the memory M60, is not equal to the target output of the A/D converter connected to the potentiometer 55 for the motor for adjusting the printing pressure between the intaglio cylinder and the impression cylinder, which is stored in the memory M83, the CPU 10 executes Step P472.

In Step P474, the CPU 10 stops the output of the normal rotation instruction to the motor driver 54 for adjusting the printing pressure between the intaglio cylinder and the impression cylinder. Upon completion of the processing of Step P474, the CPU 10 executes Step P479.

In Step P475, the CPU 10 outputs a reverse rotation instruction to the motor driver 54 for adjusting the printing pressure between the intaglio cylinder and the impression cylinder. Upon completion of the processing of Step P475, the CPU 10 executes Step P476.

In Step P476, the CPU 10 reads the output of the A/D converter connected to the potentiometer 55 for the motor for adjusting the printing pressure between the intaglio cylinder and the impression cylinder. The CPU 10 then stores the read value in the memory M60. Upon completion of the processing of Step P476, the CPU 10 executes Step P477.

In Step P477, the CPU 10 determines whether or not the output of the A/D converter connected to the potentiometer 55 for the motor for adjusting the printing pressure between the intaglio cylinder and the impression cylinder, which is stored in the memory M60, is equal to the target output of the A/D converter connected to the potentiometer 55 for the motor for adjusting the printing pressure between the intaglio cylinder and the impression cylinder, which is stored in the memory M83.

When the output of the A/D converter connected to the potentiometer 55 for the motor for adjusting the printing pressure between the intaglio cylinder and the impression cylinder, which is stored in the memory M60, is equal to the target output of the A/D converter connected to the potentiometer 55 for the motor for adjusting the printing pressure between the intaglio cylinder and the impression cylinder, which is stored in the memory M83, the CPU 10 executes Step P478.

On the other hand, when the output of the A/D converter connected to the potentiometer 55 for the motor for adjusting the printing pressure between the intaglio cylinder and the impression cylinder, which is stored in the memory M60, is not equal to the target output of the A/D converter connected to the potentiometer 55 for the motor for adjusting the printing pressure between the intaglio cylinder and the impression cylinder, which is stored in the memory M83, the CPU 10 executes Step P476.

In Step P478, the CPU stops the output of the reverse rotation instruction to the motor driver 54 for adjusting the printing pressure between the intaglio cylinder and the impression cylinder. Upon completion of the processing of Step P478, the CPU 10 executes Step P479. With the foregoing steps, each contact-pressure adjusting means of each ink supply unit M is adjusted in accordance with the corresponding printing press temperature, which is measured by the printing press temperature meter of the ink supply unit M.

In Step P479, the CPU 10 determines whether or not the final-printing completing button, which is provided to the input device 13, has been turned ON by the operator. When the final-printing completing button has been turned ON, the CPU 10 executes Step P300. On the other hand, when the final-printing completing button has not been turned ON, the CPU 10 executes Step P377.

Sixth Embodiment

Figure 27:
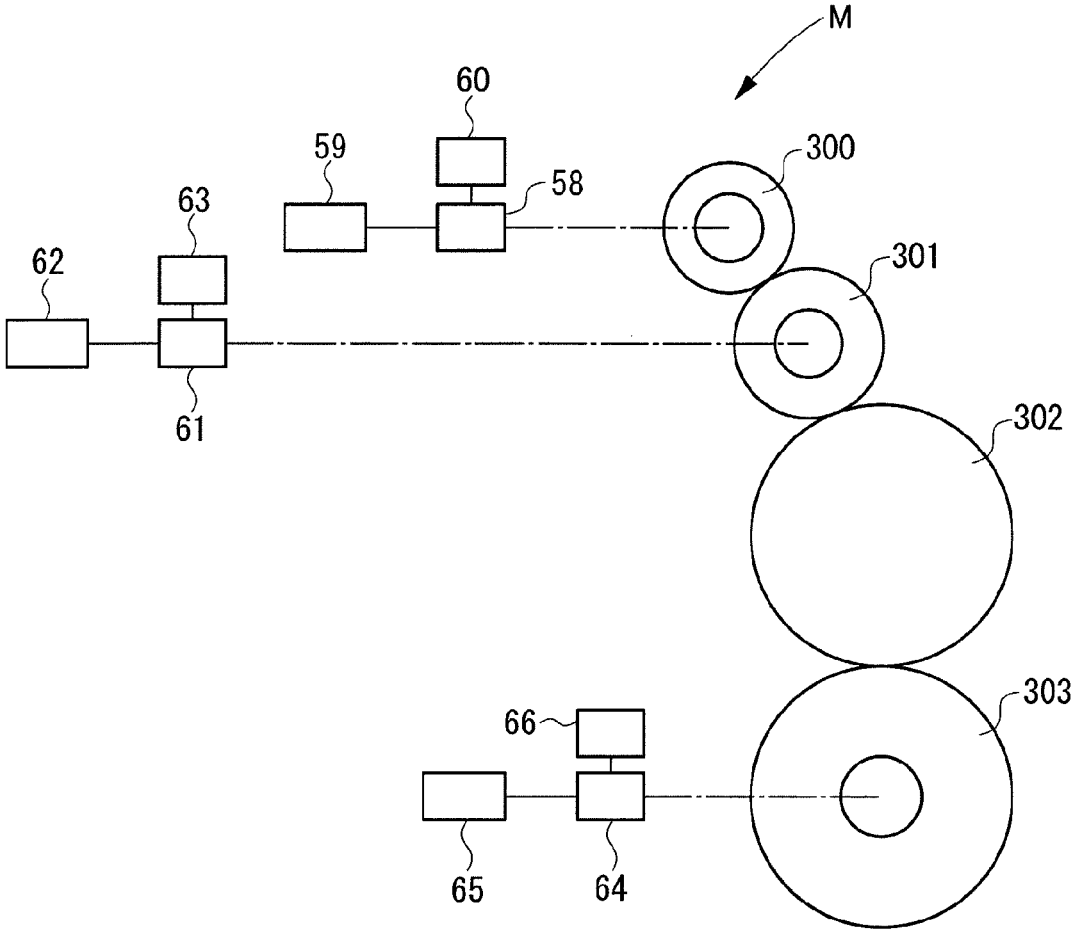
FIG. 27 shows a schematic view of the inside of a printing press to which a contact-pressure adjusting system for a liquid application machine according to a sixth embodiment of the present invention is employed.

A description will be given of a contact-pressure adjusting method and a contact-pressure adjusting system, for a liquid application machine, according to a sixth embodiment of the present invention. FIG. 27 shows a schematic view of the inside of a printing press to which the contact-pressure adjusting system, for a liquid application machine, according to the sixth embodiment of the present invention is employed. As shown in FIG. 27, the printing press according to the present embodiment includes an ink fountain roller 300, a pattern cylinder 301, an intaglio cylinder 302, and an impression cylinder 303, for each ink supply unit M. The ink fountain roller 300 draws ink from an ink fountain (not illustrated). The pattern cylinder 301 includes a plate with concave portions which are brought into contact with the ink fountain roller to function as an image area. The intaglio cylinder 302 is in contact with the pattern cylinder 301, so that ink on the image area on the plate surface is transferred onto the intaglio cylinder 302. The impression cylinder 303 applies a printing pressure to a printing product that is in contact with the intaglio cylinder 302. Note that, the contact-pressure adjusting method for adjusting a nip pressure or a printing pressure, according to the present embodiment, is the same as the contact-pressure adjusting method described in the first embodiment.

The ink fountain roller 300 is provided with a motor 58 for adjusting the nip pressure between the ink fountain roller 300 and the pattern cylinder 301 for the purpose of adjusting the nip pressure between the ink fountain roller 300 and the pattern cylinder 300. The motor 58 for adjusting the nip pressure between the ink fountain roller 300 and the pattern cylinder 301 is controlled by a motor driver 59 for adjusting the nip pressure between the ink fountain roller 300 and the pattern cylinder 301. In addition, the motor 58 for adjusting the nip pressure between the ink fountain roller 300 and the pattern cylinder 301 is provided with a potentiometer 60 for the motor for adjusting the nip pressure between the ink fountain roller 300 and the pattern cylinder 301 for the purpose of detecting the nip pressure between the ink fountain roller 300 and the pattern cylinder 301.

The pattern cylinder 301 is provided with a motor 61 for adjusting the nip pressure between the pattern cylinder 301 and the intaglio cylinder 302 for the purpose of adjusting the nip pressure between the pattern cylinder 301 and the intaglio cylinder 302. The motor 61 for adjusting the nip pressure between the pattern cylinder 301 and the intaglio cylinder 302 is controlled by a motor driver 62 for adjusting the nip pressure between the pattern cylinder 301 and the intaglio cylinder 302. In addition, the motor 61 for adjusting the nip pressure between the pattern cylinder 301 and the intaglio cylinder 302 is provided with a potentiometer 63 for the motor for adjusting the nip pressure between the pattern cylinder 301 and the intaglio cylinder 302 for the purpose of detecting the nip pressure between the pattern cylinder 301 and the intaglio cylinder 302.

The impression cylinder 303 is provided with a motor 64 for adjusting the printing pressure between the intaglio cylinder 302 and the impression cylinder 303 for the purpose of adjusting the printing pressure between the intaglio cylinder 302 and the impression cylinder 303. The motor 64 for adjusting the printing pressure between the intaglio cylinder 302 and the impression cylinder 303 is controlled by a motor driver 65 for adjusting the printing pressure between the intaglio cylinder 302 and the impression cylinder 303. In addition, the motor 64 for adjusting the printing pressure between the intaglio cylinder 302 and the impression cylinder 303 is provided with a potentiometer 66 for the motor for adjusting the printing pressure between the intaglio cylinder 302 and the impression cylinder 303 for the purpose of detecting the printing pressure between the intaglio cylinder 302 and the impression cylinder 303.

Figure 28A:
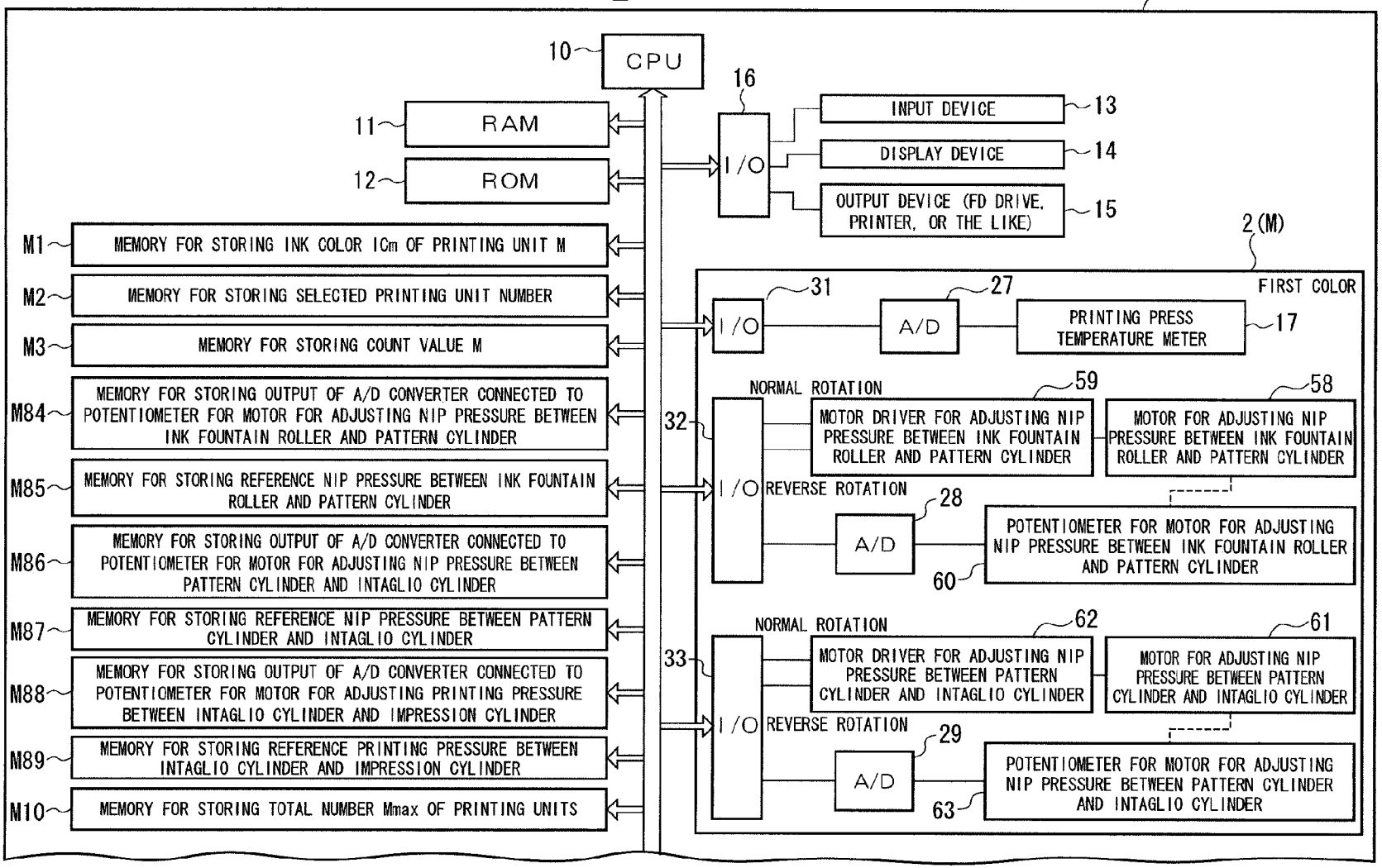
FIG. 28A shows a hardware block diagram of the contact-pressure adjusting system for a liquid application machine according to the sixth embodiment of the present invention.
Figure 28B:
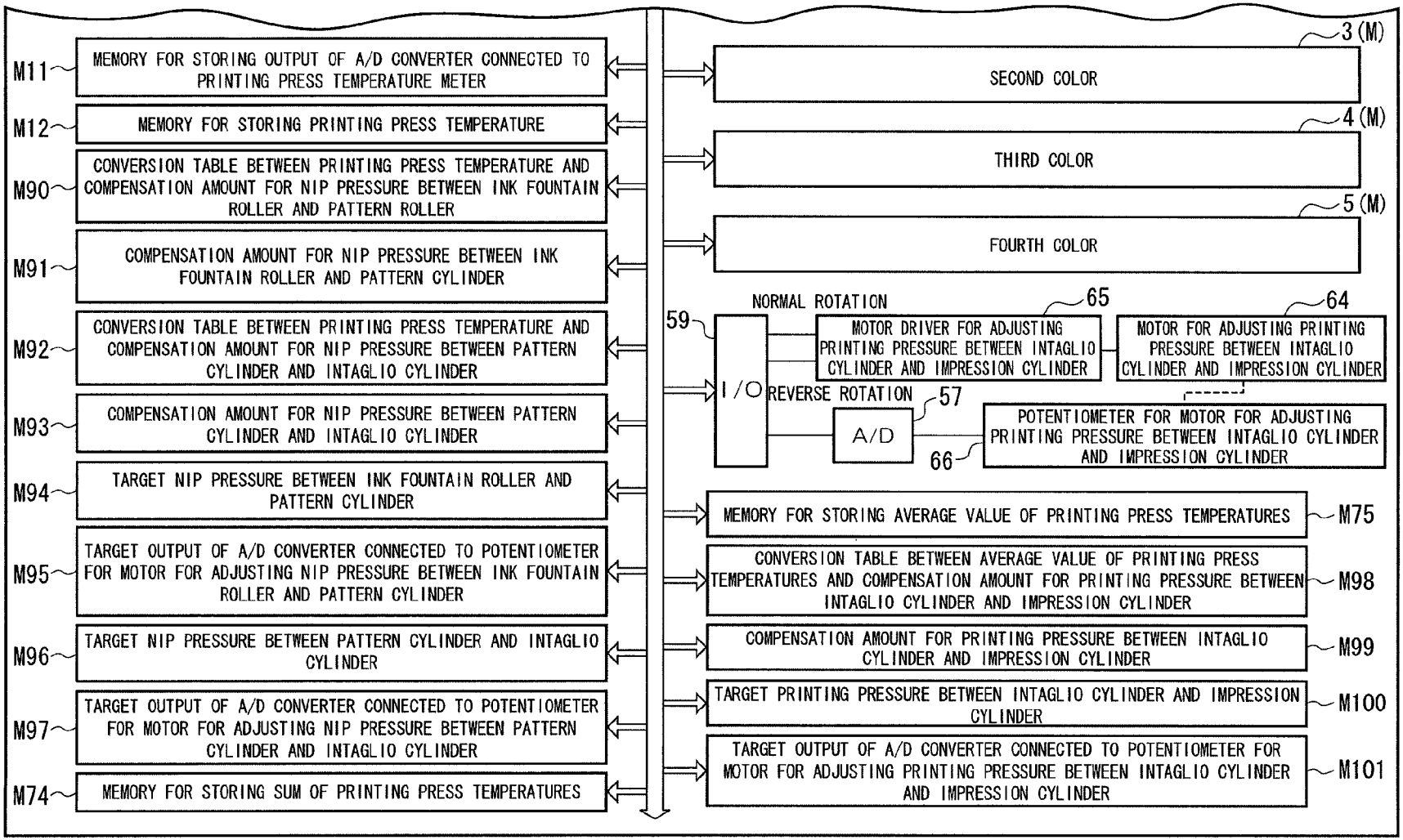
FIG. 28B shows a hardware block diagram continued from FIG. 28A.
Figure 29A:
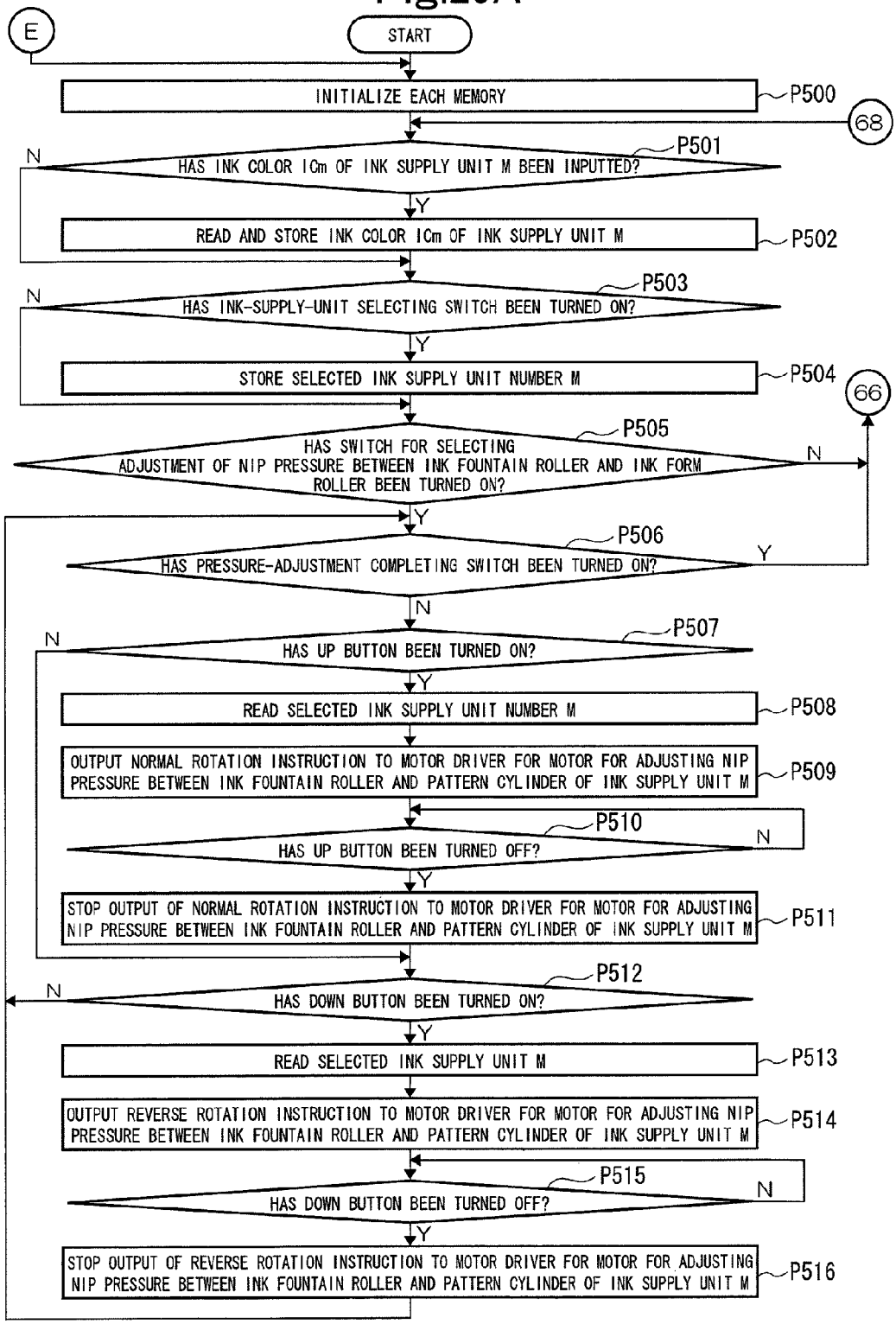
FIG. 29A shows an operational flowchart of the contact-pressure adjusting system for a liquid application machine according to the sixth embodiment of the present invention.
Figure 29B:
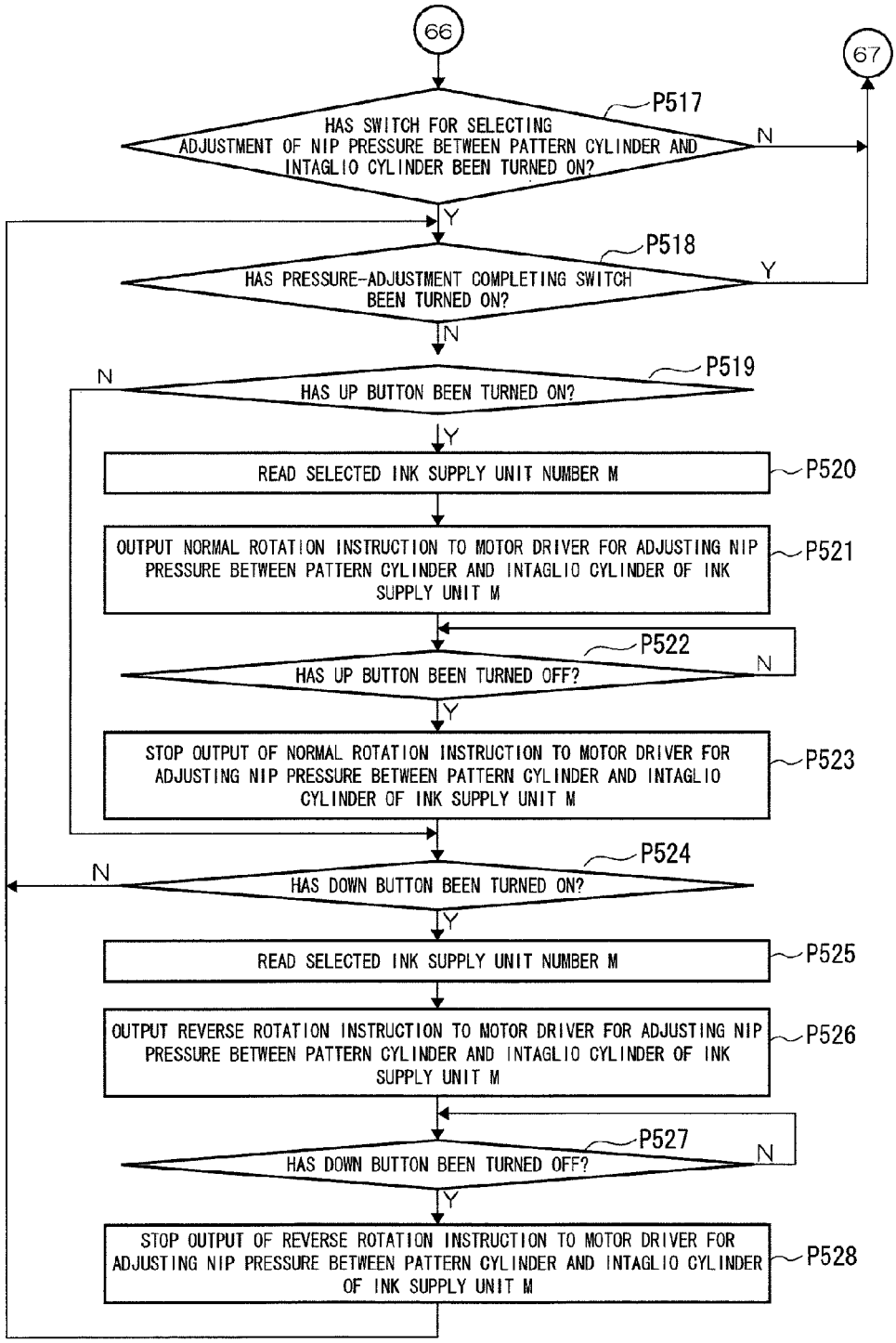
FIG. 29B shows an operational flowchart subsequent to that of FIG. 29A.
Figure 29C:
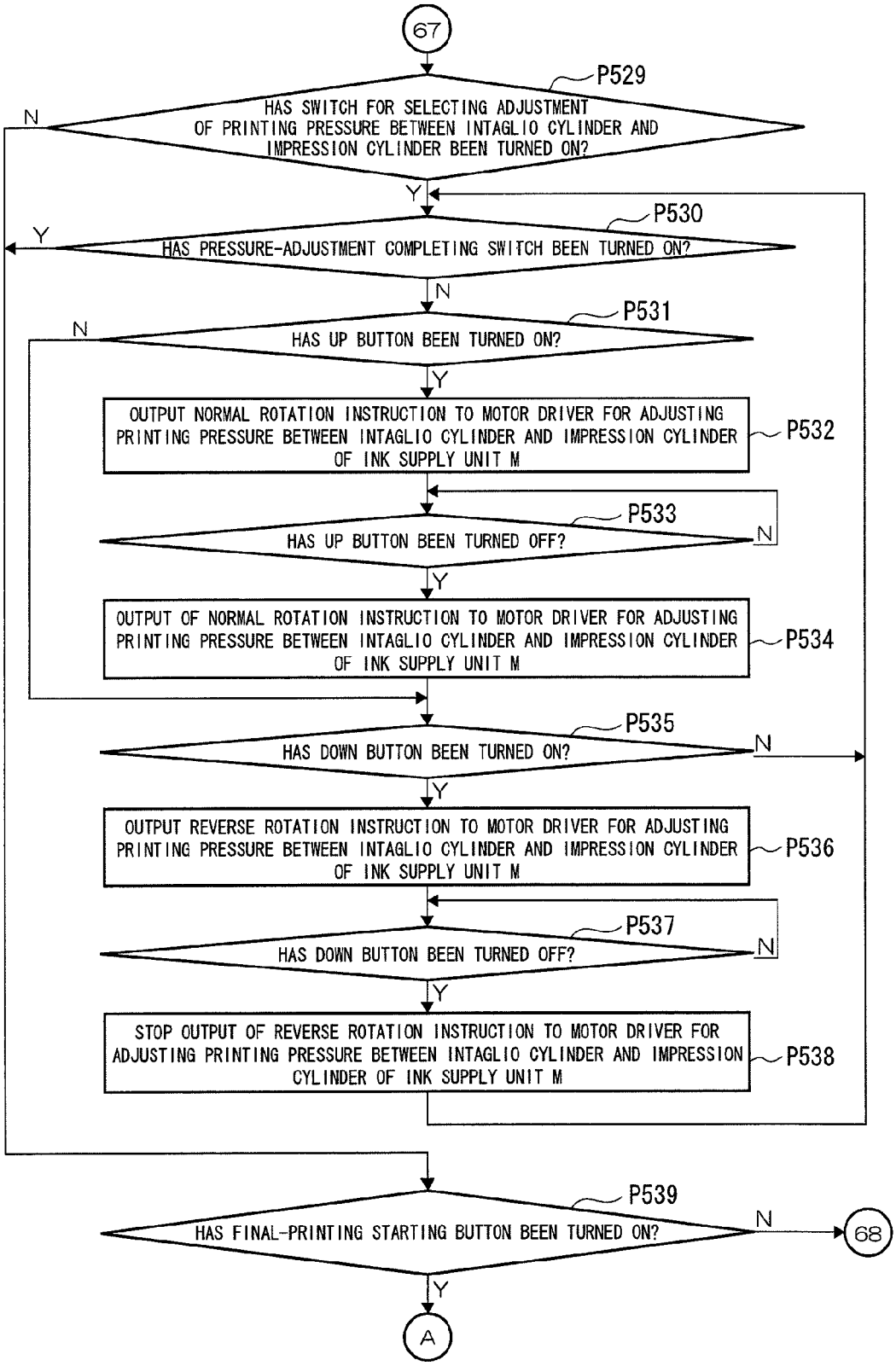
FIG. 29C shows an operational flowchart subsequent to that of FIG. 29B.
Figure 30A:
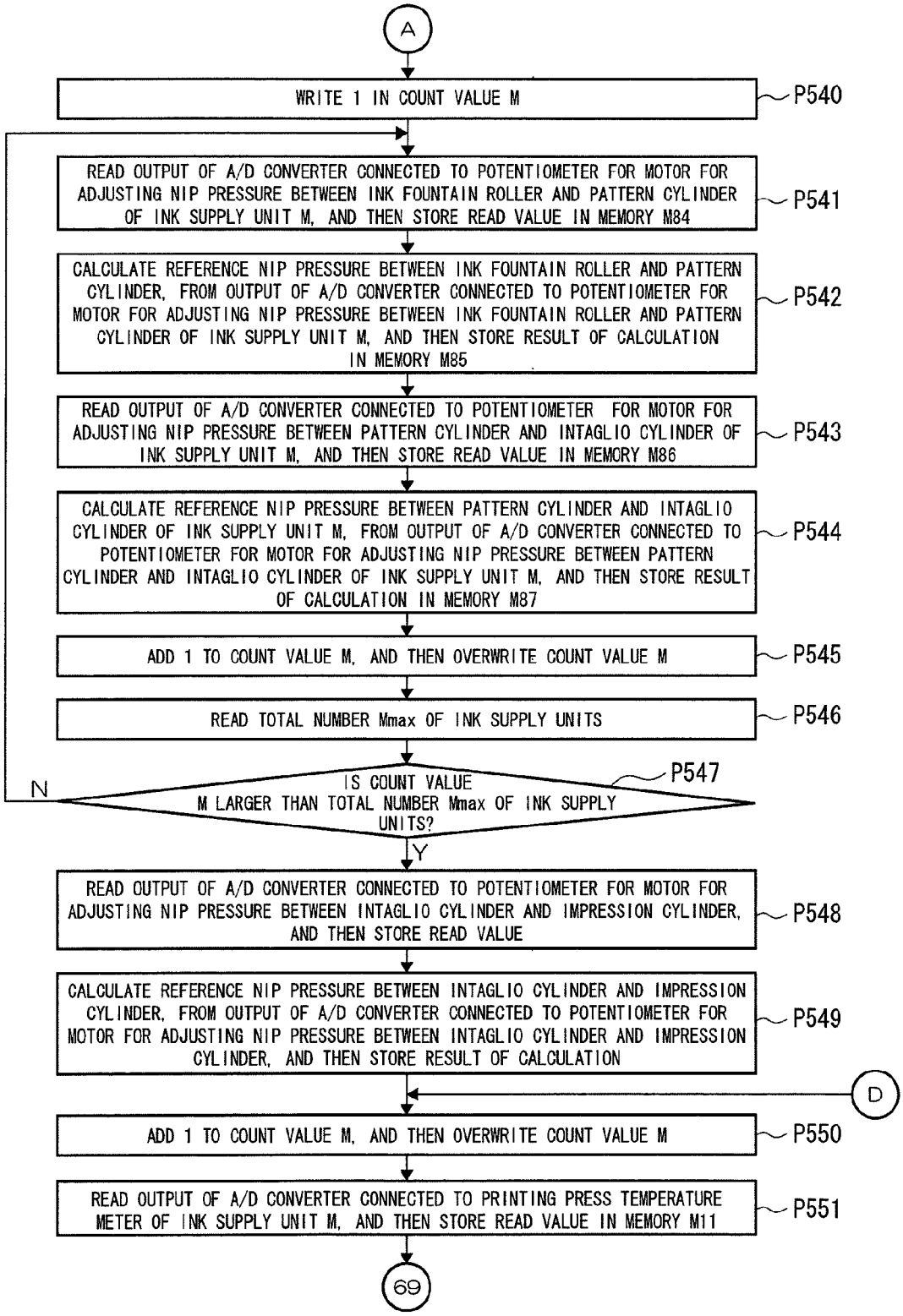
FIG. 30A shows an operational flowchart subsequent to that of FIG. 29C.
Figure 30B:
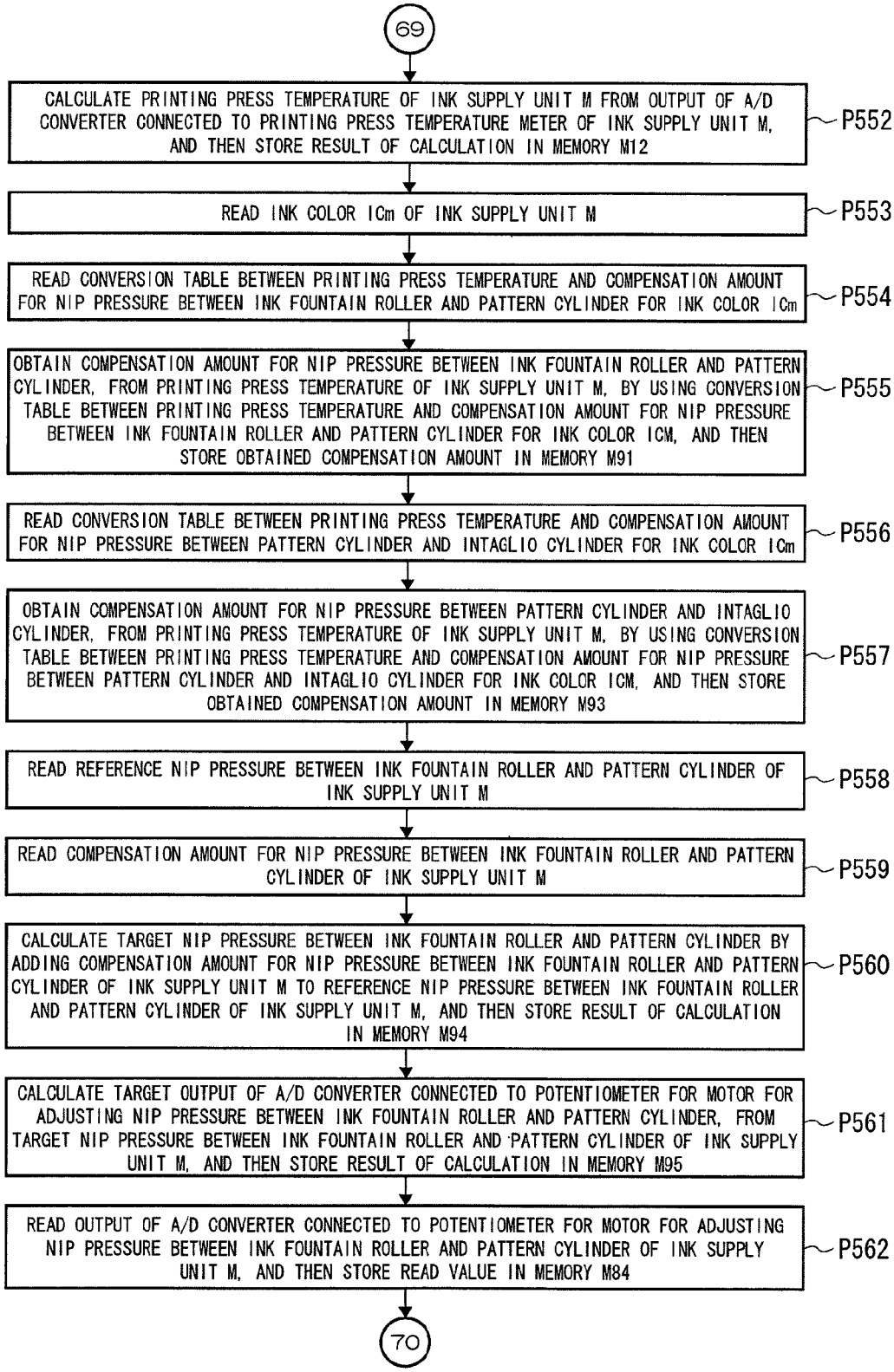
FIG. 30B shows an operational flowchart subsequent to that of FIG. 30A.
Figure 30C:
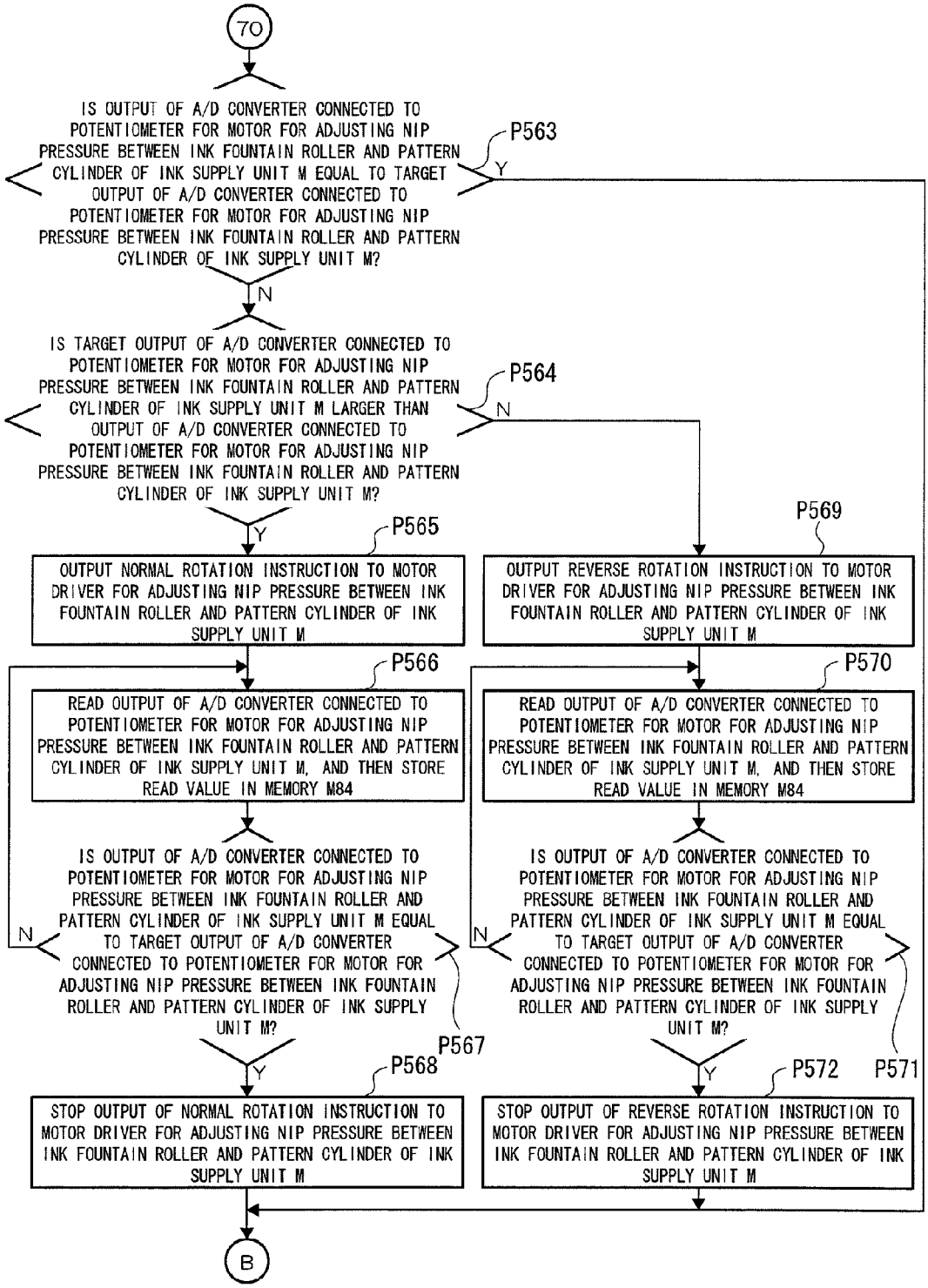
FIG. 30C shows an operational flowchart subsequent to that of FIG. 30B.
Figure 31A:
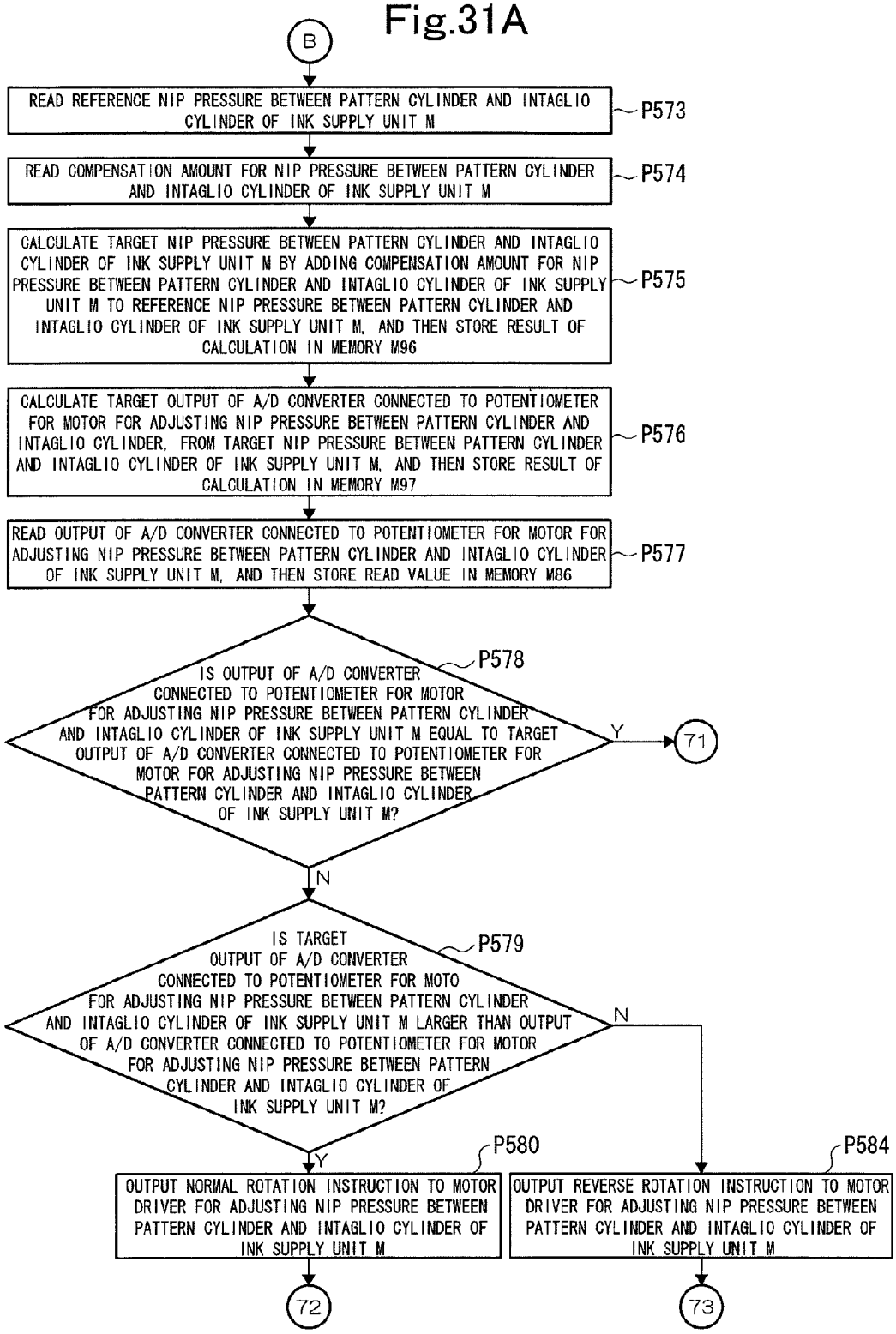
FIG. 31A shows an operational flowchart subsequent to that of FIG. 30C.
Figure 31B:
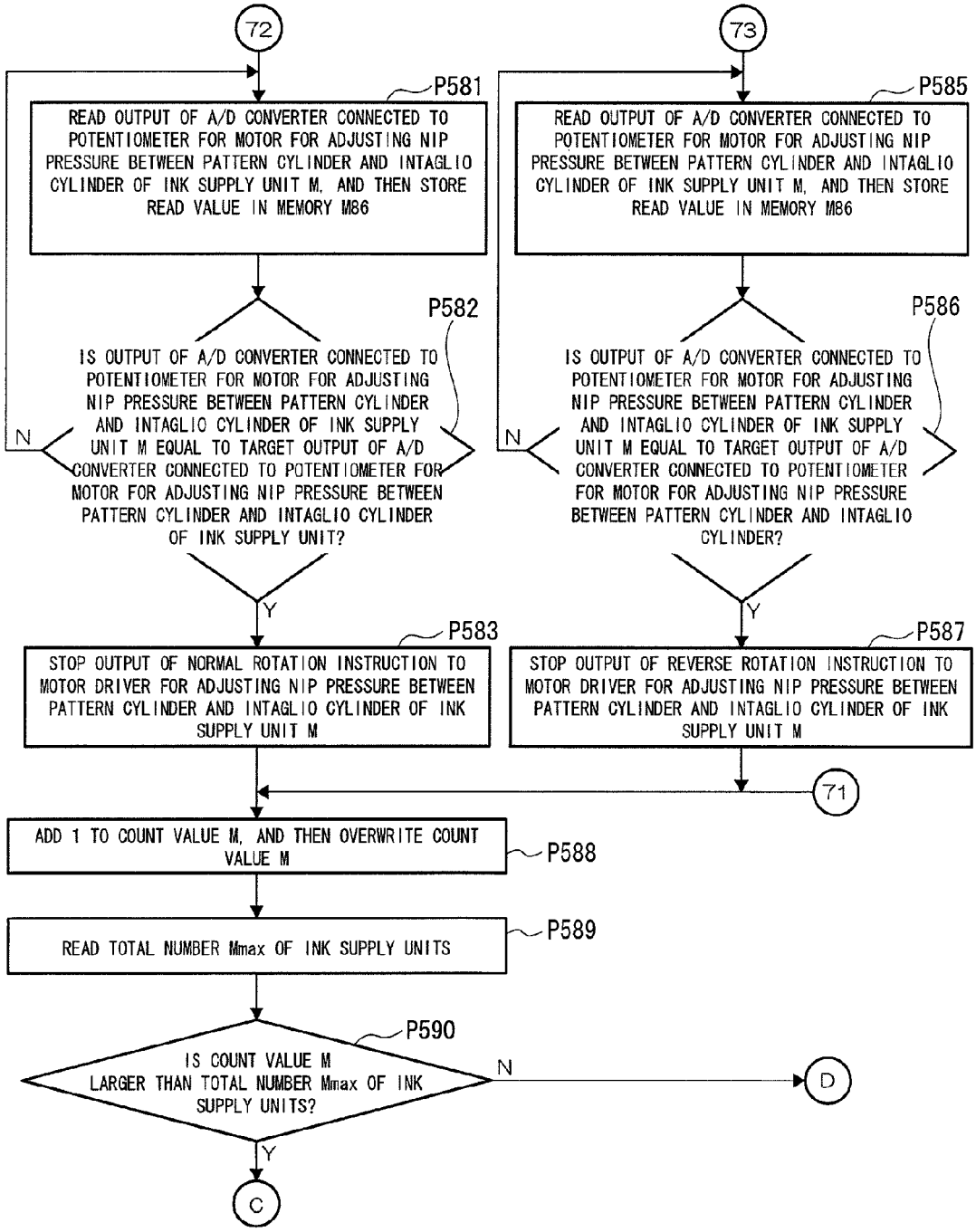
FIG. 31B shows an operational flowchart subsequent to that of FIG. 31A.
Figure 32A:
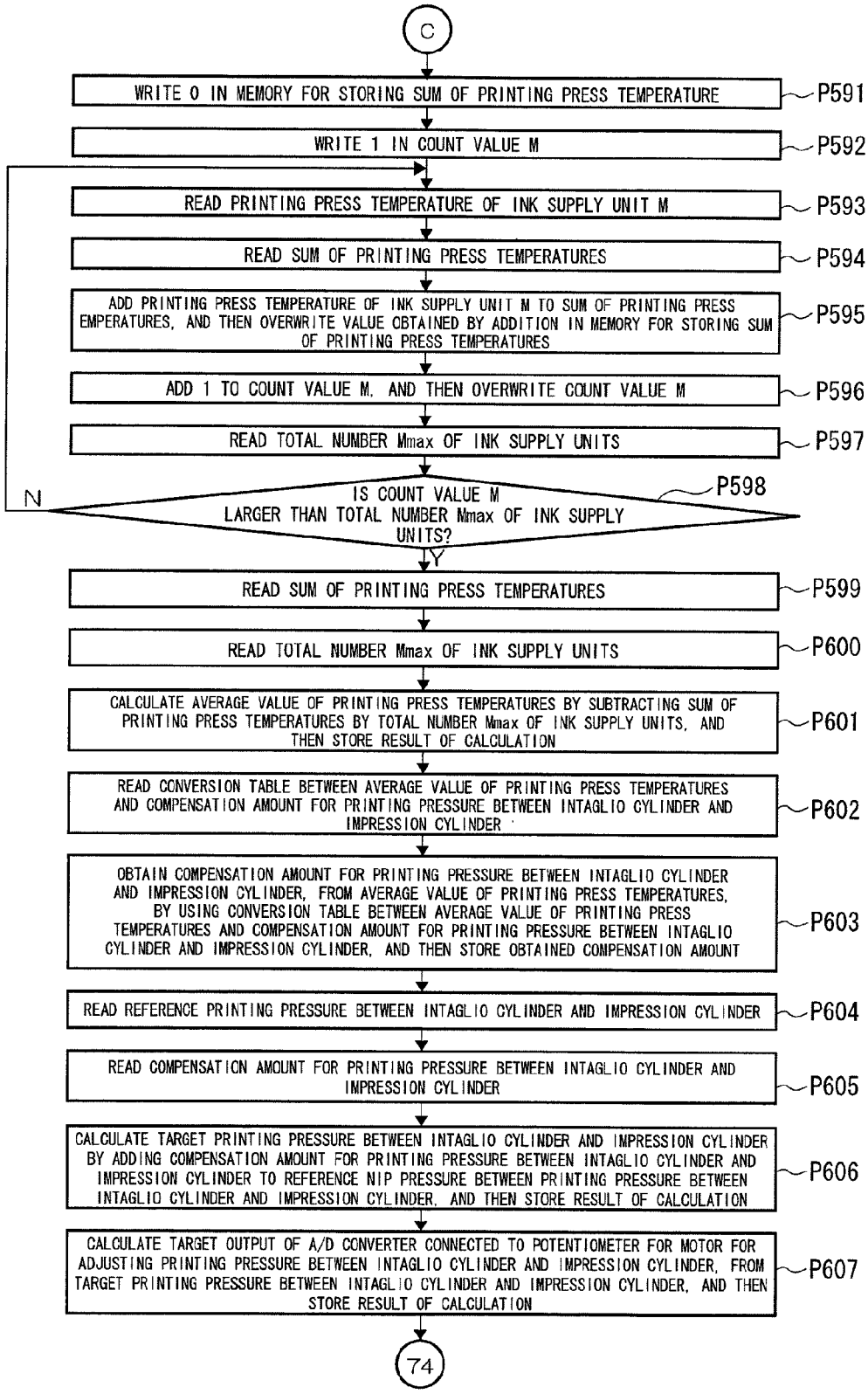
FIG. 32A shows an operational flowchart subsequent to that of FIG. 31B.
Figure 32B:
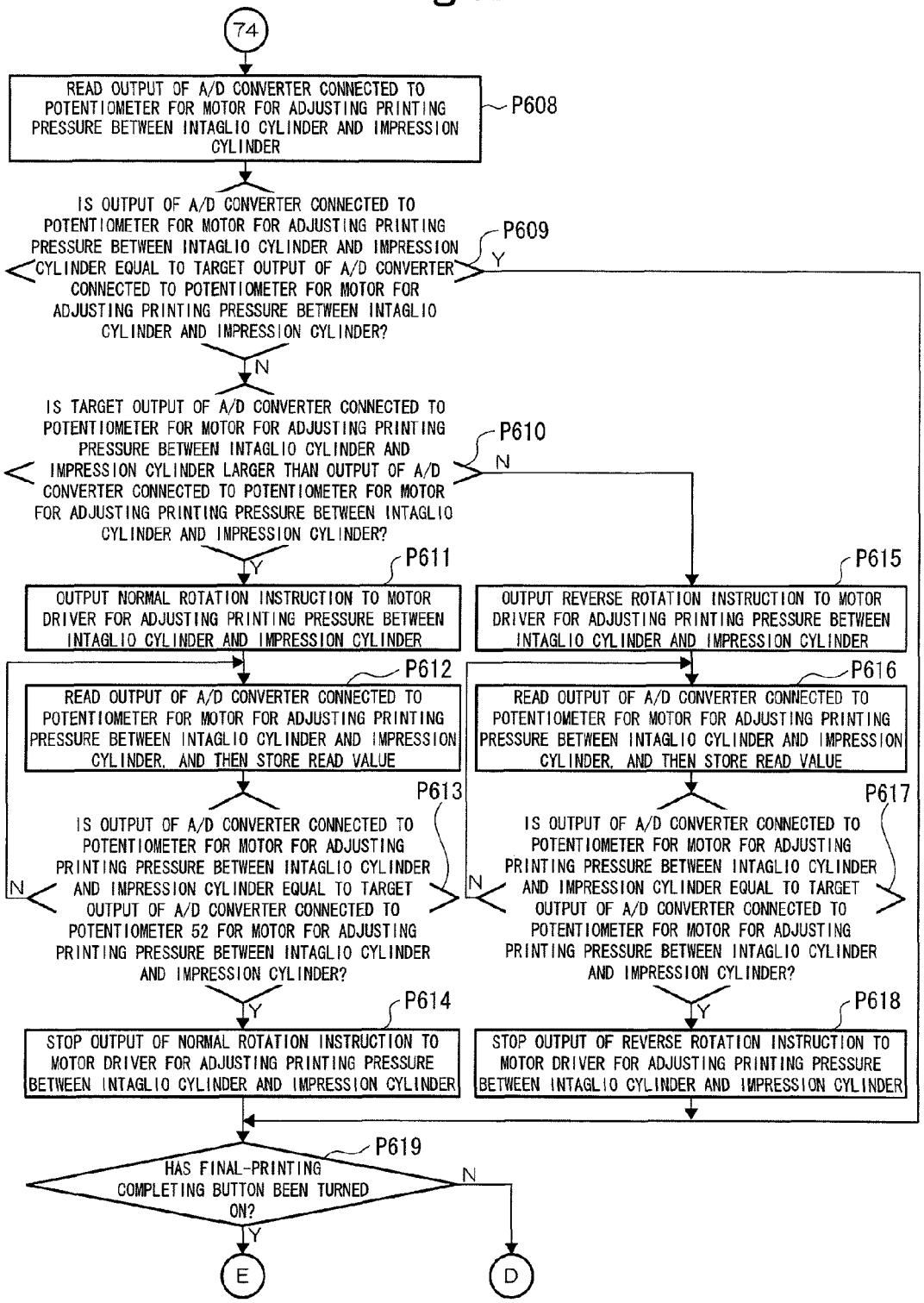
FIG. 32B shows an operational flowchart subsequent to that of FIG. 32A.

Next, a description will be given of a contact-pressure adjusting system for a liquid application machine according to the sixth embodiment of the present invention. FIGS. 28A and 28B show hardware block diagrams of the contact-pressure adjusting system for a liquid application machine according to the sixth embodiment of the present invention. As shown in FIGS. 28A and 28B, the contact-pressure adjusting system 1 for a liquid application machine includes a CPU 10, a RAM 11, a ROM 12, an input device 13, a display device 14, an output device (an FD drive, a printer or the like) 15, an I/O (input/output) interface 16.

In addition, the ink supply unit M includes a printing press temperature meter 17, the motor 58 for adjusting the nip pressure between the ink fountain roller 300 and the pattern cylinder 301, the motor driver 59 for adjusting the nip pressure between the ink fountain roller 300 and the pattern cylinder 301, the potentiometer 60 for the motor for adjusting the nip pressure between the ink fountain roller 300 and the pattern cylinder 301, the motor 61 for adjusting the nip pressure between the pattern cylinder 301 and the intaglio cylinder 302, the motor driver 62 for adjusting the nip pressure between the pattern cylinder 301 and the intaglio cylinder 302, the potentiometer 63 for the motor for adjusting the nip pressure between the pattern cylinder 301 and the intaglio cylinder 302, A/D (analog/digital) converters 27 to 29, and I/O (input/output) interfaces 31 to 33.

In the printing press according to the present embodiment, inks of four colors are used. Accordingly, each of an ink supply unit 2 of the first color (for example, black), an ink supply unit 3 of the second color (for example, cyan), an ink supply unit 4 of the third color (for example, magenta), and an ink supply unit 5 of the fourth color (for example, yellow) includes the printing press temperature meter 17, the motor 58 for adjusting the nip pressure between the ink fountain roller 300 and the pattern cylinder 301, the motor driver 59 for adjusting the nip pressure between the ink fountain roller 300 and the pattern cylinder 301, the potentiometer 60 for the motor for adjusting the nip pressure between the ink fountain roller 300 and the pattern cylinder 301, the motor 61 for adjusting the nip pressure between the pattern cylinder 301 and the intaglio cylinder 302, the motor driver 62 for adjusting the nip pressure between the pattern cylinder 301 and the intaglio cylinder 302, the potentiometer 63 for the motor for adjusting the nip pressure between the pattern cylinder 301 and the intaglio cylinder 302, the A/D (analog/digital) converters 27 to 29, and the I/O (input/output) interfaces 31 to 33. Although the inks of four colors are used in the present embodiment, the number of colors of inks to be used may be increased or decreased by increasing or decreasing the number of ink supply units.

Moreover, the contact-pressure adjusting system 1 includes the motor 64 for adjusting the printing pressure between the intaglio cylinder 302 and the impression cylinder 303, the motor driver 65 for adjusting the printing pressure between the intaglio cylinder 302 and the impression cylinder 303, the potentiometer 66 for the motor for adjusting the printing pressure between the intaglio cylinder 302 and the impression cylinder 303, an A/D (analog/digital) converter 57, and an I/O (input/output) interface 59.

Furthermore, the contact-pressure adjusting system 1 includes memories M1 to M3, M10 to M12, M74, M75, and M84 to M101. In the memory M1, an ink color ICm of the ink supply unit M is stored. In the memory M2, a selected ink supply unit number is stored. In the memory M3, a count value M is stored. In the memory M10, the total number Mmax of ink supply units is stored. In the memory M11, an output of the A/D converter connected to the printing press temperature meter is stored. In the memory M12, a printing press temperature is stored. In the memory M74, the sum of the printing press temperatures is stored. In the memory M75, the average value of the printing press temperatures is stored. In the memory M84, an output of the A/D converter connected to the potentiometer 60 for the motor for adjusting the nip pressure between the ink fountain roller 300 and the pattern cylinder 301 is stored. In the memory M85, a reference nip pressure between the ink fountain roller 300 and the pattern cylinder 301 is stored. In the memory M86, an output of the A/D converter connected to the potentiometer 63 for the motor for adjusting the nip pressure between the pattern cylinder 301 and the intaglio cylinder 302 is stored. In the memory M87, a reference nip pressure between the pattern cylinder 301 and the intaglio cylinder 302 is stored. In the memory M88, an output of the A/D converter connected to the potentiometer 66 for the motor for adjusting the printing pressure between the intaglio cylinder 302 and the impression cylinder 303 is stored. In the memory M89, a reference printing pressure between the intaglio cylinder 302 and the impression cylinder 303 is stored. In the memory M90, a conversion table between the printing press temperature and the compensation amount for the nip pressure between the ink fountain roller 300 and the pattern roller 301 is stored. In the memory M91, a compensation amount for the nip pressure between the ink fountain roller 300 and the pattern cylinder 301 is stored. In the memory M92, a conversion table between the printing press temperature and the compensation amount for the nip pressure between the pattern cylinder 301 and the intaglio cylinder 302 is stored. In the memory M93, a compensation amount for the nip pressure between the pattern cylinder 301 and the intaglio cylinder 302 is stored. In the memory M94, a target nip pressure between the ink fountain roller 300 and the pattern cylinder 301 is stored. In the memory M95, a target output of the A/D converter connected to the potentiometer 60 for the motor for adjusting the nip pressure between the ink fountain roller 300 and the pattern cylinder 301 is stored. In the memory M96, a target nip pressure between the pattern cylinder 301 and the intaglio cylinder 302 is stored. In the memory M97, a target output of the A/D converter connected to the potentiometer 63 for the motor for adjusting the nip pressure between the pattern cylinder 301 and the intaglio cylinder 302 is stored. In the memory M98, a conversion table between the average value of the printing press temperatures and the compensation amount for the printing pressure between the intaglio cylinder 302 and the impression cylinder 303 is stored. In the memory M99, a compensation amount for the printing pressure between the intaglio cylinder 302 and the impression cylinder 303 is stored. In the memory M100, a target printing pressure between the intaglio cylinder 302 and the impression cylinder 303 is stored. In the memory M101, a target output of the A/D converter connected to the potentiometer 66 for the motor for adjusting the printing pressure between the intaglio cylinder 302 and the impression cylinder 303 is stored.

The CPU 10 obtains various kinds of information which are inputted thereto via the I/O interfaces 16, 31 to 33, and 59, and operates in accordance with a program stored in the ROM 12, while accessing the RAM 11 as well as the memories M1 to M3, M10 to M12, M74, M75, M84 to M101. The input device 13 is provided with various kinds of input devices including an input unit of the ink color ICm of the ink supply unit M, an ink-supply-unit selecting switch, a switch for selecting the adjustment of the nip pressure between the ink fountain roller 300 and the pattern cylinder 301, a switch for selecting the adjustment of the nip pressure between the pattern cylinder 301 and the intaglio cylinder 302, a switch for selecting the adjustment of the printing pressure between the intaglio cylinder 302 and the impression cylinder 303, a final-printing starting button, a final-printing completing button.

Next, the operation of the contact-pressure adjusting system for a liquid application machine according to the sixth embodiment of the present invention will be described. Each of FIGS. 29A to 29C, 30A to 30C, 31A to 31B, 32A, and 32B shows an operational flowchart of the contact-pressure adjusting system 1 for a liquid application machine. Hereinafter, the content of the processing of each step will be described.

In Step P500, the CPU 10 initializes each memory. Upon completion of the processing of Step P500, the CPU 10 executes Step P501.

In Step P501, the CPU 10 determines whether or not an ink color ICm of the ink supply unit M has been inputted, by the operator, to the input unit of the ink color ICm of the ink supply unit M, which is provided to the input device 13. When the ink color ICm of the ink supply unit M has been inputted by the operator, the CPU 10 executes Step P502. On the other hand, when the ink color ICm of the ink supply unit M has not been inputted by the operator, the CPU 10 skips Step P502, and then executes P503.

In Step P502, the CPU 10 reads the ink color ICm of the ink supply unit M, and then stores the ink color ICm in the memory M1. Upon completion of the processing of Step P502, the CPU 10 executes Step P503.

In Step P503, the CPU 10 determines whether or not the ink-supply-unit selecting switch, which is provided to the input device 13, has been turned ON by the operator. When the ink-supply-unit selecting switch has been turned ON, the CPU 10 executes Step P504. On the other hand, when the ink-supply-unit selecting switch has not been turned ON, the CPU 10 skips Step P504, and then executes Step P505.

In Step P504, the CPU 10 stores the selected ink supply unit number M in the memory M2. Upon completion of the processing of Step P504, the CPU 10 executes Step P505.

In Step P505, the CPU 10 determines whether or not the switch for selecting the adjustment for the nip pressure between the ink fountain roller and the pattern cylinder, which is provided to the input unit 13, has been turned ON by the operator. When the switch for selecting the adjustment for the nip pressure between the ink fountain roller and the pattern cylinder has been turned ON, the CPU 10 executes Step P506. On the other hand, when the switch for selecting the adjustment for the nip pressure between the ink fountain roller and the pattern cylinder has not been turned ON, the CPU 10 skips Steps P506 to P516, and then executes Step P517.

In Step P506, the CPU 10 determines whether or not the pressure-adjustment completing switch, which is provided to the input device 13, has been turned ON by the operator. When the pressure-adjustment completing switch has been turned ON, the CPU 10 skips Steps P507 to P516, and then executes Step P517. On the other hand, when the pressure-adjustment completing switch has not been turned ON, the CPU 10 executes Step P507.

In Step P507, the CPU 10 determines whether or not the up button, which is provided to the input device 13, has been turned ON by the operator. When the up button has been turned ON, the CPU 10 executes Step P508. On the other hand, when the up button has not been turned ON, the CPU 10 skips Steps P508 to P511, and then executes Step P512.

In Step P508, the CPU 10 reads the selected ink supply unit number M, which is stored in the memory M2. Upon completion of the processing of Step P508, the CPU 10 executes Step P509.

In Step P509, the CPU 10 outputs a normal rotation instruction to the motor driver 59 for the motor for adjusting the nip pressure between the ink fountain roller and the pattern cylinder of the ink supply unit M. Upon completion of the processing of Step P509, the CPU 10 executes Step P510.

In Step P510, the CPU 10 determines whether or not the up button, which is provided to the input device 13, has been turned OFF by the operator. When the up button has been turned OFF, the CPU 10 executes Step P511. On the other hand, when the up button has not been turned OFF, the CPU 10 executes Step P510 again.

In Step P511, the CPU 10 stops the output of the normal rotation instruction to the motor driver 59 for the motor for adjusting the nip pressure between the ink fountain roller and the pattern cylinder of the ink supply unit M. Upon completion of the processing of Step P511, the CPU 10 executes Step P512.

In Step P512, the CPU 10 determines whether or not the down button, which is provided to the input device 13, has been turned ON by the operator. When the down button has been turned ON, the CPU 10 executes Step P513. On the other hand, when the down button has not been turned ON, the CPU 10 executes Step P506.

In Step P513, the CPU 10 reads the selected ink supply unit number M, which is stored in the memory M2. Upon completion of the processing of Step P513, the CPU 10 executes Step P514.

In Step P514, the CPU 10 outputs a reverse rotation instruction to the motor driver 59 for the motor for adjusting the nip pressure between the ink fountain roller and the pattern cylinder of the ink supply unit M. Upon completion of the processing of Step P514, the CPU 10 executes Step P515.

In Step P515, the CPU 10 determines whether or not the down button, which is provided to the input device 13, has been turned OFF by the operator. When the down button has been turned OFF, the CPU 10 executes Step P516. On the other hand, when the down button has not been turned OFF, the CPU 10 executes Step P515 again.

In Step P516, the CPU 10 stops the output of the reverse rotation instruction to the motor driver 59 for the motor for adjusting the nip pressure between the ink fountain roller and the pattern cylinder of the ink supply unit M. Upon completion of the processing of Step P516, the CPU 10 executes Step P506.

In Step P517, the CPU 10 determines whether or not the switch for selecting the adjustment of the nip pressure between the pattern cylinder and the intaglio cylinder, which is provided to the input device 13, has been turned ON by the operator. When the switch for selecting the adjustment of the nip pressure between the pattern cylinder and the intaglio cylinder has been turned ON, the CPU 10 executes Step P518. On the other hand, when the switch for selecting the adjustment of the nip pressure between the pattern cylinder and the intaglio cylinder has not been turned ON, the CPU skips Steps P518 to P528, and then executes Step P529.

In Step P518, the CPU 10 determines whether or not the pressure-adjustment completing switch, which is provided to the input device 13, has been turned ON by the operator. When the pressure-adjustment completing switch has been turned ON, the CPU 10 skips Steps P519 to P528, and then executes Step P529. On the other hand, when the pressure-adjustment completing switch has not been turned ON, the CPU 10 executes Step P519.

In Step P519, the CPU 10 determines whether or not the up button, which is provided to the input device 13, has been turned ON by the operator. When the up button has been turned ON, the CPU 10 executes Step P520. On the other hand, when the up button has not been turned ON, the CPU 10 skips Steps P520 to P523, and then executes Step P524.

In Step P520, the CPU 10 reads the selected ink supply unit number M from the memory M2. Upon completion of the processing of Step P520, the CPU 10 executes Step P521.

In Step P521, the CPU 10 outputs a normal rotation instruction to the motor driver 62 for adjusting the nip pressure between the pattern cylinder and the intaglio cylinder of the ink supply unit M. Upon completion of the processing of Step P521, the CPU 10 executes Step P522.

In Step P522, the CPU 10 determines whether or not the up button, which is provided to the input device 13, has been turned OFF by the operator. When the up button has been turned OFF, the CPU 10 executes Step P523. On the other hand, when the up button has not been turned OFF, the CPU 10 executes Step P522 again.

In Step P523, the CPU 10 stops the output of the normal rotation instruction to the motor driver 62 for adjusting the nip pressure between the pattern cylinder and the intaglio cylinder of the ink supply unit M. Upon completion of the processing of Step P524, the CPU 10 executes Step P524.

In Step P524, the CPU 10 determines whether or not the down button, which is provided to the input device 13, has been turned ON by the operator. When the down button has been turned ON, the CPU 10 executes Step P525. On the other hand, when the down button has not been turned ON, the CPU 10 executes Step P518.

In Step P525, the CPU 10 reads the selected ink supply unit number M from the memory M2. Upon completion of the processing of Step P525, the CPU 10 executes Step P526.

In Step P526, the CPU 10 outputs a reverse rotation instruction to the motor driver 62 for adjusting the nip pressure between the pattern cylinder and the intaglio cylinder of the ink supply unit M. Upon completion of the processing of Step P526, the CPU 10 executes Step P527.

In Step P527, the CPU 10 determines whether or not the down button, which is provided to the input device 13, has been turned OFF by the operator. When the down button has been turned OFF, the CPU 10 executes Step P528. On the other hand, when the down button has not been turned OFF, the CPU 10 executes Step P527 again.

In Step P528, the CPU 10 stops the output of the reverse rotation instruction to the motor driver 62 for adjusting the nip pressure between the pattern cylinder and the intaglio cylinder of the ink supply unit M. Upon completion of the processing of Step P528, the CPU 10 executes Step P518.

In Step P529, the CPU 10 determines whether or not the switch for selecting the adjustment of the printing pressure between the intaglio cylinder and the impression cylinder, which is provided to the input device 13, has been turned ON by the operator. When the switch for selecting the adjustment of the printing pressure between the intaglio cylinder and the impression cylinder has been turned ON, the CPU 10 executes Step P530. On the other hand, the switch for selecting the adjustment of the printing pressure between the intaglio cylinder and the impression cylinder has not been turned ON, the CPU 10 skips Steps P530 to P538, and then executes Step P539.

In Step P530, the CPU 10 determines whether or not the pressure-adjustment completing switch, which is provided to the input device 13, has been turned ON by the operator. When the pressure-adjustment completing switch has been turned ON, the CPU 10 skips P531 to P538, and then executes Step P539. On the other hand, when the pressure-adjustment completing switch has not been turned ON, the CPU 10 executes Step P531.

In Step P531, the CPU 10 determines whether or not the up button, which is provided to the input device 13, has been turned ON by the operator. When the up button has been turned ON, the CPU 10 executes Step P532. On the other hand, when the up button has not been turned ON, the CPU 10 skips Steps P532 to P534, and then executes Step P535.

In Step P532, the CPU 10 outputs a normal rotation instruction to the motor driver 65 for adjusting the printing pressure between the intaglio cylinder and the impression cylinder. Upon completion of the processing of Step P532, the CPU 10 executes Step P533.

In Step P533, the CPU 10 determines whether or not the up button, which is provided to the input device 13, has been turned OFF by the operator. When the up button has been turned OFF, the CPU 10 executes Step P534. On the other hand, when the up button has not been turned OFF, the CPU 10 executes Step P533 again.

In Step P534, the CPU 10 stops the output of the normal rotation instruction to the motor driver 65 for adjusting the printing pressure between the intaglio cylinder and the impression cylinder. Upon completion of the processing of Step P534, the CPU 10 executes Step P535.

In Step P535, the CPU 10 determines whether or not the down button, which is provided to the input device 13, has been turned ON by the operator. When the down button has been turned ON, the CPU 10 executes Step P536. On the other hand, when the down button has not been turned ON, the CPU 10 executes Step P530.

In Step P536, the CPU 10 outputs a reverse rotation instruction to the motor driver 65 for adjusting the printing pressure between the intaglio cylinder and the impression cylinder. Upon completion of the processing of Step P536, the CPU 10 executes Step P537.

In Step P537, the CPU 10 determines whether or not the down button, which is provided to the input device 13, has been turned OFF by the operator. When the down button has been turned OFF, the CPU 10 executes Step P538. On the other hand, when the down button has not been turned OFF, the CPU 10 executes Step P537 again.

In Step P538, the CPU 10 stops the output of the reverse rotation instruction to the motor driver 65 for adjusting the printing pressure between the intaglio cylinder and the impression cylinder. Upon completion of the processing of Step P538, the CPU 10 executes Step P530. With the foregoing steps, the adjustment of each contact-pressure adjusting means of each ink supply unit M before starting the final printing is performed by manual operation of the operator.

In Step P539, the CPU 10 determines whether or not the final-printing starting button, which is provided to the input device 13, has been turned ON by the operator. When the final-printing starting button has been turned ON, the CPU 10 executes Step P540. On the other hand, when the final-printing starting button has not been turned ON, the CPU 10 executes Step P501.

In Step P540, the CPU 10 writes 1 in the count value M, which is stored in the memory M3. Upon completion of the processing of Step P540, the CPU 10 executes Step P541.

In Step P541, the CPU 10 reads the output of the A/D converter connected to the potentiometer 60 for the motor for adjusting the nip pressure between the ink fountain roller and the pattern cylinder of the ink supply unit M. The CPU 10 then stores the read value in the memory M84. Upon completion of the processing of Step P541, the CPU 10 executes Step P542.

In Step P542, the CPU 10 calculates a reference nip pressure between the ink fountain roller and the pattern cylinder, from the output of the A/D converter connected to the potentiometer 60 for the motor for adjusting the nip pressure between the ink fountain roller and the pattern cylinder of the ink supply unit M. The CPU 10 then stores the result of the calculation in the memory M85. Upon completion of the processing of Step P542, the CPU 10 executes Step P543.

In Step P543, the CPU 10 reads the output of the A/D converter connected to the potentiometer 63 for the motor for adjusting the nip pressure between the pattern cylinder and the intaglio cylinder of the ink supply unit M. The CPU 10 then stores the read value in the memory M86. Upon completion of the processing of Step P543, the CPU 10 executes Step P544.

In Step P544, the CPU 10 calculates a reference nip pressure between the pattern cylinder and the intaglio cylinder, from the output of the A/D converter connected to the potentiometer 63 for the motor for adjusting the nip pressure between the pattern cylinder and the intaglio cylinder of the ink supply unit M. The CPU 10 then stores the result of the calculation in the memory M87. Upon completion of the processing of Step P544, the CPU 10 executes Step P545.

In Step P545, the CPU 10 adds 1 to the count value M, which is stored in the memory M3, and then overwrites the count value M. Upon completion of the processing of Step P545, the CPU 10 executes Step P546.

In Step P546, the CPU 10 reads the total number Mmax of ink supply units, which is stored in the memory M10. Upon completion of the processing of Step P546, the CPU 10 executes Step P547.

In Step P547, the CPU 10 determines whether or not the count value M, which is stored in the memory M3, is larger than the total number Mmax of ink supply units. When the count value M, which is stored in the memory M3, is larger than the total number Mmax of ink supply units, the CPU 10 executes Step P548. On the other hand, when the count value M, which is stored in the memory M3, is not larger than the total number Mmax of ink supply units, the CPU 10 executes Step P541.

In Step P548, the CPU 10 reads the output of the A/D converter connected to the potentiometer 66 for the motor for adjusting the printing pressure between the intaglio cylinder and the impression cylinder. The CPU 10 then stores the read value in the memory M88. Upon completion of the processing of Step P548, the CPU 10 executes Step P549.

In Step P549, the CPU 10 calculates a reference printing pressure between the intaglio cylinder and the impression cylinder, from the output of the A/D converter connected to the potentiometer 66 for the motor for adjusting the printing pressure between the intaglio cylinder and the impression cylinder. The CPU 10 then stores the result of the calculation in the memory M89. Upon completion of the processing of Step P549, the CPU 10 executes Step P550. With the foregoing steps, the position of each contact-pressure adjusting means of each ink supply unit M at the time of starting the final printing is stored as a reference position.

In Step P550, the CPU 10 writes 1 in the count value M, which is stored in the memory M3. Upon completion of the processing of Step P550, the CPU 10 executes Step P551.

In Step P551, the CPU 10 reads the output of the A/D converter connected to the printing press temperature meter 17 of the ink supply unit M. The CPU 10 then stores the read value in the memory M11. Upon completion of the processing of Step P551, the CPU 10 executes Step P552.

In Step P552, the CPU 10 calculates the printing press temperature of the ink supply unit M, from the output of the A/D converter connected to the printing press temperature meter 17 of the ink supply unit M. Upon completion of the processing of Step P552, the CPU 10 executes Step P553.

In Step P553, the CPU 10 reads the ink color ICm of the ink supply unit M, which is stored in the memory M1. Upon completion of the processing of Step P553, the CPU 10 executes Step P554.

In Step P554, the CPU 10 reads the conversion table between the printing press temperature and the compensation amount for the nip pressure between the ink fountain roller and the pattern cylinder for the ink color ICm, which conversion table is stored in the memory M90. Upon completion of the processing of Step P554, the CPU 10 executes Step P555.

In Step P555, the CPU 10 obtains a compensation amount for the nip pressure between the ink fountain roller and the pattern cylinder, from the printing press temperature of the ink supply unit M, by using the conversion table between the printing press temperature and the compensation amount for the nip pressure between the ink fountain roller and the pattern cylinder for the ink color ICm. The CPU 10 then stores the obtained compensation amount in the memory M91. Upon completion of the processing of Step P555, the CPU 10 executes Step P556.

In Step P556, the CPU 10 reads the conversion table between the printing press temperature and the compensation amount for the nip pressure between the pattern cylinder and the intaglio cylinder, which conversion table is stored in the memory M92. Upon completion of the processing of Step P556, the CPU 10 executes Step P557.

In Step P557, the CPU 10 obtains a compensation amount for the nip pressure between the pattern cylinder and the intaglio cylinder, from the printing press temperature of the ink supply unit M, by using the conversion table between the printing press temperature and the compensation amount for the nip pressure between the pattern cylinder and the intaglio cylinder. The CPU 10 then stores the obtained compensation amount in the memory M93. Upon completion of the processing of Step P557, the CPU 10 executes Step P558.

In Step P558, the CPU 10 reads the reference nip pressure between the ink fountain roller and the pattern cylinder of the ink supply unit M, which is stored in the memory M85. Upon completion of the processing of Step P558, the CPU 10 executes Step P559.

In Step P559, the CPU 10 reads the compensation amount for the nip pressure between the ink fountain roller and the pattern cylinder of the ink supply unit M, which is stored in the memory M91. Upon completion of the processing of Step P559, the CPU 10 executes Step P560.

In Step P560, the CPU 10 calculates a target nip pressure between the ink fountain roller and the pattern cylinder by adding the compensation amount for the nip pressure between the ink fountain roller and the pattern cylinder of the ink supply unit M to the reference nip pressure between the ink fountain roller and the pattern cylinder of the ink supply unit M. The CPU 10 then stores the result of the calculation in the memory M94. Upon completion of the processing of Step P560, the CPU 10 executes Step P561.

In Step P561, the CPU 10 calculates a target output of the A/D converter connected to the potentiometer 60 for the motor for adjusting the nip pressure between the ink fountain roller and the pattern cylinder, from the target nip pressure between the ink fountain roller and the pattern cylinder of the ink supply unit M. The CPU 10 then stores the result of the calculation in the memory M95. Upon completion of the processing of Step P561, the CPU 10 executes Step P562.

In Step P562, the CPU 10 reads the output of the A/D converter connected to the potentiometer 60 for the motor for adjusting the nip pressure between the ink fountain roller and the pattern cylinder of the ink supply unit M. The CPU 10 then stores the read value in the memory M84. Upon completion of the processing of Step P562, the CPU 10 executes Step P563.

In Step P563, the CPU 10 determines whether or not the output of the A/D converter connected to the potentiometer 60 for the motor for adjusting the nip pressure between the ink fountain roller and the pattern cylinder of the ink supply unit M, which is stored in the memory M84, is equal to the target output of the A/D converter connected to the potentiometer 60 for the motor for adjusting the nip pressure between the ink fountain roller and the pattern cylinder of the ink supply unit M, which is stored in the memory M95.

When the output of the A/D converter connected to the potentiometer 60 for the motor for adjusting the nip pressure between the ink fountain roller and the pattern cylinder of the ink supply unit M, which is stored in the memory M84, is equal to the target output of the A/D converter connected to the potentiometer 60 for the motor for adjusting the nip pressure between the ink fountain roller and the pattern cylinder of the ink supply unit M, which is stored in the memory M95, the CPU 10 skips Steps P564 to P572, and then executes Step P573.

On the other hand, when the output of the A/D converter connected to the potentiometer 60 for the motor for adjusting the nip pressure between the ink fountain roller and the pattern cylinder of the ink supply unit M, which is stored in the memory M84, is not equal to the target output of the A/D converter connected to the potentiometer 60 for the motor for adjusting the nip pressure between the ink fountain roller and the pattern cylinder of the ink supply unit M, which is stored in the memory M95, the CPU 10 executes Step P564.

In Step P564, the CPU 10 determines whether or not the target output of the A/D converter connected to the potentiometer 60 for the motor for adjusting the nip pressure between the ink fountain roller and the pattern cylinder of the ink supply unit M, which is stored in the memory M95, is larger than the output of the A/D converter connected to the potentiometer 60 for the motor for adjusting the nip pressure between the ink fountain roller and the pattern cylinder of the ink supply unit M, which is stored in the memory M84.

When the target output of the A/D converter connected to the potentiometer 60 for the motor for adjusting the nip pressure between the ink fountain roller and the pattern cylinder of the ink supply unit M, which is stored in the memory M95, is larger than the output of the A/D converter connected to the potentiometer 60 for the motor for adjusting the nip pressure between the ink fountain roller and the pattern cylinder of the ink supply unit M, which is stored in the memory M84, the CPU 10 executes Step P565.

On the other hand, when the target output of the A/D converter connected to the potentiometer 60 for the motor for adjusting the nip pressure between the ink fountain roller and the pattern cylinder of the ink supply unit M, which is stored in the memory M95, is not larger than the output of the A/D converter connected to the potentiometer 60 for the motor for adjusting the nip pressure between the ink fountain roller and the pattern cylinder of the ink supply unit M, which is stored in the memory M84, the CPU 10 executes Step P569.

In Step P565, the CPU 10 outputs a normal rotation instruction to the motor driver 59 for the motor for adjusting the nip pressure between the ink fountain roller and the pattern cylinder of the ink supply unit M. Upon completion of the processing of Step P565, the CPU 10 executes Step P566.

In Step P566, the CPU 10 reads the output of the A/D converter connected to the potentiometer 60 for the motor for adjusting the nip pressure between the ink fountain roller and the pattern cylinder of the ink supply unit M. The CPU 10 then stores the read value in the memory M84. Upon completion of the processing of Step P566, the CPU 10 executes Step P567.

In Step P567, the CPU 10 determines whether or not the output of the A/D converter connected to the potentiometer 60 for the motor for adjusting the nip pressure between the ink fountain roller and the pattern cylinder of the ink supply unit M, which is stored in the memory M84, is equal to the target output of the A/D converter connected to the potentiometer 60 for the motor for adjusting the nip pressure between the ink fountain roller and the pattern cylinder of the ink supply unit M, which is stored in the memory M95.

When the output of the A/D converter connected to the potentiometer 60 for the motor for adjusting the nip pressure between the ink fountain roller and the pattern cylinder of the ink supply unit M, which is stored in the memory M84, is equal to the target output of the A/D converter connected to the potentiometer 60 for the motor for adjusting the nip pressure between the ink fountain roller and the pattern cylinder of the ink supply unit M, which is stored in the memory M95, the CPU 10 executes Step P568.

On the other hand, when the output of the A/D converter connected to the potentiometer 60 for the motor for adjusting the nip pressure between the ink fountain roller and the pattern cylinder of the ink supply unit M, which is stored in the memory M84, is not equal to the target output of the A/D converter connected to the potentiometer 60 for the motor for adjusting the nip pressure between the ink fountain roller and the pattern cylinder of the ink supply unit M, which is stored in the memory M95, the CPU 10 executes Step P566.

In Step P568, the CPU 10 stops the output of the normal rotation instruction to the motor driver 59 for adjusting the nip pressure between the ink fountain roller and the pattern cylinder of the ink supply unit M. Upon completion of the processing of Step P568, the CPU 10 executes Step P573.

In Step P569, the CPU 10 outputs a reverse rotation instruction to the motor driver 59 for the motor for adjusting the nip pressure between the ink fountain roller and the pattern cylinder of the ink supply unit M. Upon completion of the processing of Step P569, the CPU 10 executes Step P570.

In Step P570, the CPU 10 reads the output of the A/D converter connected to the potentiometer 60 for the motor for adjusting the nip pressure between the ink fountain roller and the pattern cylinder of the ink supply unit M. The CPU 10 then stores the read value in the memory M84. Upon completion of the processing of Step P570, the CPU 10 executes Step P571.

In Step P571, the CPU 10 determines whether or not the output of the A/D converter connected to the potentiometer 60 for the motor for adjusting the nip pressure between the ink fountain roller and the pattern cylinder of the ink supply unit M, which is stored in the memory M84, is equal to the target output of the A/D converter connected to the potentiometer 60 for the motor for adjusting the nip pressure between the ink fountain roller and the pattern cylinder of the ink supply unit M, which is stored in the memory M95.

When the output of the A/D converter connected to the potentiometer 60 for the motor for adjusting the nip pressure between the ink fountain roller and the pattern cylinder of the ink supply unit M, which is stored in the memory M84, is equal to the target output of the A/D converter connected to the potentiometer 60 for the motor for adjusting the nip pressure between the ink fountain roller and the pattern cylinder of the ink supply unit M, which is stored in the memory M95, the CPU 10 executes Step P572.

On the other hand, when the output of the A/D converter connected to the potentiometer 60 for the motor for adjusting the nip pressure between the ink fountain roller and the pattern cylinder of the ink supply unit M, which is stored in the memory M84, is not equal to the target output of the A/D converter connected to the potentiometer 60 for the motor for adjusting the nip pressure between the ink fountain roller and the pattern cylinder of the ink supply unit M, which is stored in the memory M95, the CPU 10 executes Step P570.

In Step P572, the CPU 10 stops the output of the reverse rotation instruction to the motor driver 59 for the motor for adjusting the nip pressure between the ink fountain roller and the pattern cylinder of the ink supply unit M, so as to stop the motor 58 for adjusting the nip pressure between the ink fountain roller and the pattern cylinder of the ink supply unit M. Upon completion of the processing of Step P572, the CPU 10 executes Step P573.

In Step P573, the CPU 10 reads the reference nip pressure between the pattern cylinder and the intaglio cylinder of the ink supply unit M, which is stored in the memory M87. Upon completion of the processing of Step P573, the CPU 10 executes Step P574.

In Step P574, the CPU 10 reads the compensation amount for the nip pressure between the pattern cylinder and the intaglio cylinder of the ink supply unit M, which is stored in the memory M93. Upon completion of the processing of Step P574, the CPU 10 executes Step P575.

In Step P575, the CPU 10 calculates a target nip pressure between the pattern cylinder and the intaglio cylinder by adding the compensation amount for the pattern cylinder and the intaglio cylinder of the ink supply unit M to the reference nip pressure between the pattern cylinder and the intaglio cylinder of the ink supply unit M. The CPU 10 then stores the result of the calculation in the memory M96. Upon completion of the processing of Step P575, the CPU 10 executes Step P576.

In Step P576, the CPU 10 calculates a target output of the A/D converter connected to the potentiometer 63 for the motor for adjusting the nip pressure between the pattern cylinder and the intaglio cylinder, from the target nip pressure between the pattern cylinder and the intaglio cylinder of the ink supply unit M. The CPU 10 then stores the result of the calculation in the memory M97. Upon completion of the processing of Step 576, the CPU 10 executes Step P577.

In Step P577, the CPU 10 reads the output of the A/D converter connected to the potentiometer 63 for the motor for adjusting the nip pressure between the pattern cylinder and the intaglio cylinder of the ink supply unit M. The CPU 10 then stores the result of the calculation in the memory M86. Upon completion of the processing of Step P577, the CPU 10 executes Step P578.

In Step P578, the CPU 10 determines whether or not the output of the A/D converter connected to the potentiometer 63 for the motor for adjusting the nip pressure between the pattern cylinder and the intaglio cylinder of the ink supply unit M, which is stored in the memory M86, is equal to the target output of the A/D converter connected to the potentiometer 63 for the motor for adjusting the nip pressure between the pattern cylinder and the intaglio cylinder of the ink supply unit M, which is stored in the memory M97.

When the output of the A/D converter connected to the potentiometer 63 for the motor for adjusting the nip pressure between the pattern cylinder and the intaglio cylinder of the ink supply unit M, which is stored in the memory M86, is equal to the target output of the A/D converter connected to the potentiometer 63 for the motor for adjusting the nip pressure between the pattern cylinder and the intaglio cylinder of the ink supply unit M, which is stored in the memory M97, the CPU 10 skips Steps P579 to P587, and then executes Step P588.

On the other hand, when the output of the A/D converter connected to the potentiometer 63 for the motor for adjusting the nip pressure between the pattern cylinder and the intaglio cylinder of the ink supply unit M, which is stored in the memory M86, is not equal to the target output of the A/D converter connected to the potentiometer 63 for the motor for adjusting the nip pressure between the pattern cylinder and the intaglio cylinder of the ink supply unit M, which is stored in the memory M97, the CPU 10 executes Step P579.

In Step P579, the CPU 10 determines whether or not the target output of the A/D converter connected to the potentiometer 63 for the motor for adjusting the nip pressure between the pattern cylinder and the intaglio cylinder of the ink supply unit M, which is stored in the memory M97, is larger than the output of the A/D converter connected to the potentiometer 63 for the motor for adjusting the nip pressure between the pattern cylinder and the intaglio cylinder of the ink supply unit M, which is stored in the memory M86.

When the target output of the A/D converter connected to the potentiometer 63 for the motor for adjusting the nip pressure between the pattern cylinder and the intaglio cylinder of the ink supply unit M, which is stored in the memory M97, is larger than the output of the A/D converter connected to the potentiometer 63 for the motor for adjusting the nip pressure between the pattern cylinder and the intaglio cylinder of the ink supply unit M, which is stored in the memory M86, the CPU 10 executes Step P580.

On the other hand, when the target output of the A/D converter connected to the potentiometer 63 for the motor for adjusting the nip pressure between the pattern cylinder and the intaglio cylinder of the ink supply unit M, which is stored in the memory M97, is not larger than the output of the A/D converter connected to the potentiometer 63 for the motor for adjusting the nip pressure between the pattern cylinder and the intaglio cylinder of the ink supply unit M, which is stored in the memory M86, the CPU 10 executes Step P584, In Step P580, the CPU 10 outputs a normal rotation instruction to the motor driver 62 for adjusting the nip pressure between the pattern cylinder and the intaglio cylinder of the ink supply unit M. Upon completion of the processing of Step P580, the CPU 10 executes Step P581.

In Step P581, the CPU 10 reads the output of the A/D converter connected to the potentiometer 63 for the motor for adjusting the nip pressure between the pattern cylinder and the intaglio cylinder of the ink supply unit M. The CPU 10 then stores the read value in the memory M86. Upon completion of the processing of Step P581, the CPU 10 executes Step P582.

In Step P582, the CPU 10 determines whether or not the output of the A/D converter connected to the potentiometer 63 for the motor for adjusting the nip pressure between the pattern cylinder and the intaglio cylinder of the ink supply unit M, which is stored in the memory M86, is equal to the target output of the A/D converter connected to the potentiometer 63 for the motor for adjusting the nip pressure between the pattern cylinder and the intaglio cylinder of the ink supply unit M, which is stored in the memory M97.

When the output of the A/D converter connected to the potentiometer 63 for the motor for adjusting the nip pressure between the pattern cylinder and the intaglio cylinder of the ink supply unit M, which is stored in the memory M86, is equal to the target output of the A/D converter connected to the potentiometer 63 for the motor for adjusting the nip pressure between the pattern cylinder and the intaglio cylinder of the ink supply unit M, which is stored in the memory M97, the CPU 10 executes Step P583.

On the other hand, when the output of the A/D converter connected to the potentiometer 63 for the motor for adjusting the nip pressure between the pattern cylinder and the intaglio cylinder of the ink supply unit M, which is stored in the memory M86, is not equal to the target output of the A/D converter connected to the potentiometer 63 for the motor for adjusting the nip pressure between the pattern cylinder and the intaglio cylinder of the ink supply unit M, which is stored in the memory M97, the CPU 10 executes Step P581.

In Step P583, the CPU 10 stops the output of the normal rotation instruction to the motor driver 62 for adjusting the nip pressure between the pattern cylinder and the intaglio cylinder of the ink supply unit M. Upon completion of the processing of Step P583, the CPU 10 executes Step P588.

In Step P584, the CPU 10 outputs a reverse rotation instruction to the motor driver 62 for adjusting the nip pressure between the pattern cylinder and the intaglio cylinder of the ink supply unit M. Upon completion of the processing of Step P584, the CPU 10 executes Step P585.

In Step P585, the CPU 10 reads the output of the A/D converter connected to the potentiometer 63 for the motor for adjusting the nip pressure between the pattern cylinder and the intaglio cylinder of the ink supply unit M. The CPU 10 then stores the read value in the memory M86. Upon completion of the processing of Step P585, the CPU 10 executes Step P586.

In Step P586, the CPU 10 determines whether or not the output of the A/D converter connected to the potentiometer 63 for the motor for adjusting the nip pressure between the pattern cylinder and the intaglio cylinder of the ink supply unit M, which is stored in the memory M86, is equal to the target output of the A/D converter connected to the potentiometer 63 for the motor for adjusting the nip pressure between the pattern cylinder and the intaglio cylinder, which is stored in the memory M97.

When the output of the A/D converter connected to the potentiometer 63 for the motor for adjusting the nip pressure between the pattern cylinder and the intaglio cylinder of the ink supply unit M, which is stored in the memory M86, is equal to the target output of the A/D converter connected to the potentiometer 63 for the motor for adjusting the nip pressure between the pattern cylinder and the intaglio cylinder, which is stored in the memory M97, the CPU 10 executes Step P587.

On the other hand, when the output of the A/D converter connected to the potentiometer 63 for the motor for adjusting the nip pressure between the pattern cylinder and the intaglio cylinder of the ink supply unit M, which is stored in the memory M86, is not equal to the target output of the A/D converter connected to the potentiometer 63 for the motor for adjusting the nip pressure between the pattern cylinder and the intaglio cylinder, which is stored in the memory M97, the CPU 10 executes Step P585.

In Step P587, the CPU 10 stops the output of the reverse rotation instruction to the motor driver 62 for adjusting the nip pressure between the pattern cylinder and the intaglio cylinder of the ink supply unit M. Upon completion of the processing of Step P587, the CPU 10 executes Step P588.

In Step P588, the CPU 10 adds 1 to the count value M, which is stored in the memory M3, and then overwrites the count value M. Upon completion of the processing of Step P588, the CPU 10 executes Step P589.

In Step P589, the CPU 10 reads the total number Mmax of ink supply units from the memory M10. Upon completion of the processing of Step P589, the CPU 10 executes Step P590.

In Step P590, the CPU 10 determines whether or not the count value M, which is stored in the memory M3, is larger than the total number Mmax of ink supply units. When the count value M, which is stored in the memory M3, is larger than the total number Mmax of ink supply units, the CPU 10 executes Step P591. On the other hand, when the count value M, which is stored in the memory M3, is not larger than the total number Mmax of ink supply units, the CPU 10 executes Step P550.

In Step P591, the CPU 10 writes 0 in the memory M74 for storing the sum of the printing press temperatures. Upon completion of the processing of Step P591, the CPU 10 executes Step P592.

In Step P592, the CPU 10 writes 1 in the count value M, which is stored in the memory M3. Upon completion of the processing of Step P592, the CPU 10 executes Step P593.

In Step P593, the CPU 10 reads the printing press temperature of the ink supply unit M, which is stored in the memory M12. Upon completion of the processing of Step P593, the CPU 10 executes Step P594.

In Step P594, the CPU 10 reads the sum of the printing press temperatures, which is stored in the memory M74. Upon completion of the processing of Step P594, the CPU 10 executes Step P595.

In Step P595, the CPU 10 adds the printing press temperature of the ink supply unit M to the sum of the printing press temperatures. The CPU 10 then overwrites the value obtained by the addition in the memory M74 for storing the sum of the printing press temperatures. Upon completion of the processing of Step P595, the CPU 10 executes Step P596.

In Step P596, the CPU 10 adds 1 to the count value M, which is stored in the memory M3, and then overwrites the count value M. Upon completion of the processing of Step P596, the CPU 10 executes Step P597.

In Step P597, the CPU 10 reads the total number Mmax of ink supply units from the memory M10. Upon completion of the processing of Step P597, the CPU 10 executes Step P598.

In Step P598, the CPU 10 determines whether or not the count value M, which is stored in the memory M3, is larger than the total number Mmax of ink supply units. When the count value M, which is stored in the memory M3, is larger than the total number Mmax of ink supply units, the CPU 10 executes Step P599. On the other hand, when the count value M, which is stored in the memory M3, is not larger than the total number Mmax of ink supply units, the CPU 10 executes Step P593.

In Step P599, the CPU 10 reads the sum of the printing press temperatures, which is stored in the memory M74. Upon completion of the processing of Step P599, the CPU 10 executes Step P600.

In Step P600, the CPU 10 reads the total number Mmax of ink supply units from the memory M10. Upon completion of the processing of Step P600, the CPU 10 executes Step P601.

In Step P601, the CPU 10 calculates an average value of the printing press temperatures by subtracting the sum of the printing press temperatures by the total number Mmax of ink supply units. The CPU 10 then stores the result of the calculation in the memory M75. Upon completion of the processing of Step P601, the CPU 10 executes Step P602.

In Step P602, the CPU 10 reads the conversion table between the average value of the printing press temperatures and the compensation amount for the printing pressure between the intaglio cylinder and the impression cylinder, which is stored in the memory M75. Upon completion of the processing of Step P602, the CPU 10 executes Step P603.

In Step P603, the CPU 10 obtains a compensation amount for the printing pressure between the intaglio cylinder and the impression cylinder, from the average value of the printing press temperatures, by using the conversion table between the average value of the printing press temperatures and the compensation amount for the printing pressure between the intaglio cylinder and the impression cylinder. The CPU 10 then stores the obtained compensation amount in the memory M99. Upon completion of the processing of Step P603, the CPU 10 executes Step p604.

In Step P604, the CPU 10 reads the reference printing pressure between the intaglio cylinder and the impression cylinder, which is stored in the memory M89. Upon completion of the processing of Step P604, the CPU 10 executes Step P605.

In Step P605, the CPU 10 reads the compensation amount for the printing pressure between the intaglio cylinder and the impression cylinder, which is stored in the memory M99. Upon completion of the processing of Step P605, the CPU 10 executes Step P606.

In Step P606, the CPU 10 calculates a target printing pressure between the intaglio cylinder and the impression cylinder by adding the compensation amount for the printing pressure between the intaglio cylinder and the impression cylinder to the reference printing pressure between the intaglio cylinder and the impression cylinder. The CPU 10 then stores the result of the calculation in the memory M100. Upon completion of the processing of Step P606, the CPU 10 executes Step P607.

In Step P607, the CPU 10 calculates a target output of the A/D converter connected to the potentiometer 66 for the motor for adjusting the printing pressure between the intaglio cylinder and the impression cylinder, from the target printing pressure between the intaglio cylinder and the impression cylinder. The CPU 10 then stores the result of the calculation in the memory M101. Upon completion of the processing of Step P607, the CPU 10 executes Step P608.

In Step P608, the CPU 10 reads the output of the A/D converter connected to the potentiometer 66 for the motor for adjusting the printing pressure between the intaglio cylinder and the impression cylinder. The CPU 10 then stores the read value in the memory M88. Upon completion of the processing of Step P608, the CPU 10 executes Step P609.

In Step P609, the CPU 10 determines whether or not the output of the A/D converter connected to the potentiometer 66 for the motor for adjusting the printing pressure between the intaglio cylinder and the impression cylinder, which is stored in the memory M88, is equal to the target output of the A/D converter connected to the potentiometer 66 for the motor for adjusting the printing pressure between the intaglio cylinder and the impression cylinder, which is stored in the memory M101.

When the output of the A/D converter connected to the potentiometer 66 for the motor for adjusting the printing pressure between the intaglio cylinder and the impression cylinder, which is stored in the memory M88, is equal to the target output of the A/D converter connected to the potentiometer 66 for the motor for adjusting the printing pressure between the intaglio cylinder and the impression cylinder, which is stored in the memory M101, the CPU 10 skips Steps P610 to P618, and then executes Step P619.

On the other hand, when the output of the A/D converter connected to the potentiometer 66 for the motor for adjusting the printing pressure between the intaglio cylinder and the impression cylinder, which is stored in the memory M88, is not equal to the target output of the A/D converter connected to the potentiometer 66 for the motor for adjusting the printing pressure between the intaglio cylinder and the impression cylinder, which is stored in the memory M101, the CPU 10 executes Step P610.

In Step P610, the CPU 10 determines whether or not the target output of the A/D converter connected to the potentiometer 66 for the motor for adjusting the printing pressure between the intaglio cylinder and the impression cylinder, which is stored in the memory M101, is larger than the output of the A/D converter connected to the potentiometer 66 for the motor for adjusting the printing pressure between the intaglio cylinder and the impression cylinder, which is stored in the memory M88.

When the target output of the A/D converter connected to the potentiometer 66 for the motor for adjusting the printing pressure between the intaglio cylinder and the impression cylinder, which is stored in the memory M101, is larger than the output of the A/D converter connected to the potentiometer 66 for the motor for adjusting the printing pressure between the intaglio cylinder and the impression cylinder, which is stored in the memory M88, the CPU 10 executes Step P611.

On the other hand, when the target output of the A/D converter connected to the potentiometer 66 for the motor for adjusting the printing pressure between the intaglio cylinder and the impression cylinder, which is stored in the memory M101, is not larger than the output of the A/D converter connected to the potentiometer 66 for the motor for adjusting the printing pressure between the intaglio cylinder and the impression cylinder, which is stored in the memory M88, the CPU 10 executes Step P615, In Step P611, the CPU 10 outputs a normal rotation instruction to the motor driver 65 for adjusting the printing pressure between the intaglio cylinder and the impression cylinder. Upon completion of the processing of Step P611, the CPU 10 executes Step P612.

In Step P612, the CPU 10 reads the output of the A/D converter connected to the potentiometer 66 for the motor for adjusting the printing pressure between the intaglio cylinder and the impression cylinder. The CPU 10 then stores the read value in the memory M88. Upon completion of the processing of Step P612, the CPU 10 executes Step P613.

In Step P613, the CPU 10 determines whether or not the output of the A/D converter connected to the potentiometer 66 for the motor for adjusting the printing pressure between the intaglio cylinder and the impression cylinder, which is stored in the memory M88, is equal to the target output of the A/D converter connected to the potentiometer 66 for the motor for adjusting the printing pressure between the intaglio cylinder and the impression cylinder, which is stored in the memory M101.

When the output of the A/D converter connected to the potentiometer 66 for the motor for adjusting the printing pressure between the intaglio cylinder and the impression cylinder, which is stored in the memory M88, is equal to the target output of the A/D converter connected to the potentiometer 66 for the motor for adjusting the printing pressure between the intaglio cylinder and the impression cylinder, which is stored in the memory M101, the CPU 10 executes Step P614.

On the other hand, when the output of the A/D converter connected to the potentiometer 66 for the motor for adjusting the printing pressure between the intaglio cylinder and the impression cylinder, which is stored in the memory M88, is not equal to the target output of the A/D converter connected to the potentiometer 66 for the motor for adjusting the printing pressure between the intaglio cylinder and the impression cylinder, which is stored in the memory M101, the CPU 10 executes Step P612.

In Step P614, the CPU 10 stops the output of the normal rotation instruction to the motor driver 65 for adjusting the printing pressure between the intaglio cylinder and the impression cylinder. Upon completion of the processing of Step P614, the CPU 10 executes Step P619.

In Step P615, the CPU 10 outputs a reverse rotation instruction to the motor driver 65 for adjusting the printing pressure between the intaglio cylinder and the impression cylinder. Upon completion of the processing of Step P615, the CPU 10 executes Step P616.

In Step P616, the CPU 10 reads the output of the A/D converter connected to the potentiometer 66 for the motor for adjusting the printing pressure between the intaglio cylinder and the impression cylinder. The CPU 10 then stores the read value in the memory M88. Upon completion of the processing of Step P616, the CPU 10 executes Step P617.

In Step P617, the CPU 10 determines whether or not the output of the A/D converter connected to the potentiometer 66 for the motor for adjusting the printing pressure between the intaglio cylinder and the impression cylinder, which is stored in the memory M88, is equal to the target output of the A/D converter connected to the potentiometer 66 for the motor for adjusting the printing pressure between the intaglio cylinder and the impression cylinder, which is stored in the memory M101.

When the output of the A/D converter connected to the potentiometer 66 for the motor for adjusting the printing pressure between the intaglio cylinder and the impression cylinder, which is stored in the memory M88, is equal to the target output of the A/D converter connected to the potentiometer 66 for the motor for adjusting the printing pressure between the intaglio cylinder and the impression cylinder, which is stored in the memory M101, the CPU 10 executes Step P618.

On the other hand, when the output of the A/D converter connected to the potentiometer 66 for the motor for adjusting the printing pressure between the intaglio cylinder and the impression cylinder, which is stored in the memory M88, is not equal to the target output of the A/D converter connected to the potentiometer 66 for the motor for adjusting the printing pressure between the intaglio cylinder and the impression cylinder, which is stored in the memory M101, the CPU 10 executes Step P616. With the foregoing Steps, each contact-pressure adjusting means of each ink supply unit M is adjusted in accordance with the corresponding printing press temperature, which is measured by the printing press temperature 17 of the ink supply unit M.

In Step P618, CPU 10 stops the output of the reverse rotation to the motor driver 65 for adjusting the printing pressure between the intaglio cylinder and the impression cylinder. Upon completion of the processing of Step P618, the CPU 10 executes Step P619.

In Step P619, the CPU 10 determines whether or not the final-printing completing button, which is provided to the input device 13, has been turned ON by the operator. When the final-printing completing button has been turned ON, the CPU 10 executes Step P500. On the other hand, when the final-printing completing button has not been turned ON, the CPU 10 executes Step P550.

Seventh Embodiment

Figure 33:
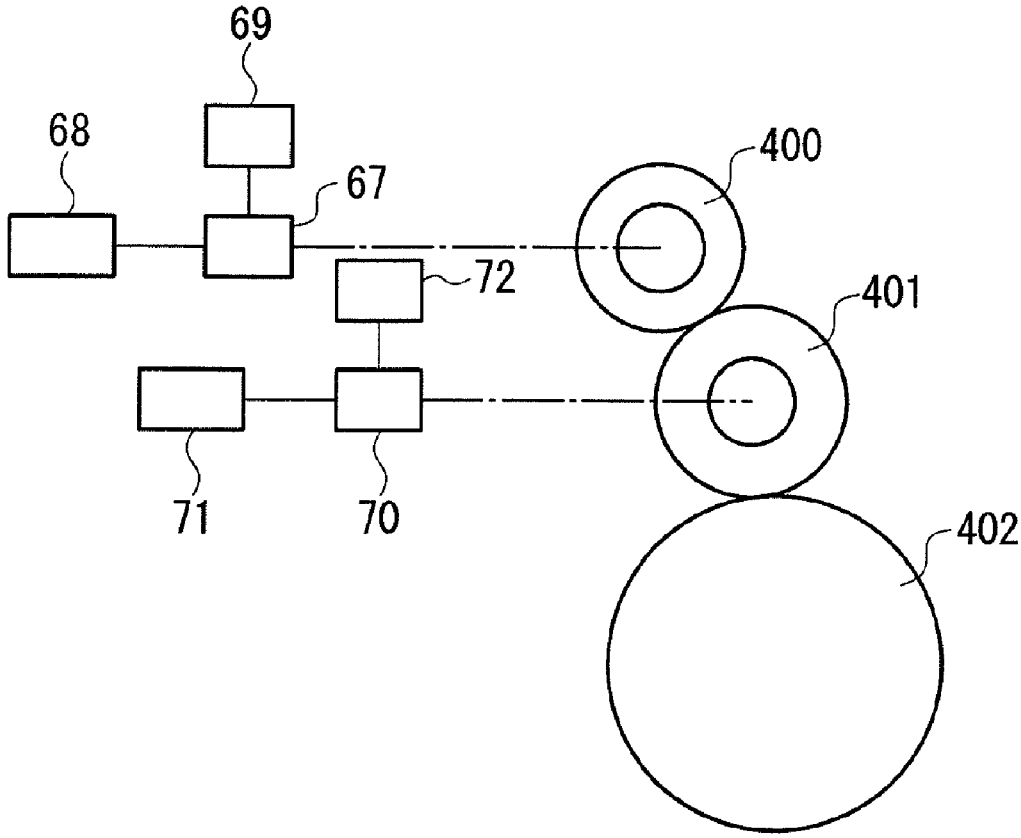
FIG. 33 shows a schematic view of the inside of a numbering and imprinting machine to which a contact-pressure adjusting system for a liquid application machine according to a seventh embodiment of the present invention is employed.

A description will be given of a contact-pressure adjusting method and a contact-pressure adjusting system, for a liquid application machine, according to a seventh embodiment of the present invention. FIG. 33 shows a schematic view of the inside of a numbering and imprinting machine to which the contact-pressure adjusting system, for a liquid application machine, according to the seventh embodiment of the present invention is employed. As shown in FIG. 33, the numbering and imprinting machine according to the present invention includes an ink form roller 400, a numbering cylinder 401, and an impression cylinder 402. The ink form roller 400 evenly applies ink to an image area on a plate. The numbering cylinder 401 includes the plate with protruding portions which are brought into contact with the ink form roller 400. The impression cylinder 402 applies a printing pressure to a printing product that is in contact with the numbering cylinder 401. Note that, the contact-pressure adjusting means for adjusting a nip pressure or a printing pressure, according to the present embodiment, is the same as the contact-pressure adjusting method described in the first embodiment.

The ink form roller 400 is provided with a motor 67 for adjusting the nip pressure between the ink form roller 400 and the numbering cylinder 401 for the purpose of adjusting the nip pressure between the ink form roller 400 and the numbering cylinder 401. The motor 67 for adjusting the nip pressure between the ink form roller 400 and the numbering cylinder 401 is controlled by a motor driver 68 for adjusting the nip pressure between the ink form roller 400 and the numbering cylinder 401. In addition, the motor 67 for adjusting the nip pressure between the ink form roller 400 and the numbering cylinder 401 is provided with a potentiometer 69 for the motor for adjusting the nip pressure between the ink form roller 400 and the numbering cylinder 401 for the purpose of detecting the nip pressure between the ink form roller 400 and the numbering cylinder 401.

The numbering cylinder 401 is provided with a motor 70 for adjusting the printing pressure between the numbering cylinder 401 and the impression cylinder 402 for the purpose of adjusting the printing pressure between the numbering cylinder 401 and the impression cylinder 402. The motor 70 for adjusting the printing pressure between the numbering cylinder 401 and the impression cylinder 402 is controlled by a motor driver 71 for adjusting the printing pressure between the numbering cylinder 401 and the impression cylinder 402. In addition, the motor 70 for adjusting the printing pressure between the numbering cylinder 401 and the impression cylinder 402 is provided with a potentiometer 72 for the motor for adjusting the printing pressure between the numbering cylinder 401 and the impression cylinder 402 for the purpose of detecting the printing pressure between the numbering cylinder 401 and the impression cylinder 402.

Figure 34:
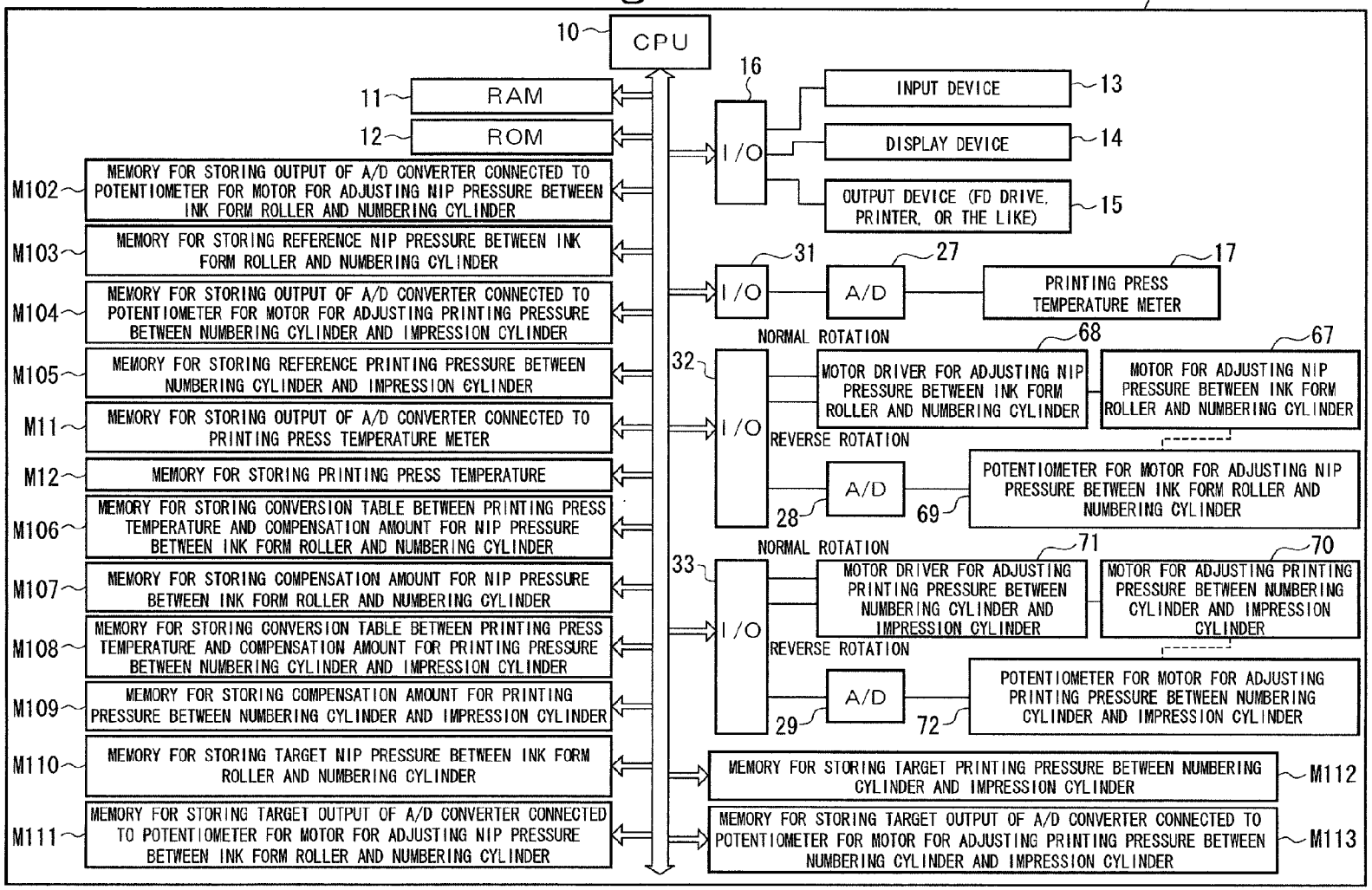
FIG. 34 shows a hardware block diagram of the contact-pressure adjusting system for a liquid application machine according to the seventh embodiment of the present invention.
Figure 35A:
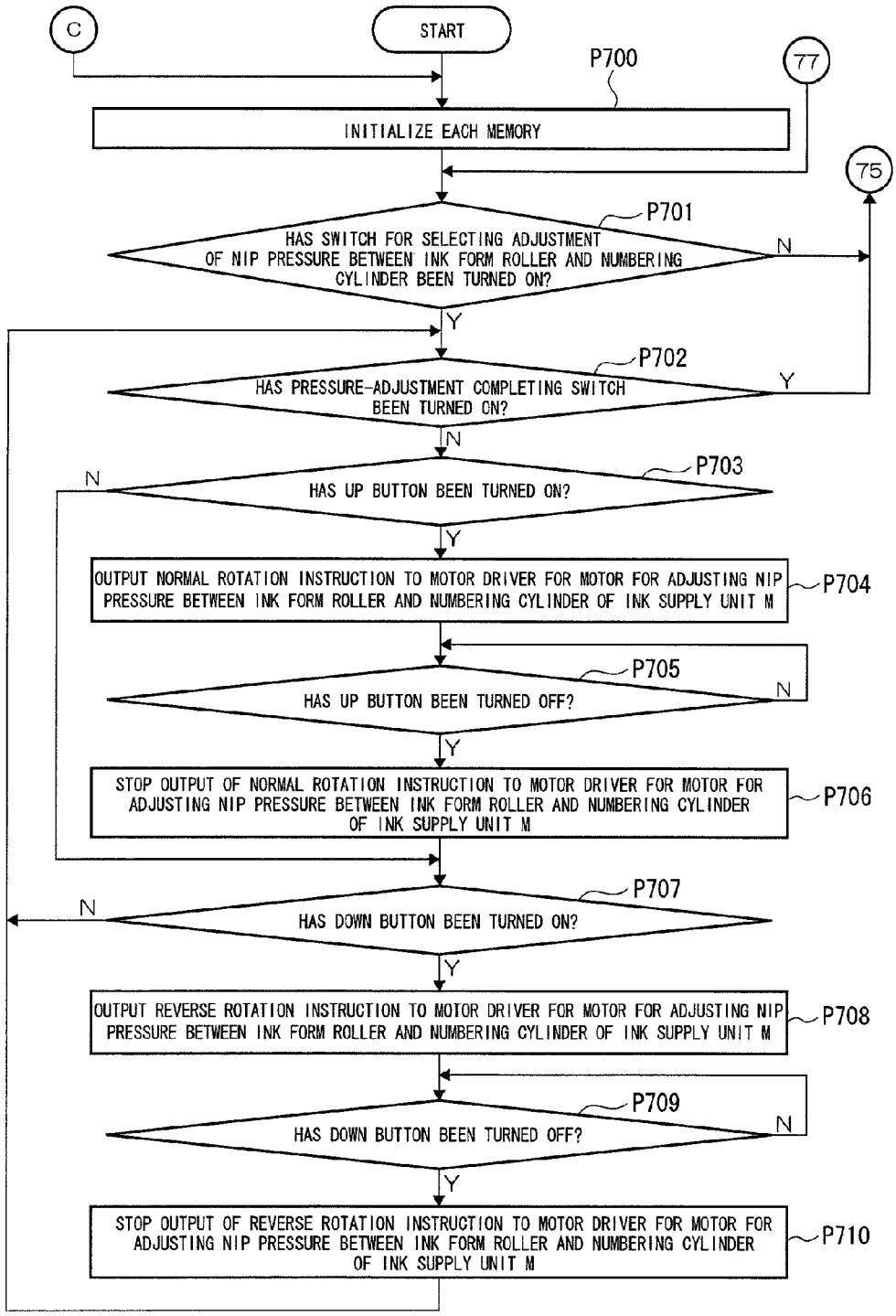
FIG. 35A shows an operational flowchart of the contact-pressure adjusting system for a liquid application machine according to the seventh embodiment of the present invention.
Figure 35B:
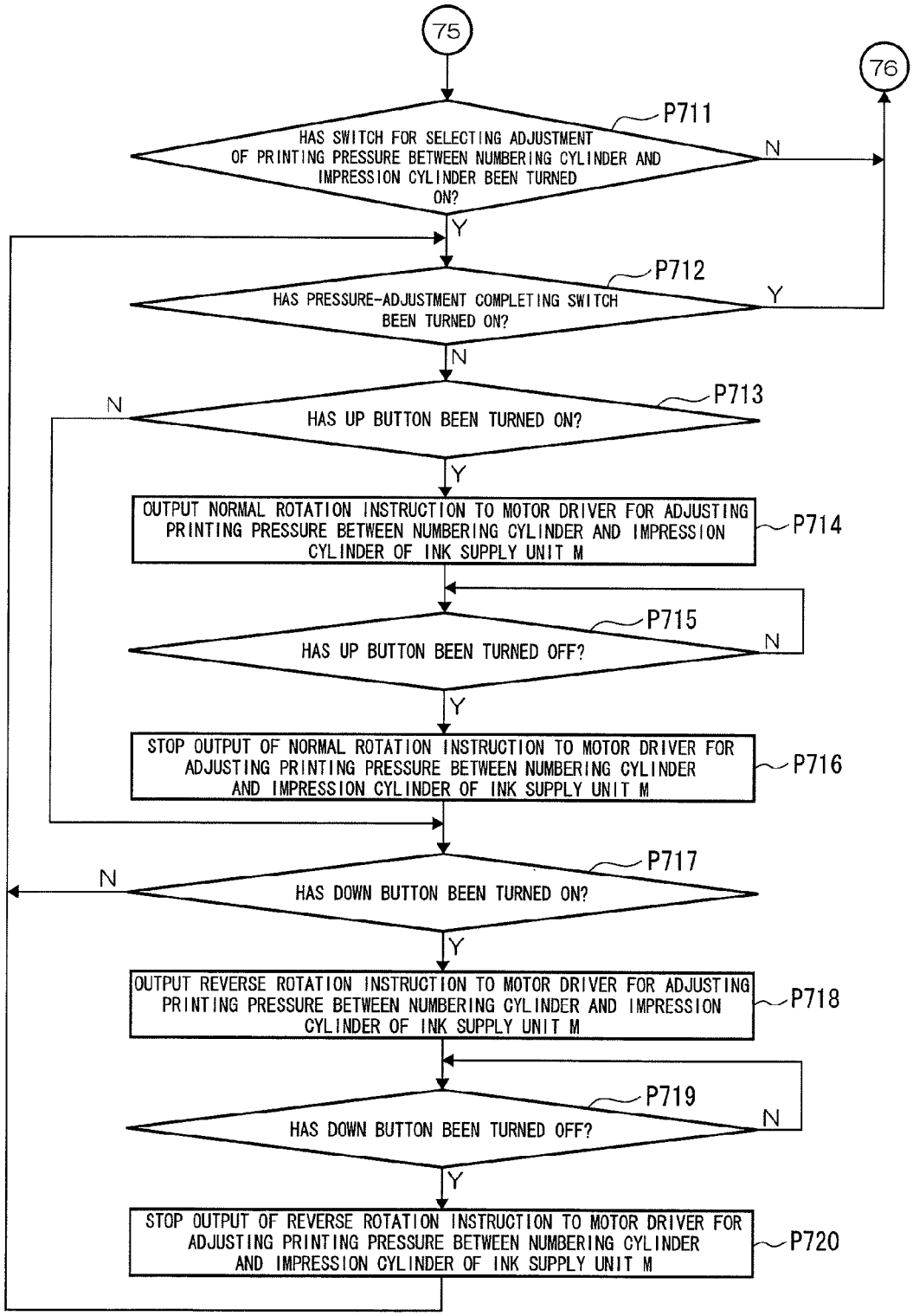
FIG. 35B shows an operational flowchart subsequent to that of FIG. 35A.
Figure 35C:
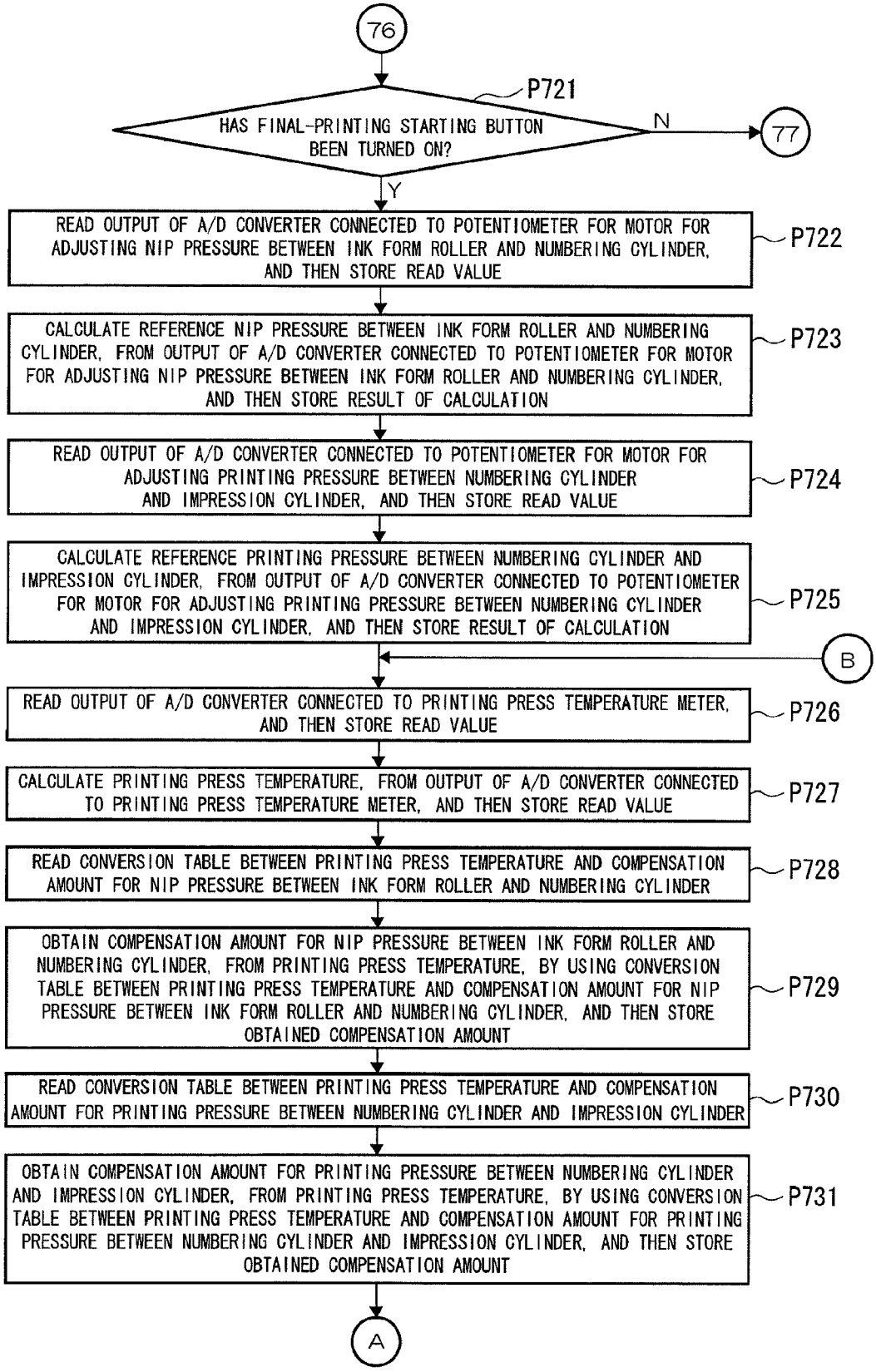
FIG. 35C shows an operational flowchart subsequent to that of FIG. 35B.
Figure 36A:
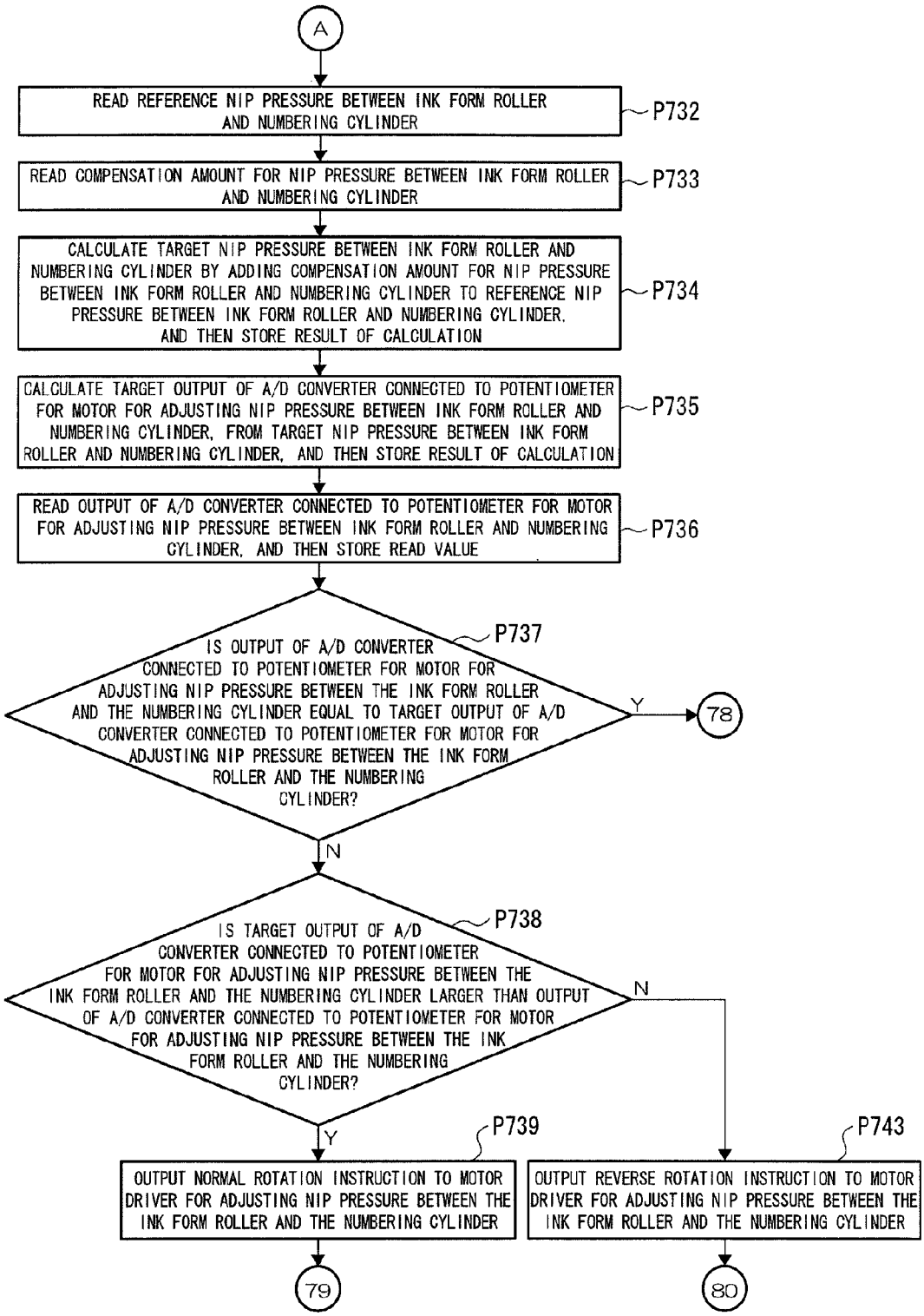
FIG. 36A shows an operational flowchart subsequent to that of FIG. 35C.
Figure 36B:
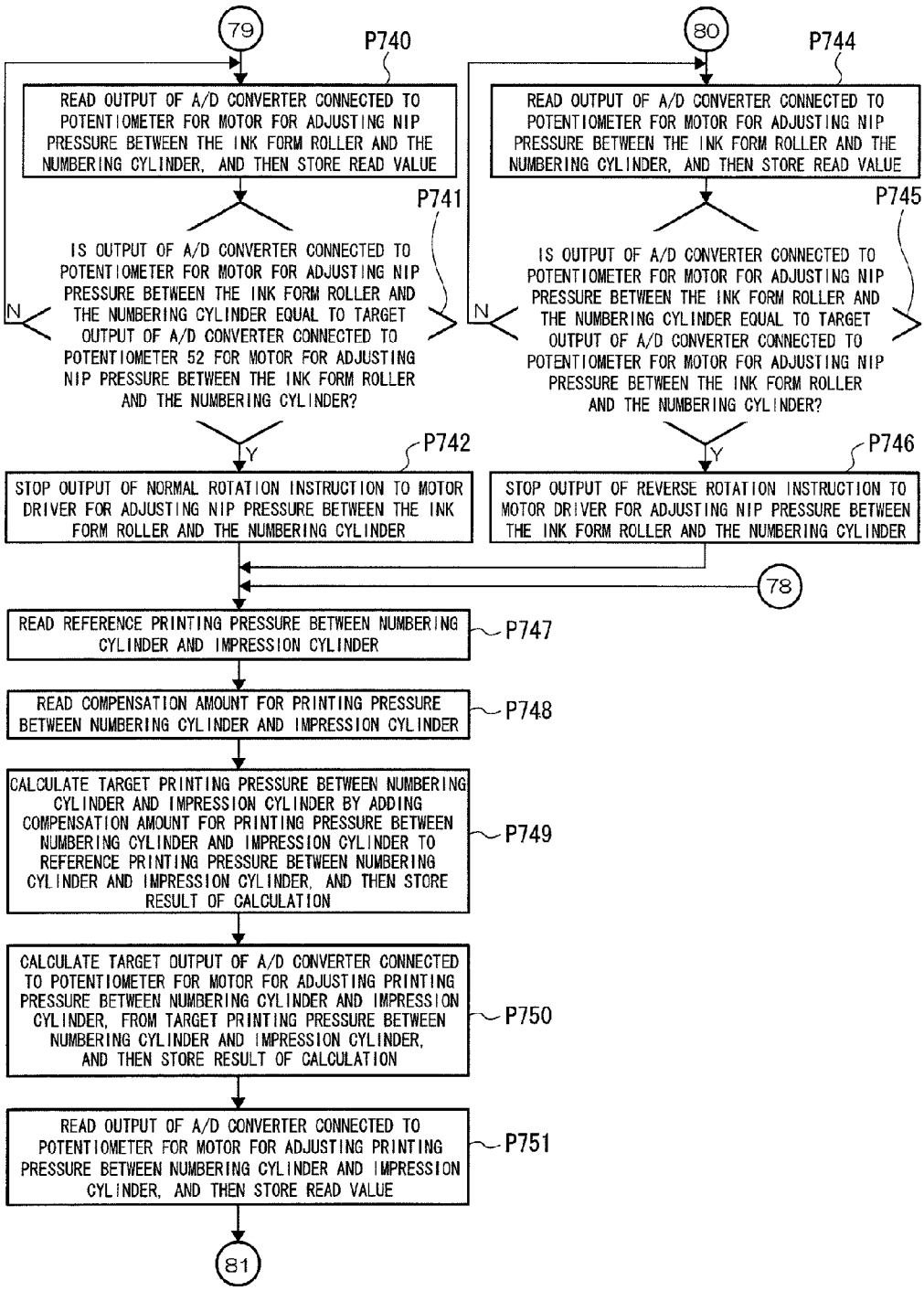
FIG. 36B shows an operational flowchart subsequent to that of FIG. 36A.
Figure 36C:
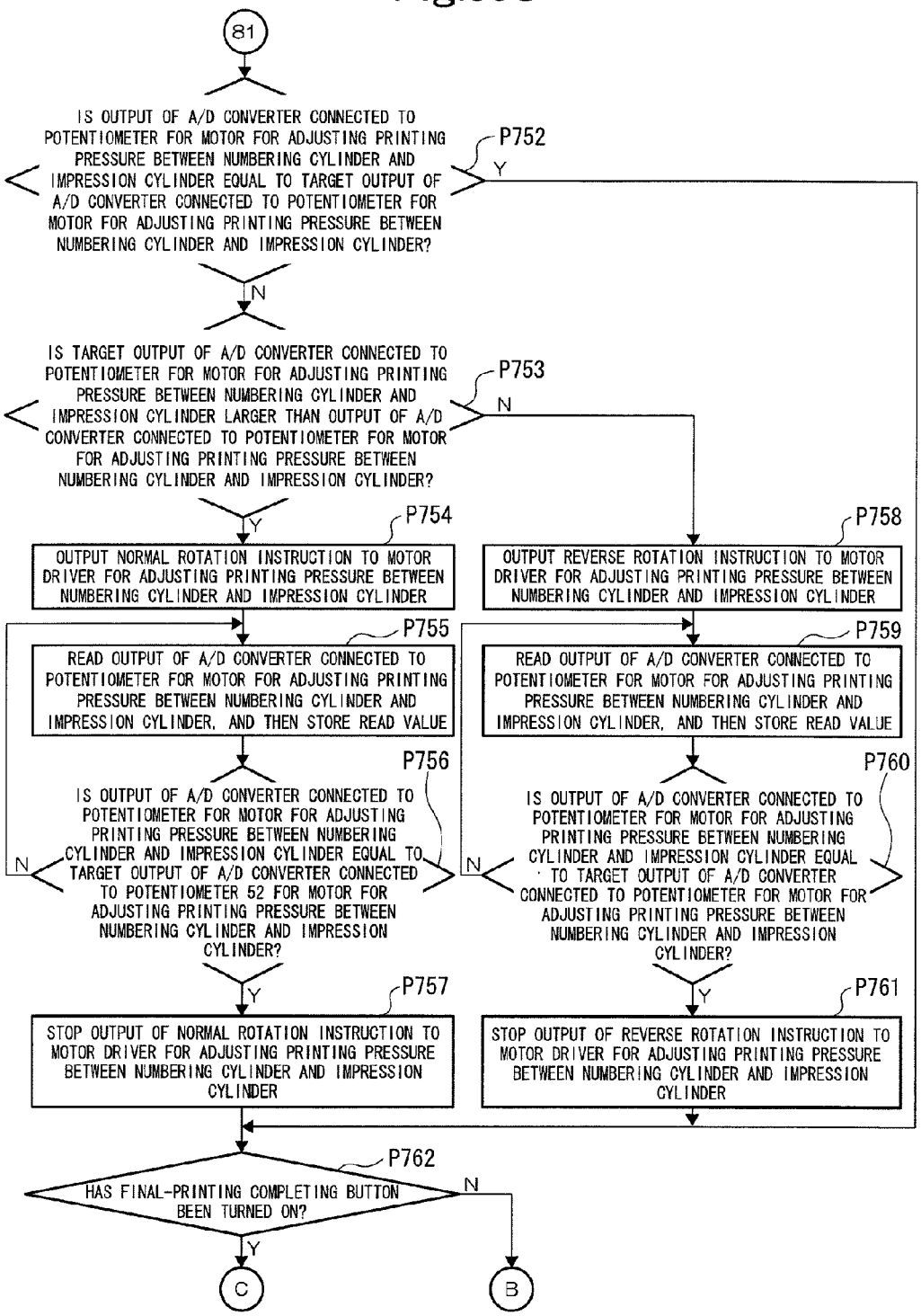
FIG. 36C shows an operational flowchart subsequent to that of FIG. 36B.

Next, a description will be given of a contact-pressure adjusting system for a liquid application machine according to the seventh embodiment of the present invention. FIG. 34 shows a hardware block diagram of the contact-pressure adjusting system for a liquid application machine. As shown in FIG. 34, the contact-pressure adjusting system 1 for a liquid application machine includes a CPU 10, a RAM 11, a ROM 12, an input device 13, a display device 14, an output device (an FD drive, a printer or the like) 15, an I/O (input/output) interface 16.

In addition, the contact-pressure adjusting system 1 includes a printing press temperature meter 17, the motor 67 for adjusting the nip pressure between the ink form roller 400 and the numbering cylinder 401, the motor driver 68 for adjusting the nip pressure between the ink form roller 400 and the numbering cylinder 401, the potentiometer 69 for the motor for adjusting the nip pressure between the ink form roller 400 and the numbering cylinder 401, the motor 70 for adjusting the printing pressure between the numbering cylinder 401 and the impression cylinder 402, the motor driver 71 for adjusting the printing pressure between the numbering cylinder 401 and the impression cylinder 402, the potentiometer 72 for the motor for adjusting the printing pressure between the numbering cylinder 401 and the impression cylinder 402, A/D (analog/digital) converters 27 to 29, and I/O (input/output) interfaces 31 to 33.

Furthermore, the contact-pressure adjusting system 1 includes memories M11, M12, and M102 to M 113. In the memory M11, an output of the A/D converter connected to the printing press temperature meter 17 is stored. In the memory M12, a printing press temperature is stored. In the memory M102, an output of the A/D converter connected to the potentiometer 69 for the motor for adjusting the nip pressure between the ink form roller 400 and the numbering cylinder 401 is stored. In the memory M103, a reference nip pressure between the ink form roller 400 and the numbering cylinder 401 is stored. In the memory M104, an output of the A/D converter connected to the potentiometer 72 for the motor for adjusting the printing pressure between the numbering cylinder 401 and the impression cylinder 402 is stored. In the memory M105, a reference printing pressure between the numbering cylinder 401 and the impression cylinder 402 is stored. In the memory M106, a conversion table between the printing press temperature and the compensation amount for the nip pressure between the ink form roller 400 and the numbering cylinder 401 is stored. In the memory M107, a compensation amount for the nip pressure between the ink form roller 400 and the numbering cylinder 401 is stored. In the memory M108, a conversion table between the printing press temperature and the compensation amount for the printing pressure between the numbering cylinder 401 and the impression cylinder 402 is stored. In the memory M109, a compensation amount for the printing pressure between the numbering cylinder 401 and the impression cylinder 402 is stored. In the memory M110, a target nip pressure between the ink form roller 400 and the numbering cylinder 401 is stored. In the memory M111, a target output of the A/D converter connected to the potentiometer 69 for the motor for adjusting the nip pressure between the ink form roller 400 and the numbering cylinder 401 is stored. In the memory M112, a target printing pressure between the numbering cylinder 401 and the impression cylinder 402 is stored. In the memory M113, a target output of the A/D converter connected to the potentiometer 72 for the motor for adjusting the printing pressure between the numbering cylinder 401 and the impression cylinder 402 is stored.

The CPU 10 obtains various kinds of information which are inputted thereto via the I/O interfaces 16, and 31 to 33, and operates in accordance with a program stored in the ROM 12, while accessing the RAM 11 as well as the memories M11, M12, and M102 to M113. The input device 13 is provided with various kinds of input devices including a switch for selecting the adjustment of the nip pressure between the ink form roller 400 and the numbering cylinder 401, a pressure-adjustment completing switch, an up button, a down button, a switch for selecting the adjustment of the printing pressure between the numbering cylinder 401 and the impression cylinder 402, a final-printing starting button, a final-printing completing button.

Next, the operation of the contact-pressure adjusting system for a liquid application machine according to the seventh embodiment of the present invention will be described. Each of FIGS. 35A to 35C, and 36A to 36C shows an operational flowchart of the contact-pressure adjusting system 1 for a liquid application machine according to the seventh embodiment of the present invention. Hereinafter, the content of the processing of each step will be described.

In Step P700, the CPU 10 initializes each memory. Upon completion of the processing of Step P700, the CPU 10 executes Step P701.

In Step P701, the CPU 10 determines whether or not the switch for selecting the adjustment of the nip pressure between the ink form roller and the numbering cylinder, which is provided to the input device 13, has been turned ON by the operator. When the switch for selecting the adjustment of the nip pressure between the ink form roller and the numbering cylinder has been turned ON, the CPU 10 executes Step P702. On the other hand, when the switch for selecting the adjustment of the nip pressure between the ink form roller and the numbering cylinder has not been turned ON, the CPU 10 skips Steps P702 to P710, and then executes Step P711.

In Step P702, the CPU 10 determines whether or not the pressure-adjustment completing switch, which is provided to the input device 13, has been turned ON by the operator. When the pressure-adjustment completing switch has been turned ON, the CPU 10 skips Steps P703 to P710, and then executes Step P711. On the other hand, when the pressure-adjustment completing switch has not been turned ON, the CPU 10 executes Step P703.

In Step P703, the CPU 10 determines whether or not the up button, which is provided to the input device 13, has been turned ON by the operator. When the up button has been turned ON, the CPU 10 executes Step P704. On the other hand, when the up button has not been turned ON, the CPU 10 skips Steps P704 to P706, and then executes Step P707.

In Step P704, the CPU 10 outputs a normal rotation instruction to the motor driver 68 for adjusting the nip pressure between the ink form roller and the numbering cylinder. Upon completion of the processing of Step P704, the CPU 10 executes Step P705.

In Step P705, the CPU 10 determines whether or not the up button, which is provided to the input device 13, has been turned OFF by the operator. When the up button has been turned OFF, the CPU 10 executes Step P706. On the other hand, when the up button has not been turned OFF, the CPU 10 executes Step P705 again.

In Step P706, the CPU 10 stops the output of the normal rotation instruction to the motor driver 68 for adjusting the nip pressure between the ink form roller and the numbering cylinder. Upon completion of the processing of Step P706, the CPU 10 executes Step P707.

In Step P707, the CPU 10 determines whether or not the down button, which is provided to the input device 13, has been turned ON by the operator. When the down button has been turned ON, the CPU 10 executes Step P708. On the other hand, when the down button has not been turned ON, the CPU 10 executes Step P702.

In Step P708, the CPU 10 outputs a reverse rotation instruction to the motor driver 68 for adjusting the nip pressure between the ink form roller and the numbering cylinder. Upon completion of the processing of Step P708, the CPU 10 executes Step P709.

In Step P709, the CPU 10 determines whether or not the down button, which is provided to the input device 13, has been turned OFF by the operator. When the down button has been turned OFF, the CPU 10 executes Step P710. On the other hand, when the down button has not been turned OFF, the CPU 10 executes Step P709 again.

In Step P710, the CPU 10 stops the output of the reverse rotation instruction to the motor driver 68 for adjusting the nip pressure between the ink form roller and the numbering cylinder. Upon completion of the processing of Step P710, the CPU 10 executes Step P702.

In Step P711, the CPU 10 determines whether or not the switch for selecting the adjustment of the printing pressure between the numbering cylinder and the impression cylinder, which is provided to the input device 13, has been turned ON by the operator. When the switch for selecting the adjustment of the printing pressure between the numbering cylinder and the impression cylinder has been turned ON, the CPU 10 executes Step P712. On the other hand, when the switch for selecting the adjustment of the printing pressure between the numbering cylinder and the impression cylinder has not been turned ON, the CPU 10 skips Steps P712 to P720, and then executes Step P721.

In Step P712, the CPU 10 determines whether or not the pressure-adjustment completing switch, which is provided to the input device 13, has been turned ON by the operator. When the pressure-adjustment completing switch has been turned ON, the CPU 10 skips Steps P713 to P720, and then executes Step P721. On the other hand, when the pressure-adjustment completing switch has not been turned ON, the CPU 10 executes Step P713.

In Step P713, the CPU 10 determines whether or not the up button, which is provided to the input device 13, has been turned ON by the operator. When the up button has been turned ON, the CPU 10 executes Step P714. On the other hand, when the up button has not been turned ON, the CPU 10 skips P714 to P716, and then executes Step P717.

In Step P714, the CPU 10 outputs a normal rotation instruction to the motor driver 71 for adjusting the printing pressure between the numbering cylinder and the impression cylinder. Upon completion of the processing of Step P714, the CPU 10 executes Step P715.

In Step P715, the CPU 10 determines whether or not the up button, which is provided to the input device 13, has been turned OFF by the operator. When the up button has been turned OFF, the CPU 10 executes Step P716. On the other hand, when the up button has not been turned OFF, the CPU 10 executes Step P715 again.

In Step P716, the CPU 10 stops the output of the normal rotation instruction to the motor driver 71 for adjusting the printing pressure between the numbering cylinder and the impression cylinder. Upon completion of the processing of Step P716, the CPU 10 executes Step P717.

In Step P717, the CPU 10 determines whether or not the down button, which is provided to the input device 13, has been turned ON by the operator. When the down button has been turned ON, the CPU 10 executes Step P718. On the other hand, when the down button has not been turned ON, the CPU 10 executes Step P712.

In Step P718, the CPU 10 outputs a reverse rotation instruction to the motor driver 71 for adjusting the printing pressure between the numbering cylinder and the impression cylinder. Upon completion of the processing of Step P718, the CPU 10 executes Step P719.

In Step P719, the CPU 10 determines whether or not the down button, which is provided to the input device 13, has been turned OFF by the operator. When the down button has been turned OFF, the CPU 10 executes Step P720. On the other hand, when the down button has not been turned OFF, the CPU 10 executes Step P719 again.

In Step P720, the CPU 10 stops the output of the reverse rotation instruction to the motor driver 71 for adjusting the printing pressure between the numbering cylinder and the impression cylinder. Upon completion of the processing of Step P720, the CPU 10 executes Step P721. With the foregoing steps, the adjustment of each contact-pressure adjusting means of the numbering and imprinting machine before starting the final printing is performed by manual operation of the operator.

In Step P721, the CPU 10 determines whether or not the final-printing starting button, which is provided to the input device 13, has been turned ON by the operator. When the final-printing starting button has been turned ON, the CPU 10 executes Step P722. On the other hand, when the final-printing starting button has not been turned ON, the CPU 10 executes Step P701.

In Step P722, the CPU 10 reads the output of the A/D converter connected to the potentiometer 69 for the motor for adjusting the nip pressure between the ink form roller and the numbering cylinder. The CPU 10 then stores the read value in the memory M102. Upon completion of the processing of Step P722, the CPU 10 executes Step P723.

In Step P723, the CPU 10 calculates a reference nip pressure between the ink form roller and the numbering cylinder, from the output of the A/D converter connected to the potentiometer 69 for the motor for adjusting the nip pressure between the ink form roller and the numbering cylinder. The CPU 10 then stores the result of the calculation in the memory M103. Upon completion of the processing of Step P723, the CPU 10 executes Step P724.

In Step P724, the CPU 10 reads the output of the A/D converter connected to the potentiometer 72 for the motor for adjusting the printing pressure between the numbering cylinder and the impression cylinder. The CPU 10 then stores the read value in the memory M104. Upon completion of the processing of Step P724, the CPU 10 executes Step P725.

In Step P725, the CPU 10 calculates a reference printing pressure between the numbering cylinder and the impression cylinder, from the output of the A/D converter connected to the potentiometer 72 for the motor for adjusting the printing pressure between the numbering cylinder and the impression cylinder. The CPU 10 then stores the result of the calculation in the memory M105. Upon completion of the processing of Step P725, the CPU 10 executes Step P726. With the foregoing steps, the position of each contact-pressure adjusting means of the numbering and imprinting machine at the time of starting the final printing is stored as a reference position.

In Step P726, the CPU 10 reads the output of the A/D converter connected to the printing press temperature meter 17. The CPU 10 then stores the read value in the memory M11. Upon completion of the processing of Step P726, the CPU 10 executes Step P727.

In Step P727, the CPU 10 calculates a printing press temperature, from the output of the A/D converter connected to the printing press temperature meter 17. The CPU 10 then stores the read value in the memory M12. Upon completion of the processing of Step P727, the CPU 10 executes Step P728.

In Step P728, the CPU 10 reads the conversion table between the printing press temperature and the compensation amount for the nip pressure between the ink form roller and the numbering cylinder, which is stored in the memory M106. Upon completion of the processing of Step P728, the CPU 10 executes Step P729.

In Step P729, the CPU 10 obtains a compensation amount for the nip pressure between the ink form roller and the numbering cylinder, from the printing press temperature, by using the conversion table between the printing press temperature and the compensation amount for the nip pressure between the ink form roller and the numbering cylinder. The CPU 10 then stores the obtained compensation amount in the memory M107. Upon completion of the processing of Step P729, the CPU 10 executes Step P730.

In Step P730, the CPU 10 reads the conversion table between the printing press temperature and the compensation amount for the printing pressure between the numbering cylinder and the impression cylinder, which is stored in the memory M108. Upon completion of the processing of Step P730, the CPU 10 executes Step P731.

In Step P731, the CPU 10 obtains a compensation amount for the printing pressure between the numbering cylinder and the impression cylinder, from the printing press temperature, by using the conversion table between the printing press temperature and the compensation amount for the printing pressure between the numbering cylinder and the impression cylinder. The CPU 10 then stores the obtained compensation amount in the memory M109. Upon completion of the processing of Step P731, the CPU 10 executes Step P732.

In Step P732, the CPU 10 reads the reference nip pressure between the ink form roller and the numbering cylinder, which is stored in the memory M103. Upon completion of the processing of Step P732, the CPU 10 executes Step P733.

In Step P733, the CPU 10 reads the compensation amount for the nip pressure between the ink form roller and the numbering cylinder, which is stored in the memory M107. Upon completion of the processing of Step P733, the CPU 10 executes Step P734.

In Step P734, the CPU 10 calculates a target nip pressure between the ink form roller and the numbering cylinder by adding the compensation amount for the nip pressure between the ink form roller and the numbering cylinder to the reference nip pressure between the ink form roller and the numbering cylinder. The CPU 10 then stores the result of the calculation in the memory M110. Upon completion of the processing of Step P734, the CPU 10 executes Step P735.

In Step P735, the CPU 10 calculates a target output of the A/D converter connected to the potentiometer 69 for the motor for adjusting the nip pressure between the ink form roller and the numbering cylinder, from the target nip pressure between the ink form roller and the numbering cylinder. The CPU 10 then stores the result of the calculation in the memory M111. Upon completion of the processing of Step P735, the CPU 10 executes Step P736.

In Step P736, the CPU 10 reads the output of the A/D converter connected to the potentiometer 69 for the motor for adjusting the nip pressure between the ink form roller and the numbering cylinder. The CPU 10 then stores the read value in the memory M102. Upon completion of the processing of Step P736, the CPU 10 executes Step P737.

In Step P737, the CPU 10 determines whether or not the output of the A/D converter connected to the potentiometer 69 for the motor for adjusting the nip pressure between the ink form roller and the numbering cylinder, which is stored in the memory M102, is equal to the target output of the A/D converter connected to the potentiometer 69 for the motor for adjusting the nip pressure between the ink form roller and the numbering cylinder, which is stored in the memory M111.

When the output of the A/D converter connected to the potentiometer 69 for the motor for adjusting the nip pressure between the ink form roller and the numbering cylinder, which is stored in the memory M102, is equal to the target output of the A/D converter connected to the potentiometer 69 for the motor for adjusting the nip pressure between the ink form roller and the numbering cylinder, which is stored in the memory M111, the CPU 10 skips Steps P738 to P746, and then executes Step P747.

On the other hand, when the output of the A/D converter connected to the potentiometer 69 for the motor for adjusting the nip pressure between the ink form roller and the numbering cylinder, which is stored in the memory M102, is not equal to the target output of the A/D converter connected to the potentiometer 69 for the motor for adjusting the nip pressure between the ink form roller and the numbering cylinder, which is stored in the memory M111, the CPU 10 executes Step P738.

In Step P738, the CPU 10 determines whether or not the target output of the A/D converter connected to the potentiometer 69 for the motor for adjusting the nip pressure between the ink form roller and the numbering cylinder, which is stored in the memory M111, is larger than the output of the A/D converter connected to the potentiometer 69 for the motor for adjusting the nip pressure between the ink form roller and the numbering cylinder, which is stored in the memory M102.

When the target output of the A/D converter connected to the potentiometer 69 for the motor for adjusting the nip pressure between the ink form roller and the numbering cylinder, which is stored in the memory M111, is larger than the output of the A/D converter connected to the potentiometer 69 for the motor for adjusting the nip pressure between the ink form roller and the numbering cylinder, which is stored in the memory M102, the CPU 10 executes Step P739.

On the other hand, when the target output of the A/D converter connected to the potentiometer 69 for the motor for adjusting the nip pressure between the ink form roller and the numbering cylinder, which is stored in the memory M111, is not larger than the output of the A/D converter connected to the potentiometer 69 for the motor for adjusting the nip pressure between the ink form roller and the numbering cylinder, which is stored in the memory M102, the CPU 10 executes Step P743.

In Step P739, the CPU 10 outputs a normal rotation instruction to the motor driver 68 for adjusting the nip pressure between the ink form roller and the numbering cylinder. Upon completion of the processing of Step P739, the CPU 10 executes Step P740.

In Step P740, the CPU 10 reads the output of the A/D converter connected to the potentiometer 69 for the motor for adjusting the nip pressure between the ink form roller and the numbering cylinder. The CPU 10 then stores the read value in the memory M102. Upon completion of the processing of Step P740, the CPU 10 executes Step P741.

In Step P741, the CPU 10 determines whether or not the output of the A/D converter connected to the potentiometer 69 for the motor for adjusting the nip pressure between the ink form roller and the numbering cylinder, which is stored in the memory M102, is equal to the target output of the A/D converter connected to the potentiometer 69 for the motor for adjusting the nip pressure between the ink form roller and the numbering cylinder, which is stored in the memory M111.

When the output of the A/D converter connected to the potentiometer 69 for the motor for adjusting the nip pressure between the ink form roller and the numbering cylinder, which is stored in the memory M102, is equal to the target output of the A/D converter connected to the potentiometer 69 for the motor for adjusting the nip pressure between the ink form roller and the numbering cylinder, which is stored in the memory M111, the CPU 10 executes Step P742.

On the other hand, when the output of the A/D converter connected to the potentiometer 69 for the motor for adjusting the nip pressure between the ink form roller and the numbering cylinder, which is stored in the memory M102, is not equal to the target output of the A/D converter connected to the potentiometer 69 for the motor for adjusting the nip pressure between the ink form roller and the numbering cylinder, which is stored in the memory M111, the CPU 10 executes Step P740.

In Step P742, the CPU 10 stops the output of the normal rotation instruction to the motor driver 68 for adjusting the nip pressure between the ink form roller and the numbering cylinder. Upon completion of the processing of Step P742, the CPU 10 executes Step P747.

In Step P743, the CPU 10 outputs a reverse rotation instruction to the motor driver 68 for adjusting the nip pressure between the ink form roller and the numbering cylinder. Upon completion of the processing of Step P743, the CPU 10 executes Step P744.

In Step P744, the CPU 10 reads the output of the A/D converter connected to the potentiometer 69 for the motor for adjusting the nip pressure between the ink form roller and the numbering cylinder. The CPU 10 then stores the read value in the memory M102. Upon completion of the processing of Step P744, the CPU 10 executes Step P745.

In Step P745, the CPU 10 determines whether or not the output of the A/D converter connected to the potentiometer 69 for the motor for adjusting the nip pressure between the ink form roller and the numbering cylinder, which is stored in the memory M102, is equal to the target output of the A/D converter connected to the potentiometer 69 for the motor for adjusting the nip pressure between the ink form roller and the numbering cylinder, which is stored in the memory M111.

When the output of the A/D converter connected to the potentiometer 69 for the motor for adjusting the nip pressure between the ink form roller and the numbering cylinder, which is stored in the memory M102, is equal to the target output of the A/D converter connected to the potentiometer 69 for the motor for adjusting the nip pressure between the ink form roller and the numbering cylinder, which is stored in the memory M111, the CPU 10 executes Step P746.

On the other hand, when the output of the A/D converter connected to the potentiometer 69 for the motor for adjusting the nip pressure between the ink form roller and the numbering cylinder, which is stored in the memory M102, is not equal to the target output of the A/D converter connected to the potentiometer 69 for the motor for adjusting the nip pressure between the ink form roller and the numbering cylinder, which is stored in the memory M111, the CPU 10 then executes Step P744.

In Step P746, the CPU 10 stops the output of the reverse rotation instruction to the motor driver 68 for adjusting the nip pressure between the ink form roller and the numbering cylinder. Upon completion of the processing of Step P746, the CPU 10 executes Step P747.

In Step P747, the CPU 10 reads the reference printing pressure between the numbering cylinder and the impression cylinder, which is stored in the memory M105. Upon completion of the processing of Step P747, the CPU 10 executes Step P748.

In Step P748, the CPU 10 reads the compensation amount for the printing pressure between the numbering cylinder and the impression cylinder, which is stored in the memory M109. Upon completion of the processing of Step P748, the CPU 10 executes Step P749.

In Step P749, the CPU 10 calculates a target printing pressure between the numbering cylinder and the impression cylinder by adding the compensation amount for the printing pressure between the numbering cylinder and the impression cylinder to the reference printing pressure between the numbering cylinder and the impression cylinder. The CPU 10 then stores the result of the calculation in the memory M112. Upon completion of the processing of Step P749, the CPU 10 executes Step P750.

In Step P750, the CPU 10 calculates a target output of the A/D converter connected to the potentiometer 72 for the motor for adjusting the printing pressure between the numbering cylinder and the impression cylinder, from the target printing pressure between the numbering cylinder and the impression cylinder. The CPU 10 then stores the result of the calculation in the memory M113. Upon completion of the processing of Step P750, the CPU 10 executes Step P751.

In Step P751, the CPU 10 reads the output of the A/D converter connected to the potentiometer 72 for the motor for adjusting the printing pressure between the numbering cylinder and the impression cylinder. The CPU 10 then stores the read value in the memory M104. Upon completion of the processing of Step P751, the CPU 10 executes Step P752.

In Step P752, the CPU 10 determines whether or not the output of the A/D converter connected to the potentiometer 72 for the motor for adjusting the printing pressure between the numbering cylinder and the impression cylinder, which is stored in the memory M104, is equal to the target output of the A/D converter connected to the potentiometer 72 for the motor for adjusting the printing pressure between the numbering cylinder and the impression cylinder, which is stored in the memory M113.

When the output of the A/D converter connected to the potentiometer 72 for the motor for adjusting the printing pressure between the numbering cylinder and the impression cylinder, which is stored in the memory M104, is equal to the target output of the A/D converter connected to the potentiometer 72 for the motor for adjusting the printing pressure between the numbering cylinder and the impression cylinder, which is stored in the memory M113, the CPU 10 skips Steps P753 to P761, and then executes Step P762.

On the other hand, when the output of the A/D converter connected to the potentiometer 72 for the motor for adjusting the printing pressure between the numbering cylinder and the impression cylinder, which is stored in the memory M104, is not equal to the target output of the A/D converter connected to the potentiometer 72 for the motor for adjusting the printing pressure between the numbering cylinder and the impression cylinder, which is stored in the memory M113, the CPU 10 executes Step P753.

In Step P753, the CPU 10 determines whether or not the target output of the A/D converter connected to the potentiometer 72 for the motor for adjusting the printing pressure between the numbering cylinder and the impression cylinder, which is stored in the memory M113, is larger than the output of the A/D converter connected to the potentiometer 72 for the motor for adjusting the printing pressure between the numbering cylinder and the impression cylinder, which is stored in the memory M104.

When the target output of the A/D converter connected to the potentiometer 72 for the motor for adjusting the printing pressure between the numbering cylinder and the impression cylinder, which is stored in the memory M113, is larger than the output of the A/D converter connected to the potentiometer 72 for the motor for adjusting the printing pressure between the numbering cylinder and the impression cylinder, which is stored in the memory M104, the CPU 10 executes Step P754.

When the target output of the A/D converter connected to the potentiometer 72 for the motor for adjusting the printing pressure between the numbering cylinder and the impression cylinder, which is stored in the memory M113, is not larger than the output of the A/D converter connected to the potentiometer 72 for the motor for adjusting the printing pressure between the numbering cylinder and the impression cylinder, which is stored in the memory M104, the CPU 10 executes Step P758.

In Step P754, the CPU 10 outputs a normal rotation instruction to the motor driver 71 for adjusting the printing pressure between the numbering cylinder and the impression cylinder. Upon completion of the processing of Step P754, the CPU 10 executes Step P755.

In Step P755, the CPU 10 reads the output of the A/D converter connected to the potentiometer 72 for the motor for adjusting the printing pressure between the numbering cylinder and the impression cylinder. The CPU 10 then stores the read value in the memory M104. Upon completion of the processing of Step P755, the CPU 10 executes Step P756.

In Step P756, the CPU 10 determines whether or not the output of the A/D converter connected to the potentiometer 72 for the motor for adjusting the printing pressure between the numbering cylinder and the impression cylinder, which is stored in the memory M104, is equal to the target output of the A/D converter connected to the potentiometer 72 for the motor for adjusting the printing pressure between the numbering cylinder and the impression cylinder, which is stored in the memory M113.

When the output of the A/D converter connected to the potentiometer 72 for the motor for adjusting the printing pressure between the numbering cylinder and the impression cylinder, which is stored in the memory M104, is equal to the target output of the A/D converter connected to the potentiometer 72 for the motor for adjusting the printing pressure between the numbering cylinder and the impression cylinder, which is stored in the memory M113, the CPU 10 executes Step P757.

On the other hand, when the output of the A/D converter connected to the potentiometer 72 for the motor for adjusting the printing pressure between the numbering cylinder and the impression cylinder, which is stored in the memory M104, is not equal to the target output of the A/D converter connected to the potentiometer 72 for the motor for adjusting the printing pressure between the numbering cylinder and the impression cylinder, which is stored in the memory M113, the CPU 10 executes Step P755.

In Step P757, the CPU 10 stops the output of the normal rotation instruction to the motor driver 71 for adjusting the printing pressure between the numbering cylinder and the impression cylinder. Upon completion of the processing of Step P757, the CPU 10 executes Step P762.

In Step P758, the CPU 10 outputs a reverse rotation instruction to the motor driver 71 for adjusting the printing pressure between the numbering cylinder and the impression cylinder. Upon completion of the processing of Step P758, the CPU 10 executes Step P759.

In Step P759, the CPU 10 reads the output of the A/D converter connected to the potentiometer 72 for the motor for adjusting the printing pressure between the numbering cylinder and the impression cylinder. The CPU 10 then stores the read value in the memory M104. Upon completion of the processing of Step P759, the CPU 10 executes Step P760.

In Step P760, the CPU 10 determines whether or not the output of the A/D converter connected to the potentiometer 72 for the motor for adjusting the printing pressure between the numbering cylinder and the impression cylinder, which is stored in the memory M104, is equal to the target output of the A/D converter connected to the potentiometer 72 for the motor for adjusting the printing pressure between the numbering cylinder and the impression cylinder, which is stored in the memory M113.

When the output of the A/D converter connected to the potentiometer 72 for the motor for adjusting the printing pressure between the numbering cylinder and the impression cylinder, which is stored in the memory M104, is equal to the target output of the A/D converter connected to the potentiometer 72 for the motor for adjusting the printing pressure between the numbering cylinder and the impression cylinder, which is stored in the memory M113, the CPU 10 executes Step P761.

On the other hand, when the output of the A/D converter connected to the potentiometer 72 for the motor for adjusting the printing pressure between the numbering cylinder and the impression cylinder, which is stored in the memory M104, is not equal to the target output of the A/D converter connected to the potentiometer 72 for the motor for adjusting the printing pressure between the numbering cylinder and the impression cylinder, which is stored in the memory M113, the CPU 10 executes Step P759.

In Step P761, the CPU 10 stops the output of the reverse rotation instruction to the motor driver 71 for adjusting the printing pressure between the numbering cylinder and the impression cylinder. Upon completion of the processing of Step P761, the CPU 10 executes Step P762. With the foregoing steps, each contact-pressure adjusting means of the numbering and imprinting machine is adjusted in accordance with the printing press temperature, which is measured by the printing press temperature meter 17 of the numbering and imprinting machine.

In Step P762, the CPU 10 determines whether or not the final-printing completing button, which is provided to the input device 13, has been turned ON by the operator. When the final-printing completing button has been turned ON, the CPU 10 executes Step P700. On the other hand, when the final-printing completing button has not been turned ON, the CPU 10 executes Step P726.

Eighth Embodiment

Figure 37:
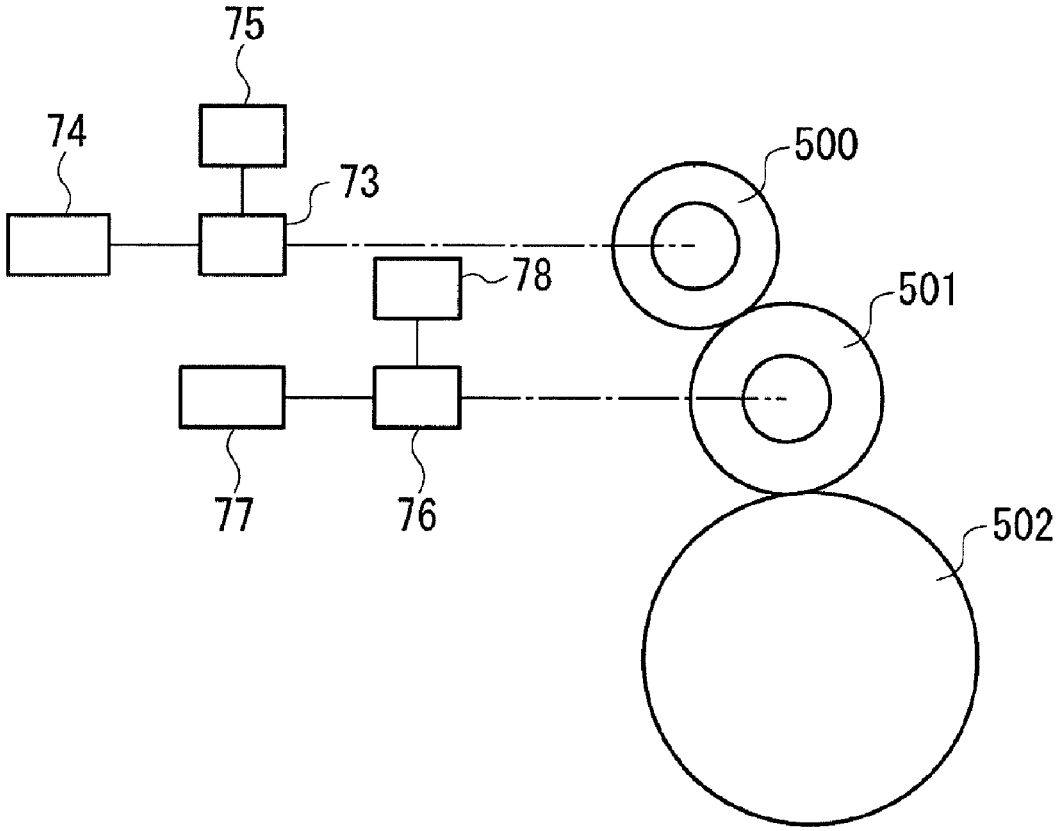
FIG. 37 shows a schematic view of the inside of a coater machine to which a contact-pressure adjusting system for a liquid application machine according to an eighth embodiment of the present invention is employed.

A description will be given of a contact-pressure adjusting method and a contact-pressure adjusting system, for a liquid application machine, according to an eighth embodiment of the present invention. FIG. 37 shows a schematic view of the inside of a coater machine to which the contact-pressure adjusting system for a liquid application machine according to the eighth embodiment of the present invention is employed. As shown in FIG. 37, the coater machine according to the present embodiment includes a form roller 500, a coater cylinder 501, and an impression cylinder 502. The form roller 500 evenly applies a coating medium to a plate surface. The coater cylinder 501 applies the coating medium to a sheet that is in contact with the form roller 500. The impression cylinder 502 applies a printing pressure to the sheet that is in contact with the coater cylinder 501. Note that, the contact-pressure adjusting means for adjusting a nip pressure or a printing pressure, according to the present embodiment, is the same as the contact-pressure adjusting method described in the first embodiment.

The form roller 500 is provided with a motor 73 for adjusting the nip pressure between the form roller 500 and the coater cylinder 501 for the purpose of adjusting the nip pressure between the form roller 500 and the coater cylinder 501. The motor 73 for adjusting the nip pressure between the form roller 500 and the coater cylinder 501 is controlled by a motor driver 74 for adjusting the nip pressure between the form roller 500 and the coater cylinder 501. In addition, the motor 73 for adjusting the nip pressure between the form roller 500 and the coater cylinder 501 is provided with a potentiometer 75 for the motor for adjusting the nip pressure between the form roller 500 and the coater cylinder 501.

The coater cylinder 501 is provided with a motor 76 for adjusting the printing pressure between the coater cylinder 501 and the impression cylinder 502 for the purpose of adjusting the printing pressure between the coater cylinder 501 and the impression cylinder 502. The motor 76 for adjusting the printing pressure between the coater cylinder 501 and the impression cylinder 502 is controlled by a motor driver 77 for adjusting the printing pressure between the coater cylinder 501 and the impression cylinder 502. In addition, the motor 76 for adjusting the printing pressure between the coater cylinder 501 and the impression cylinder 502 is provided with a potentiometer 78 for the motor for adjusting the printing pressure between the coater cylinder 501 and the impression cylinder 502 for the purpose of detecting the printing pressure between the coater cylinder 501 and the impression cylinder 502.

Figure 38:
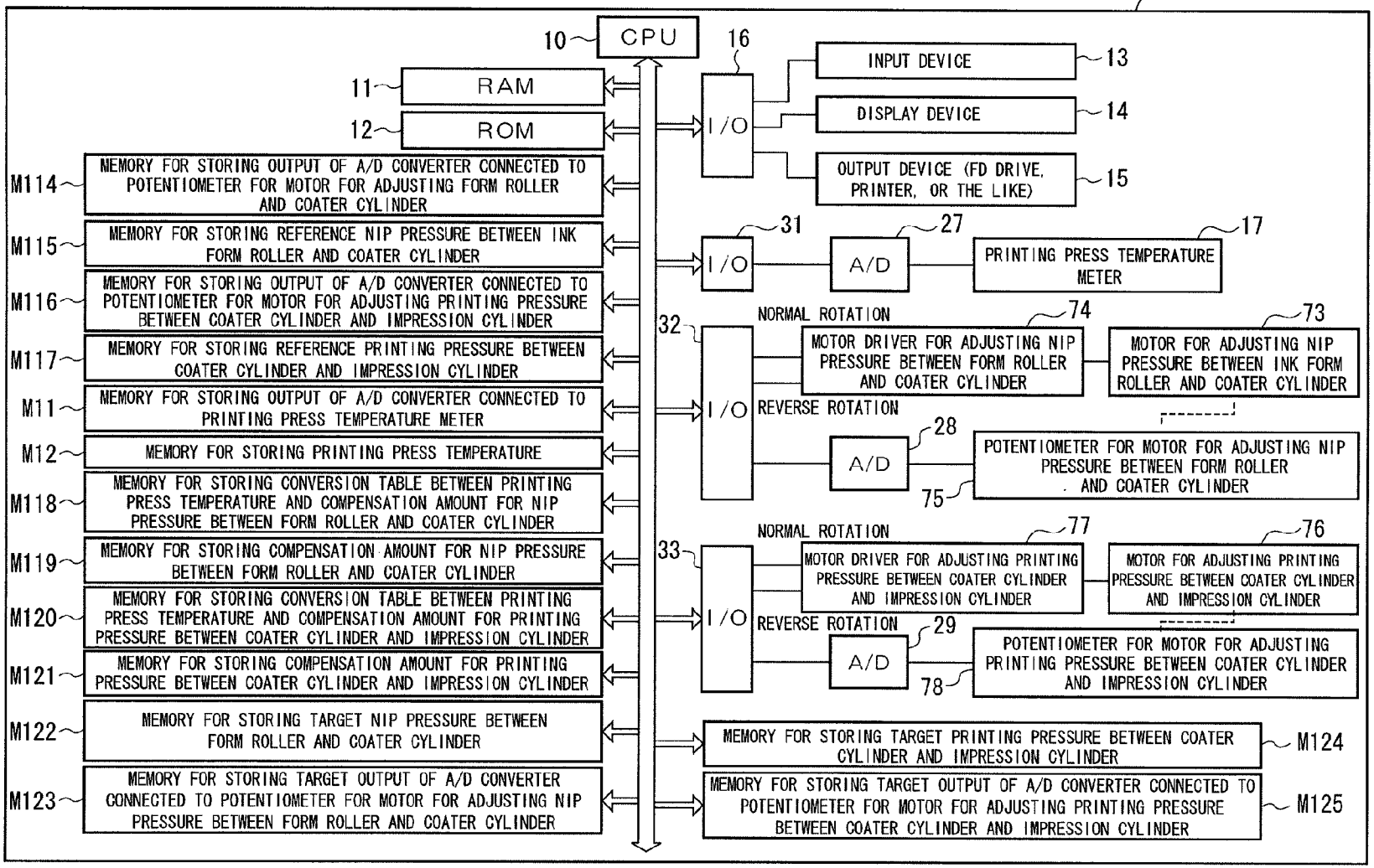
FIG. 38 shows a hardware block diagram of the contact-pressure adjusting system for a liquid application machine according to the eighth embodiment of the present invention.
Figure 39A:
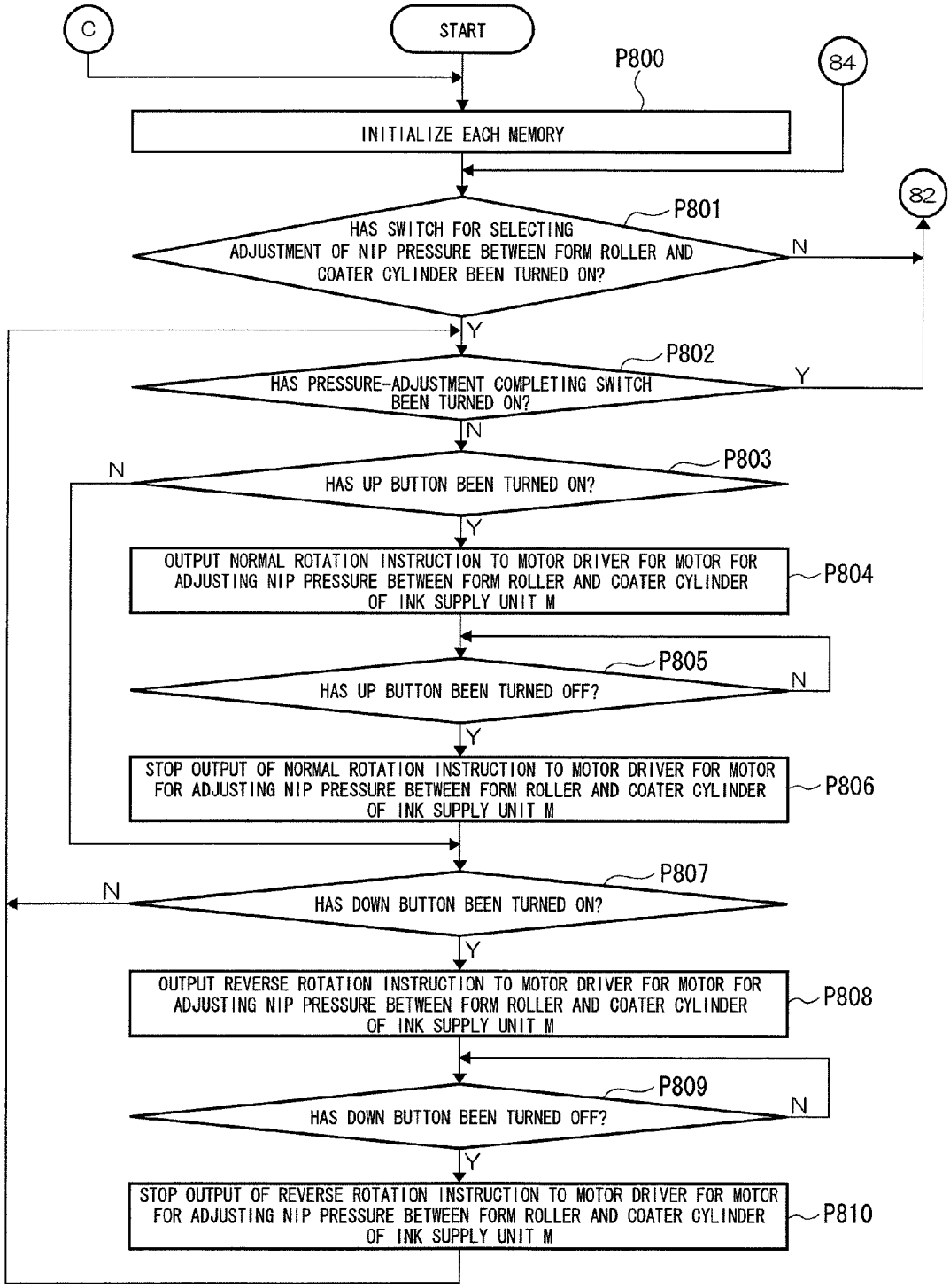
FIG. 39A shows an operational flowchart of the contact-pressure adjusting system for a liquid application machine according to the eighth embodiment of the present invention.
Figure 39B:
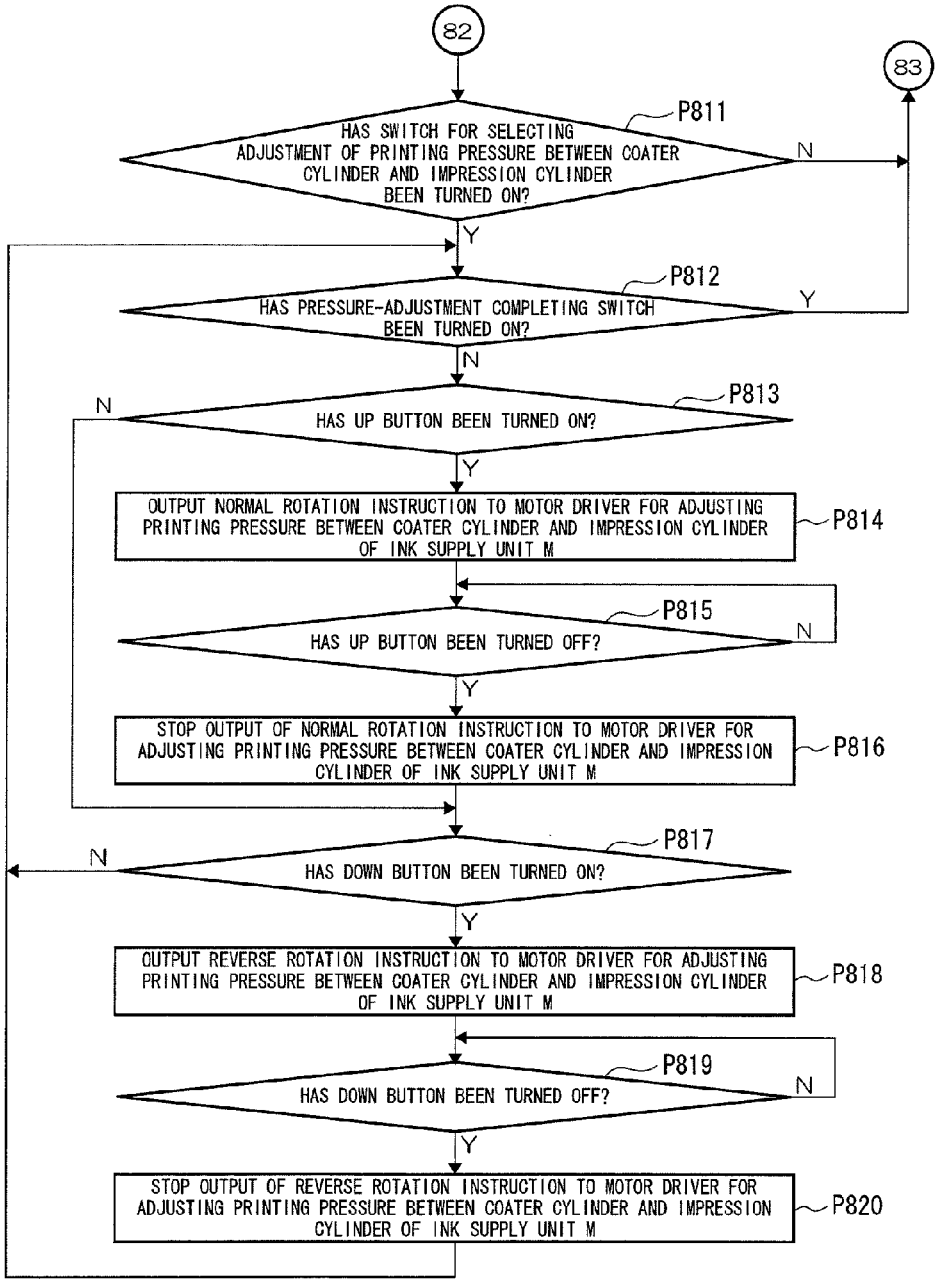
FIG. 39B shows an operational flowchart subsequent to that of FIG. 39A.
Figure 39C:
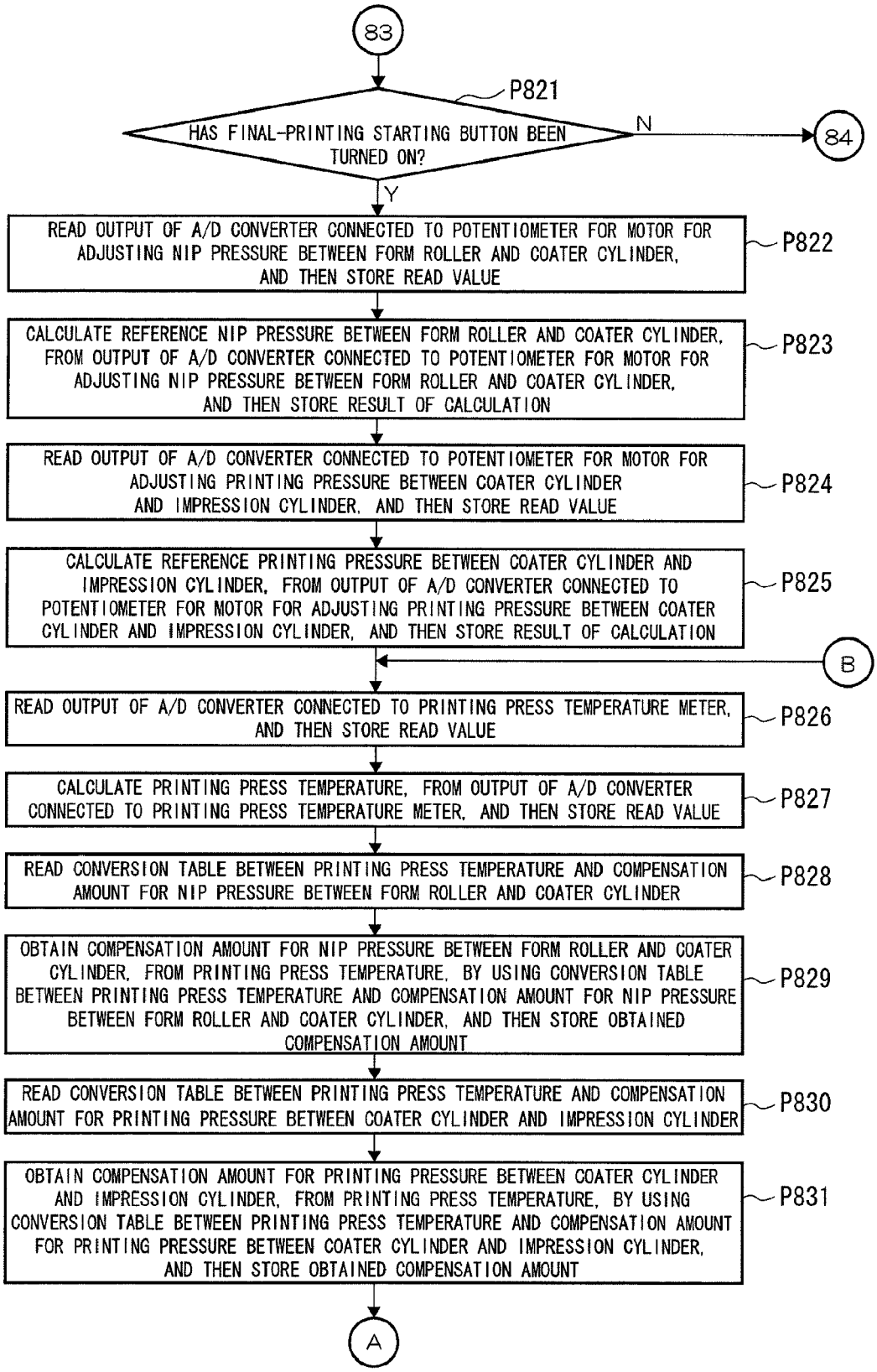
FIG. 39C shows an operational flowchart subsequent to that of FIG. 39B.
Figure 40A:
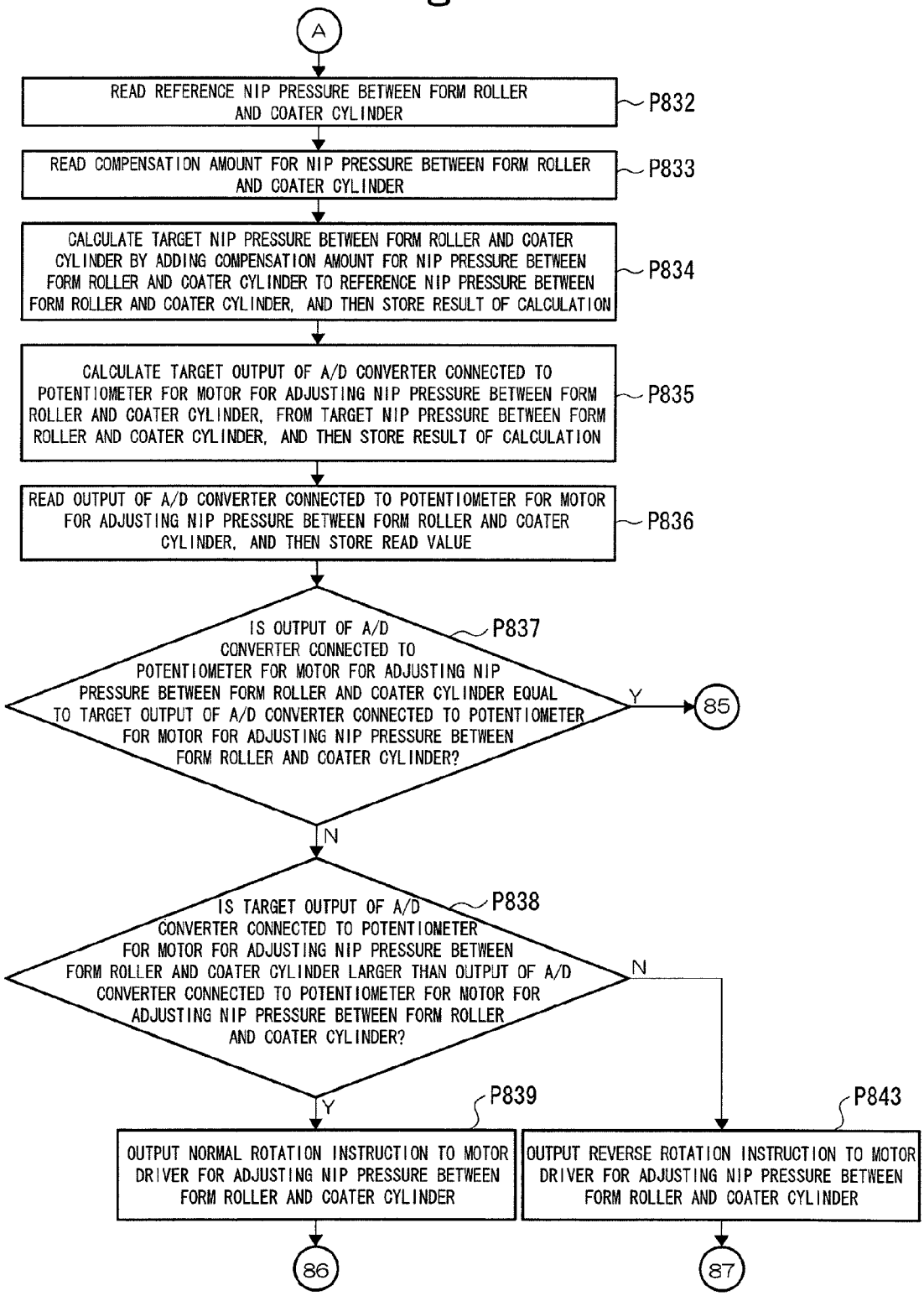
FIG. 40A shows an operational flowchart subsequent to that of FIG. 39C.
Figure 40B:
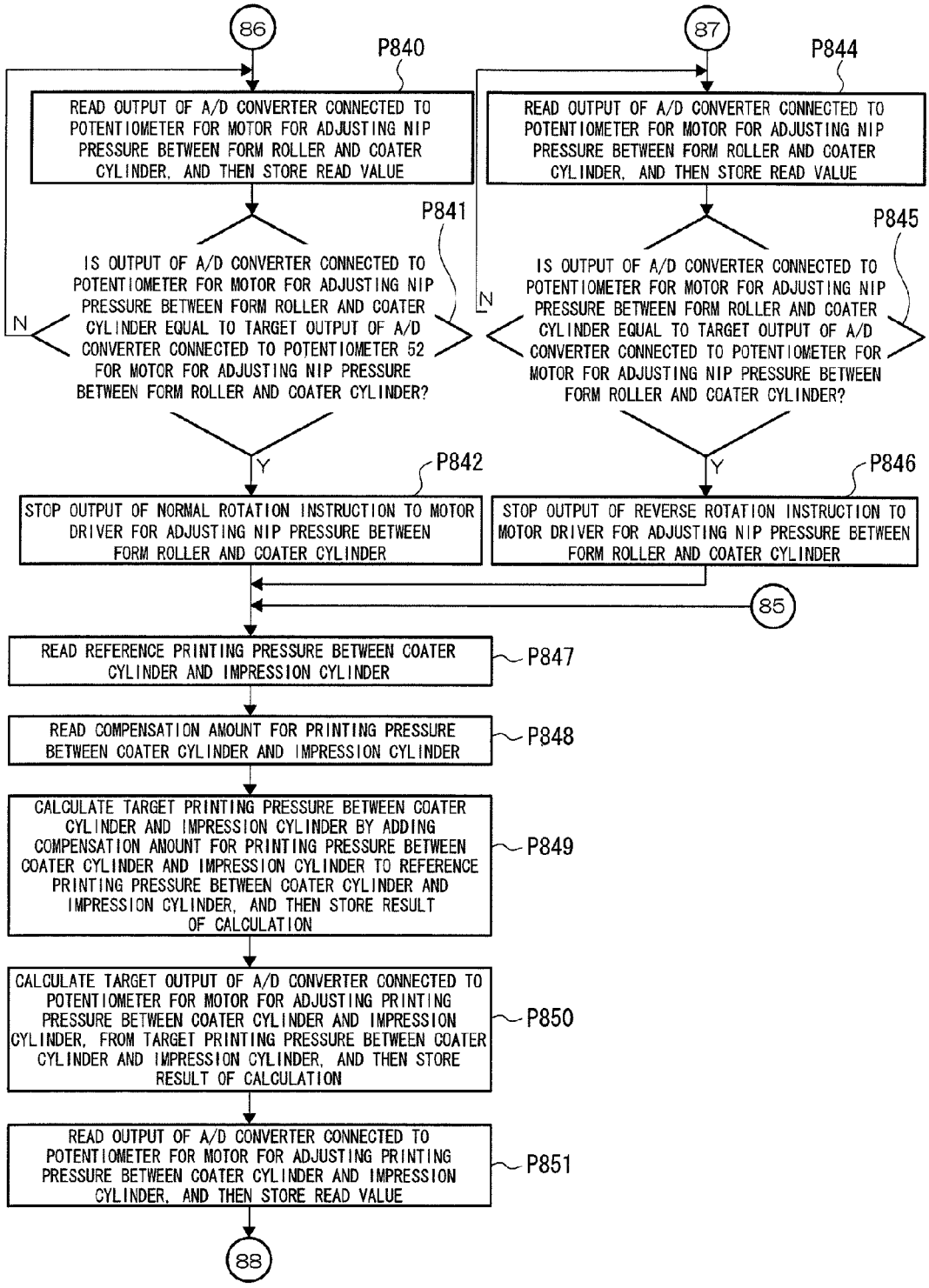
FIG. 40B shows an operational flowchart subsequent to that of FIG. 40A.
Figure 40C:
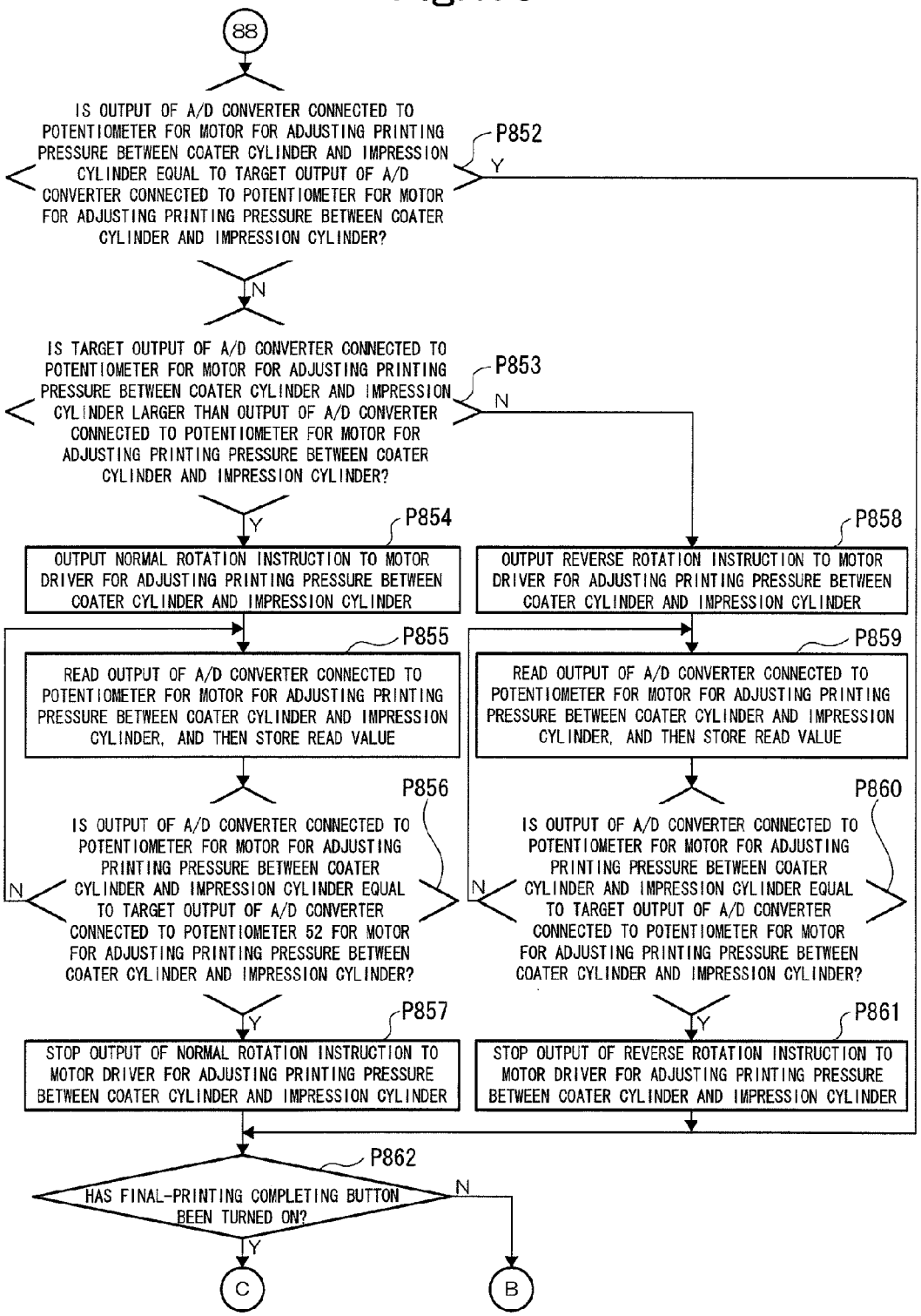
FIG. 40C shows an operational flowchart subsequent to that of FIG. 40B.

Next, a description will be given of a contact-pressure adjusting system for a liquid application machine according to the eighth embodiment of the present invention. FIG. 38 shows a hardware block diagram of the contact-pressure adjusting system for a liquid application machine according to the eighth embodiment of the present invention. As shown in FIG. 38, the contact-pressure adjusting system 1 for a liquid application machine includes a CPU 10, a RAM 11, a ROM 12, an input device 13, a display device 14, an output device (an FD drive, a printer or the like) 15, an I/O (input/output) interface 16.

In addition, the contact-pressure adjusting system 1 includes a printing press temperature meter 17, the motor 73 for adjusting the nip pressure between the ink form roller 500 and the coater cylinder 501, the motor driver 74 for adjusting the nip pressure between the form roller 500 and the coater cylinder 501, the potentiometer 75 for the motor for adjusting the nip pressure between the form roller 500 and the coater cylinder 501, the motor 76 for adjusting the printing pressure between the coater cylinder 501 and the impression cylinder 502, the motor driver 77 for adjusting the printing pressure between the coater cylinder 501 and the impression cylinder 502, the potentiometer 78 for the motor for adjusting the printing pressure between the coater cylinder 501 and the impression cylinder 502, A/D (analog/digital) converters 27 to 29, and I/O (input/output) interfaces 31 to 33. Note that, the printing press temperature meter 17 is configured to measure, as a reference, the temperature inside the printing unit M, or the temperature of ink on the surface of each roller. Accordingly, the printing press temperature meter 17 may be installed in a vicinity of the form roller 500, the coater cylinder 501, and the impression cylinder 502.

Moreover, the contact-pressure adjusting system 1 includes memories M11, M12, and M114 to M125. In the memory M11, an output of the A/D converter connected to the printing press temperature meter 17 is stored. In the memory M12, a printing press temperature is stored. In the memory M114, an output of the A/D converter connected to the potentiometer 75 for the motor for adjusting the form roller 500 and the coater cylinder 501 is stored. In the memory M115, a reference nip pressure between the ink form roller 500 and the coater cylinder 501 is stored. In the memory M116, an output of the A/D converter connected to the potentiometer 78 for the motor for adjusting the printing pressure between the coater cylinder 501 and the impression cylinder 502 is stored. In the memory M117, a reference printing pressure between the coater cylinder 501 and the impression cylinder 502 is stored. In the memory M118, a conversion table between the printing press temperature and the compensation amount for the nip pressure between the form roller 500 and the coater cylinder 501 is stored. In the memory M119, a compensation amount for the nip pressure between the form roller 500 and the coater cylinder 501 is stored. In the memory M120, a conversion table between the printing press temperature and the compensation amount for the printing pressure between the coater cylinder 501 and the impression cylinder 502 is stored. In the memory M121, a compensation amount for the printing pressure between the coater cylinder 501 and the impression cylinder 502 is stored. In the memory M122, a target nip pressure between the form roller 500 and the coater cylinder 501 is stored. In the memory M123, a target output of the A/D converter connected to the potentiometer 75 for the motor for adjusting the nip pressure between the form roller 500 and the coater cylinder 501 is stored. In the memory M124, a target printing pressure between the coater cylinder 501 and the impression cylinder 502 is stored. In the memory M125, a target output of the A/D converter connected to the potentiometer 78 for the motor for adjusting the printing pressure between the coater cylinder 501 and the impression cylinder 502 is stored.

The CPU 10 obtains various kinds of information which are inputted thereto via the I/O interfaces 16, and 31 to 33, and operates in accordance with a program stored in the ROM 12, while accessing the RAM 11 as well as the memories M11, M12 and M114 to M125. The input device 13 is provided with various kinds of input devices including a switch for selecting the adjustment of the nip pressure between the form roller 500 and the coater cylinder 501, a pressure-adjustment completing switch, an up button, a down button, a switch for selecting the adjustment of the printing pressure between the coater cylinder 501 and the impression cylinder 502, a final-printing starting button, and a final-printing completing button.

Next, the operation of the contact-pressure adjusting system for a liquid application machine according to the eighth embodiment of the present invention will be described. Each of FIGS. 39A to 39C, and 40A to 40C shows an operational flowchart of the contact-pressure adjusting system 1 for a liquid application machine according to the eighth embodiment of the present invention. Hereinafter, the content of the processing of each step will be described.

In Step P800, the CPU 10 initializes each memory. Upon completion of the processing of Step P800, the CPU 10 executes Step P801.

In Step P801, the CPU 10 determines whether or not the switch for selecting the adjustment of the nip pressure between the form roller and the coater cylinder, which is provided to the input device 13, has been turned ON by the operator. When the switch for selecting the adjustment of the nip pressure between the form roller and the coater cylinder has been turned ON, the CPU 10 executes Step P802. On the other hand, when the switch for selecting the adjustment of the nip pressure between the form roller and the coater cylinder has not been turned ON, the CPU 10 skips Steps P802 to P810, and then executes Step P811.

In Step P802, the CPU 10 determines whether or not the pressure-adjustment completing switch, which is provided to the input device 13, has been turned ON by the operator. When the pressure-adjustment completing switch has been turned ON, the CPU 10 skips Steps P803 to P810, and then executes Step P811. On the other hand, when the pressure-adjustment completing switch has not been turned ON, the CPU 10 executes Step P803.

In Step P803, the CPU 10 determines whether or not the up button, which is provided to the input device 13, has been turned ON by the operator. When the up button has been turned ON, the CPU 10 executes Step P804. On the other hand, when the up button has not been turned ON, the CPU 10 skips Steps P804 to P806, and then executes Step P807.

In Step P804, the CPU 10 outputs a normal rotation instruction to the motor driver 74 for adjusting the nip pressure between the form roller and the coater cylinder. Upon completion of the processing of Step P804, the CPU 10 executes Step P805.

In Step P805, the CPU 10 determines whether or not the up button, which is provided to the input device 13, has been turned OFF by the operator. When the up button has been turned OFF, the CPU 10 executes Step P806. On the other hand, when the up button has not been turned OFF, the CPU 10 executes Step P805 again.

In Step P806, the CPU 10 stops the output of the normal rotation instruction to the motor driver 74 for adjusting the nip pressure between the form roller and the coater cylinder. Upon completion of the processing of Step P806, the CPU 10 executes Step P807.

In Step P807, the CPU 10 determines whether or not the down button, which is provided to the input device 13, has been turned ON by the operator. When the down button has been turned ON, the CPU 10 executes Step P808. On the other hand, when the down button has not been turned ON, the CPU 10 executes Step P802.

In Step P808, the CPU 10 outputs a reverse rotation instruction to the motor driver 74 for adjusting the nip pressure between the form roller and the coater cylinder. Upon completion of the processing of Step P808, the CPU 10 executes Step P809.

In Step P809, the CPU 10 determines whether or not the down button, which is provided to the input device 13, has been turned OFF by the operator. When the down button has been turned OFF, the CPU 10 executes Step P810. On the other hand, when the down button has not been turned OFF, the CPU 10 executes Step P809 again.

In Step P810, the CPU 10 stops the output of the reverse rotation instruction to the motor driver 74 for adjusting the nip pressure between the form roller and the coater cylinder. Upon completion of the processing of Step P810, the CPU 10 executes Step P802.

In Step P811, the CPU 10 determines whether or not the switch for selecting the adjustment of the printing pressure between the coater cylinder and the impression cylinder, which is provided to the input device 13, has been turned ON by the operator. When the switch for selecting the adjustment of the printing pressure between the coater cylinder and the impression cylinder has been turned ON, the CPU 10 executes Step P812. On the other hand, when the switch for selecting the adjustment of the printing pressure between the coater cylinder and the impression cylinder has not been turned ON, the CPU 10 skips Steps P812 to P820, and then executes Step P821.

In Step P812, the CPU 10 determines whether or not the pressure-adjustment completing switch, which is provided to the input device 13, has been turned ON by the operator. When the pressure-adjustment completing switch has been turned ON, the CPU 10 skips Steps P813 to P820, and then executes Step P821. On the other hand, when the pressure-adjustment completing switch has not been turned ON, the CPU 10 executes Step P813.

In Step P813, the CPU 10 determines whether or not the up button, which is provided to the input device 13, has been turned ON by the operator. When the up button has been turned ON, the CPU 10 executes Step P814. On the other hand, when the up button has not been turned ON, the CPU 10 skips Steps P814 to P816, and then executes Step P817.

In Step P814, the CPU 10 outputs a normal rotation instruction to the motor driver 77 for adjusting the printing pressure between the coater cylinder and the impression cylinder. Upon completion of the processing of Step P814, the CPU 10 executes Step P815.

In Step P815, the CPU 10 determines whether or not the up button, which is provided to the input device 13, has been turned OFF by the operator. When the up button has been turned OFF, the CPU 10 executes Step P816. On the other hand, when the up button has not been turned OFF, the CPU 10 executes Step P815 again.

In Step P816, the CPU 10 stops the output of the normal rotation instruction to the motor driver 77 for adjusting the printing pressure between the coater cylinder and the impression cylinder. Upon completion of the processing of Step P816, the CPU 10 executes Step P817.

In Step P817, the CPU 10 determines whether or not the down button, which is provided to the input device 13, has been turned ON by the operator. When the down button has been turned ON, the CPU 10 executes Step P818. On the other hand, when the down button has not been turned ON, the CPU 10 executes Step P812.

In Step P818, the CPU 10 outputs a reverse rotation instruction to the motor driver 77 for adjusting the printing pressure between the coater cylinder and the impression cylinder. Upon completion of the processing of Step P818, the CPU 10 executes Step P819.

In Step P819, the CPU 10 determines whether or not the down button, which is provided to the input device 13, has been turned OFF by the operator. When the down button has been turned OFF, the CPU 10 executes Step P820. On the other hand, when the down button has not been turned OFF, the CPU 10 executes Step P819 again.

In Step P820, the CPU 10 stops the output of the reverse rotation instruction to the motor driver 77 for adjusting the printing pressure between the coater cylinder and the impression cylinder. Upon completion of the processing of Step P820, the CPU 10 executes Step P812. With the foregoing steps, the adjustment of each contact-pressure adjusting means of the coater machine before starting the final printing is performed by manual operation of the operator.

In Step P821, the CPU 10 determines whether or not the final-printing starting button, which is provided to the input device 13, has been turned ON by the operator. When the final-printing starting button has been turned ON, the CPU 10 executes Step P822. On the other hand, when the final-printing starting button has not been turned ON, the CPU 10 executes Step P801.

In Step P822, the CPU 10 reads the output of the A/D converter connected to the potentiometer 75 for the motor for adjusting the nip pressure between the form roller and the coater cylinder. The CPU 10 then stores the read value in the memory M114. Upon completion of the processing of Step P822, the CPU 10 executes Step P823.

In Step P823, the CPU 10 calculates a reference nip pressure between the form roller and the coater cylinder, from the output of the A/D converter connected to the potentiometer 75 for the motor for adjusting the nip pressure between the form roller and the coater cylinder. The CPU 10 then stores the result of the calculation in the memory M115. Upon completion of the processing of Step P823, the CPU 10 executes Step P824.

In Step P824, the CPU 10 reads the output of the A/D converter connected to the potentiometer 78 for the motor for adjusting the printing pressure between the coater cylinder and the impression cylinder. The CPU 10 then stores the read value in the memory M116. Upon completion of the processing of Step P824, the CPU 10 executes Step P825.

In Step P825, the CPU 10 calculates a reference printing pressure between the coater cylinder and the impression cylinder, from the output of the A/D converter connected to the potentiometer 78 for the motor for adjusting the printing pressure between the coater cylinder and the impression cylinder. The CPU 10 then stores the result of the calculation in the memory M117. Upon completion of the processing of Step P825, the CPU 10 executes Step P826. With the foregoing steps, the position of each contact-pressure adjusting means of the coater machine at the time of starting the final printing is stored as a reference position.

In Step P826, the CPU 10 reads the output of the A/D converter connected to the printing press temperature meter 17. The CPU 10 then stores the read value in the memory M11. Upon completion of the processing of Step P826, the CPU 10 executes Step P827.

In Step P827, the CPU 10 calculates a printing press temperature, from the output of the A/D converter connected to the printing press temperature meter 17. The CPU 10 then stores the result of the calculation in the memory M12. Upon completion of the processing of Step P827, the CPU 10 executes Step P828.

In Step P828, the CPU 10 reads the conversion table between the printing press temperature and the compensation amount for the nip pressure between the form roller and the coater cylinder, which is stored in the memory M118. Upon completion of the processing of Step P828, the CPU 10 executes Step P829.

In Step P829, the CPU 10 obtains a compensation amount for the nip pressure between the form roller and the coater cylinder, from the printing press temperature, by using the conversion table between the printing press temperature and the compensation amount for the nip pressure between the form roller and the coater cylinder. The CPU 10 then stores the obtained compensation amount in the memory M119. Upon completion of the processing of Step P829, the CPU 10 executes Step P830.

In Step P830, the CPU 10 reads the conversion table between the printing press temperature and the compensation amount for the printing pressure between the coater cylinder and the impression cylinder, which is stored in the memory M20. Upon completion of the processing of Step P830, the CPU 10 executes Step P831.

In Step P831, the CPU 10 obtains a compensation amount for the printing pressure between the coater cylinder and the impression cylinder, from the printing press temperature, by using the conversion table between the printing press temperature and the compensation amount for the printing pressure between the coater cylinder and the impression cylinder. The CPU 10 then stores the obtained compensation amount in the memory M121. Upon completion of the processing of Step P831, the CPU 10 executes Step P832.

In Step P832, the CPU 10 reads the reference nip pressure between the form roller and the coater cylinder, which is stored in the memory M115. Upon completion of the processing of Step P832, the CPU 10 executes Step P833.

In Step P833, the CPU 10 reads the compensation amount for the nip pressure between the form roller and the coater cylinder, which is stored in the memory M119. Upon completion of the processing of Step P833, the CPU 10 executes Step P834.

In Step P834, the CPU 10 calculates a target nip pressure between the form roller and the coater cylinder by adding the compensation amount for the nip pressure between the form roller and the coater cylinder to the reference nip pressure between the form roller and the coater cylinder. The CPU 10 then stores the result of the calculation in the memory M122. Upon completion of the processing of Step P834, the CPU 10 executes Step P835.

In Step P835, the CPU 10 calculates a target output of the A/D converter connected to the potentiometer 75 for the motor for adjusting the nip pressure between the form roller and the coater cylinder, from the target nip pressure between the form roller and the coater cylinder. The CPU 10 then stores the result of the calculation in the memory M123. Upon completion of the processing of Step P835, the CPU 10 executes Step P836.

In Step P836, the CPU 10 reads the output of the A/D converter connected to the potentiometer 75 for the motor for adjusting the nip pressure between the form roller and the coater cylinder. The CPU 10 then stores the read value in the memory M114. Upon completion of the processing of Step P836, the CPU 10 executes Step P837.

In Step P837, the CPU 10 determines whether or not the output of the A/D converter connected to the potentiometer 75 for the motor for adjusting the nip pressure between the form roller and the coater cylinder, which is stored in the memory M114, is equal to the target output of the A/D converter connected to the potentiometer 75 for the motor for adjusting the nip pressure between the form roller and the coater cylinder, which is stored in the memory M123.

When the output of the A/D converter connected to the potentiometer 75 for the motor for adjusting the nip pressure between the form roller and the coater cylinder, which is stored in the memory M114, is equal to the target output of the A/D converter connected to the potentiometer 75 for the motor for adjusting the nip pressure between the form roller and the coater cylinder, which is stored in the memory M123, the CPU 10 skips Steps P838 to P846, and then executes Step P847.

On the other hand, when the output of the A/D converter connected to the potentiometer 75 for the motor for adjusting the nip pressure between the form roller and the coater cylinder, which is stored in the memory M114, is not equal to the target output of the A/D converter connected to the potentiometer 75 for the motor for adjusting the nip pressure between the form roller and the coater cylinder, which is stored in the memory M123, the CPU 10 executes Step P838.

In Step P838, the CPU 10 determines whether or not the target output of the A/D converter connected to the potentiometer 75 for the motor for adjusting the nip pressure between the form roller and the coater cylinder, which is stored in the memory M123, is larger than the output of the A/D converter connected to the potentiometer 75 for the motor for adjusting the nip pressure between the form roller and the coater cylinder, which is stored in the memory M114.

When the target output of the A/D converter connected to the potentiometer 75 for the motor for adjusting the nip pressure between the form roller and the coater cylinder, which is stored in the memory M123, is not larger than the output of the A/D converter connected to the potentiometer 75 for the motor for adjusting the nip pressure between the form roller and the coater cylinder, which is stored in the memory M114, the CPU 10 executes Step P839.

On the other hand, when the target output of the A/D converter connected to the potentiometer 75 for the motor for adjusting the nip pressure between the form roller and the coater cylinder, which is stored in the memory M123, is not larger than the output of the A/D converter connected to the potentiometer 75 for the motor for adjusting the nip pressure between the form roller and the coater cylinder, which is stored in the memory M114, the CPU 10 executes Step P843.

In Step P839, the CPU 10 outputs a normal rotation instruction to the motor driver 74 for adjusting the nip pressure between the form roller and the coater cylinder. Upon completion of the processing of Step P839, the CPU 10 executes Step P840.

In Step P840, the CPU 10 reads the output of the A/D converter connected to the potentiometer 75 for the motor for adjusting the nip pressure between the form roller and the numbering cylinder. The CPU 10 then stores the read value in the memory M114. Upon completion of the processing of Step P840, the CPU 10 executes Step P841.

In Step P841, the CPU 10 determines whether or not the output of the A/D converter connected to the potentiometer 75 for the motor for adjusting the nip pressure between the form roller and the coater cylinder, which is stored in the memory M114, is equal to the target output of the A/D converter connected to the potentiometer 75 for the motor for adjusting the nip pressure between the form roller and the coater cylinder, which is stored in the memory M123.

When the output of the A/D converter connected to the potentiometer 75 for the motor for adjusting the nip pressure between the form roller and the coater cylinder, which is stored in the memory M114, is equal to the target output of the A/D converter connected to the potentiometer 75 for the motor for adjusting the nip pressure between the form roller and the coater cylinder, which is stored in the memory M123, the CPU 10 executes Step P842.

On the other hand, when the output of the A/D converter connected to the potentiometer 75 for the motor for adjusting the nip pressure between the form roller and the coater cylinder, which is stored in the memory M114, is not equal to the target output of the A/D converter connected to the potentiometer 75 for the motor for adjusting the nip pressure between the form roller and the coater cylinder, which is stored in the memory M123, the CPU 10 executes Step P840.

In Step P842, the CPU 10 stops the output of the normal rotation instruction to the motor driver 74 for adjusting the nip pressure between the form roller and the coater cylinder. Upon completion of the processing of Step P842, the CPU 10 executes Step P847.

In Step P843, the CPU 10 outputs a reverse rotation instruction to the motor driver 74 for adjusting the nip pressure between the form roller and the coater cylinder. Upon completion of the processing of Step P843, the CPU 10 executes Step P844.

In Step P844, the CPU 10 reads the output of the A/D converter connected to the potentiometer 75 for the motor for adjusting the nip pressure between the form roller and the coater cylinder. The CPU 10 then stores the read value in the memory M114. Upon completion of the processing of Step P844, the CPU 10 executes Step P845.

In Step P845, the CPU 10 determines whether or not the output of the A/D converter connected to the potentiometer 75 for the motor for adjusting the nip pressure between the form roller and the coater cylinder, which is stored in the memory M114, is equal to the target output of the A/D converter connected to the potentiometer 75 for the motor for adjusting the nip pressure between the form roller and the coater cylinder, which is stored in the memory M123.

When the output of the A/D converter connected to the potentiometer 75 for the motor for adjusting the nip pressure between the form roller and the coater cylinder, which is stored in the memory M114, is equal to the target output of the A/D converter connected to the potentiometer 75 for the motor for adjusting the nip pressure between the form roller and the coater cylinder, which is stored in the memory M123, the CPU 10 executes Step P846.

On the other hand, when the output of the A/D converter connected to the potentiometer 75 for the motor for adjusting the nip pressure between the form roller and the coater cylinder, which is stored in the memory M114, is not equal to the target output of the A/D converter connected to the potentiometer 75 for the motor for adjusting the nip pressure between the form roller and the coater cylinder, which is stored in the memory M123, the CPU 10 executes Step P844.

In Step P846, the CPU 10 stops the output of the reverse rotation instruction to the motor driver 74 for adjusting the nip pressure between the form roller and the coater cylinder. Upon completion of the processing of Step P846, the CPU 10 executes Step P847.

In Step P847, the CPU 10 reads the reference printing pressure between the coater cylinder and the impression cylinder, which is stored in the memory M117. Upon completion of the processing of Step P847, the CPU 10 executes Step P848.

In Step P848, the CPU 10 reads the compensation amount for the printing pressure between the coater cylinder and the impression cylinder, which is stored in the memory M121. Upon completion of the processing of Step P848, the CPU 10 executes Step P849.

In Step P849, the CPU 10 calculates a target printing pressure between the coater cylinder and the impression cylinder by adding the compensation amount for the printing pressure between the coater cylinder and the impression cylinder to the reference printing pressure between the coater cylinder and the impression cylinder. The CPU 10 then stores the result of the calculation in the memory M124. Upon completion of the processing of Step P849, the CPU 10 executes Step P850.

In Step P850, the CPU 10 calculates a target output of the A/D converter connected to the potentiometer 78 for the motor for adjusting the printing pressure between the coater cylinder and the impression cylinder, from the target printing pressure between the coater cylinder and the impression cylinder. The CPU 10 then stores the result of the calculation in the memory M125. Upon completion of the processing of Step P850, the CPU 10 executes Step P851.

In Step P851, the CPU 10 reads the output of the A/D converter connected to the potentiometer 78 for the motor for adjusting the printing pressure between the coater cylinder and the impression cylinder. The CPU 10 then stores the read value in the memory M116. Upon completion of the processing of Step P851, the CPU 10 executes Step P852.

In Step P852, the CPU 10 determines whether or not the output of the A/D converter connected to the potentiometer 78 for the motor for adjusting the printing pressure between the coater cylinder and the impression cylinder, which is stored in the memory M116, is equal to the target output of the A/D converter connected to the potentiometer 78 for the motor for adjusting the printing pressure between the coater cylinder and the impression cylinder, which is stored in the memory M125.

When the output of the A/D converter connected to the potentiometer 78 for the motor for adjusting the printing pressure between the coater cylinder and the impression cylinder, which is stored in the memory M116, is equal to the target output of the A/D converter connected to the potentiometer 78 for the motor for adjusting the printing pressure between the coater cylinder and the impression cylinder, which is stored in the memory M125, the CPU 10 skips Steps P853 to P861, and then executes Step P862.

When the output of the A/D converter connected to the potentiometer 78 for the motor for adjusting the printing pressure between the coater cylinder and the impression cylinder, which is stored in the memory M116, is not equal to the target output of the A/D converter connected to the potentiometer 78 for the motor for adjusting the printing pressure between the coater cylinder and the impression cylinder, which is stored in the memory M125, the CPU 10 executes Step P853.

In Step P853, the CPU 10 determines whether or not the target output of the A/D converter connected to the potentiometer 78 for the motor for adjusting the printing pressure between the coater cylinder and the impression cylinder, which is stored in the memory M125, is larger than the output of the A/D converter connected to the potentiometer 78 for the motor for adjusting the printing pressure between the coater cylinder and the impression cylinder, which is stored in the memory M116.

When the target output of the A/D converter connected to the potentiometer 78 for the motor for adjusting the printing pressure between the coater cylinder and the impression cylinder, which is stored in the memory M125, is larger than the output of the A/D converter connected to the potentiometer 78 for the motor for adjusting the printing pressure between the coater cylinder and the impression cylinder, which is stored in the memory M116, the CPU 10 executes Step P854.

On the other hand, when the target output of the A/D converter connected to the potentiometer 78 for the motor for adjusting the printing pressure between the coater cylinder and the impression cylinder, which is stored in the memory M125, is not larger than the output of the A/D converter connected to the potentiometer 78 for the motor for adjusting the printing pressure between the coater cylinder and the impression cylinder, which is stored in the memory M116, the CPU 10 executes Step P858.

In Step P854, the CPU 10 outputs a normal rotation instruction to the motor driver 77 for adjusting the printing pressure between the coater cylinder and the impression cylinder. Upon completion of the processing of Step P855, the CPU 10 executes Step P855.

In Step P855, the CPU 10 reads the output of the A/D converter connected to the potentiometer 78 for the motor for adjusting the printing pressure between the coater cylinder and the impression cylinder. The CPU 10 then stores the read value in the memory M116. Upon completion of the processing of Step P855, the CPU 10 executes Step P856.

In Step P856, the CPU 10 determines whether or not the output of the A/D converter connected to the potentiometer 78 for the motor for adjusting the printing pressure between the coater cylinder and the impression cylinder, which is stored in the memory M116, is equal to the target output of the A/D converter connected to the potentiometer 78 for the motor for adjusting the printing pressure between the coater cylinder and the impression cylinder, which is stored in the memory M125.

When the output of the A/D converter connected to the potentiometer 78 for the motor for adjusting the printing pressure between the coater cylinder and the impression cylinder, which is stored in the memory M116, is equal to the target output of the A/D converter connected to the potentiometer 78 for the motor for adjusting the printing pressure between the coater cylinder and the impression cylinder, which is stored in the memory M125, the CPU 10 executes Step P857.

On the other hand, when the output of the A/D converter connected to the potentiometer 78 for the motor for adjusting the printing pressure between the coater cylinder and the impression cylinder, which is stored in the memory M116, is not equal to the target output of the A/D converter connected to the potentiometer 78 for the motor for adjusting the printing pressure between the coater cylinder and the impression cylinder, which is stored in the memory M125, the CPU 10 executes Step P855.

In Step P857, the CPU 10 stops the output of the normal rotation instruction to the motor driver 77 for adjusting the printing pressure between the coater cylinder and the impression cylinder. Upon completion of the processing of Step P857, the CPU 10 executes Step P862.

In Step P858, the CPU 10 outputs a reverse rotation instruction to the motor driver 77 for adjusting the printing pressure between the coater cylinder and the impression cylinder. Upon completion of the processing of Step P858, the CPU 10 executes Step P859.

In Step P859, the CPU 10 reads the output of the A/D converter connected to the potentiometer 78 for the motor for adjusting the printing pressure between the coater cylinder and the impression cylinder. The CPU 10 then stores the read value in the memory M116. Upon completion of the processing of Step P859, the CPU 10 executes Step P860.

In Step P860, the CPU 10 determines whether or not the output of the A/D converter connected to the potentiometer 78 for the motor for adjusting the printing pressure between the coater cylinder and the impression cylinder, which is stored in the memory M116, is equal to the target output of the A/D converter connected to the potentiometer 78 for the motor for adjusting the printing pressure between the coater cylinder and the impression cylinder, which is stored in the memory M125.

When the output of the A/D converter connected to the potentiometer 78 for the motor for adjusting the printing pressure between the coater cylinder and the impression cylinder, which is stored in the memory M116, is equal to the target output of the A/D converter connected to the potentiometer 78 for the motor for adjusting the printing pressure between the coater cylinder and the impression cylinder, which is stored in the memory M125, the CPU 10 executes Step P861.

On the other hand, when the output of the A/D converter connected to the potentiometer 78 for the motor for adjusting the printing pressure between the coater cylinder and the impression cylinder, which is stored in the memory M116, is not equal to the target output of the A/D converter connected to the potentiometer 78 for the motor for adjusting the printing pressure between the coater cylinder and the impression cylinder, which is stored in the memory M125, the CPU 10 executes Step P859.

In Step P861, the CPU 10 stops the output of the reverse rotation instruction to the motor driver 77 for adjusting the printing pressure between the coater cylinder and the impression cylinder. Upon completion of the processing of Step P861, the CPU 10 executes Step P862. With the foregoing steps, each contact-pressure adjusting means of the coater machine is adjusted in accordance with the printing press temperature, which is measured by the printing press temperature meter 17 of the coater machine.

In Step P862, the CPU 10 determines whether or not the final-printing completing button, which is provided to the input device 13, has been turned ON by the operator. When the final-printing completing button has been turned ON, the CPU 10 executes Step P800. On the other hand, when the final-printing completing button has not been turned ON, the CPU 10 executes Step P826.

According to the present invention, the adjustment of a contact pressure (a nip pressure or a printing pressure) is automatically controlled. For this reason, it is possible to eliminate the variation in the quality of printing products which would otherwise occur depending on the operators. Moreover, since the adjustment of a contact pressure is automatically controlled, the burden on the operator is reduced. Furthermore, since the present invention has a configuration in which the adjustment of a contact pressure is automatically controlled, the quality of printing products does not vary from the start of printing to the end thereof.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A contact-pressure adjusting method for a liquid application machine including: a first rotor to which liquid is supplied; a second rotor to which the liquid is supplied from the first rotor; a third rotor to which the liquid is supplied from the second rotor; first contact-pressure adjusting means for adjusting a first contact pressure between the first rotor and the second rotor; and second contact pressure adjusting means for adjusting a second contact pressure between the second rotor and the third rotor, the contact-pressure adjusting method comprising:

measuring, by using temperature measuring means, at least one of:

a temperature of at least one of a surface of the first rotor, a surface of the second rotor, and a surface of the third rotor, a temperature of at least one of liquid on the surface of the first rotor, the liquid on the surface of the second rotor, and the liquid on the surface of the third rotor, and a temperature of at least one of a vicinity of the first rotor, a vicinity of the second rotor, and a vicinity of the third rotor; and adjusting the first contact-pressure by the first contact-pressure adjusting means in accordance with the measured temperature by using a first conversion table indicative of a relationship between temperature and contact pressure between the first rotor and the second rotor, as well as adjusting the second contact-pressure by the second contact-pressure adjusting means in accordance with the measured temperature by using a second conversion table indicative of a relationship between temperature and contact pressure between the second rotor and the third rotor.

2. A contact-pressure adjusting method for a liquid application machine including: a first rotor to which liquid is supplied; a second rotor to which the liquid is supplied from the first rotor; a third rotor facing the second rotor, and holding a liquid-applied member to which the liquid is supplied from the second rotor; first contact-pressure adjusting means for adjusting a first contact pressure between the first rotor and the second rotor; and second contact-pressure adjusting means for adjusting a second contact-pressure between the second rotor and the third rotor, the contact-pressure adjusting method comprising:

measuring, by using temperature measuring means, at least one of:

a temperature of at least one of a surface of the first rotor, the surface of the second rotor, and a surface of the third rotor, a temperature of at least one of the liquid on the surface of the first rotor, the liquid on the surface of the second rotor, and the liquid on the surface of the third rotor, and a temperature of at least one of a vicinity of the first rotor, a vicinity of the second rotor, and a vicinity of the liquid-applied member; and adjusting the first contact-pressure by the first contact-pressure adjusting means in accordance with the measured temperature by using a first conversion table indicative of a relationship between temperature and contact pressure between the first rotor and the second rotor, as well as adjusting the second contact-pressure by the second contact-pressure adjusting means in accordance with the measured temperature by using a second conversion table indicative of a relationship between temperature and contact pressure between the second rotor and the third rotor.

3. A contact-pressure adjusting system for a liquid application machine including: a first rotor to which liquid is supplied; a second rotor to which the liquid is supplied from the first rotor; a third rotor to which the liquid is supplied from the second rotor; first contact-pressure adjusting means for adjusting a first contact pressure between the first rotor and the second rotor; and second contact pressure adjusting means for adjusting a second contact pressure between the second rotor and the third rotor, the contact-pressure adjusting system comprising:

temperature measuring means for measuring at least one of:

a temperature of at least one of a surface of the first rotor, a surface of the second rotor, and a surface of the third rotor, a temperature of at least one of the liquid on the surface of the first rotor, the liquid on the surface of the second rotor, and the liquid on the surface of the third rotor; and a temperature of at least one of a vicinity of the first rotor, a vicinity of the second rotor, and a vicinity of the third rotor; and contact-pressure controlling means for controlling the first contact-pressure adjusting means to adjust the first contact-pressure in accordance with the measured temperature by using a first conversion table indicative of a relationship between temperature and contact pressure between the first rotor and the second rotor, as well as controlling the second contact-pressure adjusting means to adjust the second contact-pressure in accordance with the measured temperature by using a second conversion table indicative of a relationship between temperature and contact pressure between the second rotor and the third rotor.

4. A contact-pressure adjusting system for a liquid application machine including: a first rotor to which liquid is supplied; a second rotor to which the liquid is supplied from the first rotor; a third rotor facing the second rotor, and holding a liquid-applied member to which the liquid is supplied from the second rotor; first contact-pressure adjusting means for adjusting a first contact pressure between the first rotor and the second rotor; and second contact-pressure adjusting means for adjusting a second contact pressure between the second rotor and the third rotor, the contact-pressure adjusting system comprising:

temperature measuring means for measuring at least one of:

a temperature of at least one of a surface of the first rotor, a surface of the second rotor, and a surface of the third rotor, a temperature of at least one of the liquid on the surface of the first rotor, the liquid on the surface of the second rotor, and the liquid on the surface of the third rotor, and a temperature of at least one of a vicinity of the first rotor, a vicinity of the second rotor, and a vicinity of the liquid-applied member; and contact-pressure controlling means for controlling the first contact-pressure adjusting means to adjust the first contact-pressure in accordance with the measured temperature by using a first conversion table indicative of a relationship between temperature and contact pressure between the first rotor and the second rotor, as well as controlling the second contact-pressure adjusting means to adjust the second contact-pressure in accordance with the measured temperature by using a second conversion table indicative of a relationship between temperature and contact pressure between the second rotor and the third rotor.

* * * * *